US006251576B1

(12) United States Patent
Taguchi et al.

(10) Patent No.: US 6,251,576 B1
(45) **Date of Patent: *Jun. 26, 2001**

(54) PHOTOSENSITIVE COMPOSITION AND COLOR PHOTOSENSITIVE MATERIALS

(75) Inventors: Toshiki Taguchi; Masaaki Tukase; Makoto Yamada; Hideaki Naruse, all of Kanagawa-ken (JP)

(73) Assignee: Fuji Photo Film Co., Ltd., Kanagawa-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/479,947

(22) Filed: Jan. 10, 2000

Related U.S. Application Data

(63) Continuation-in-part of application No. 09/225,485, filed on Jan. 6, 1999, now abandoned, and a continuation-in-part of application No. 09/006,005, filed on Jan. 12, 1998, now abandoned.

(30) Foreign Application Priority Data

Jan. 13, 1997 (JP) ..... 9-15921
Jul. 18, 1997 (JP) ..... 9-210104
Jan. 16, 1998 (JP) ..... 10-020465

(51) Int. Cl.[7] ..... G03C 1/005
(52) U.S. Cl. ..... 430/566; 430/203; 430/404; 430/405; 430/448
(58) Field of Search ..... 430/203, 405, 430/448, 566

(56) References Cited

U.S. PATENT DOCUMENTS

| | | | |
|---|---|---|---|
| 4,021,240 | 5/1977 | Cerqune et al. | 430/203 |
| 4,782,004 | 11/1988 | Takeuchi et al. | 430/203 |
| 4,789,623 | 12/1988 | Sato et al. | 430/351 |
| 4,952,474 | 8/1990 | Tsukahara et al. | 430/203 |
| 5,698,365 | 12/1997 | Taguchi et al. | 430/203 |
| 5,716,772 | 2/1998 | Taguchi | 430/566 |
| 6,004,736 * | 12/1999 | Taguchi et al. | 430/448 |

FOREIGN PATENT DOCUMENTS

| | | | |
|---|---|---|---|
| 0 220 746 | 5/1987 | (EP) | G03C/7/32 |
| 0 334 362A2 | 9/1989 | (EP) | G03C/7/26 |
| 0727 708 | 8/1996 | (EP) | G03C/7/413 |
| 0731 380 | 9/1996 | (EP) | G03C/1/498 |
| 0 762 201A1 | 3/1997 | (EP) | G03C/7/30 |
| 0 764 876 A1 | 3/1997 | (EP) | G03C/1/498 |
| 0 853 255 A2 | 6/1998 | (EP) | G03C/1/498 |
| 2 056 103 | 3/1981 | (GB) | G03C/7/30 |
| 2 156 091A | 10/1985 | (GB) | G03C/1/02 |
| 62-203158A | 9/1987 | (JP) | G03C/7/00 |
| 08110608 | 4/1996 | (JP) | G03C/1/498 |
| 08122994 | 5/1996 | (JP) | G03C/8/40 |
| 0910506 | 1/1997 | (JP) | B01D/19/00 |
| 9-146248 | 6/1997 | (JP) | |
| 10-90854 | 10/1998 | (JP) | |

OTHER PUBLICATIONS

XP002062573, (JP 60 128438 Abstract), Database WPI,, Section Ch, Week 8533, Derwent Publications Ltd. London, GB, Jul. 9, 1985.

Patent Abstracts of Japan vol. 097 No. 010, Oct. 31, 1997 and JP 09 152705 A (Fuji Photo Film Co., Ltd.) Jun. 10, 1997 *Abstract.

Patent Abstracts of Japan vol. 095 No. 003, Apr. 28, 1995 and JP 06 347969 A (Fuji Photo Film Co., Ltd) Dec. 22, 1994 *Abstract.

* cited by examiner

*Primary Examiner*—Hoa Van Le
(74) *Attorney, Agent, or Firm*—Sughrue, Mion, Zinn, Macpeak & Seas, PLLC

(57) ABSTRACT

A heat developing color photosensitive material including a substrate carrying thereon a photosensitive silver halide, binder, a developing agent having specific structure classified into an aminophenol derivative or a phenylenediamine derivative and a compound which forms or releases a diffusive dye by reaction with an oxidized product of the developing agent, in which the material further comprises at least one of the specific naphtol derivatives, phenol derivatives, pyrazolone derivatives, aminophenol derivatives, and the like. These compounds each preferably contain an organic ballasting group which allows the compound. There is also disclosed a silver halide photographic light-sensitive material which includes at least a compound of the formula (1) or (2):

formula (1)

formula (2)

This light-sensitive material is excellent in discrimination and raw stock storability.

22 Claims, No Drawings

PHOTOSENSITIVE COMPOSITION AND COLOR PHOTOSENSITIVE MATERIALS

This application is a continuation-in-part of U.S. application Ser. No. 09/225,485 filed on Jan. 6, 1999, now abandoned, and U.S. application Ser. No. 09/006,005 filed on Jan. 12, 1998, now abandoned, the disclosure of each of which is incorporated herein by reference.

BACKGROUND OF THE INVENTION

1. Field of the Invention

The present invention relates to a heat developing color photosensitive material, and more particularly, to a heat developing color photosensitive material which can provide an excellent image in an extremely short developing time and which is not easily affected by variations in processing conditions.

Additionally, the present invention relates to a silver halide photographic light-sensitive material, in particular to a silver halide photographic light-sensitive material excellent in the discrimination for an image formed and raw stock storability.

2. Description of the Related Art

Formation of an image by heat development of a silver halide photographic photosensitive material is publicly known and described, for example, in "Fundamentals of Photographic Engineering (ed. by Non-Silver Salt Photography) Corona Publishing Co., Ltd.", 1982, pp. 242 to 255, U.S. Pat. No. 4,500,626 and the like.

Heat developing photographic materials using silver halide are conventionally widely used due to their excellent photographic properties such as sensitivity, (gradation and the like, as compared with the electrophotographic method, or the diazo photographic method and the like. There are several proposals regarding methods to obtain a color image by heat development using a silver halide photosensitive material, and a coloring development method, in which a dye image is formed by the coupling reaction of an oxidized compound of a developing agent with a coupler, is listed as one method thereof. Regarding the coupler and developing agent which can be used in this coloring development method, a combination of a p-phenylene diamines reducing agent with phenol or an activated methylene coupler described in U.S. Pat. No. 3,531,256, a p-amino phenol-based reducing agent described in U.S. Pat. No. 3,761,270, a combination of a sulfonamide phenol-based reducing agent with a tetravalent coupler described in U.S. Pat. No. 4,021,240, and the like are suggested.

However, this method has flaws such as the coloring of the undeveloped part of a undeveloped silver halide remaining after processing due to print out or the lapse of time, or color turbidity arising due to the existence of a color image and reduced silver on the exposed portions at the same time, and the like. To solve these flaws, a dye transferring method is proposed in which a diffusive dye is formed by heat development and transferred onto an image receiving layer.

Regarding this type of diffusion transfer type heat developing photosensitive material, there are examples where a photosensitive material and an image receiving layer which can receive a dye being supported on the same substrate, and examples where an image receiving layer is supported on a substrate other than that carrying a photosensitive material.

Particularly for heat developing color photosensitive materials, it is desirable that an image receiving material in which a dye receiving layer is supported on a substrate other than that carrying photosensitive material is used, and the dye is diffused and transferred either simultaneously with or after diffusive dye formation by color development dye to obtain a dye image having high color purity.

A method is proposed in which a diffusive dye is released or formed into an image form by heat development, and transferred onto a diffusive dye-fixing element. In this method, a negative dye image or a positive dye image can also be obtained by changing the kind of dye donative compound used or the kind of silver halide used. More details are described in U.S. Pat. Nos. 4,500,625, 4,483,914, 4,503,137, 4,559,290, Japanese Patent Application Laid-Open (JP-A) Nos. 58-149046, 60-133449, 59 -218443, 61-238056, EP No. 220,746 A2, RD 87-6199, EP No. 210660 A2 and the like. However, there is the problem that since the color developed dye has been previously fixed on a dye donative material, greater light energy in the exposing light is required to lower the sensitivity of the photosensitive material, and a relatively large scale exposing light apparatus is used. Therefore, it is preferable to achieve a method in which a colorless coupler and a developing agent initially react and the desired pigment is diffused.

Regarding the above-described coupling method for forming an image, there are disclosed a color developing agent precursor which releases p-phenylenediamine, and a heat developing photosensitive material containing a coupler in Japanese Patent Application Publication (JP-B) No. 63-36487, JP-A Nos. 5-224381,6-83005 and the like, a combination of a ureido aniline-based reducing agent with an active methylene-based coupler in JP-A No. 59-111,148, and a photosensitive material using a coupler which has a polymer chain in a releasable group and releases a diffusive dye in color development in JP-A No. 58-149047.

Further, JP-A No. 9-152705 discloses a photosensitive material containing novel carbamoylhydrazine.

However, when a color developing agent or color developing agent precursor herein described is used, higher temperature developing conditions and a longer developing time are often required to obtain an image. Particularly when an image is formed under high temperature developing conditions, control of the processing machines may be difficult and a uneven image may be formed.

The photographic process, in which silver halides are used, is conventionally most widely used, since it is excellent in photographic characteristics, such as sensitivity and gradation adjustment, in comparison with another photographic process, for example, electrophotography and diazo photography. The silver halide photographic process is still vigorously investigated because the highest image quality as, in particular, color hard copies can be obtained.

In recent years, from the image-formation processing method of light-sensitive materials in which silver halides are used, a system that can give an image easily and quickly by using, for example, an instant photographic system having a built-in developing solution or a dry-process heat development processing using heating or the like, has been developed in place of the conventional wet process. With respect to heat-development light-sensitive materials, "Shashin Kogaku No Kiso (Hi-ginen Shashin-hen)", published by Corona Co., p. 242, describes them, which is only directed to the black-and-white image formation method for dry silver as a representative.

As heat-development color light-sensitive materials, recently, products called PICTROGRAPHY and PICTROSTAT (trade names) have been marketed by Fuji Photo Film Co., Ltd. This easy, quick processing method uses a redox compound having a preformed dye linked (hereinafter referred to as a coloring material), to carry out the color image formation. On the other hand, as the method for the color image formation for photographic light-sensitive materials, one in which a coupling reaction of a coupler with the oxidized product of a developing agent is used, is most popular. Many ideas on heat development color light-sensitive materials that employ that method are disclosed and filed as patent applications, for example, in U.S. Pat. No. 3,761,270, U.S. Pat. No. 4,021,240, JP-A-59-231539 ("JP-A" means unexamined published Japanese patent application) and JP-A-60-128438. Further, JP-A-9-146247, JP-A-9-146248, and JP-A-9-204031 disclose color light-sensitive materials for photographing (shooting) wherein a processing material containing a base precursor is used, and processing by heating is carried out, in the presence of a small amount of water.

In the above-described heat-development light-sensitive materials, there are points that need improving because, for example, the processing time is long, it takes time from the exposure to the output, and the processor becomes large-sized. Further, the discrimination of images needs improving.

Generally, in heat-development light-sensitive materials, the built-in reducing agent (or the developing agent) reduces the silver halide in the development processing, which is a first step to initiate an image-forming reaction. In order to quicken this, first, a method is conceivable wherein the reducing agent is made hydrophilic, to accelerate its reaction with the silver halide in the aqueous phase. However, when this method is used for usual heat-development light-sensitive materials, the reducing agent moves between layers during processing, which allows unpreferable reactions to inevitably take place, such as causing mixing of colors. In order to obviate this, a method is conceivable wherein a hydrophilic reducing agent is used as an auxiliary developing agent in combination with a lipophilic reducing agent, so that electron transfer will occur between them, thereby increasing the development rate. This idea is known in the art, and its application to heat-development light-sensitive materials is described, for example, in JP-A-1-138556.

However, generally the reducing agent increased in hydrophilicity and improved in silver developability has the problem that it is poor in stability and is easily oxidized with oxygen in the air, to be decreased, during raw stock storage. As an auxiliary developing agent particularly excellent in silver developability, a 1-phenyl-3-pyrazolidinone derivative is known in the art, but this compound is not satisfactorily stable as a built-in developing agent. The inventors of the present invention have been searching for compounds that solve these problems. It has been found under these circumstances that sulfonamidophenols, as described, for example, in U.S. Pat. No. 4,021,240, JP-A-60-128438, and JP-A-8-220717, are compounds excellent in discrimination and raw stock storability when they are built into light-sensitive materials. The performance of the sulfonamidophenols as a reducing agent has been investigated in various ways. As a result, it has been found that these compounds are compounds that have satisfactory raw stock storability, even when they are increased in hydrophilicity, as a built-in developing agent, to improve the silver developability. However, since, for the sulfonamidophenols, the oxidized product of the developing agent after the silver development is poor in stability, the oxidized product of the developing agent is hydrolyzed at the developed part, thereby producing developed silver whose quantity is more than the theoretical quantity. It has been found that, as a result, a problem arises that color contamination owing to silver images takes place.

SUMMARY OF THE INVENTION

Accordingly, an object of the present invention is to provide a heat developing color photosensitive material which can provide an excellent image in an extremely short developing time and is not easily affected by variations in processing conditions. A further object of the present invention is to provide a heat developing color photosensitive material, which can obtain an image even under low temperature processing conditions. Another object of the present invention is to provide a heat developing color photosensitive material with excellent storage properties. Another object of the present invention is to provide a silver halide photographic light-sensitive material excellent in discrimination and raw stock storability.

It has been found that the objects of the present invention are solved by the following methods.

A heat developing color photosensitive material comprising a substrate carrying thereon a photosensitive silver halide, a binder, a compound represented by the general formula (I) or (D) and a compound which forms or releases a diffusible dye by reaction with an oxidized product of the compound represented by the general formula (I) or (D), in which the material further comprises at least one of the compounds represented by the general formulae (II-a), (II-b), (III-a), (III-b), (IV-a), (IV-b), (IV-c), (IV-d), (IV-e), (IV-f) or (IV-g)

General formula (I):

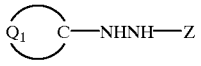

(wherein, Z represents a carbamoyl group, an acyl group, an alkoxycarbonyl group, an aryloxycarbonyl group, a sulfonyl croup or a sulfamoyl group, and both Q and C represent an atomic group forming an unsaturated ring.) General formula (D):

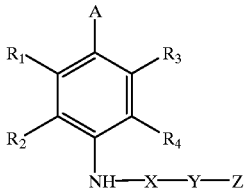

wherein, $R_1$ to $R_4$ each independently represent a hydrogen atom or substituent thereof, A represents a hydroxyl group or substituted amino group, X represents a linkage group with a valency of two or more selected from the group consisting of —CO—, —SO—, —$SO_2$—, and —PO<, Y represents a bivalent linkage group, Z represents a nucleophilic group which can attack the X group when the compound represented by the formula D is oxidized, $R_1$ and $R_2$ and, $R_3$ and $R_4$ each independently may bond with each other to form a ring. General formula (II-a) General formula (II-b)

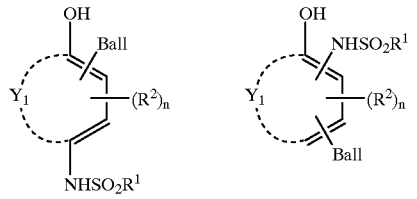

In general formulae (II-a) and (II-b), Ball represents an organic ballasting group which allows the compounds represented by these formulae to become non-diffusive. When $R_1$ is non-diffusive, Ball may not he required.

$Y_1$ represents a carbon atom group required for completing a benzene nucleus or naphthalene nucleus.

$R^1$ represents an alkyl group, a cycloalkyl group, an aralkyl group, an aryl group, an amino group, or a hetero cyclic group.

$R^2$ represents a hydrogen atom, a halogen atom, an alkyl group, a cycloalkyl group, an aralkyl group, an aryl group, a heterocyclic group, an alkoxy group, an aryloxy group, an acyl group, an alkyloxycarbonyl group, an aryloxycarbonyl group, a carbamoyl group, a sulfamoyl group, an alkylsulfonyl group, an arylsulifonyl group, an acylamino group, an alkylthio group, or an arylthio group.

n represents an integer from 0 to 5, and when n is 2 to 5, $R^2$ may be the same or different, or a plurality may bond together to form a ring.

When $Y_1$ represents an atomic group required for completing a naphthalene nucleus, Ball and $R^2$ can be bonded to any one of the rings formed in this way.

General formula (III-a)

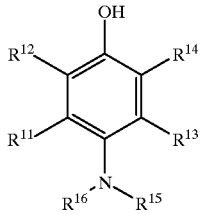

General formula (III-b)

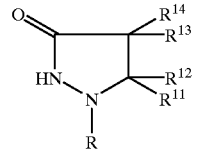

In general formulae (III-a) and (III-b), R represents an aryl group. $R^{11}$, $R^{12}$, $R^{13}$, $R^{14}$, $R^{15}$ and $R^{16}$ each independently represent a hydrogen atom, a halogen atom, an acylamino group, an alkoxy group, an alkylthio group, an alkyl group or an aryl group, and these may be the same or different.

General formula (IV-a)

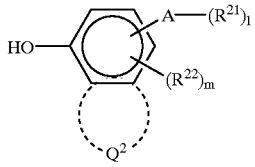

General formula (IV-b)

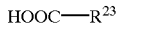

General formula (IV-c)

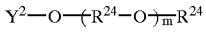

General formula (IV-d)

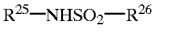

General formula (IV-e)

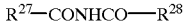

General formula (IV-f)

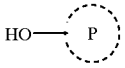

General formula (IV-g)

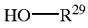

In general formulae (IV-a) to (IV-G), A represents a bivalent electron attractive group, $R^{21}$ represents an alkyl group, an aryl group, an alkoxyl group, an aryloxy group, an alkylamino group, an aniline group or a haterocyclic group. 1 represents an integer of 1 or 2. $R^{22}$ represents an alkyl group, an alkoxy group, a hydroxyl group or a halogen atom, m represents an integer from 0 to 4. $Q^2$ represents a benzene ring or heterocyclic ring which may be condensed with a phenol ring.

$R^{23}$ represents an alkyl group, an aryl group or a heterocyclic group.

$Y^2$ represents an aryl group, an alkyl group, a heterocyclic group, a —P(=O)(Rb)—Ra group, or a —C(=O)—Ra group. $R^{24}$ represents an alkylene group, an arylene group or an aralkylene group, $R^{24}$ represents an alkyl group or an aryl group. However, $Y^2$ and $R^{24}$ can not represent an alkyl group simultaneously. Ra and Rb each independently represent an alkyl group, an aryl group, an amino group, an alkoxy group, or an aryloxy group. n represents an integer from 1 to 5.

$R^{25}$ represents a hydrogen atom, an alkyl group, an aryl group, a phenylsulfonyl group, or an acyl group. $R^{26}$ and $R^{24}$ have the same meaning. $R^{25}$ and $R^{26}$ may close a ring to form a 5- to 7-membered ring.

$R^{27}$ and $R^{28}$ have the same meaning as for $R^{24}$, and may close a ring to form a 5- to 7-membered ring. $R^{29}$ represents an alkyl group having 12 to 50 carbon atoms in total.

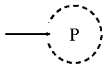

represents a 5 to 7-membered heterocyclic ring.

DESCRIPTION OF THE PREFERRED EMBODIMENTS

The present invention will be described below in detail.

First, compounds represented by the general formula (I) used in the present invention will be described in detail.

In the general formula (I), Z represents a carbamoyl group, an acyl group, an alkoxycarbonyl group, an aryloxycarbonyl group, a sulfonyl group or a sulfamoyl group. Among them, a carbamoyl group is preferred, and a carbamoyl group having a hydrogen atom on a nitrogen atom is particularly preferable.

As the carbamoyl group, a carbamoyl group having 1 to 50 carbon atoms is preferable and one having 6 to 40 carbon atoms is more preferable. Specific examples thereof include a carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbmoyl group, a dodecylcarbamoyl group, a 3-dodecyloxypropylcarbamoyl group, an octadecylcarbamoyl group, a 3-(2,4-tert-pentyl phenoxy)propylcarbamoyl gro up, a 2-hexyldecylcarbamoyl group, a phenylcarbarpoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group, a 2,5-dioxo-1-pyrrolidinylcarbamoyl group and the like.

As the acyl group, an acyl group having 1 to 50 carbon atoms is preferable, and one having 6 to 40 carbon atoms is more preferable. Specific examples thereof include a formyl group, an acetyl group, a 2-methylpropanoyl group, a cyclohexylcarbonyl group, an n-octanoyl group, a 2-hexyldecanoyl group, a dodecanoyl group, a chaoroacetyl group, a trifluoroacetyl group, a benzoyl group, a 4-dodecyloxybenzoyl group, a 2-hydroxymethylbenzoyl group, a 3-(N-hydroxyl-N-methylaminocarbonyl) propanyl group and the like.

As the alkoxycarbonyl group and aryloxycarbonyl group, an alkoxycarbonyl group having 2 to 50 carbon atoms and an aryloxycarbonyl group having 6 to 50 carbon atoms are preferable and an alkoxycarbonyl group and aryloxycarbonyl group each having 6 to 40 carbon atoms are more preferable. Specific examples thereof include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2 -hydroxymethylphenoxycarbonyl gr oup, a 4-dodecyloxyphenoxycarbonyl group and the like.

As the sulfonyl group, a sulfonyl group having 1 to 50 carbon atoms is preferable, and one having 6 to 40 carbon atoms is more preferable. Specific examples thereof include a methylsulfonyl group, a butylsulfonyl group, an octylsulfonyl group, a 2-hexyldecysulfonyl group, a 3. dodecyloxypropylsulfonyl group, a 2-n-octyloxy-5-t-octyephenylsulfonyl group, a 4-dodecyoxyphenylsulfonyl group and the like.

As the sulfamoyl group, a sulfamoyl group having 0 to 50 carbon atoms is preferable, and one having 6 to 40 carbon atoms is more preferable. Specific examples thereof include a sulfamoyl group, an ethylsulfamoyl group, a 2-ethylhexylsulfamoyl group, a decylsulfamoyl group, a hexadecylsulfamoyl group, a 3-(2-ethylhexyloxy) propylsulfamoyl group, (2-chloro-5-dodecyloxycarbonylphenyl) sulfamoyl group, 2-tetradecyloxyphenylsulfamoyl group and the like.

Both $Q^1$ and C represent an atom group which forms an unsaturated ring, and as the unsaturated ring formed, a 3 to 8-membered ring is preferable, and 5 to 6-membered ring is more preferable. Examples thereof include a benzene ring, a pyridine ring, a pyradine ring, a pyrimidine ring, a pyridazine ring, a 1,2,4-triazine ring, a 1,3,5-triazine ring a pyrrole ring, an imidazole ring, a pyrazole ring, a 12, 34-triazole ring, l a 1,2,4-triazole ring, a tetrazole ring, a 1,3,4-thiadiazole ring, a 1,2,4-thiadiazole ring, a 1.2,5-thiadiazole ring, a 1,3,4-oxadiazole ring, a 1,2,4-oxadiazole ring, a 1,2,5-oxadiazolering, a thiazole ring, an oxazole ring, an isothiazole ring, an isooxazole ring, a thiophene ring and the like. And condensed rings obtained by condensation of these rings are also preferably used.

The rings may further have a substituent, and examples of the substituent include a straight or branched, linear or cyclic alkyl group having 1 to 50 carbon atoms (such as trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl and the like), a straight or branched, linear or cyclic alkenyl group having 2 to 50 carbon atoms (such as vinyl, 1-methylvinyl, cyclohexene-1-yl and the like), an alkynyl group having 2 to 50 carbon atoms in total (such as ethynyl, 1-propynyl and the like), an aryl group having 6 to 50 carbon atoms (such as phenyl, naphthyl, anthryl and the like), an acyloxy group having 1 to 50 carbon atoms (such as acetoxy, tetradecanoyloxy, benzoyloxy and the like), an alkoxycarbonyloxy group having 2 to 50 carbon atoms (such as methoxycarbonyloxy, 2-methoxyethoxycarbonyloxy groups and the like), an aryloxycarbonyloxy group having 7 to 50 carbon atoms (such as a phenoxycarbonyloxy group and the like), a carbamoyloxy group having 1 to 50 carbon atoms (such as N,N-dimethylcarbamoyloxy and the like), a carbonamide group having 1 to 50 carbon atoms (such as formamide, N-methylacetoamide, acetoamide, N-methylformamide, benzamide and the like), a sulfonamide group having 1 to 50 carbon atoms (such as methanesulfonamide, dodecanesulfonamide, benzenesulfonamide, p-toluenesulfonamide and the like), a carbamoyl group having 1 to 50 carbon atoms (such as N-methylcarbamoyl, N,N-diethylcarbamoyl, N-mesylcarbamoyl and the like), a sulfamoyl group having 0 to 50 carbon atoms (such as N-butylsulfamoyl, N,N-diethylsulfamoyl, N-methyl-N-(4-methoxyphenyl) sulfaamoyl and the like), an alkoxy group having 1 to 50 carbon atoms (such as methoxy, propoxy, isopropoxy, octyloxy, t-octyloxy, dodecyloxy, 2-(2,4-di-t-pentylphenoxy) ethoxy and the like), an aryloxy group having 6 to 50 carbon atoms (such as phenoxy, 4-methoxyphenoxy, naphthoxy and the like), an aryloxycarbonyl group having 7 to 50 carbon atoms (such as phenoxycarbonyl, naphthoxycarbonyl and the like), an alkoxycarbonyl group having 2 to 50 carbon atoms (such as methoxycarbonyl, t-butoxycarbonyl and the like), an N-acylsulfamoyl group having 1 to 50 carbon atoms (such as N-tetradecanoylsulfamoyl, N-benzoylsulfamoyl and the like), an N-sulfamoylcarbamoyl group having 1 to 50 carbon atoms (such as N-methanesulfonylcarbamoyl group and the like), an alkylsulfonyl group having 1 to 50 carbon atoms (such as methanesulfonyl, octylsulfonyl, 2-methoxyethylsulfonyl, 2-hexyldecylsulfonyl and the like), an arylsulfonyl group having 6 to 50 carbon atoms (such as benzensulfonyl, p-toluenesulfonyl, 4-phenylsulfonylphenylsulfonyl and the like), an alkoxycarbonylamino group having 2 to 50 carbon atoms (such as ethoxycarbonylamino and the like), an aryloxycarbonylamino group having 7 to 50 carbon atoms (such as phenoxycarbonylamino, naphthoxycarbonylamino and the like), an a mino group having 0 to 50 carbon atoms (such as amino, methylamino, diethylamino, diusopropylamino, anilino, morpholino and the like), an ammonio group having 3 to 50 carbon atoms (such as trimethylammonio, dinethylbenzylammonio groups and the like), a cyano group, a nitro group, a carboxyl group, a hydroxy group, a sulfo group, a mercapto group, an alkylsulfinyl group having 1 to 50 carbon atoms (such as methanesulf inyl, octanesulf inyl and the like) an arylsulfinyl group having 6 to 50 carbon atoms (such as benzenesulfinyl, 4-chlorop henylsulfinyl, p-toluenesulfinyl and the like), an alkylthio group having 1 to 50 carbon atoms (such as methylthio, octylthio, cyclohexylthio and the like), an arylthio group having 6 to 50 carbon atoms (such as phenylthio, naphthylthio and the like), a ureido group having 1 to 50 carbon atoms (such as 3-methylureido, 3,3-dimethylureido, 1,3-diphenylureido and the like), a heterocyclic group having 2 to 50 carbon atoms (such as 3 to 12-membered monocyclic or condensed rings containing at least one hetero atom such as nitrogen, oxygen, sulfur and the like, for example, 2-furyl, 2-pyranyl, 2-pyridyl, 2-thienyl, 2-imidazoyl, morpholino, 2-quinolyl, 2-benzoimidazolyl, 2-benzothiazolyl, 2-benzooxazolyl and the like), an acyl group having 1 to 50 carbon atoms (such as acetyl, benzoyl, trifluoroacetyl and the like) a sulfamoylamino group having 0 to 50 carbon atoms (such as N-butylsulfamoylamino, N-phenylsulfamoylamino and the like), a silyl group having 3 to 50 carbon atoms (such as trimethylsilyl, dimethyl-t-butylsilyl, triphenylsilyl and the like), and a halogen atom (such as a fluorine, chlorine, or bromine atoms and the like). The above-described substituents may further have a substituent, and examples thereof include those listed above.

The number of carbon atoms of the substituent is preferably 50 or less, more preferably 42 or less and further preferably 30 or less. To import sufficient diffusion abilities to the dye which is produced by the reaction of a color developing agent with a coupler in the present invention, the total number of carbon atoms of an unsaturated ring formed from Q and C and a substituent thereof is preferably from 1 to 30, and more preferably from 1 to 24, and most preferably from 1 to 18.

When the ring formed from Q and C is composed solely of carbon atoms (such as benzene, naphthalene, anthracene rings and the like), the total a value of Hammett substituent constants (in the case of 1,2,1,4,- - - position relative to C, σp value is adopted, and in the case of 1,3,1,5,- - - position relative to C, σm value is adopted) of all substituents is preferably 0.8 or more, more preferably 1.2 or more and most preferably 1.5 or more.

The details of Hammett substituent constants σp and σm are described in, for example, N. Inamoto, "Hammett rule—structure and reactivity—" (Maruzen), "New Experimental Chemical Seminar 14 Synthesis and Reaction of Organic Compounds V" p.2605 (Japan Chemical Institute edit., Maruzen), T. Nakaya, Theoretical Organic Chemistry Commentary p.217 (Tokyo Chemical Coterie), Chemical Review, vol. 91, pp. 165 to 195 (1991) and the like.

Specific examples of the color developing agent represented by the general formula (I) will be described below, however, the present invention is not limited in range thereto.

(1)

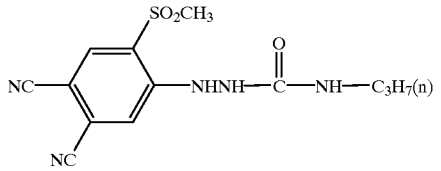

(2)

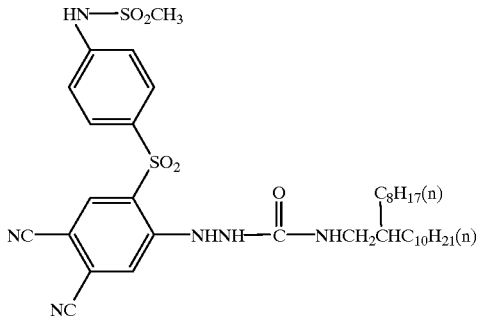

(3)

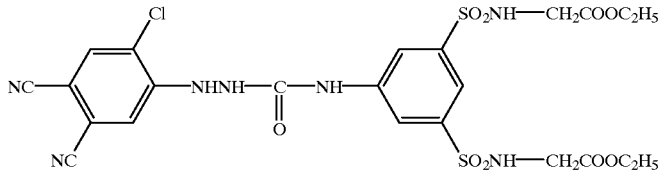

-continued
(4)
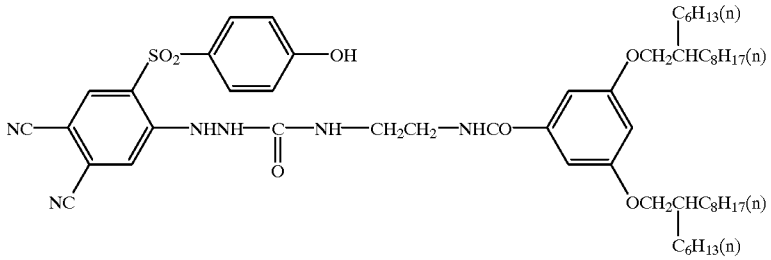
(5)
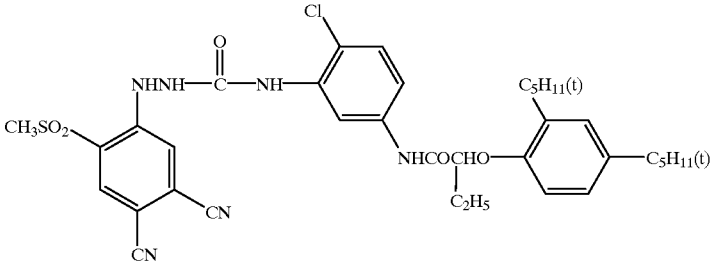
(6)
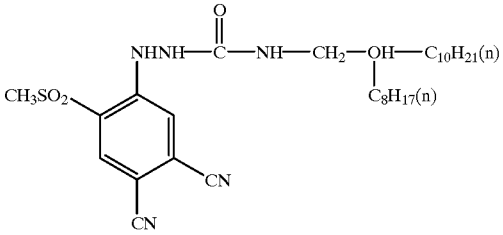
(7)
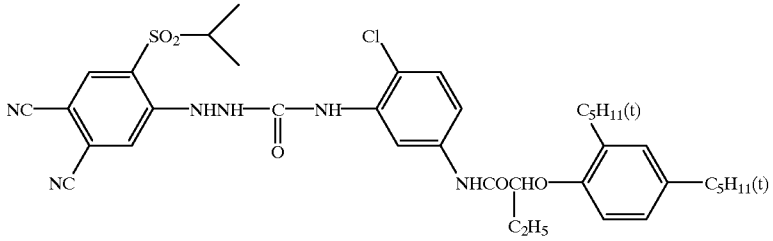
(8)
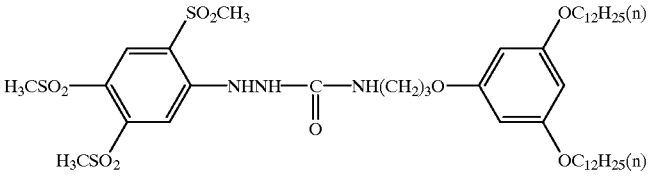
(9)
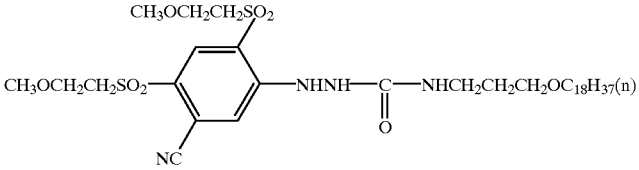

-continued
(10)
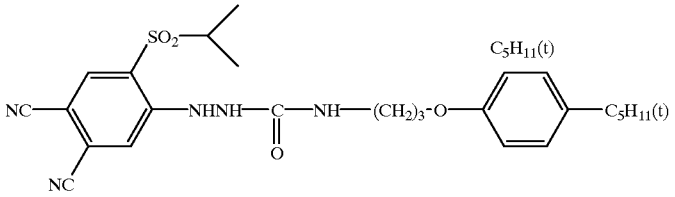
(11)
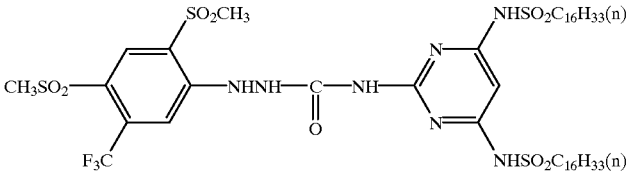
(12)
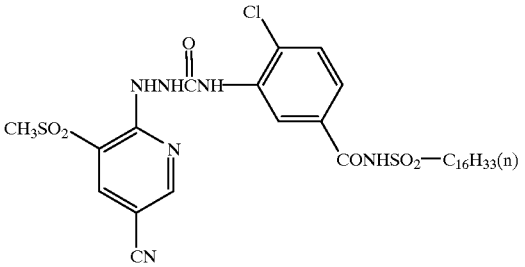
(13)
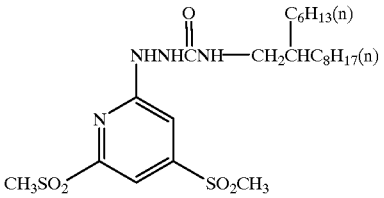
(14)
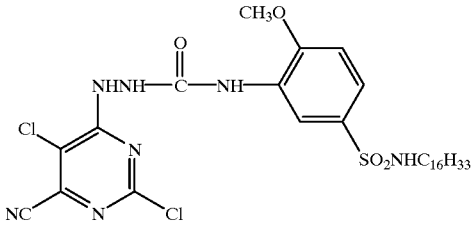
(15)
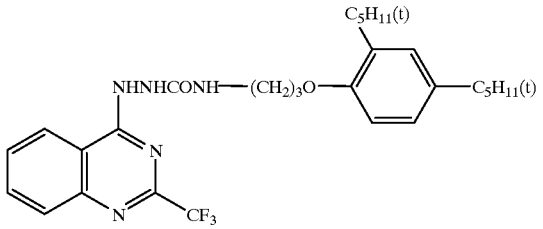

-continued
(16)
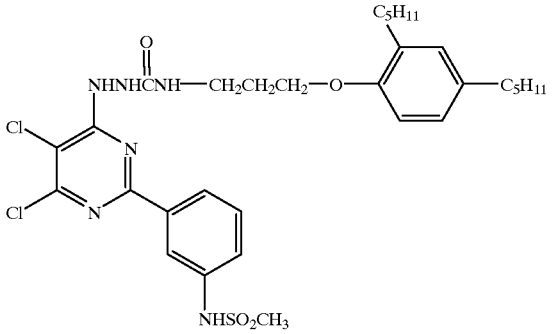
(17)
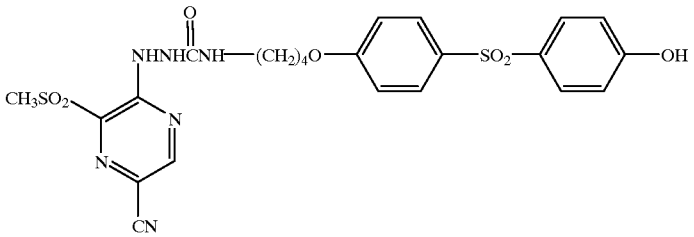
(18)
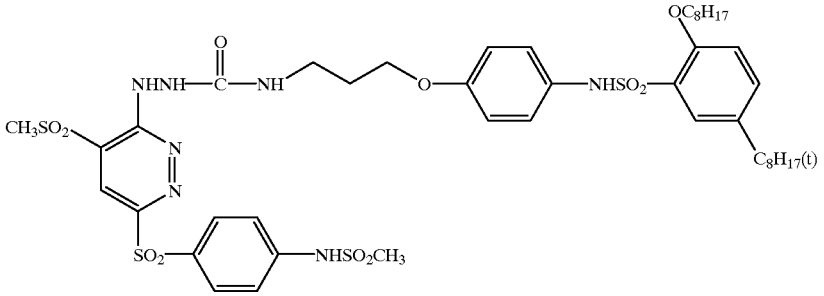
(19)
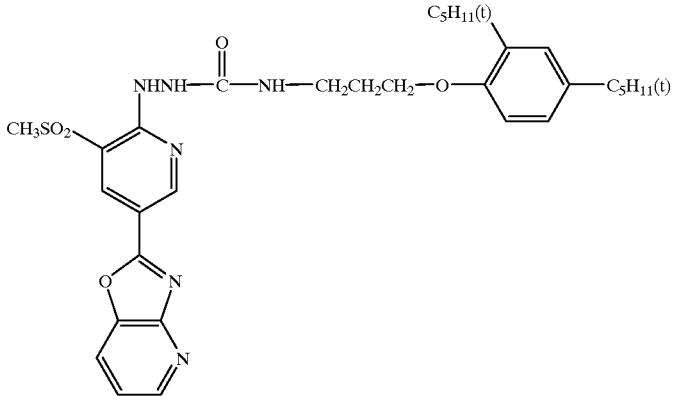
(20)
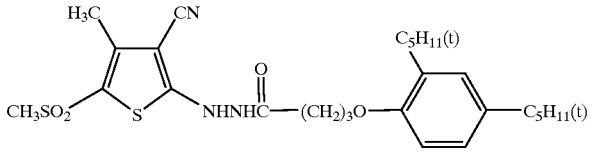

-continued
(21)
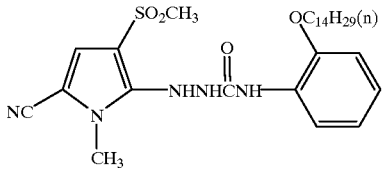
(22)
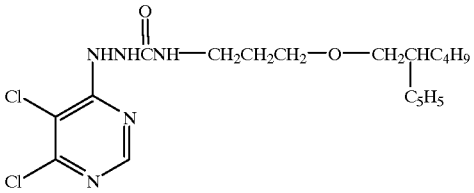
(23)
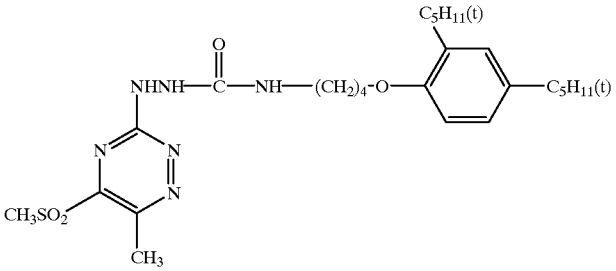
(24)
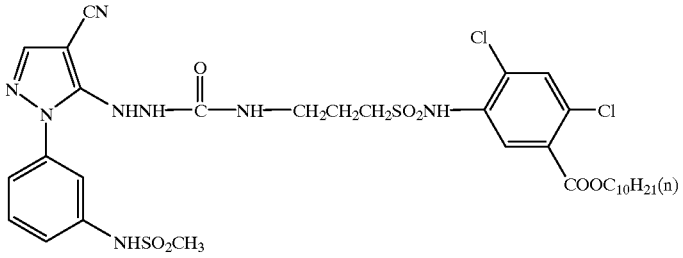
(25)
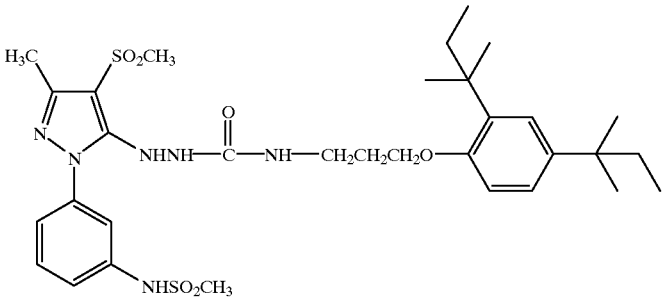
(26)
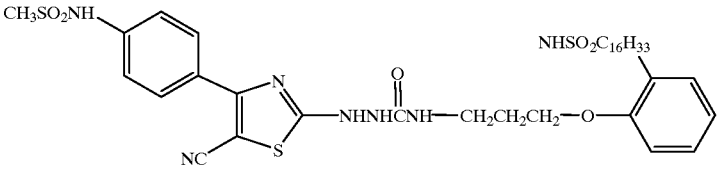
(27)
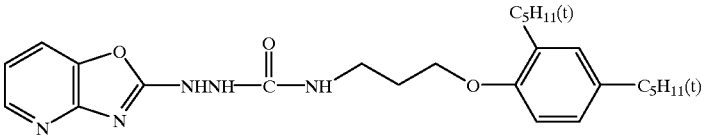

-continued (28)

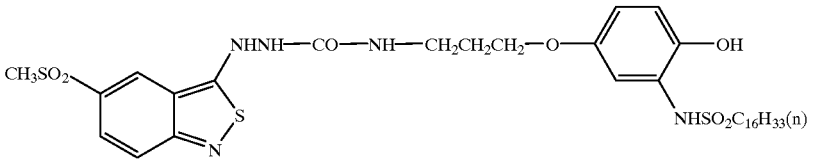

(29)

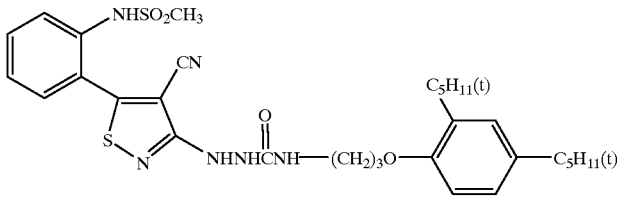

(30)

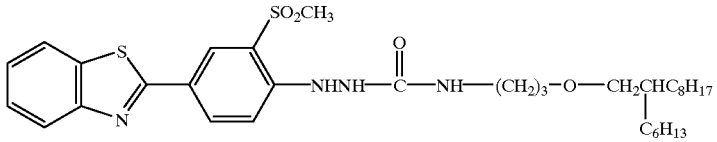

Next, general synthesis methods for the compound of the present invention are described below. A typical synthesis method for a typical compound used in the present invention is described below. The other compounds can be synthesized in the same manner as described below.

Synthesis Example 1. Synthesis of exemplary compound (1)

The compound (1) was synthesized according to the following synthesis route.

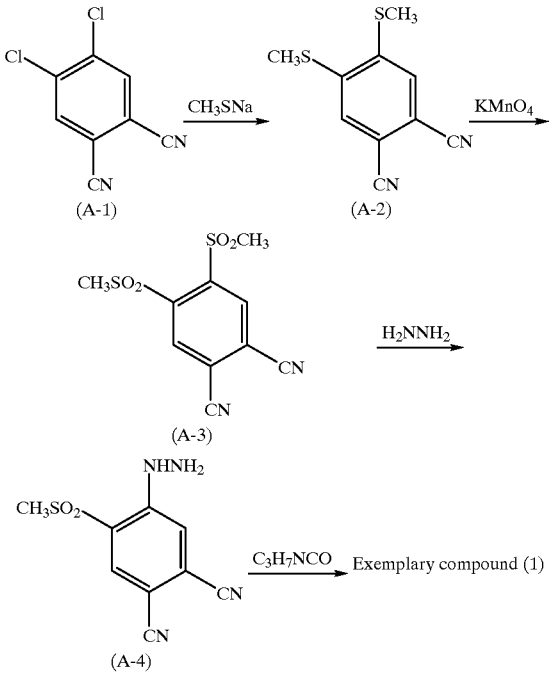

Synthesis of compound (A-2)

53.1 g of 1,2-dichloro-4,5-dicyanobenzene (a-1) (CAS Registry No. 139152-08-2) was dissolved in 1.1 liters of N,N-dimethylformamide (DMF), to this was added dropwise 268 g of an aqueous methylmercaptane sodium salt solution (15%) at room temperature over a period of 1 hour, and the resulting mixture was stirring for 1 hour at 60° C. The reaction solution was cooled to room temperature, water was added to this solution, and the resulting mixture was stirred for 30 minutes. The white solid produced was collected by filtration, and washed with water, and dried. Yield: 46.5 g, 78.1%

Synthesis of compound (A-3)

41 .1 g of compound (A-2) was suspended in 400 ml of acetic acid, and to this was added dropwise a solution obtained by dissolving 89.3 g of potassium permanganate into 400 ml of water over a period of 1 hour while water cooling. The mixture was allowed to stand overnight at room temperature, then, 2 liters of water and 2 liters of ethyl acetate were added, and the resulted mixture was subjected to Celite filtration. The filtrate was separated, and the resulting organic layer was washed with water, an aqueous sodium hydrosulfite solution, a sodium hydrogencarbonate solution and a sodium chloride solution before drying over anhydrous magnesium sulfate. After filtration, the solvent was distilled off, to the residue was added a mixed solvent composed of ethyl acetate and hexane for crystallization to give 29.4 g of compound (A-3) as a white solid. Yield 55.0%

Synthesis of compound (A-4)

29.4 g of compound (A-3) was dissolved in 200 ml of dimethylsulfoxide (DMSO), to this was added dropwise 8.7 g of hydrazine monohydrate over a period of 15 minutes while water-cooling, and the mixture was further stirred for 10 minutes while water-cooling. The reaction solution was poured into water, and the produced yellow solid was collected by filtration, washed with water, and dried. Yield: 17.4 g, 70.9%

Synthesis of exemplary compound (1)

11.8 g of compound (A-4) was dissolved in 50 ml of tetrahydrofuran, to this was added dropwise 4.7 g of propyl isocyanate over a period of 30 minutes at room temperature, and the mixture was further stirred for 1 hour. The reaction mixture was poured into water, and extracted with ethyl acetate. The organic layer was washed with a hydrochloric acid solution and a sodium chloride solution, before drying over anhydrous magnesium sulfate, and after filtration the solvent was removed. The residue was crystallized out from a mixed solvent of ethyl acetate-hexane (1:10) to give 14.5 g of exemplary compound (1) as a white solid. Yield: 90.2%

Synthesis Example 2. Synthesis of exemplary compound (5)

Exemplary compound (5) was synthesized according to the following synthesis route.

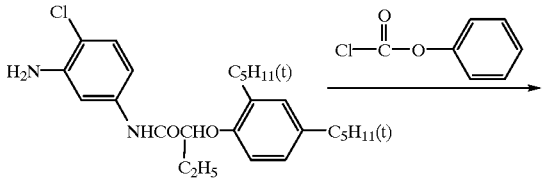

(A-5)

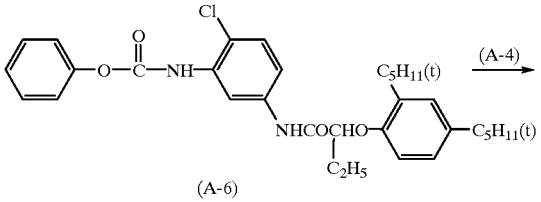

(A-6)

-continued

Exemplary compound (5)

Synthesis of compound (A-6)

44.5 g of compound (A-5) (CAS Registry No. 51461-11-1) was dissolved in 500 ml of ethyl acetate, and to the resulting mixture was added 500 ml of water to which 25 g of sodium hydrogencarbonate had been dissolved. To this solution was added dropwise 16.4 g of phenyl chlorocarbonate over a period of 30 minutes at room temperature, and the resulting mixture was stirred for further 1 hour. The reaction mixture was separated, and the organic layer was washed with a sodium chloride solution before drying over anhydrous magnesium sulfate, and after filtration, the solvent was distilled off to give 54.0 g of compound (A-6) as a pale yellow oil. Yield: 95.6%

Synthesis of exemplary compound (5)

5.0 g of compound (A-4), 13.0 g of compound (A-9) and 0.50 g of DMAP (N,N-dimethylaminopyridine) were dissolved in 100 ml of acetonitrile, and the mixture was stirred for 3 hours at 60° C. The reaction mixture was poured into water, and extracted with ethyl acetate. The resulted organic layer was washed with a sodium hydrogencarbonate solution, a hydrochloric acid solution, and a sodium chloride solution before drying over anhydrous magnesium sulfate. After filtration, the solvent was distilled off. The residue was purified by silica gel column chromatography (eluant:ethyl acetate/hexane=1/2), and crystallized out from hexane to give 7.5 g of exemplary compound (5) as a white solid.

Synthesis Example 3. Synthesis of exemplary compound (15)

Exemplary compound (15) was synthesized according to the following synthesis route.

Synthesis of exemplary compound (15)

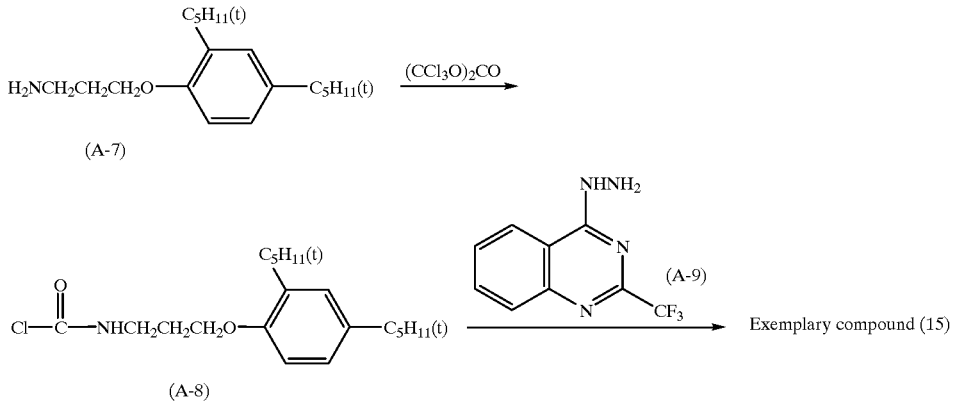

4.6 g of triphosgene was dissolved in 100 ml of THF, to which was added dropwise 13.6 g of compound (A-7) (CAS Registry No. 61053-26-7) over a period of time of 10 minutes at room temperature, and to this was further added dropwise 18.7 ml of triethylamine over a period of 10 minutes at room temperature. The mixture was reacted for 30 minutes to obtain a solution of compound (A-8). To this reaction solution was added 9.0 g of compound (A-9) in several portions over a period of time of 10 minutes at room temperature. The mixture was further stirred for 1 hour, then poured into water, and the resulting mixture was extracted with ethyl acetate. The organic layer was washed with a sodium hydrogencarbonate solution, a hydrochloric acid solution, and a sodium chloride solution before drying over anhydrous magnesium sulfate, and after filtration, the solvent was distilled off. The residue was purified by silica gel column chromatography, and crystallized out from an ethyl acetate/hexane=1/10 mixed solution to give exemplary compound (15) as a white solid.

Next, the compound of the present invention represented by the general formula (D) will be described below.

The compound represented by the general formula (D) represents a developing agent classified under aminophenol derivatives and phenylenediamine derivatives. In the formula, $R_1$ to $R_4$ each independently represent a hydrogen atom or substituent thereof, and examples thereof include a halogen atom (such as chloro and bromo groups), an alkyl group (such as methyl, ethyl, isopropyl, n-butyl and t-butyl groups), an aryl group (such as phenyl group, tolyl group and xylyl groups) a carbon amide group (such as acetylamino, propionylamino, butyloylamino and benzoyl amino groups), a sulfonamide group (such as methanesulfonylamino, ethanesulfonylamino, benzenesulfonylamino and toluenesulfonylamino groups), an alkoxy group (such as methoxy and ethoxy groups), an aryloxy group (such as a phenoxy group), an alkylthio group (such as methylthio, ethylthio and butylthio groups), an arylthio group (such as phenylthio and tolylthio groups), a carbamoyl group (such as methylcarbamoyl, dimethylcarbaomyl, ethylcarbamoyl, diethylcarbamoyl, dibutylcarbamoyl, dipiperidinocarbamoyl, morpholinocarbamoyl, phenylcarbamoyl, methylphenylcarbamoyl, ethylphenylcarbamoyl and benzylphenylcarbamoyl groups), a sulfamoyl group (such as methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfanoyl, benzylphenylsulfamoyl groups), a cyano group, a sulfonyl group (such as methanesulfonyl, ethanesulfonyl, phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as a phenoxycarbonyl group), an acyl group (such as acetyl, propionyl, butyloyl, benzoyl and alkylbenzoyl groups), a ureido group (such as methylaminocarbonamide and diethylaminocarbonamide groups), a urethane group (such as methoxycarbonamide and butoxycarbonamide groups) and an acylthio group (such as acetyloxy, propionyloxy and butyloyloxy groups), and the like. Among $R_1$ to $R_4$, $R_2$ and/or $R_4$ is preferably a hydrogen atom. When A is a hydroxyl group, the total value of Hammett constants σp of $R_1$ to $R_4$ is preferably 0 or more, and when A is a substituted amino group, the total value of Hammett constants σp of $R_1$ to $R_4$ is preferably 0 or less.

A represents a hydroxyl group or substituted amino group (such as dimethylamino, diethylamino and ethylhydroxyethylamino groups), and preferably a hydroxyl group. X represents a linkage group having a valency of two or more selected from —CO—, —SO—, —$SO_2$— and —PO<, and among then, —CO—, —$SO_2$— and —PO< are preferable. Z represents a nucleophilic group which can effect a nucleophilic attack on a carbon atom, sulfur atom or phosphorus atom of X to form a dye, after the coupling reaction of a coupler with an oxidized compound produced by the reduction of a silver halide by the present compound. In this nucleophilic group, moieties manifesting nucleophilicity asis generally the case in organic chemistry, include an atom having a non-covalent electron pair (such as nitrogen, phosphorus, oxygen, sulfur and selenium atoms and the like) and anionic species (such as nitrogen, oxygen, carbon and sulfur anions). Examples of this nucleophilic group are groups having partial structures and decomposed materials thereof as listed in the following specific examples. In the following specific examples, an atom underlined thus "=" has nucleophilicity. Examples of this nucleophilic group are groups having partial structures and decomposed materials thereof as listed in the following specific examples. In the following specific examples, an atom underlined thus "=" has nucleophilicity.

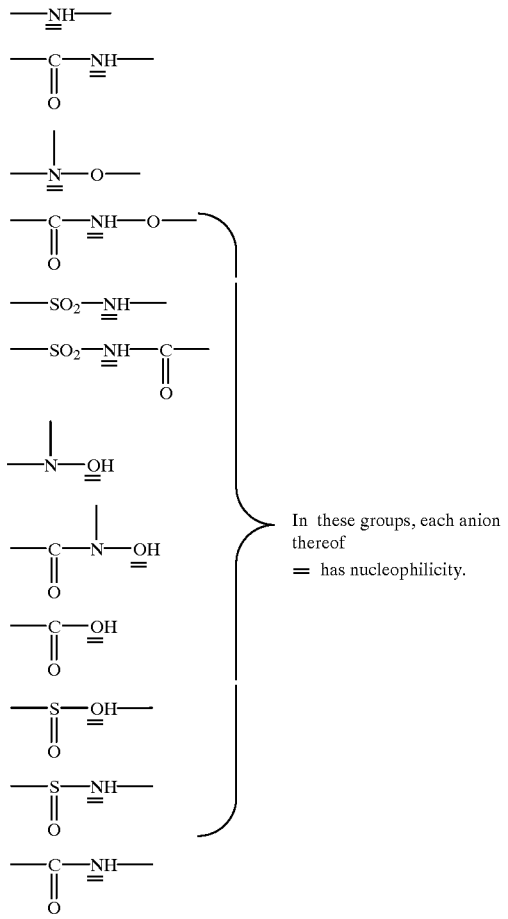

Y represents a bivalent linkage group. This linkage group represents a group in which Z is linkage in such a position as to enables an intramolecular nucleophilic attack onto X via Y. In practice, it is preferable that the atoms in the transition condition when the nucleophilic group effects a nucleophilic attack onto X are connected so as to form a 5 or 6-membered ring.

Preferable examples of such a linkage group Y include a 1,2- or 1,3-alkylene group, a 1,2-cycloalkylene group, a Z-vinylene group, a 1,2-arylene group, a 1,8-naphthylene group, and the like. n represents an integer of 1 or more. $R_1$ and $R_2$ and, $R_3$ and $R_4$ may each independently bond with each other to form a ring.

As a method for adding the developing agent represented by the general formula (D), it is possible that a coupler, developing agent, and solvent having a high boiling point (such as alkyl phosphate, alkyl phthalate and the like) are first mixed and dissolved in a solvent having a low boiling point (such as, ethyl acetate, methyl ethyl ketone and the like), and the resulting solution dispersed in water using an emulsifying dispersion method known in the art before the addition of the developing agent. Further, the developing agent can also be added by a solid dispersion method described in Japanese Patent Application Laid-Open (JP-A) No. 63-271339.

It is preferable that the compound represented by the general formula (D) is an-oil-soluble compound when the compound is added by the emulsifying dispersion method from among the above-described methods. For this purpose, it is required that at least one group having ballast properties is included. The ballast group herein represents an oil-soluble group containing an oil-soluble partial structure having 8 to 80 and preferably to 40 carbon atoms. For this structure, it is required that a ballast group having 8 or more carbon atoms is contained in any of $R_1$ to $R_4$, X, Y or Z. Preferably, the ballast group is contained in either Y or Z, with the number of carbon atoms being preferably from 8 to 80, and more preferably from 8 to 20.

The developing agent of the present-invention can be synthesized by combining organic synthesis reactions in stepwise fashion. Typical compound synthesis examples are described below.

<Synthesis of developing agent D-1>

A developing agent D-1 was synthesized by the synthesis route shown below (Scheme-1).

Scheme-1

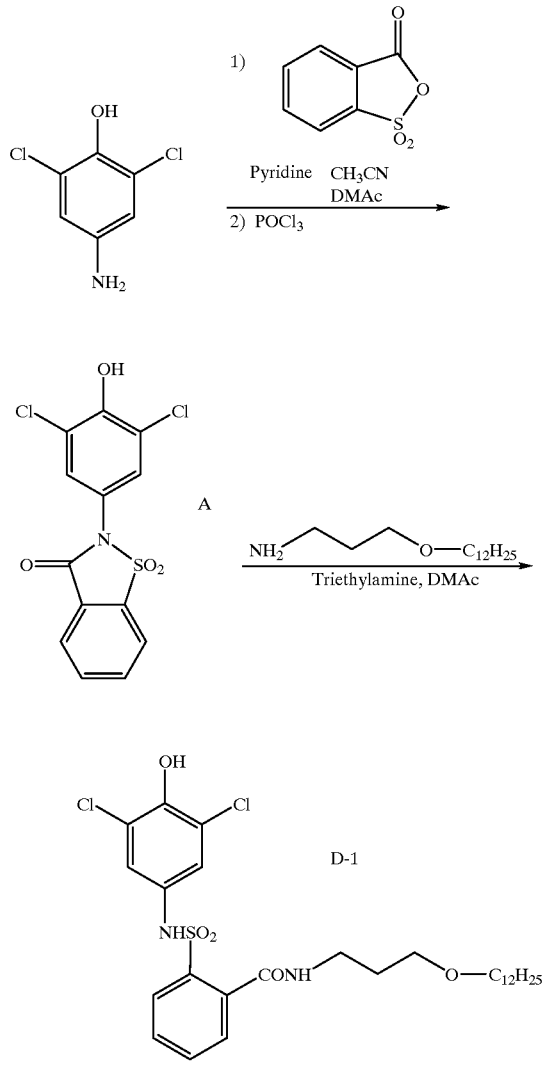

(1) Synthesis of compound A

Into a 2 L three-necked flask equipped with a condenser and thermometer were charged 600 ml of acetonitrile and 178 g (1 mol) of 2,6-dichloro-4-aminophenol, and the mixture was kept at 0° C. or lower by stirring it over a methanol-ice bath. When 81 ml (1 mol) of pyridine was added to this mixture while ventilcting it with nitrogen, an exothermic reaction occurred and a homogeneous solution was obtained. The temperature was lowered to 5° C. or less, and a solution, obtained by dissolving 184 g of o-sulfobenzoic anhydride (1 mol) in 250 ml of N,N-dimethylacetoamide (DMAc), was carefully added so that the temperature in the flask did not exceed 35° C. After completion of the addition, the mixture was further stirred for 1 hour at room temperature to complete the reaction, then, 200 g (1.3 mol) of phosphorus oxychloride was added to this dropwise. An exothermic reaction occurred as a result of the addition, and the temperature increased to about 60° C. The temperature was kept at 60 to 70° C. by using a hot water bath, and the reaction was continued for 5 hours while stirring. After completion of the reaction, this reaction mixture was added to 10 L of ice water, and the deposited crystals were separated by filtration. The resultant crude crystals were re-crystallized from a mixed solvent of acetonitrile-DMAc to obtain 300 g of crystals of compound A (yield: 87%).

(2) Synthesis of developing agent D-1

Into a 1 L three-necked flask equipped with a condenser and thermometer were charged 172 g (0.5 mol) of compound A, 600 ml of DMAC, 140 ml (1 mol) of triethylamine, and 122 g (0.5 mol) of lauryloxypropylamine, and they were reacted for 3 hours at a temperature of 70° C. while stirring. After completion of the reaction, this reaction mixture was added to 10 L of ice-hydrochloric acid solution, and the deposited crystals were separated by filtration. The resultant crude crystals were re-crystallized from ethanol to obtain 265 g of crystals of a developing agent D-1 (yield: 90%).

<Synthesis of developing agent D-7>

A developing agent D-7 was synthesized by a synthesis route as shown below (Scheme-2).

Scheme-2

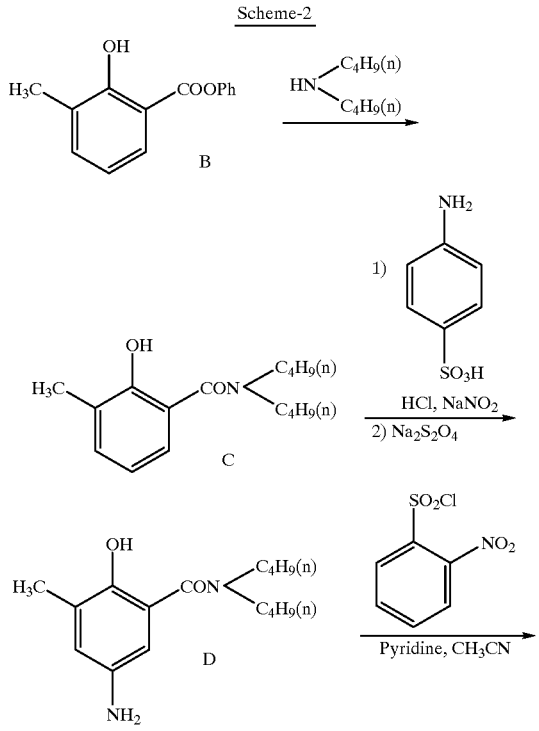

-continued

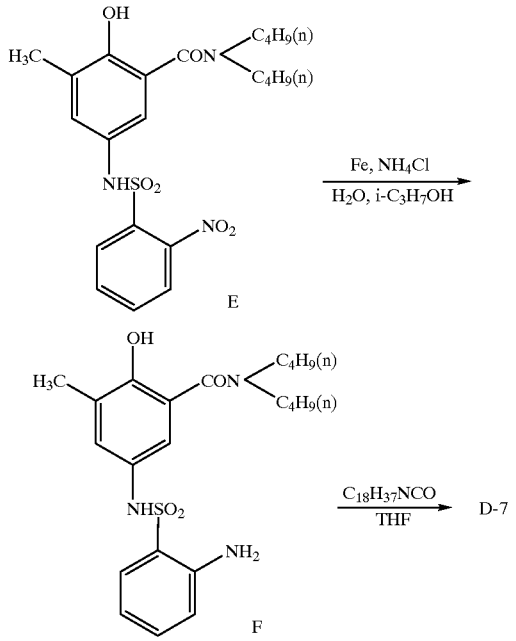

(1) Compound B→C

Into a 1 L eggplant-type flask were charged a rotator for a magnetic stirrer, 228 g (1 mol) of compound B, and 155 g (1.2 mol) of di-n-butylamine, a gas inlet tube was attached to this flask, and the tube was connected to an aspirator through a pressure resistant rubber tube. The solution was stirred using a magnetic stirrer while reduced pressure was maintained by water flow, and the temperature thereof was raised up to 120° C. to cause deposition of crystals of phenol in the glass section of the aspirator. The reaction was continued for 4 hours, and when the deposition of phenol crystals stopped, the temperature was lowered again to room temperature. This reaction mixture was added to 3 L of a hydrochloric acid solution, and the deposited crystals were separated by filtration. This crude crystal was re-crystallized from 1 L of methanol to obtain 242 g of crystals of compound C (yield 92%).

(2) Compound C→D

Into a 5 L beaker was charged 66 g (0.25 mol) of compound C, then 100 ml of methanol, 250 g (1.8 mol) of potassium carbonate, and 500 ml of water were added and they were dissolved completely. This solution was kept at 0° C. or lower while stirring. Meanwhile, another solution was prepared by dissolving 65 g (0.375 mol) of sulfanilic acid and 16.5 g of sodium hydroxide into 130 ml of water. To this was added 90 ml of concentrated hydrochloric acid to prepare a slurry solution. The prepared solution was vigorously stirred while being maintained at 0° C. or lower, and to this was gradually added a solution prepared by dissolving 27.5 g (0.4 mol) of sodium nitrite into 50 ml of water, to produce a diazonium salt. This reaction was effected with ice added appropriately to maintain the temperature at 0° C. or lower. The diazonium salt thus obtained was gradually added to the solution of the compound B which had been continually stirred. This reaction was also effected by appropriately adding ice to maintain the temperature at 0° C. or lower. As the addition proceeded, the solution turned red due to the azo dye. After completion of the addition, the solution was further reacted for 30 minutes at 0° C. or lower, and when dissipation of the raw materials was confirmed, 500 g (3 mol) of sodium hydrosulfite in the form of a powder was added. When this solution was heated to 50° C., reduction of the azo group occurred with intense foaming. When the foaming stopped and the solution had decolorized to a yellowish clear solution, it was cooled to 10° C. and deposits of crystals were found. The deposited crystals were separated by filtration, and the resultant crude crystals were re-crystallized from 300 ml of methanol to obtain 56 g of crystals of compound D (yield: 80%).

(3) Compound D→E

Into a 1 L three-necked flask equipped with a condenser were charged 200 ml of acetonitrile, 56 g (0.2 mol) of compound D, and 16 ml (0.2 mol) of pyridine, and to this was added 44 g (0.2 mol) of o-nitrobenzenesulfonyl chloride over a period of 30 minutes. After completion of the addition, the mixture was further stirred at room temperature for 2 hours to complete the reaction. This reaction mixture was added to 3 L of a hydrochloric acid solution, and the deposited crystals were separated by filtration. The crude crystals were re-crystallized from methanol to obtain 86 g of crystals of compound E (yield: 93%)8

(4) Compound E→F

Into a 3 L three-necked flask equipped with a condenser were charged 1 L of isopropanol, 100 ml of water, 10 g of ammonium chloride, and 100 g of a reduced iron powder, and the mixture was heated while stirring over a water vapor bath until the isopropanol was gently reduced under reflux conditions, stirring was continued for about 15 minutes. To this was gradually added 100 g of compound E over a period of 30 minutes. Intense reduction occurred with each addition, as the reduction reaction progressed. After completion of the addition, the solution was further reacted for 1 hour under reflux. This reaction mixture was filtered through a Buchner funnel on which celite was spread in a heated condition. The residue was further washed with methanol, and then was also filtered and added to the filtrate. When the filtrate was condensed under reduced pressure to about 300 cc, crystals were deposited, then this filtrate was cooled to grow the crystals. The crystals were filtered, and washed with methanol before drying to obtain 80 g of crystals of compound F (yield: 85%).

(5) Compound F→Developing agent D-7

Into a 1 L three-necked flask equipped with a condenser and a thermometer were charged 300 ml of tetrahydrofuran and 87 g (0.2 mol) of compound F. The mixture was stirred at room temperature. To this was added dropwise 59.1 g (0.2 mol) of octadecyl isocyanate. In this procedure, the temperature was maintained at 30° C. or less. After the addition, the mixture was stirred for 2 hours, then the reaction mixture was added to 5 L of ice water. When crystals were deposited, they were separated by filtration, and re-crystallized from 600 ml of isopropanol to obtain 139 g of crystals of a developing agent D-7 (yield: 95%).

Specific examples of the color developing agent represented by general formula D may include, but are not limited to, the following developing agents.

D-1
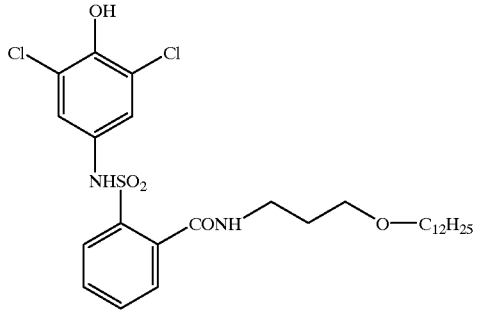
D-2
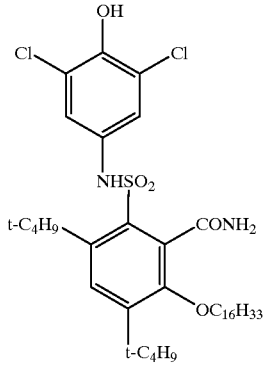
D-3
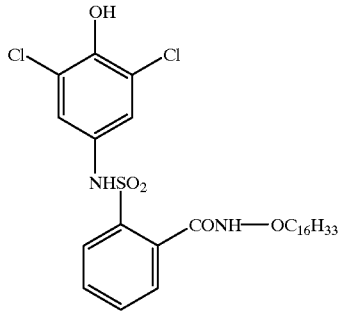
D-4
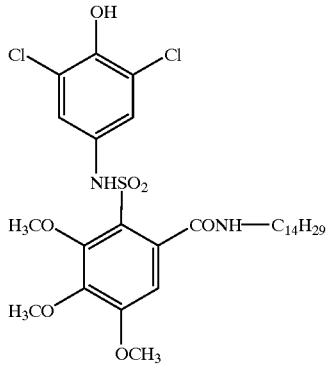
D-5
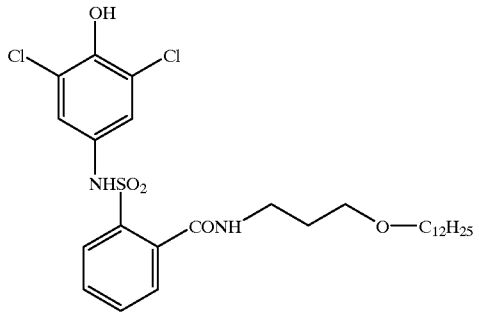
D-6
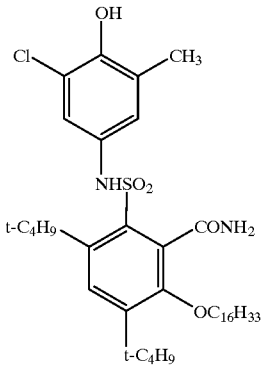
D-7
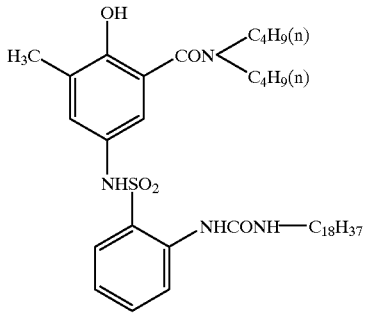
D-8
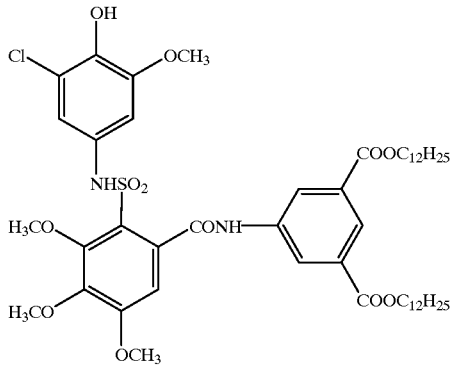

-continued
D-9
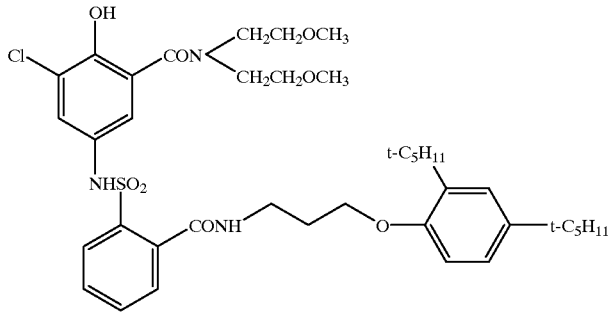
D-10
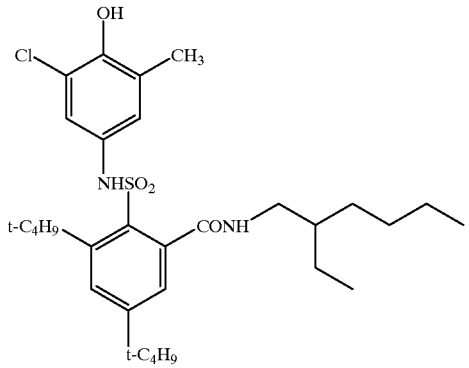
D-11
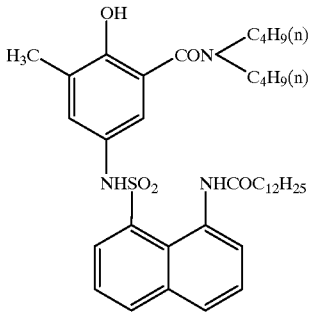
D-12
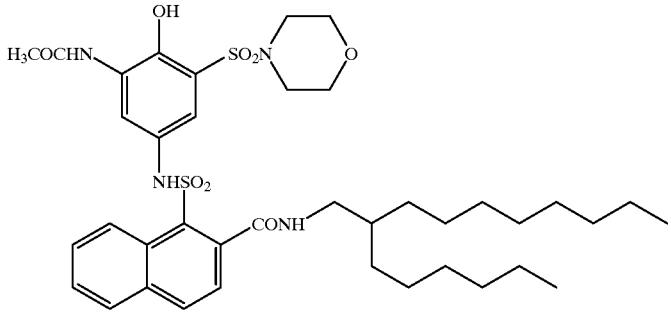
D-13
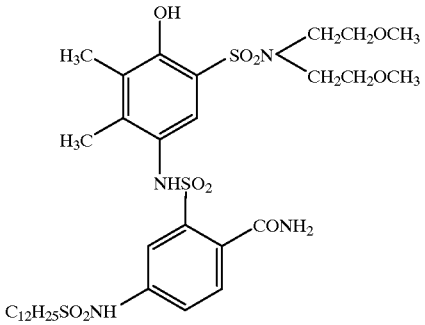
D-14
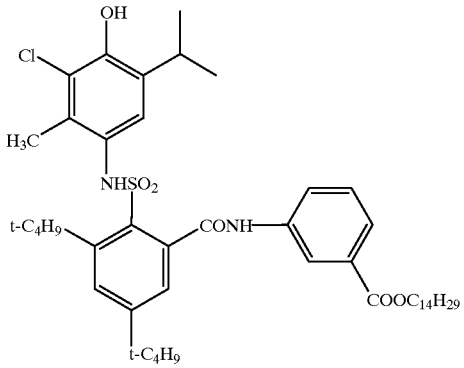

-continued
D-15
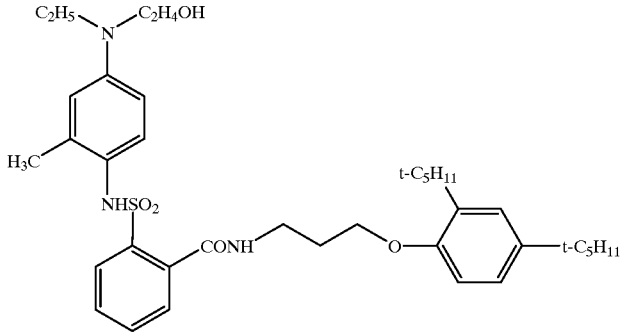
D-16
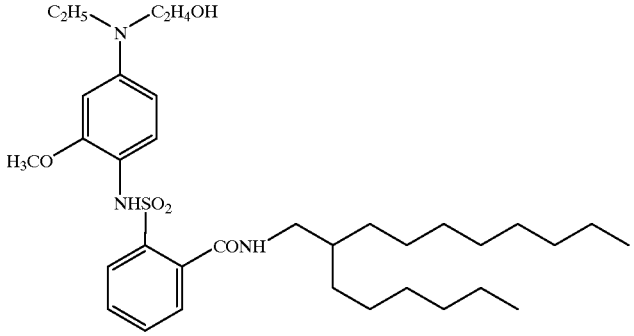
D-17
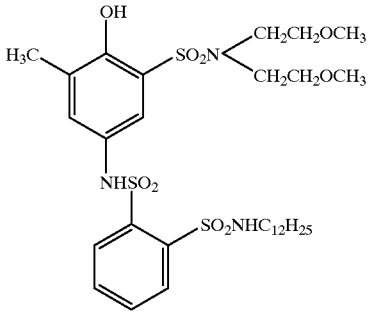
D-18
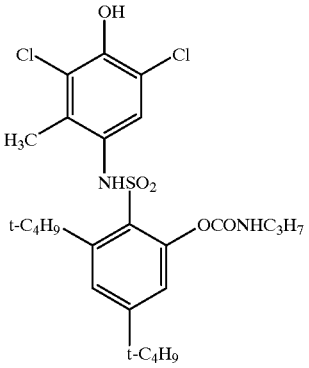
D-19
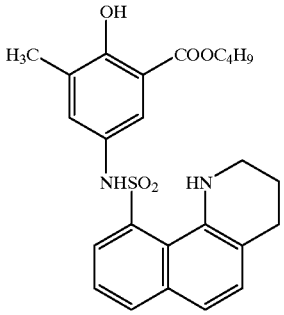
D-20
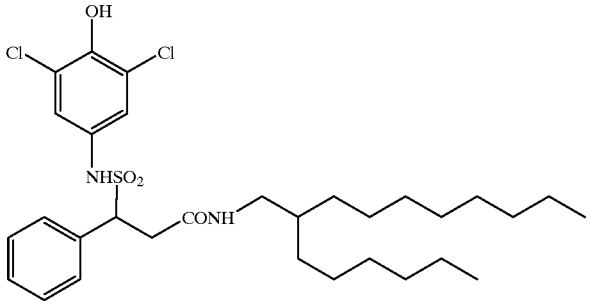

-continued
D-21
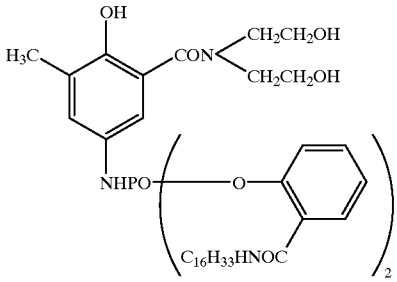
D-22
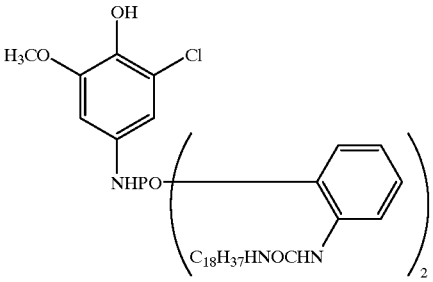
D-23
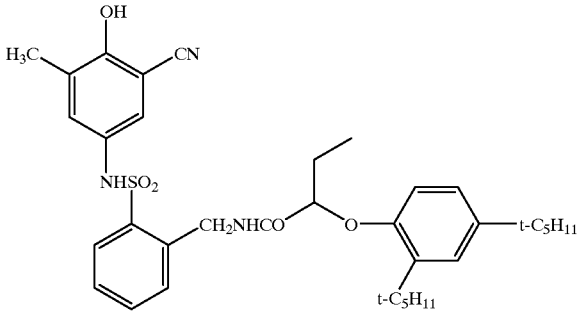
D-24
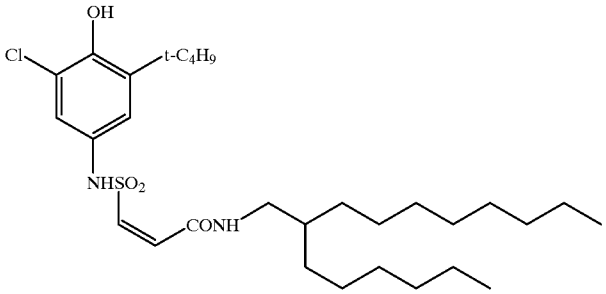
D-25
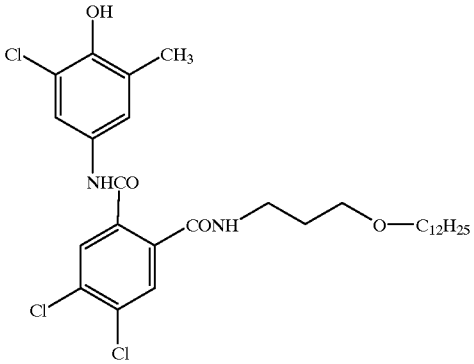
D-26
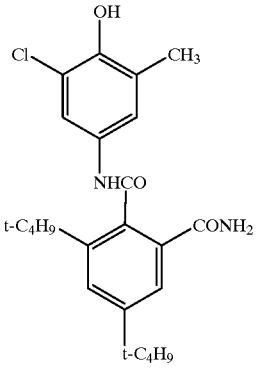
D-27
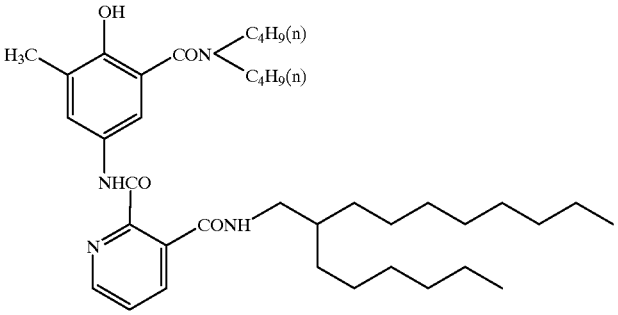

-continued
D-28
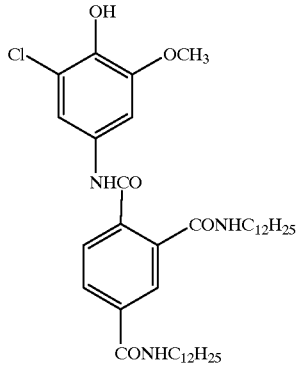
D-29
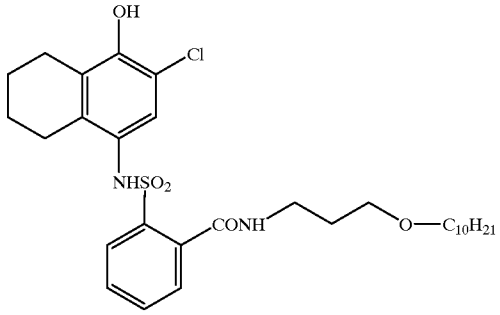
D-30
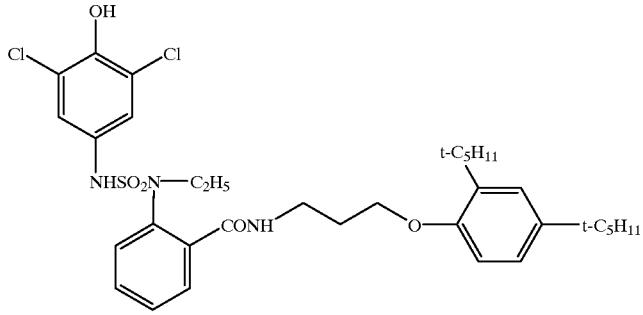
D-31
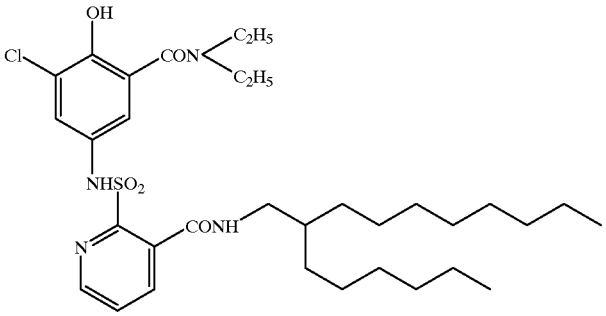
D-32
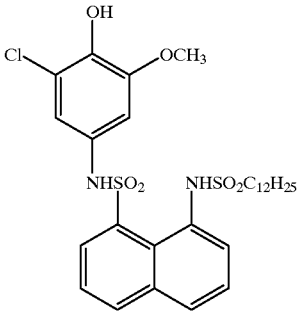
D-33
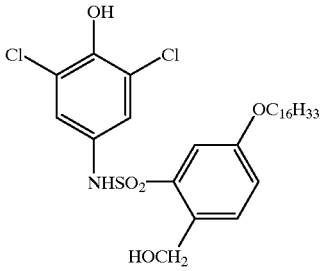

-continued

D-34

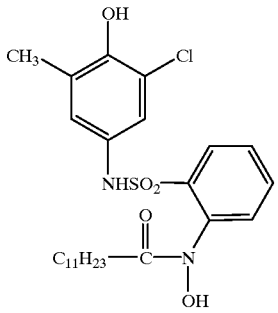

D-35

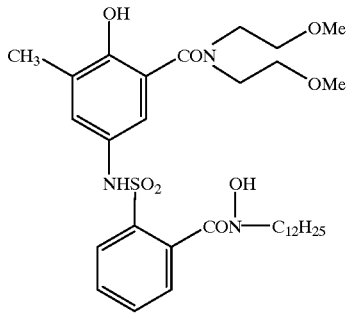

D-36

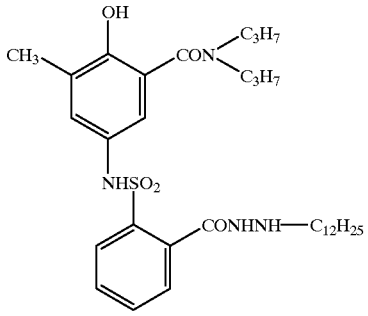

D-37

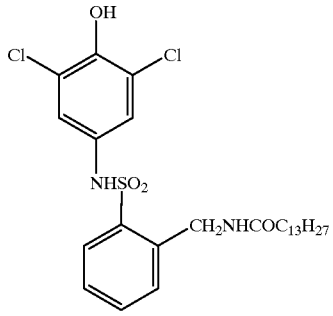

D-38

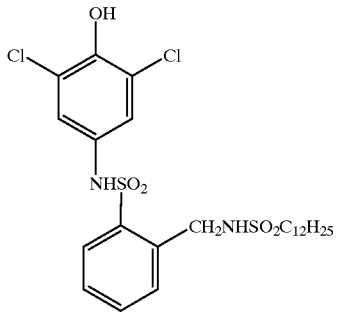

The color developing agent of the present invention represented by the general formula (I) or (D) is used together with a compound (coupler) which forms a dye by an oxidation coupling reaction. In the present invention, what is called a "two equivalent coupler" in which the coupling position is substituted, and which is used in general silver salt photography using a p-phenylenediamine developing agent as a developing chemical is preferable. Details of the above-described coupler are described, for example, in T. H. James, The Theory of the Photographic Process, 4th. Ed., Macmillan, 1977, pp. 291–334, pp. 354–361, and in Japanese Patent Application Laid-Open (JP-A) Nos. 58-12353, 58-149046, 58-149047, 59-11114, 59-124399, 59-174835, 59-231539, 59-231540, 60-2951,60-14242, 60-23474, 60-66249 and the like.

Examples of the coupler preferably used in the present invention will be described below.

Examples of the coupler preferably used in the present invention may include compounds having structures described in the following general formulae (1) to (12). These are compounds generally called active methylene, pyrazolone, pyrazoloazole, phenol, naphthol or pyrrolotriazole respectively, and are well known in the art.

(1)

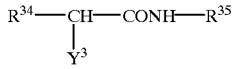

(2)

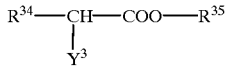

(3)

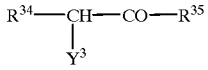

(4)

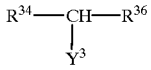

-continued (5)

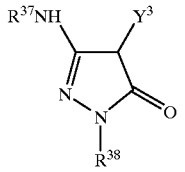

(6)

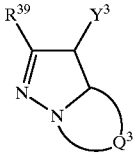

(7)

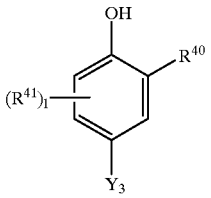

(8)

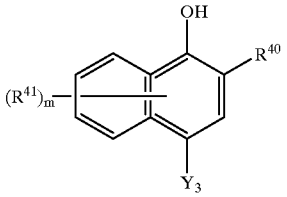

(9)

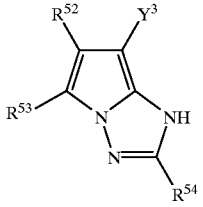

(10)

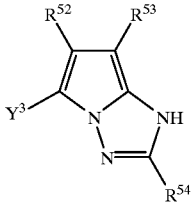

(11)

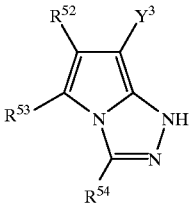

-continued (12)

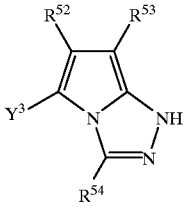

The compounds represented by the general formulae (1) to (4) are couplers called active methylene type couplers which are described in U.S. Pat. Nos. 3,933,501, 4,022,620, 4,248,961, Japanese Patent Application Publication (JP-B) No. 58-10739, BPNos. 1,425,020, 1,476,760, U.S. Pat. Nos. 3,973,968, 4,314,023, 4,511,649, EP No. 249,473A and the like. In these general formulae, $R^{34}$ represents an acyl group, a cyano group, a nitro group, an aryl group, a hetero cyclic group, an alkoxycarbonyl group, an aryloxycarbonyl group, a carbamoyl group, a sulfamoyl group, an alkylsulfonyl group, or an arylsulfonyl group each of which may have a substituent.

In the compounds represented by the general formulae (1) to (3), $R^{35}$ represents an alkyl group, an aryl group or a hetero cyclic group which may have a substituent. In the general formula (4), $R^{36}$ represents an aryl group or a hetero cyclic group which may have a substituent. Examples of the substituents that $R^{34}$, $R^{35}$ and $R^{36}$ may have include the examples of the substituents on a ring formed from $Q_1$ and C.

In the compounds represented by the general formulae (1) to (4), $R^{34}$ and $R^{35}$ may be linked to each other to form a ring and $R^{34}$ and $R^{36}$ may be linked to each other to form a ring.

The compound represented by the general formula (5) is a coupler referred to as a 5-pyrazolone-based coupler. In the general formula (5), $R^{37}$ represents an alkyl group, an aryl group, an acyl group, or a carbamoyl group. $R^{38}$ represents a phenyl group or a phenyl group having one or more substituents selected from a halogen atom, an alkyl group, a cyano group, an alkoxy group, an alkoxycarbonyl group, and an acylamino group.

In the 5-pyrazolone-based coupler represented by the general formula (5), $R^{37}$ is preferably an aryl group or acyl group, and $R^{38}$ is preferably a phenyl group having one or more substituents selected from halogen atoms.

More specifically, $R^{37}$ may include aryl or acetyl groups such as a phenyl group, a 2-chlorophenyl group, a 2-methoxyphenyl group, a 2-chloro-5-tetradecaneamidephenyl group, a 2-chloro-5-(3-octadeenyl-1-succinimide)phenyl group, a 2-chloro-5-octadecylsultoneamidephenyl group, a 2-chloro-5-[2-(4-hydroxy-3-t-butylphenoxy)tetradecaneamide]phenyl, and the like, acyl groups such as a 2-(2,4-di-t-pentylphenoxy) butanoyl group, benzoyl group, a 3-(2,4-di-t-amylphenoxyacetoamide)benzoyl group, and the like, and these groups may further have a substituent, which is an organic substituent or halogen atom which is connected via a carbon atom, oxygen a tom, nitrogen atom or sulfur atom. $Y^3$ is as defined above.

$R^{38}$ preferably may include a substituted phenyl group such as a 2,4,6-trichlorophenyl group, a 25-dichlorophenyl group, a 2-chloropheyl group, and the like.

The compound represented by the general formula (6) may be a coupler referred to as a pyrazoloazole-based coupler. In the general formula (6), $R^{39}$ represents a hydrogen atom or a substituent. $Q^3$ represents a non-metal atom group required for forming a 5-membered azole ring containing 2 to 4 nitrogen atoms, and the azole ring may have a substituent (including a condensed ring).

Among the pyrazoloazole-based couplers represented by the general formula (6), imidazo[1,2-b]pyrazoles described in U.S. Pat. No. 4,500,630, pyrazolo[1,5-b]-1,2,4-triazoles described in U.S. Pat. No. 4,500,654 and pyrazolo[5,1-c]-1,2,4-triazoles described in U.S. Pat. No. 3,725,067 are preferable from the point of the spectral absorption properties of the color developing dye.

The details of substituents on an azole ring represented by $R^{39}$, $Q^3$ are described, for example, in U.S. Pat. No. 4,540,654, 2nd column, lines 41 to 8th column, line 27. Preferable examples thereof may include a pyrazoloazole coupler in which a branched alkyl group directly bonds to the 2, 3 or 6-position of a pyrazolotriazole group described in Japanese Patent Application Laid-Open (JP-A) No. 61-65,245, a pyrazoloazole coupler containing a sulfoneamide group in the molecule described in Japanese Patent Application Laid-Open (JP-A) No. 61-65245, U.S. Pat. No. 5,541,501, a pyrazoloazole coupler having an alkoxyphenylsulfoneamide ballast group described in Japanese Patent Application Laid-Open (JP-A) No. 61-147254, a pyrazoloazole coupler having an alkoxy group and aryloxy group in the 6-position described in Japanese Patent Application Laid-Open (JP-A) No. 62-209457 or 63-307453, and a pyrazoloazole coupler having a carbonamide group in the molecule described in Japanese Patent Application No. 1-22279.

The compounds represented by the general formulae (7) and (8) are couplers referred to as a phenol-based coupler and naphthol-based coupler, respectively. In these general formulae, $R^{40}$ represents a hydrogen atom or a group selected from $—CONR^{42}R^{43}$, $—SO_2NR^{42}R^{43}$, $—NHCOR^{42}$, $—NHCONR^{42}R^{43}$ and $—NHSO_2NR^{42}R^{43}$. $R^{42}$ and $R^{43}$ represent a hydrogen atom or a substituent thereof. In the general formulae (7) and (8), $R^{41}$ represents a substituent, 1 represents an integer selected from 0 to 2, and m represents an integer selected from 0 to 4. When 1 and m are 2 or more, $R^{41}$ may be different for each of them. The substituents of $R^{42}$ to $R^{43}$ have the same definitions as defined in the substituents on a ring formed from $Q^1$ and C.

Preferable examples of the phenol-based coupler represented by the formula (7) may include 2-alkylamino-5-alkylphenol-based couplers described in U.S. Pat. Nos. 2,369,929, 2,801,171, 2,772,162, 2,895,826, 3,772,002 and the like, 2,5-dialkylaminophenol-based couplers described in U.S. Pat. Nos. 2,772,162, 3,758,308, 4,126,396, 4,334,011, 4,327,173, OLS 3,329,729, Japanese Patent Application Laid-Open (JP-A) No. 59-166956 and the like, 2-phenylureido-5-acylaminophenol-based couplers described in U.S. Pat. Nos. 3,446,622, 4,333,999, 4,451,559, 4,427,767, and the like.

Preferable examples of the naphthol coupler represented by the formula (8) may include 2-carbamoyl-1-naphthol-based couplers described in U.S. Pat. Nos. 2,474,293, 4,052,212, 4,146,396, 4,282,233, 4,296,200 and the like, as well as 2-carbamoyl-5-amide-1-naphthol-based couplers described in U.S. Pat. No. 4,690,889, and the like.

The compounds represented by the general formulae (9) to (12) are couplers each referred to as pyrrolotriazole. In these general formulae, $R^{53}$, $R^{53}$ and $R^{54}$ represent a hydrogen atom or a substituent thereof. $Y^3$ is as defined above. The substituents of $R^{52}$, $R^{53}$ and $R^{54}$ have the same definitions as defined in the above-described substitutuents on a ring formed from $Q_1$ and C. Preferable example of the pyrrolotriazole-based couplers represented by the general formulae (9) to (12) may include couplers in which at least one of $R^{55}$ and $R^{53}$ is an electron attractive group described in EP Nos. 488,248A1, 491,197A1, 545,300 and U.S. Pat. No. 5,384,236.

In the general formulae (1) to (12), is a group which imparts diffusion resistance to a coupler and can be released by a coupling reaction with an oxidized product of a developing agent. Examples of Y include a heterocyclic group (a 5 to 7 membered saturated or unsaturated monocyclic or condensed ring having at least one hetero atom such as nitrogen, oxygen, sulfur and the like, examples thereof include succinimide, maleinimide, phthalimide, diglycolimide, pyrrole, pyrazole, imidazole, 1,2,4-triazole, tetrazole, indole, benzopyrazole, benzoimidazole, benzotriazole, imidazoline-2,4-dione, oxazolidine-2,4-dione, thiozolidine-2,4-dione, imidazolidine-2-one, oxazolidine-2-one, thiazoline-2-one, benzoimidazoline-2-one, benzooxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2pyrimidone, 6-pyridazone, 2-pyrazone, 2-amino-l,3,4 -thiazolidine, 2-imino-1,3,4-thiazolidine-4-oneandthelike.), a halogen atom (such as chlorine, bromine atoms, and the like), an aryloxy group (such as phenoxy, 1-naphthoxy groups and the like), a heterocyclicoxy group (such as pyridyloxy, pyrazolyloxy groups and the like), an acyloxy group (such as acetoxy, benzoyloxy groups and the like), an alkoxy group (such as methoxy, dodecyloxy groups and the like), a carbamoyloxy group (such as N,N-diethylcarbamoyloxy, morpholinocarbonyloxy groups and the like), an aryloxycarbonyloxy group (such as a phenoxycarbonyloxy group and the like), an alkoxycarbonyloxy group (such as methoxycarbonyloxy, ethoxycarbonyloxy groups and the like), an arylthio group (such as phenylthio, naphthylthio groups and the like), a heterocyclic thio group (such as tetrazolylthio, 1,3,4-thiadiazolylthio, 1,3,4-oxadiazolylthio, benzoimidazolylthio groups and the like), an alkylthio group (such as methylthio, octylthio, hexadecylthio groups and the like), an alkylsulfonyloxy group (such as a methanesulfonyloxy group and the like), an arylsulfonyloxy group (such as benzenesulfonyloxy and toluenesulfonyloxy groups and the like), a carbonamide group (such as acetamide, trifluoroacetamide groups and the like), a sulfonamide group (such as methanesulfonamide, benzenesulfonamide groups and the like), an alkylsulfonyl group (such as a methanesulfonyl group and the like), an arylsulfonyl group (such as a benzenesulfonyl group and the like), an alkylsulfinyl group (such as a methanesulfinyl group and the like), an arylsulfinyl group (such as a benzenesulfinyl group and the like), an arylazo group (such as phenylazo, naphthylazo groups and the like), a carbamoylamino group (such as a N-methylcarbamoylamino group and the like), and the like.

$Y^3$ may be substituted with a substituent, and examples of the substituent for $Y^3$ include the examples of the substituent on a ring formed from $Q_1$ and C. The total number of carbon atoms contained in $Y^3$ is preferably from 6 to 50, more preferably from 8 to 40, and most preferably from 10 to 30.

$Y^3$ is preferably an aryloxy, heterocyclicoxy, acyloxy, aryloxycarbonyloxy, alkoxycarbonyloxy or -carbamoyloxy group.

In addition to the above-described couplers, couplers having a different structure can be used such as condensed ring phenol-based couplers, imidazole-based couplers, pyrrole-based couplers, 3-hydroxypyridine-based couplers, active methylene, active methine-based couplers, 5,5-condensed ring heterocyclic-based couplers and 5,6-condensed ring heterocyclic-based couplers.

As the condensed phenol-based coupler, couplers described in U.S. Pat. Nos. 4,327,173, 4,564,586, 4,904,575 and the like can be used.

As the imidazole-based coupler, described in U.S. Pat. Nos. 4,818,672, 5,051,347 and the like can be used couplers.

As the 3-hydroxypyridine-based coupler, couplers described in Japanese Patent Application Laid-Open (JP-A) No. 1-315736 and the like can be used.

As the active methylene and active methine-based coupler, couplers described in U.S. Pat. Nos. 5,104,783, 5,162,196 and the like can be used.

As the 5,5-condensed ring heterocyclic-based couplers, pyrrolopyrazole-based couplers described in U.S. Pat. No. 5,164,289, pyrroloimidazole-based couplers described in JP-A No. 4-174429, and the like can be used.

As the 5,6-condensed ring heterocyclic-based couplers, pyrazolopyrimidine-based couplers described in U.S. Pat. No. 4,950,585, pyrrolotriazine-based couplers described in JP-A No. 4-204730, couplers described in EP No. 556,700, and the like can be used.

In the present invention, in addition to the above-described couplers, there can be used couplers described in German Patent Nos. 3,819,051A, 3,823,049, U.S. Pat. Nos. 4,840,883, 5,024,930, 5,051,347, 4,481,268, EPNos. 304, 856A2, 329,036, 354,549A2, 374,781A2, 379,110A2, 386, 930A1, Japanese Patent Application Laid-Open (JP-A) Nos. 63-141055, 64-32260, 64-32261,2-297547, 2-44340, 2-110555, 3-7938, 3-160440, 3-172839, 4-172447, 4-179949, 4-182645, 4-184437, 4-188138, 4-188139,4-194847, 4-204532,4-204731,4-204732, and the like.

In the coupler used in the present invention, the total number of carbon atoms in parts other than $Y^3$ is preferably from 1 to 30, more preferably from 1 to 24, and most preferably from 1 to 18.

Specific examples of the coupler which can be used in the present invention include, but are not limited to, the following couplers.

(1)

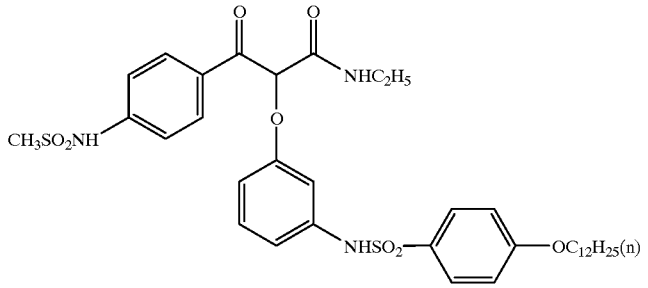

(2)

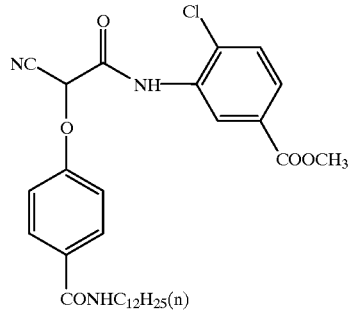

(3)

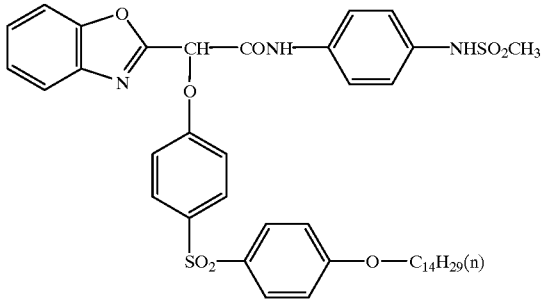

-continued
(4)
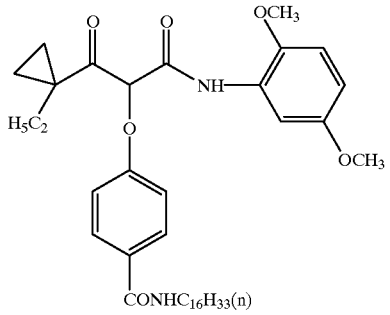
(5)
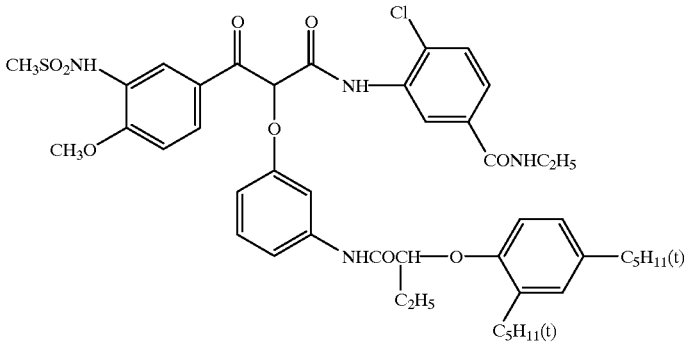
(6)
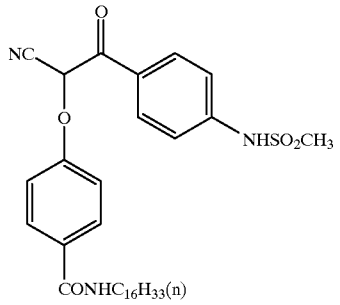
(7)
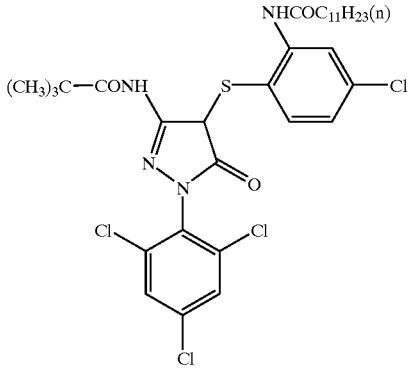
(8)
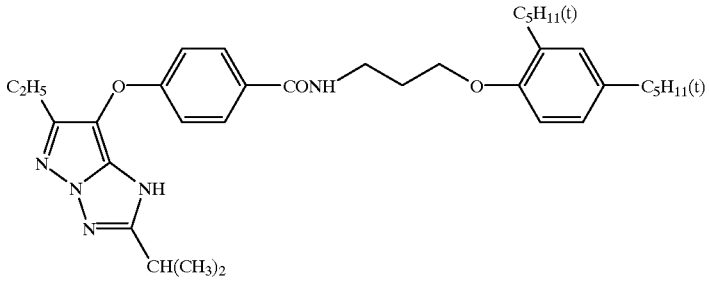

-continued
(9)
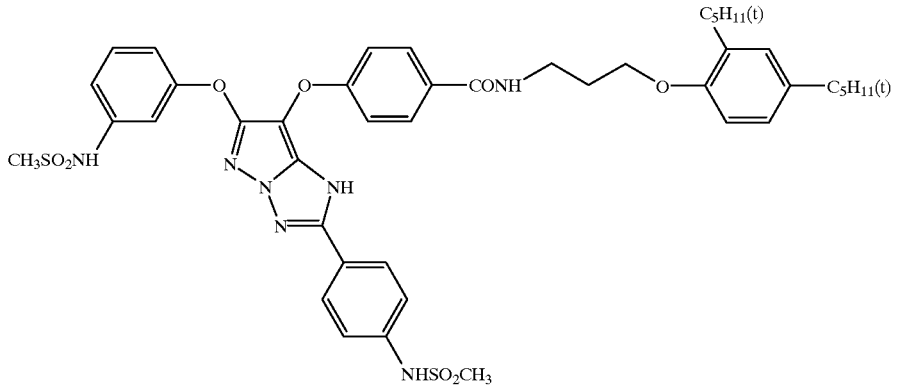
(10)
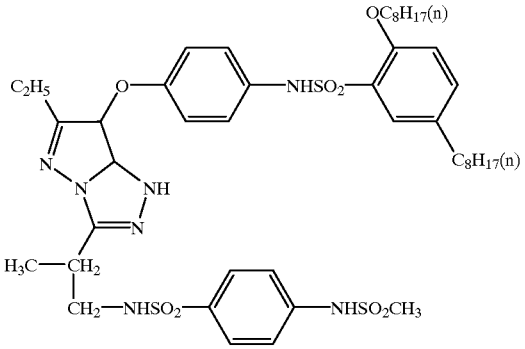
(11)
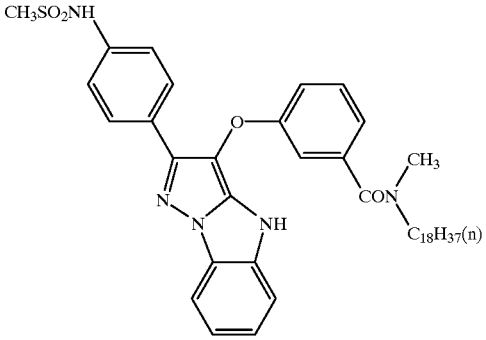
(12)
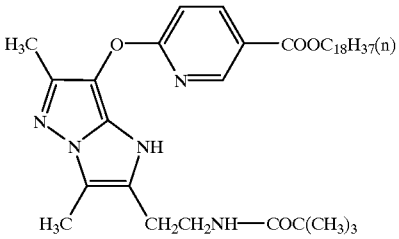
(13)
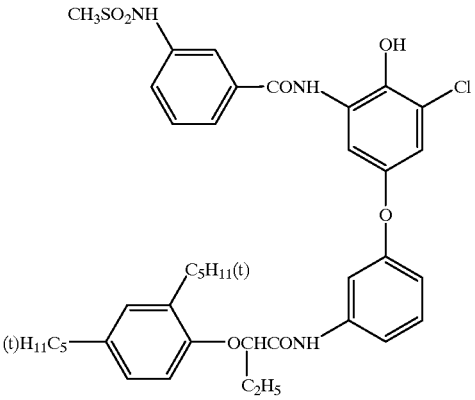
(14)
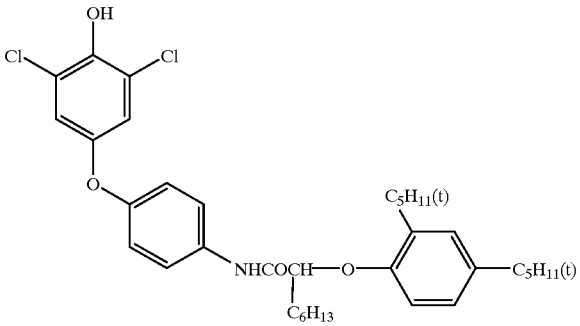

-continued
(15)
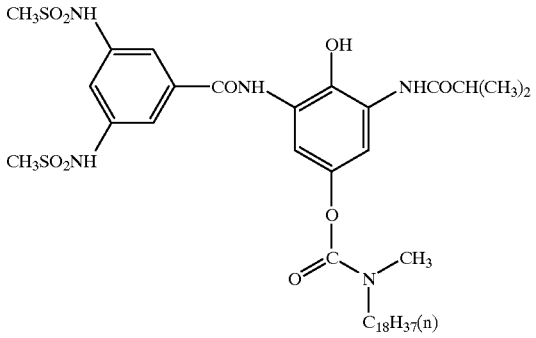
(16)
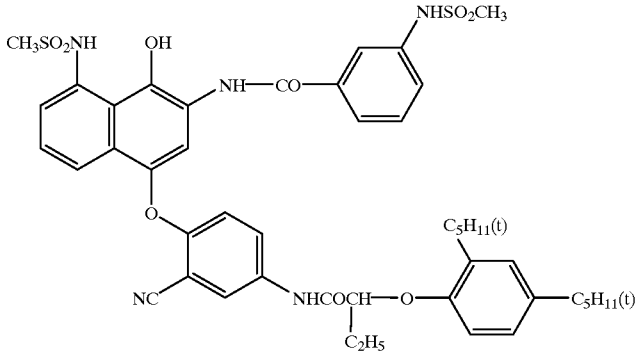
(17)
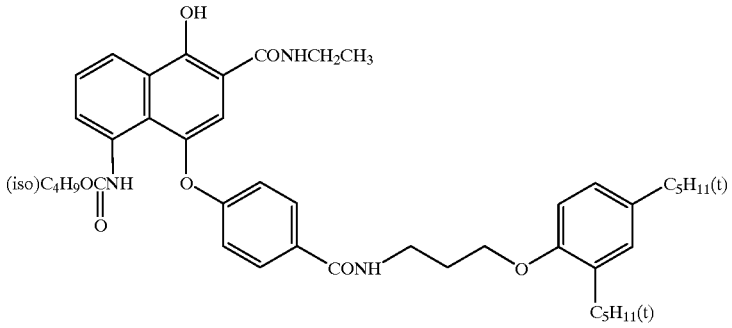
(18)
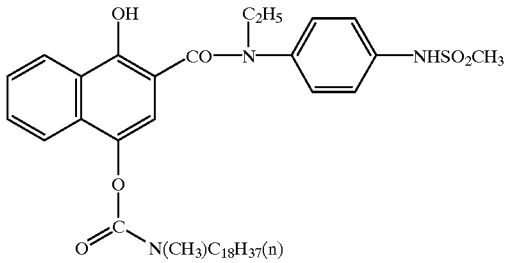
(19)
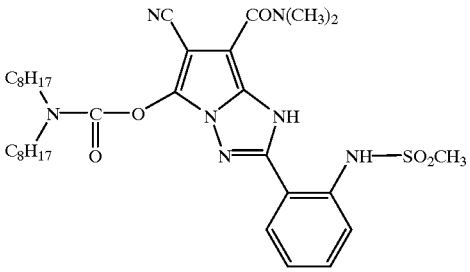

-continued
(20)
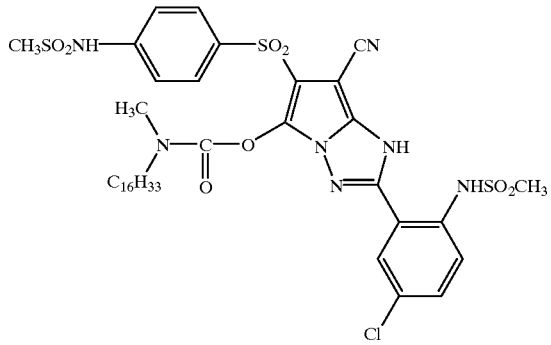
(21)
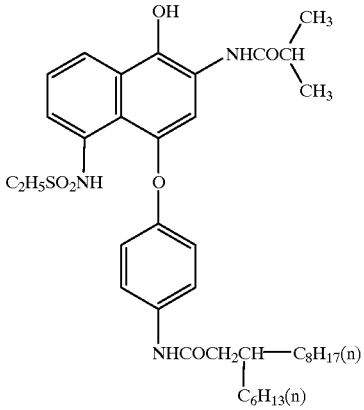
(22)
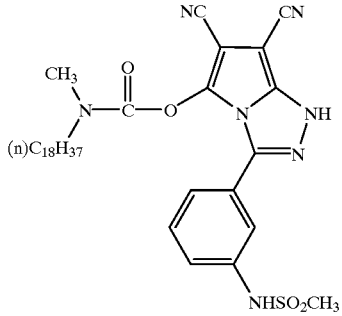
(23)
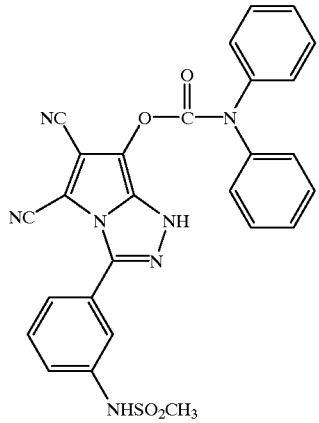
(24)
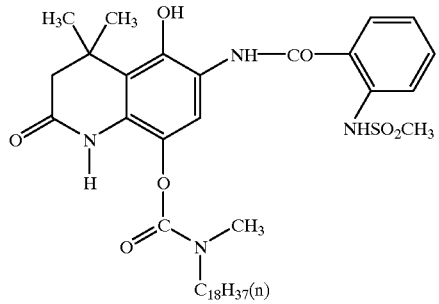
(25)
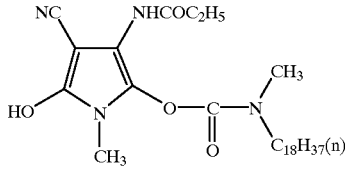
(26)
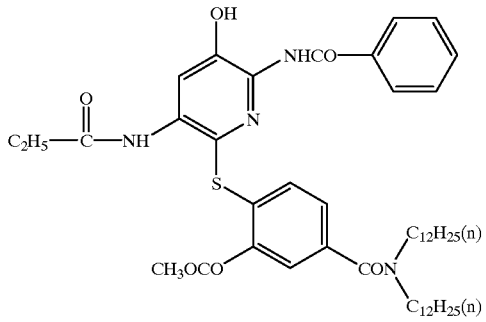
(27)
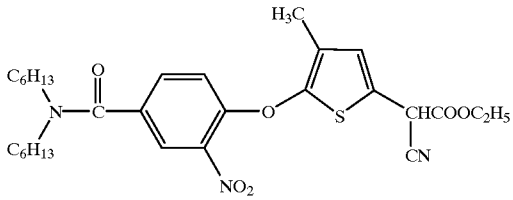

-continued (28)

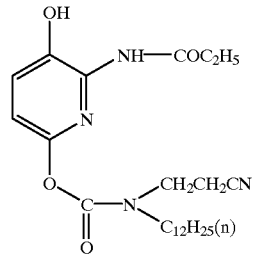

(29)

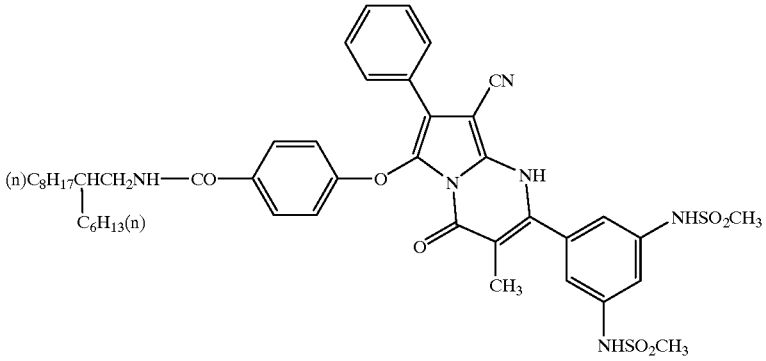

(30)

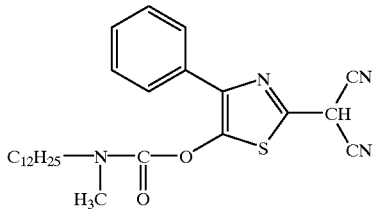

The amount added of the coupler used in the present invention depends on the molar absorptivity (E) of the dye produced, and in the case of a coupler in which E of a dye produced by coupling is from about 5,000 to 500,000, it is suitable that the amount coated is from about 0.001 to 100 mmol/$m^2$, preferably from about 0.01 to 10 millimol/$m^2$, and more preferably from about 0.05 to 5.0 millimol/$m^2$, in order to obtain an image density of 1.0 or more in terms of reflection density.

The amount added of the color developing agent of the present invention represented by the general formulae (I) or (D) is from 0. 01 to 100 times, preferably from 1 to 10 times and more preferably from 0.2 to 5 times the amount of the coupler. Further, 2 or more couplers may be used in combination.

Next, compounds represented by the general formulae (II-a), (II-b), (III-a), (III-b), (IV-a), (IV-b), (IV-c), (IV-d), (IV-e), (IV-f) and (IV-g) are described below in detail. In general formulae (II-a) and (II-b), $R^1$ represents a substituted or unsubstituted alkyl group, a cycloalkyl group, an aralkyl group, an aryl group, an amino group, or a heterocyclic group.

Preferable examples of $R^1$ include a substituted or unsubstituted alkyl group having 1 to 30 carbon atoms, e.g., a methyl group, an ethyl group, a dodecyl group, and the like; a substituted or unsubstituted cycloalkyl group having 5 to 30 carbon atoms, e.g., a cyclohexyl group and the like; a substituted or unsubstituted aralkyl group having 7 to 30 carbon atoms, e.g., a benzyl group, a β-phenetyl group, and the like; a substituted or unsubstituted aryl group having 6 to 30 carbon atoms, e.g., a phenetyl group, a naphthyl group, a tolyl group, a xylyl group, and the like; a substituted or unsubstaituted amino group having 0 to 30 carbon atoms, e.g., an amino group, a methylamino group, an isopropylamino group, a cyclohexylamino group, aphenylamino group, a benzylamino group, an N,N-dimethylamino group, an N-methyl-N-ethylamino group, an N,N-diisopropylamino group, an N,N-dicyclohexylaminogroup, an N,N-diphenylaminogroup, an N,N-dibenzylamino group; a substituted or unsubstituted heterocyclic ring, e.g., a pyridyl group, a furyl group, a thienyl group, and the like.

Examples of the substituents of the aryl group include a halogen atom (such as chlorine, bromine atoms and the like), an amino group, an alkoxy group, an aryloxy group, a carbonamide group, an alkanoyloxy group, abenzoyloxy group, anureido group, a carbamate group, a carbamoyl group, a carbonate group, a carboxy group, an alkyl group (such as methyl, ethyl and propyl groups and the like), an acylamino group, a sulfamoyl group, an ester group, an alkylsulfonyl group, an alkylsulfonylamino group, an arylsulfonylamino group, and the like.

$R^2$ represents a hydrogen atom, a halogen atom, a substituted or unsubstituted alkyl group, a cycloalkyl group, an aralkyl group, an aryl group, a heterocyclic group, an alkoxy group, an aryloxy group, an acyl group, an alkyloxycarbonyl group, an aryloxycarbonyl group, a carbamoyl group, a sulfamoyl group, an alkylsulfonyl group, an arylsulfonyl group, an acylamino group, an alkylthio group, or an arylthio group.

Preferably example of R include a hydrogen atom; a halogen atom, e.g., bromine, chlorine, and the like; a substituted or unsubstituted alkyl group having 1 to 20 carbon atoms, e.g., a methyl group, an ethyl group, an isopropyl group, a t-butyl group, and the like; a substituted or unsubstituted cycloalkyl group having 5 to 20 carbon atoms, e.g., a cyclopentyl group, a cyclohexyl group, and the like; a substituted or unsubstituted aralkyl group having 7 to 20 carbon atoms, e.g., a benzyl group, a β-phenetyl group, and the like; a substituted or unsubstituted aryl group having 6 to 20 carbon atoms, e.g., a phenyl group, a naphthyl group, and the like which are-listed for $R^1$; a substituted or unsubstituted heterocyclic group, e.g., a pyridyl group, a furyl group, a thienyl group, and the like; a substituted or unsubstituted alkoxy group having 1 to 20 carbon atoms, e.g., a methoxy group, a butoxy group, a methoxyethoxy group, and the like; a substituted or unsubstituted aryloxy group having 6 to 20 carbon atoms, e.g., a phenoxy group, and the like; a substituted or unsubstituted acyl group having 1 to 20 carbon atoms, e.g., an acetyl group, a palmitoyl group, and the like; a substituted or unsubstituted alkyloxycarbonyl group having 1 to 20 carbon atoms, e.g., a methoxycarbonyl group and the like; an aryloxycarbonyl group having 1 to 20 carbon atoms, e.g., a phenoxycarbonyl group and the like; a substituted or unsubstituted carbamoyl group having 1 to 20 carbon atoms, e.g., a methylcarbamoyl group, a dimethylcarbamoyl group, a diisopropylcarbamoyl group, and the like; a substituted or unsubstituted sulfamoyl group having 1 to 20 carbon atoms, e.g., a dimethylsulfamoyl group and the like; a substituted or unsubstituted alkylsulfonyl group having 1 to 20 carbon atoms, e.g., a methylsulfonyl group and the like; a substituted or unsubstituted arylsulfonyl group having 1 to 20 carbon atoms, e.g., a phenylsulfonyl group, a p-methyphenylsulfonyl group, and the like; a substituted or unsubstituted acylamino group having 2 to 20 carbon atoms, e.g., an acetylamino group, an N-methylacetylamino group, a palmitoylamino group, and the like; a substituted or unsubstituted alkylthio group having 1 to 20 carbon atoms, e.g., a methylthio group, an ethylthio group, and the like; a a substituted or unsubstituted arylthio group having 6 to 30 carbon atoms, e.g., a phenylthio group, an m-methoxycarbonylphenylthio group, and the like.

n represents an integer from 0 to 5, and when n is from 2 to 5, R may be the same or different, or may be linked to form a ring.

As such a ring, bicyclo[2,2,1]hept-2-en, cyclohexene condensed to a benzene ring which is completed by Y described later, and the like are listed.

Ball represents an organic ballasting group which can convert the compound represented by the formula described above into a non-diffusive compound. When R? is non-diffusive, Ball is not be required.

The properties of the ballasting group (Ball) are not critical provided that this ballasting group imparts dif fusion resistance to this compound. General ballasting groups include a linear or branched alkyl group which is directly or indirectly linked to this compound, and a benzene type or naphthalene type aromatic group which is indirectly or directly linked to a benzene nucleus. An effective ballasting group is a group generally having at least 8 carbon atoms.

Examples thereof include a substituted or unsubstituted alkyl group having 8 to 30 carbon atoms, an acylamino group having 8 to 30 carbon atoms, an acyl group having 8 to 30 carbon atoms, an acyloxy group having 8 to 30 carbon atoms, an alkoxy group having 8 to 22 carbon atoms, an alkylthio group having 8 to 30 carbon atoms, an alkoxy group having an alkoxycarbonyl group having 8 to 30 carbon atoms, and the like. Further, as the group which is indirectly linked, those linked via a carbamoyl group or sulfamoyl group (a nitrogen atom in these groups is linked to the ballasting group) represented by the general formulae (V) and (VI) are preferable.

General formula (V)

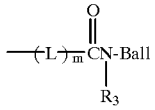

General formula (VI)

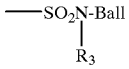

In the general formulae (V) and (VI), $R^3$ is preferably a hydrogen atom, an alkyl group having 1 to 7 carbon atoms (e.g., a methyl group, an ethyl group, and the like), a cycloalkyl group (e.g., a cyclohexyl group and the like) or an aryl group (e.g., a phenyl group and the like).

L represents a bivalent group (e.g., an alkylene group, a phenyl group, a bivalent arylthio group, and the like), and m represents 0 or 1.

$Y^1$ represents an atom group which is required to complete a benzene nucleus or naphthalene nucleus. When $Y^1$ is an atom group which is required to complete a naphthalene nucleus, Ball and $R^2$ can be linked to any ring completed in such a manner.

Specific examples of the compounds represented by the general formulae (II-a) and (II-b) include, but are not limited to, the following compounds.

II-(1)

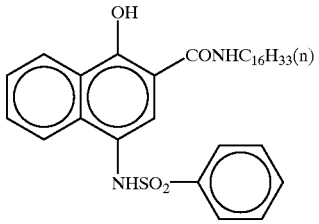

II-(2)

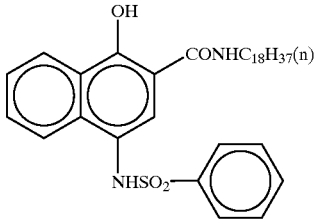

II-(3)

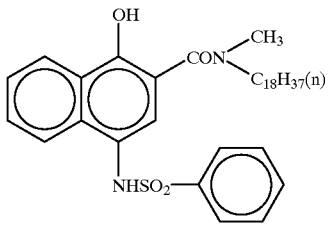

-continued
II-(4)
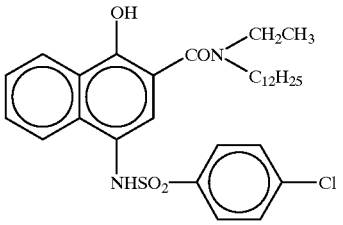
II-(5)
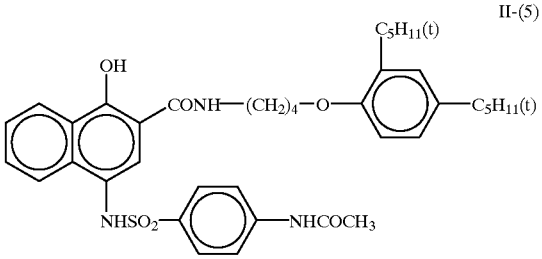
II-(6)
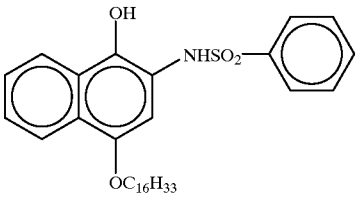
II-(7)
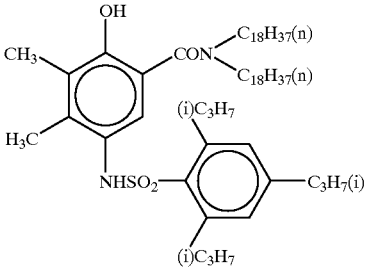
II-(8)
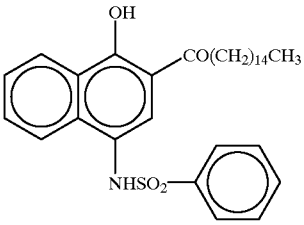
II-(9)
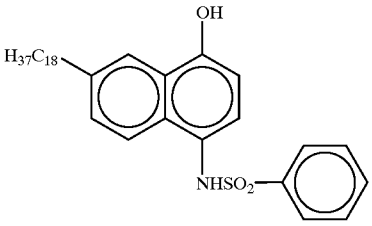
-continued
II-(10)
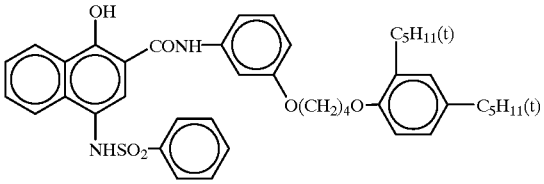
II-(11)
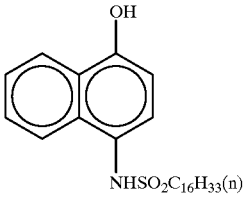
II-(12)
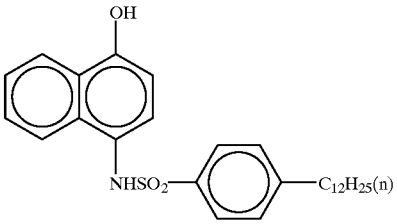
II-(13)
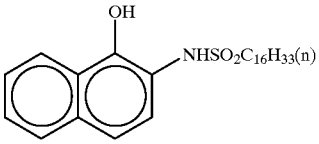
II-(14)
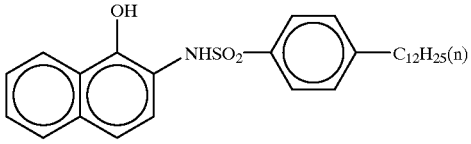
II-(15)
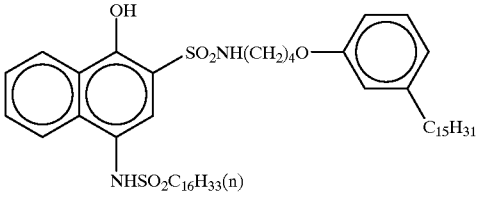
II-(16)
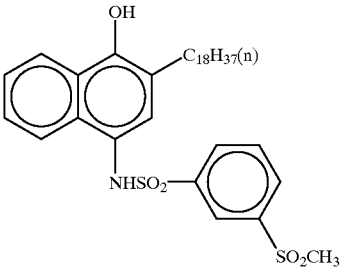

-continued
II-(17)
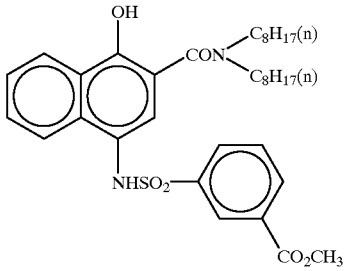
II-(18)
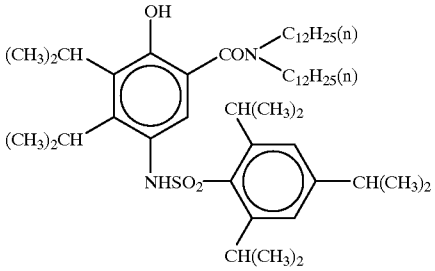
II-(19)
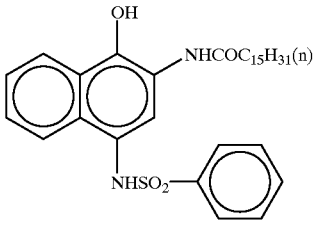
II-(20)
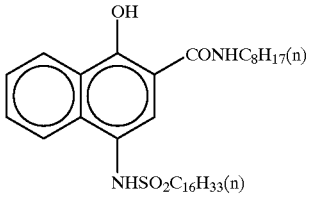
II-(21)
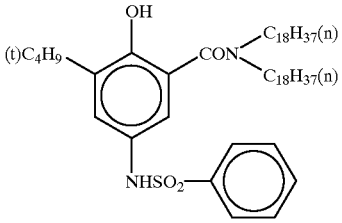
II-(22)
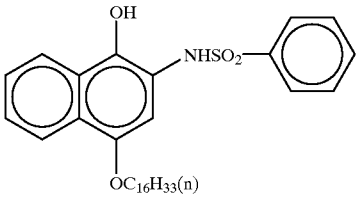
-continued
II-(23)
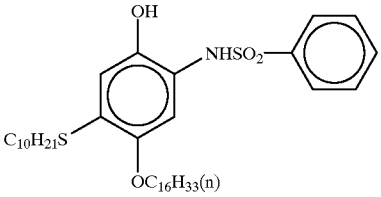
II-(24)
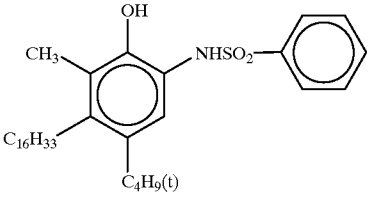
II-(25)
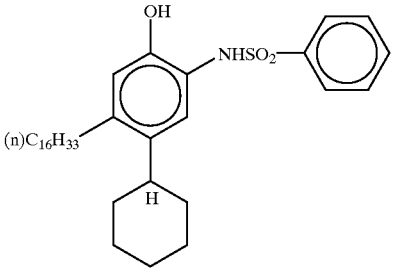
II-(26)
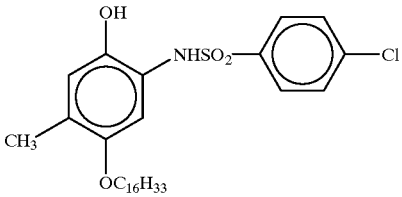
II-(27)
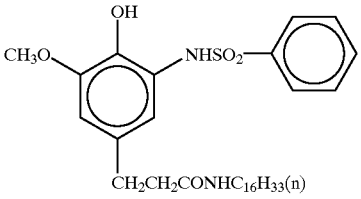
II-(28)
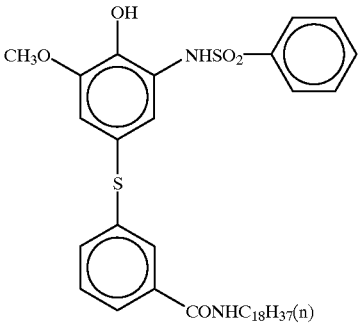

-continued
II-(29)
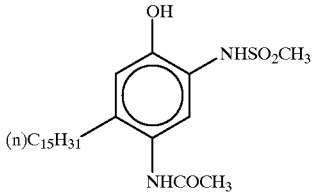
II-(30)
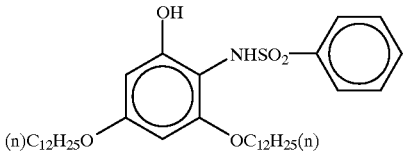
II-(31)
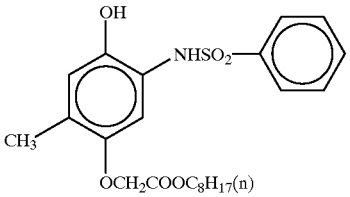
II-(32)
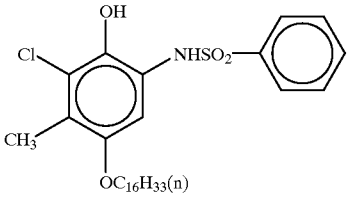
II-(33)
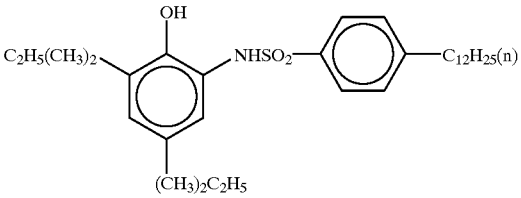
II-(34)
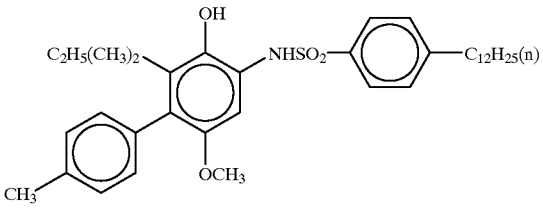
II-(35)
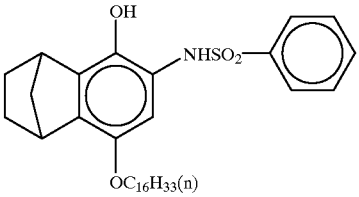
-continued
II-(36)
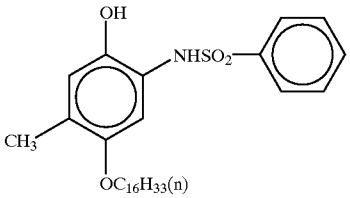
II-(37)
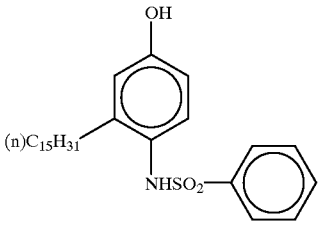
II-(38)
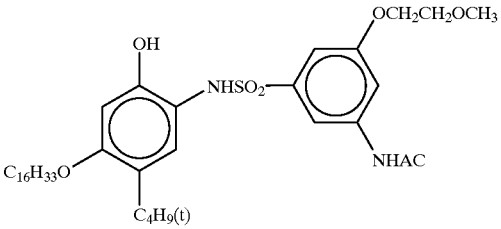
II-(39)
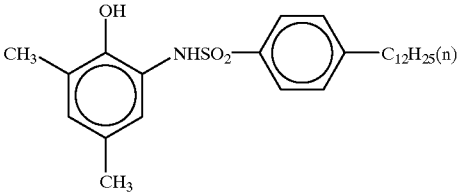
II-(40)
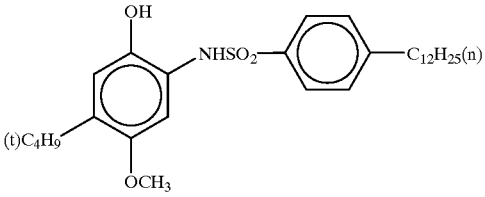
II-(41)
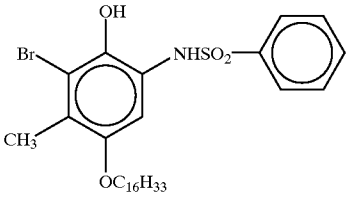

-continued
II-(42)
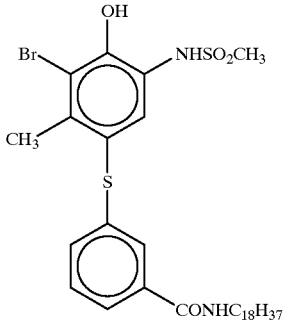
II-(43)
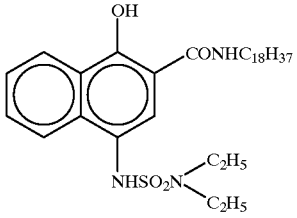
II-(44)
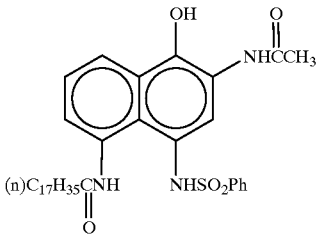
II-(45)
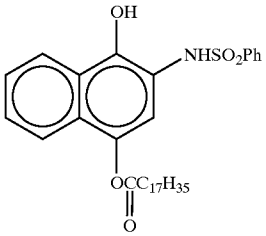
II-(46)
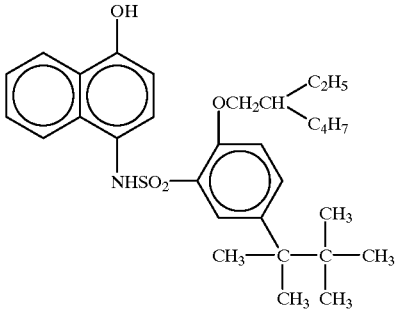
-continued
II-(47)
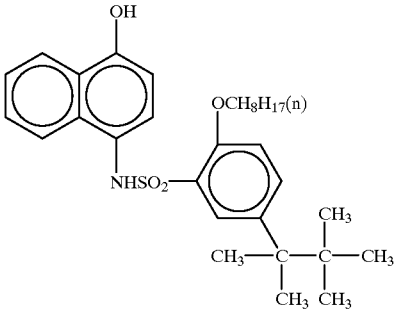
II-(48)
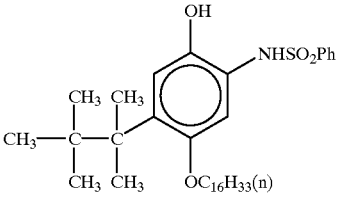
II-(49)
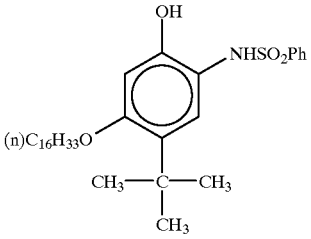
II-(50)
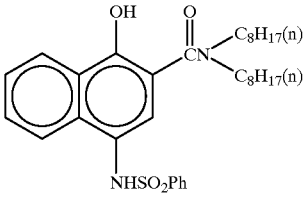
II-(51)
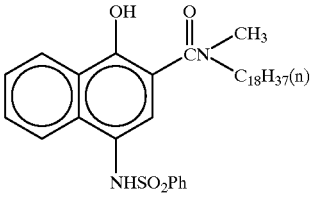
II-(52)
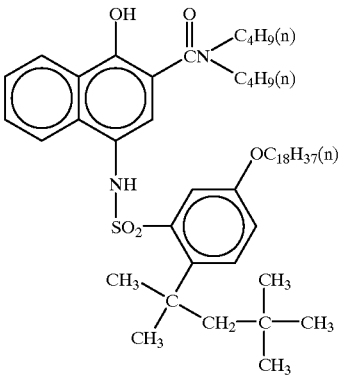

-continued
II-(53)
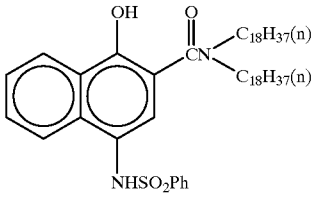
II-(54)
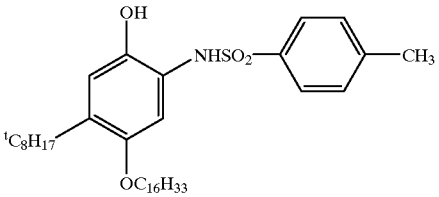
II-(55)
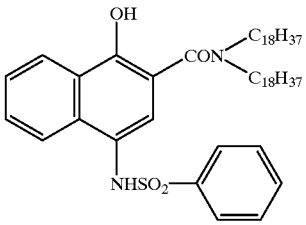
II-(56)
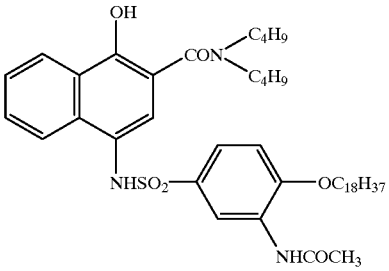
II-(57)
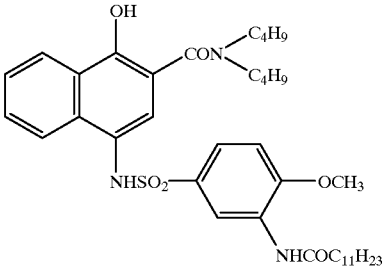
II-(58)
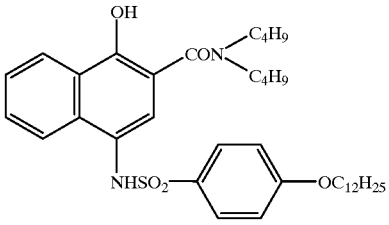
-continued
II-59
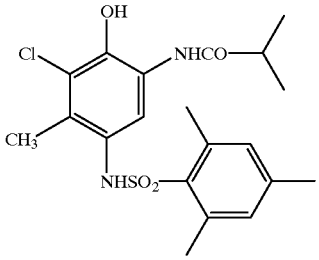
II-60
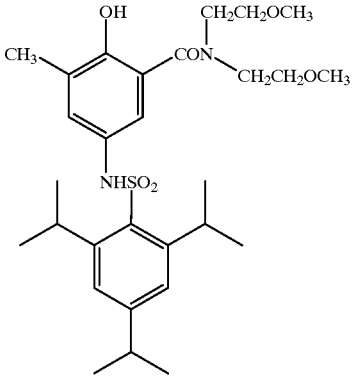
II-61
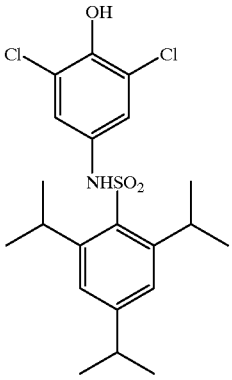
II-62
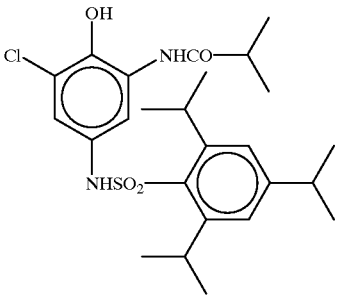

-continued

II-63

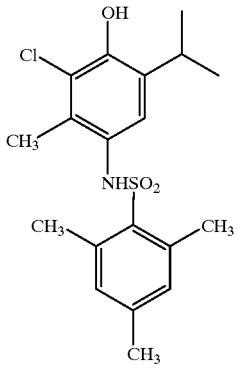

II-64

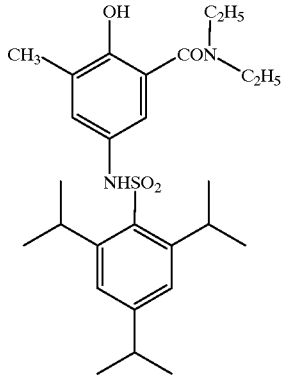

II-65

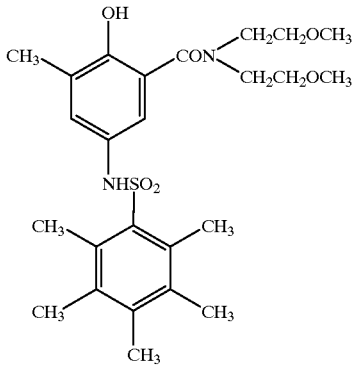

-continued

II-66

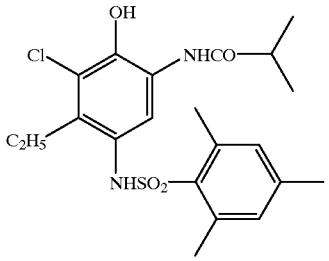

II-67

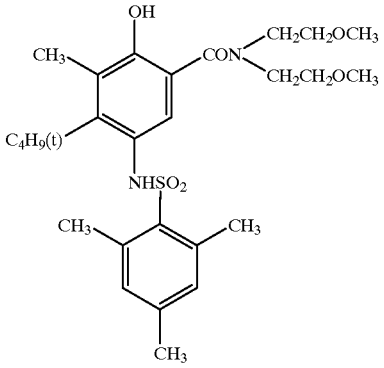

Next, the general formulae (III-a) and (III-b) are explained below.

In the formulae, R represents an aryl group. Preferable example of R include an aryl group having 6 to 24 carbon atoms such as a phenyl group, a naphthyl group, a tolyl group, an xylyl group, and the like. These groups may be substituted. Examples of the substituent include a halogen atom (e.g., a chlorine atom, a bromine atom, and the like), an amino group, an alkoxy group, an aryloxy group, a hydroxyl group, an aryl group, a carboamide group, a sulfonamide group, an alkanoyloxy group, a benzoyloxy group, an ureido group, a carbamate group, a carbamoyloxy group, a carbonate group, a carboxyl group, a sulfo group, and an alkyl group (a methyl group, an ethyl group, a propyl group, and the like).

$R^{11}$, $R^{12}$, $R^{13}$, $R^{14}$, $R^{15}$ and $R^{16}$ each independently represent a hydrogen atom, a halogen atom, an acylamino group, an alkoxy group, an alkylthio group, an alkyl group, or an aryl group, and they may be the same as or different to each other.

In $R^{11}$, $R^{12}$, $R^{13}$, $R^{14}$, $R^{15}$ and $R^{16}$, examples of the halogen atom include a chlorine atom, a bromine atom, and the like.

Examples of the acylamino group include an acylamino group having 1 to 10 carbon atoms, e.g., an acetylamino group, a benzamido group, and the like. This acylamino group may be substituted with a substituent such as a hydroxyl group, an amino group, a sulfo group, and the like.

Examples of the alkoxy group include an alkoxy group having 1 to 10 carbon atoms such as a methoxy group, an ethoxy group, a dodecyloxy group, and the like. This alkoxy group may be substituted with a substituent such as a hydroxy group, an amino group, a sulfo group, a carboxyl group, and the like.

Examples of the alkylthio group include an alkylthio group having 1 to 10 carbon atoms such as a methylthio group, an octylthio group, a hexadecylthio group, and the like. This alkylthio group may be substituted with a substituent such as a hydroxyl group, an amino group, a sulfo group, a carboxyl group, and the like.

Examples of the alkyl group include an alkyl group having 1 to 10 carbon atoms such as a methyl group, an ethyl group, a propyl group, a butyl group, and the like. This alkyl group may be substituted with a substituent such as a hydroxyl group, an amino group, a sulfo group, a carboxyl group, and the like. Examples of the aryl group include an aryl group having 6 to 24 carbon atoms such as a phenyl group, a naphthyl group, a tolyl group, a xylyl group, and the like. This aryl group may be substituted, e.g., with a halogen atom (a chlorine atom, a bromine group, and the like), an alkyl group (a methyl group, an ethyl group, a propyl group, and the like), a hydroxyl group, an alkoxy group (amethoxy group, an ethoxy group, and the like), a sulfo group, a carboxyl group, and the like.

In the present invention, the compound represented by the general formula (III-b) is more preferably used.

In the general formula (III-b), $R^{11}$, $R^{12}$, $R^{13}$ and $R^{14}$ each independently represent preferably a hydrogen atom, a substituted or unsubstituted alkyl group having 1 to 10 carbon atoms, or a substituted or unsubstituted aryl group, and more preferably a hydrogen atom, a methyl group, a hydroxymethyl group, a phenyl group or a phenyl group substituted with a hydrophilic group such as a hydroxyl group, an alkoxy group, a sulfo group, a carboxyl group, and the like.

Specific examples of the compounds represented by the general formulae (III-a) and (III-b) are described below.

III-(1)

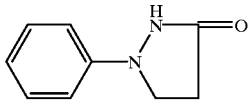

III-(2)

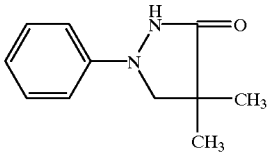

III-(3)

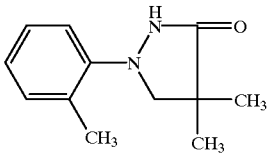

III-(4)

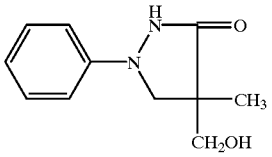

III-(5)

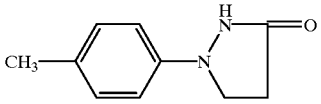

III-(6)

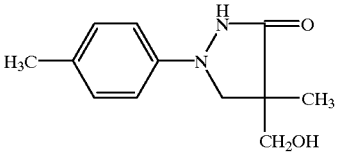

-continued

III-(7)

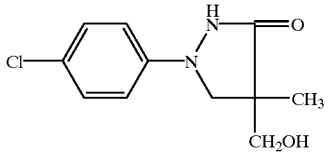

III-(8)

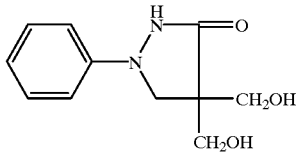

III-(9)

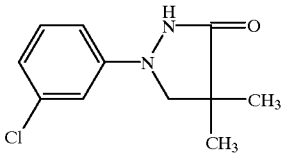

III-(10)

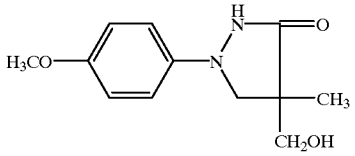

III-(11)

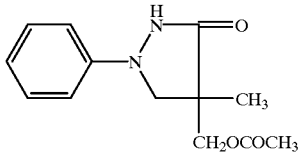

III-(12)

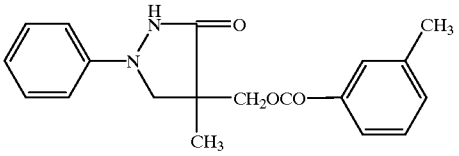

III-(13)

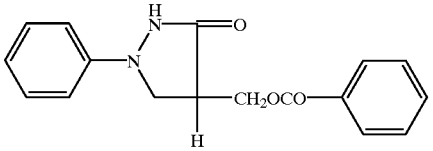

III-(14)

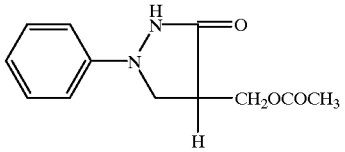

III-(15)

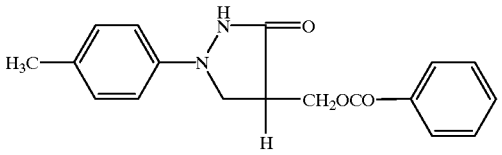

-continued
III-(16)
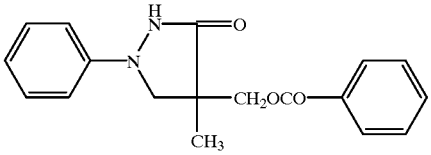
III-(17)
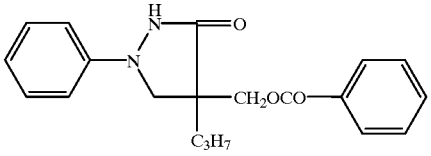
III-(18)
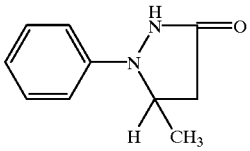
III-(19)
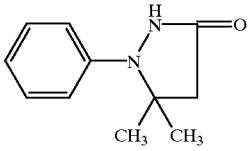
III-(20)
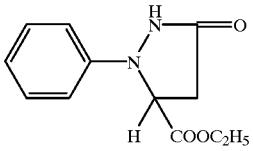
III-(21)
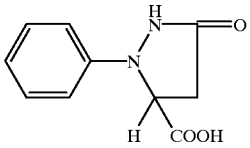
III-(22)
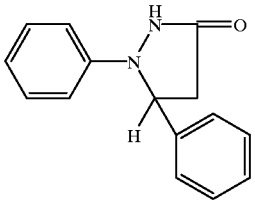
III-(23)
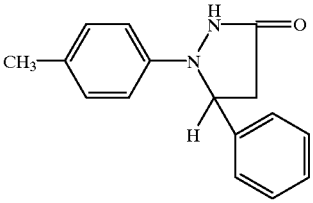
-continued
III-(24)
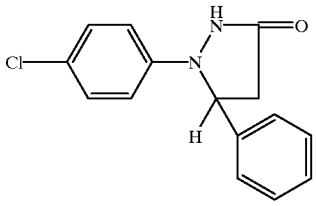
III-(25)
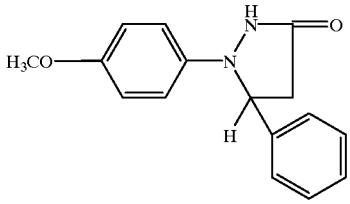
III-(26)
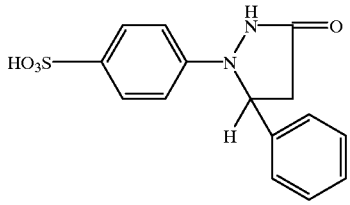
III-(27)
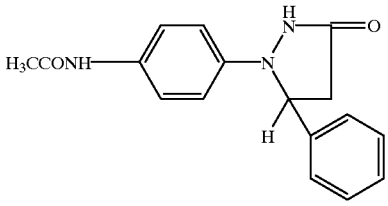
III-(28)
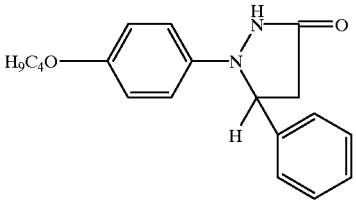
III-(29)
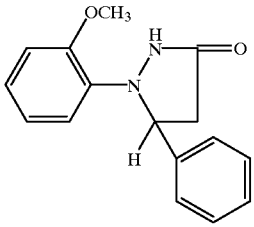
III-(30)
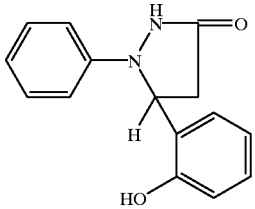

-continued
III-(31)
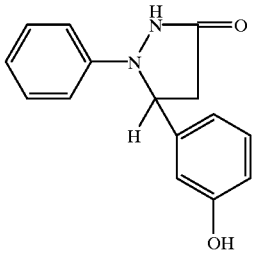
III-(32)
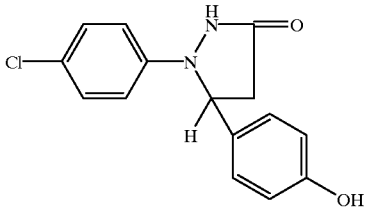
III-(33)
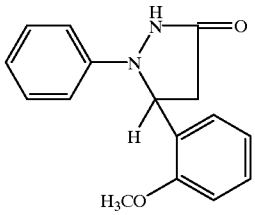
III-(34)
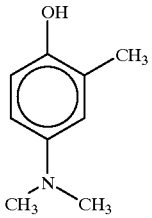
III-(35)
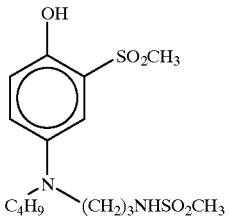
III-(36)
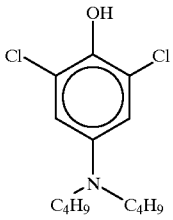
-continued
III-(37)
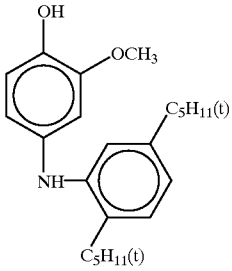
III-(38)
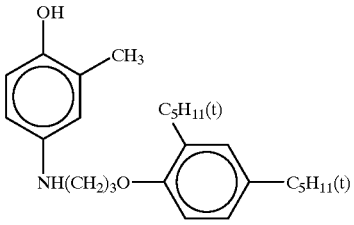
III-(39)
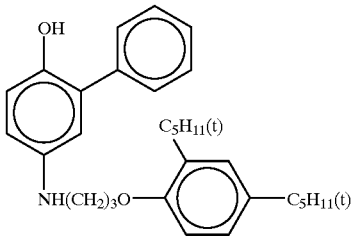
III-(40)
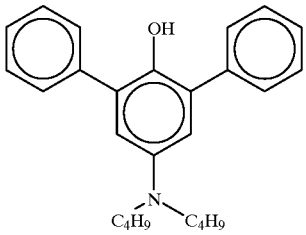
III-(41)
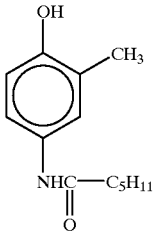
III-(42)
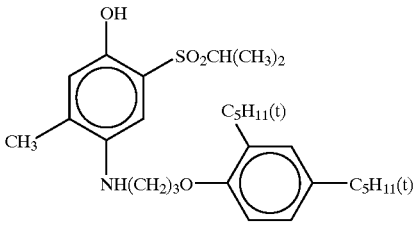
Next, the general formulae (IV-a) to (IV-g) are explained below. In the general formula (IV-a), A represents an electron attracting group represented by the following formula.

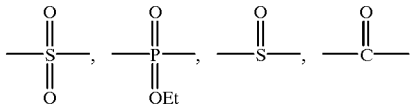

In $R^{21}$ to $R^{29}$, $Q^1$, $Q^2$ and $Y^2$, $R'^{24}$, Ra, Rb in the general formulae (IV-a) to (IV-g), the alkyl group represents a linear or branched alkyl group, an aralkyl group, an alkenyl group, an alkynyl group, a cycloalkyl group, a cycloalkenyl group, and the like; the alkyl group represents a phenyl group, a 4-t-butylphenyl group, a 2,4-di-t-amylphenyl group, a naphthyl group and the like; the alkoxy group represents a methoxy group, an ethoxy group, a benzyloxy group, a heterodecyl group, an octadecyl group, and the like; the aryloxy group represents a phenoxy group, a 2-methylphenoxy group, a naphthoxy group, and the like; the alkyl group represents a methylamino group, a butylamino group, an octylamino group, and the like; the anilino group represents a phenylamino group, a 2-chloroanilino group, a 3-dodecyloxycarbonylanilino group, and the like; the phenylsulfonyl group represents a 4-tetradecanesulfamoylphenylsulfonyl group and the like; the acyl group represents a tetradecanecarboxylic acid and the like; the alkylene group represents a methylene group, an ethylene group, a 1,10-decylene group, a —$CH_2CH_2OCH_2CH_2$— group, and the like; the arylene group represents a 1,4-phenylene group, a 1,3-phenylene group, a 1,4-naphthylene group, a 1,5-naphthylene group, and the like; the aralkylene group represents

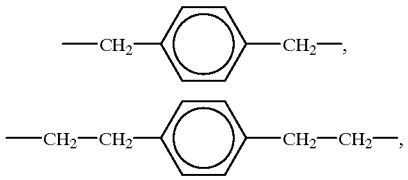

-continued

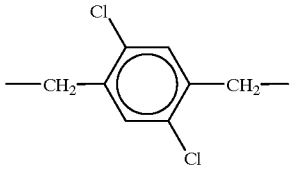

and the like; the heterocyclic group represents a pyrazoyl group, an imidazolyl group, a triazolyl group, a pyridyl group, a quinolyl group, a pyperidyl group, a triazinyl group, and the like.

Further, examples of the substituent in the substituted alkyl group, substituted aryl group, substituted alkoxy group, substituted aryloxy group, substituted alkylamino group, substituted anilino group, substituted phenylsulfonyl group, substituted acyl group, substituted alkylene group, substituted arylene group, substituted aralkylene group and substituted heterocyclic group in $R^{21}$ to $R^{29}$, $Q^1$, $Q^2$ and $Y^2$, $R^{24}$, Ra, Rb, include a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, an ureido group, an imide group, a sulfamoylamino group, a carbamoylamino group, an alkylthio group, an arylthio group, a heterocyclicthio group, an alkoxycarbonylamino group, an aryloxycarbonylamino group, a sulfonamide group, a carbamoyl group, an acyl group, a sulfamoyl group, a sulfonyl group, a sulfinyl group, an alkoxycarbonyl group, and an aryloxycarbonyl group.

Further, the heterocyclic group in Q in the general formula (IV-a) and in P in the general formula (IV-f) has the same definitions as defined in the above-described heterocyclic group, and may have the above-described substituent.

In the compounds represented by the-general formulae (IV-a) to (IV-g), compounds represented by the general formulae (IV-a), (IV-b) and (IV-d) are preferable, and compounds represented by the general formula (IV-d) are more preferable.

Specific examples of the compounds represented by the general formulae (IV-a) to (IV-g) include, but are not limited to, the following compounds.

(IV-a-1)

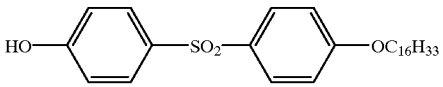

(IV-a-2)

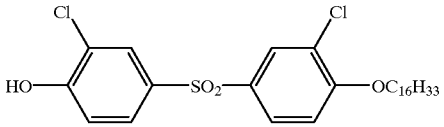

(IV-a-3)

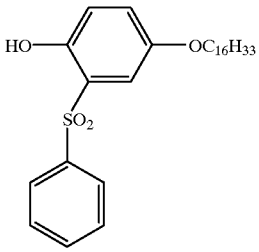

(IV-a-4)

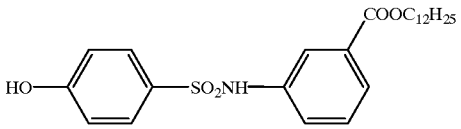

(IV-a-5)

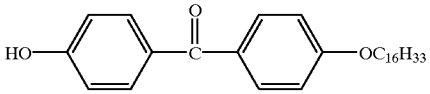

(IV-a-6)

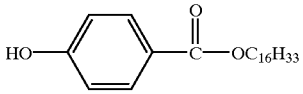

-continued
(IV-b-1)
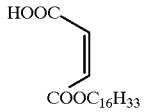
(IV-b-2)
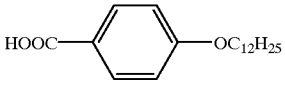
(IV-b-3)
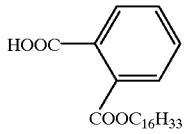
(IV-b-4)
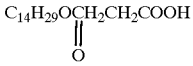
(IV-b-5)
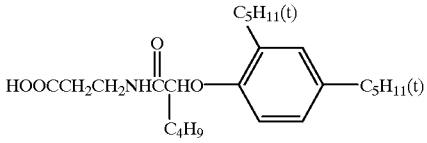
(IV-b-6)
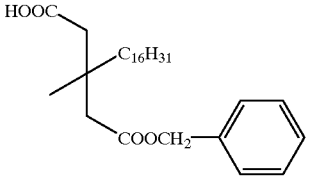
(IV-c-1)
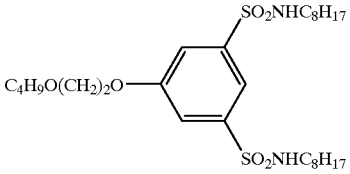
(IV-c-2)
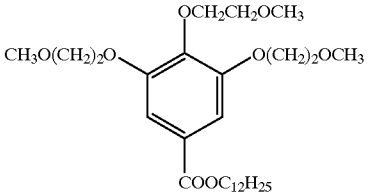
(IV-c-3)
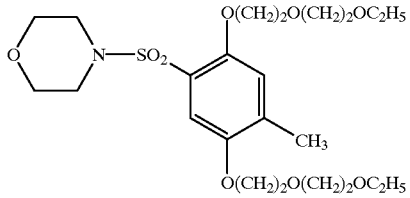
(IV-c-4)
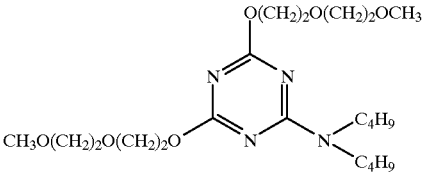
(IV-c-5)
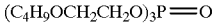
(IV-d-1)
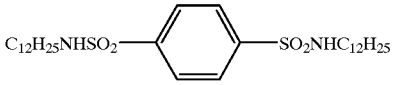
(IV-d-2)
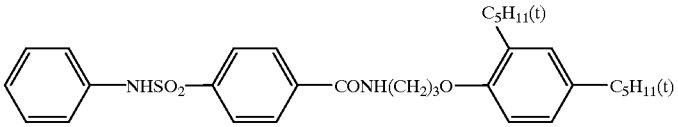
(IV-d-3)
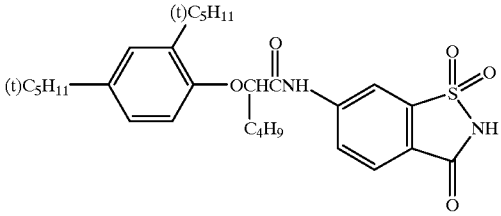
(IV-d-4)
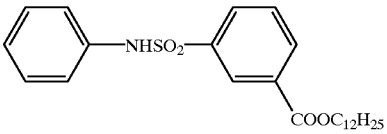
(IV-d-5)
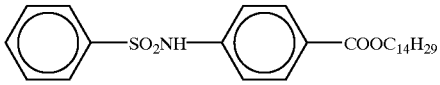

-continued
(IV-d-6)
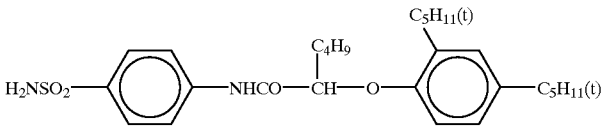
(IV-d-7)
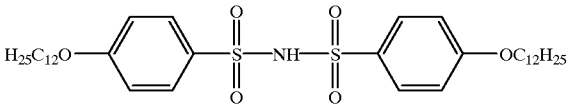
(IV-e-1)
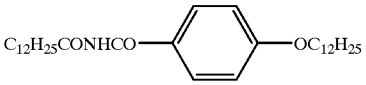
(IV-e-2)
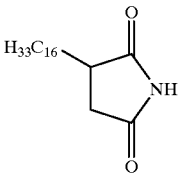
(IV-e-3)
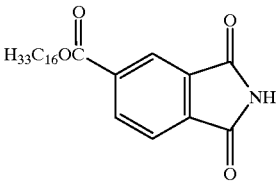
(IV-e-4)
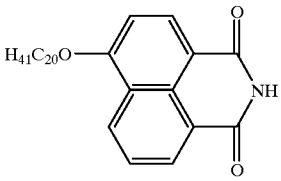
(IV-e-5)
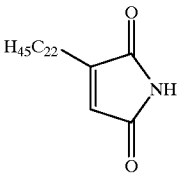
(IV-f-1)
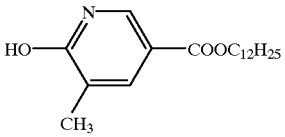
(IV-f-2)
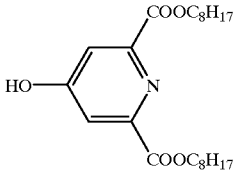
(IV-f-3)
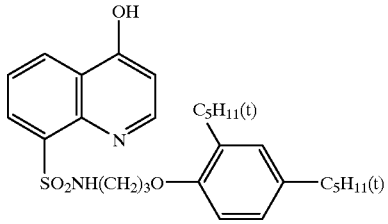
(IV-f-4)
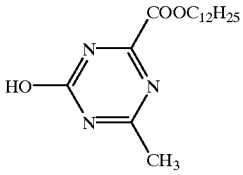
(IV-f-5)
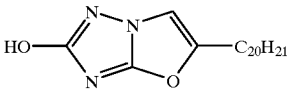
(IV-g-1)
$C_{18}H_{37}OH$
(IV-g-2)
$C_{12}H_{25}OH$
(IV-g-3)
$C_{10}H_{21}O(CH_2)_5O(CH_2)_2OH$
(IV-g-4)
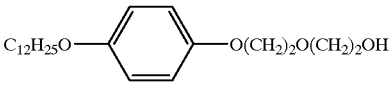
(IV-g-5)
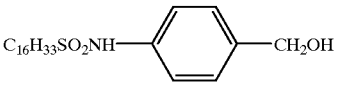
(IV-g-6)
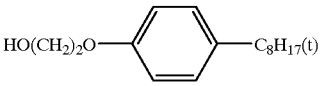

In the present invention, the compounds represented by the general formulae (II-a) to (IV-g) may be used alone or in combinations of two or more. And the compounds can be contained in any of an emulsion layer, an intermediate layer, a protective layer, and the like in the photosensitive material, and preferably they are contained in the same layer as that containing the compound represented by the general formula (I) or the coupler. In the present invention, the amount used of the compound represented by the general formulae (II-a) to (IV-g) is preferably in the range from 0.001 to 1000 times by mol, and more preferably from 0.01 to 100 times by mol based on the compound represented by the general formula (I). In the present invention, the compound represented by the general formulae (I) to (IV-g) can be added by the addition method for a hydrophilic compound described below, or added directly after dissolving in a soluble solvent.

Further, in the present invention, the compound represented by the general formulae (II-a) to (IV-g) can also be used as a precursor. The precursor is a compound which does not exhibit a developing action during storage of a photosensitive material, and can not release the compound until influenced by a suitable activator (for example, a base, nucleophilic agent and the like) or heat. The details thereof are described in Japanese Patent Application Laid-Open (JP-A) No. 64-13456.

When the developing agent is a compound represented by the general formula (D), compounds represented by the general formulae (II-a), (II-b), (III-a) or (III-b) are preferred as the auxiliary developing agent to be used together with the developing agent.

Next, techniques preferably used together with the present invention are described below.

The heat developing color photosensitive material used in the present invention basically comprises a substrate carrying thereon a photosensitive silver halide emulsion and a binder, and optionally, can contain an organic metal salt oxidizing agent, a dye donating compound (a reducing agent may also act as this compound as described later) and the like.

Though these components are added into the same layer in many cases, they can also be divided and added to separate layers. For example, when a dye donating compound which has been colored is contained in a lower layer of a silver halide emulsion, lowering of sensitivity is prevented.

Though it is preferable that the reducing agent is originally contained in the heat developing photosensitive material, it may also be supplied from outside by means such as diffusion from a dye fixing element as described below.

To obtain a wide range of colors on a chromaticity chart using the three primary colors of yellow, magenta and cyan, at least three silver halide emulsion layers each having light-sensitivity in a different spectral range are combined for use. Examples thereof include a combination of a blue sensitive layer, a green sensitive layer, and a red sensitive layer; a combination of a green sensitive layer, a red sensitive layer, and an infrared sensitive layer; a combination of a red sensitive layer, an infrared photosensitive layer (1), and an infrared photosensitive layer (2), and the like as described in Japanese Patent Application Laid-Open (JP-A) Nos. 59-180,550, 64-13,546, 62-253,159, EP-A 479,167 and the like. Each light-sensitive layer can adopt the various arranging orders known in usual color light-sensitive materials. These light-sensitive layers may each be optionally separated into two or more layers as described in Japanese Patent Application Laid-Open (JP-A) No. 1-252,954. In the heat developing photosensitive material, various non-photosensitive layers such as a protective layer, an undercoat layer, an intermediate layer, a yellow filter layer, an anti-halation layer, and the like may be provided between the above-described silver halide emulsion layers and also as the top-most layer and bottom-most layer. And various auxiliary layers such as a backing layer and the like can be provided on the opposite side to the substrate. Specifically, the layer structures and combinations thereof of the above-described patents can be provided, namely an undercoat layer as described in U.S. Pat. No. 5,051,335, an intermediate layer having a solid pigment as described in Japanese Patent Application Laid-Open (JP-A) Nos. 1-167,838, 61-20,943, an intermediate layer having a reducing agent and DIR compound as described in Japanese Patent Application Laid-Open (JP-A) Nos. 1-129,553, 5-34,884, 2-64,634, an intermediate layer having an electron transferring agent as described in U.S. Pat. Nos. 5,017,454, 5,139,919, Japanese Patent Application Laid-Open (JP-A) No. 2-235,044, a protective layer having a reducing agent as described in Japanese Patent Application Laid-Open (JP-A) No. 4-249,245. The substrate is preferably designed so that it has anti-electrostatic properties and the surface resistivity is $10^{12}$ Ω·cm or less.

Next, the silver halide emulsion used in the heat developing photosensitive material is described below in detail. The silver halide emulsion which can be used in the present invention may be any of silver chloride, silver bromide, silver iodo bromide, silver chloro bromide, silver chloroiodide and silver chloroiodo bromide.

The silver halide emulsion used in the present invention may be a surface latent image-type emulsion or also an inner latent image-type emulsion. The above-described inner latent image-type emulsion is combined with a nuclear forming agent and a light fogging agent and used as a direct reversal emulsion. Also, a so-called core-shell emulsion in which inner part of a particle has a different phase from that of the surface part of a particle may be possible, and silver halide having a different composition may be connected by an epitaxial connection. The above-described silver halide emulsion may be a mono dispersion or a multi dispersion type, and preferably used is a method in which mono dispersion emulsions are mixed and gradation is controlled as described in Japanese Patent Application Laid-Open (JP-A) Nos. 1-167,743 and 4-223,463. The particle size is from 0.1 to 2 μm, and from 0.2 to 1.5 μm is particularly preferable. The crystal habit of the silver halide particle may be any of one comprising regular crystals such as a cube, an octahedron, or a tetradecahedron, one comprising an irregular crystal system such as a spherical system, or a tabular system having a high aspect ratio, or one comprising crystal defects such as twin crystal surfaces, or complex systems thereof.

Specifically, any silver halide emulsion prepared by using a method described in U.S. Pat. No. 4,500,626, column 50, U.S. Pat. No. 4,628,021, Research Disclosure (hereinafter abbreviated as RD) No. 17,029 (1978), RD No. 17,643 (December 1978), pp. 22–23, RD No. 18,716 (November 1979), p. 648, RD No. 307,105 (November 1989), pp. 863–865, Japanese Patent Application Laid-Open (JP-A) Nos. 62-253,159, 64-13,546, 2-236,546 and 3-110,555, P. Glafkides, Chemie et Phisique Photographique, Paul Montel, 1967, G. F. Duffin, Photographic Emulsion Chemistry, Focal Press, 1966, and V. L. Zelikman et al., Making and Coating Photographic Emulsion, Focal Press, 1964, and the like can be used.

In the process for preparing the light-sensitive silver halide emulsion of the present invention, it is preferable that a desalting process be conducted in order to remove excessive salt. For the desalt, employable methods include a noodle water-washing method in which gelatin is subjected to gelation, and a flocculation method which utilizes an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelation, aromatic-acylated gelatin, aromatic-carbamoylated gelatin and the like). A flocculation method is preferably used.

For a variety of purposes, the light-sensitive silver halide emulsion in the present invention may contain a heavy metal such as iridium, rhodium, platinum, cadmium, zinc, thallium, lead, iron and osmium. These compounds may be used alone or in a combination or two or more of them. Although the amount added of such compounds varies depending on the purpose of use, this amount is generally in the range of $10^{-9}$ to $10^{-3}$ mol based on 1 mol of silver halide. The heavy metal may be present uniformly in a silver halide grain or may be present in a localized manner within or on the surface of a silver halide grain. Preferred examples of these emulsions are the emulsions described in Japanese Patent Application Laid-Open (JP-A) Nos. 2-236,542, 1-116,637 and Japanese Patent Application No. 4-126,629 and the like.

Such compounds as rhodanate, ammonia, a tetra-substituted thioether compound, an organic thioether derivative described in Japanese Patent Application Publication (JP-B) No. 47-11,386, and a sulfur-containing compound described in Japanese Patent Application Laid-Open (JP-A) No. 53-144,319 may be used as a solvent for silver halide in the grain forming stage for the light-sensitive silver halide emulsion used in the present invention.

For other conditions for the silver halide grain formation, reference will be made, e.g., to P. Glafkides, Chemie et Phisique Photographigue, Paul Montel, 1967, G. F. Duffin, Photographic Emulsion Chemistry, Focal Press, 1966, V. L. Zelikman et al., Making and Coating Photographic Emulsion, Focal Press, 1964, and the like. That is, an employable method may be selected from an acidic method, a neutral method and an ammonia method. Further, any method selected from a single jet method, a double jet method and a combination thereof may be used as a method for reacting a soluble silver salt with a soluble halide. A double jet method is preferable for obtaining a monodisperse emulsion.

A reversed mixing method in which grains are formed in the presence of an excess of silver iron can also be employed. A so-called controlled double jet method in which pAg of the liquid phase for the formation of silver halide is kept constant can also be employed as the double jet method.

Meanwhile, the concentrations, amounts to be added and adding rates of the silver salt and halogen salt may be increased in order to accelerate the growth of the grains (Japanese Patent Application Laid-Open (JP-A) Nos. 55-142,329 and55-158,124 and U.S. Pat. No. 3,650,757 and the like).

The stirring of the reaction mixture may be effected by any known method. Further, the temperature and pH of the reaction mixture during the formation of silver halide grains may be selected depending on the desired outcome. The pH is preferably in the range of 2.2 to 8.5, and more preferably 2.5 to 7.5.

A light-sensitive silver halide emulsion is normally a chemically sensitized silver halide emulsion. A sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, JP-A No. 3-110555 and Japanese Patent Application No. 4-75798 and the like). A chemical sensitization according any of the above-mentioned methods can be effected in the presence of a nitrogen-containing heterocyclic compound (Japanese Patent Application Laid-Open (JP-A) No. 62-253159). Moreover, an anti-fogging agent, which is described below, may be added to a silver halide emulsion after the chemical sensitization thereof. More concretely, the methods, which are described in Japanese Patent Application Laid-Open (JP-A) Nos. 5-45833 and 62-40446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is in the range of 1 $mg/m^2$ to 10 $g/m^2$, and preferably 10 $mg/m^2$ to 10 $g/m^2$ based on the weight of the silver.

In order to impart color-sensitivity, such as green-sensitivity, red-sensitivity or infrared-sensitivity, to the light-sensitive silver halide, the light sensitive silver halide emulsion is spectrally sensitized by means of a methine dye or the like. Further, if necessary, a blue-sensitive emulsion may be spectrally sensitized in order to enhance sensitivity to the light of the blue color region.

Examples of employable dyes include cyanine dyes, merocyanine dyes, complex cyanine dyes, complex merocyanine dyes, holopolar cyanine dyes, hemicyanine dyes, styryl dyes and hemioxonol dyes.

More concrete examples of these sensitizing dyes are disclosed, for example, in U.S. Pat. No. 4,617,257 and Japanese Patent Application Laid-Open (JP-A) Nos. 59-180550, 64-13546, 5-45828 and 5-45834 and the like.

Although these sensitizing dyes may be used alone, they may also be used in combinations thereof. A combination of these sensitizing dyes in often used particularly for supersensitization or for adjusting the spectral sensitization wavelength.

The light-sensitive silver halide emulsion used in the present invention may contain a compound which is a dye having no spectral sensitization effect itself together with the sensitizing dye, or a compound substantially incapable of absorbing a visible light but which exhibits a supersensitizing effect (e.g., compounds described in U.S. Pat. No. 3,615,641 and Japanese Patent Application Laid-Open (JP-A) No. 63-23145).

The above-mentioned sensitizing dyes can be added to the emulsion at the stage of chemical aging or thereabouts, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent such as methanol, as a dispersion such as gelative or as a solution containing a surfactant. The amount to be added is generally in the range of 108 to 102 mol based on 1 mol of silver halide.

Additives used in these processes and known photographic additives, which are used in the heat developing photosensitive material and the pigment fixing material of the present invention, are described in the aforementioned RD No. 17,643, RD No. 18,716 and RD No. 307,105, the relationship in the description is shown below.

| Kinds of additives: | RD 17,643 | RD 18,716 | RD 307,105 |
|---|---|---|---|
| 1. Chemical sensitizer | p. 23 | p. 648, RC | p. 866 |
| 2. Sensitivity enhancer | p. 648, RC | | |
| 3. Spectral sensitizer/ Supersensitizer | pp. 23–24 | pp. 648, RC~649 | pp. 866–868 |
| 4. Brightening agent | p.24 | p. 648, RC | p. 868 |
| 5. Anti-fogging agent/ Stabilizer | pp. 24–25 | p. 649, RC | pp. 868–870 |
| 6. Light absorber/ Filter dye Ultraviolet ray absorber | pp. 25–26 | pp. 649, RC~650, LC | p. 873 |
| 7. Dye image stabilizer | p. 25 | p. 650, LC | p. 872 |
| 8. Hardening agent | p. 26 | p. 651, LC | pp. 874–875 |
| 9. Binder | p. 26 | p. 651, LC | pp. 873–874 |
| 10. Plasticizer/ Lubricant | p. 27 | p. 650, RC | p. 876 |
| 11. Coating aid Surfactant | pp. 26–27 | p. 650, RC | pp. 875–876 |
| 12. Anti-static agent | p. 27 | p. 650, RC | pp. 876–877 |
| 13. Matting agent | | | pp. 878–879 |

(RC: right column, LC: left column)

The binder for the structural layers of the heat developing photosensitive material and dye fixing material is preferably a hydrophilic material. Examples thereof may include those described in the aforesaid Research Disclosure and in Japanese Patent Application Laid-Open (JP-A) No. 64-13546, pp. 71-75. More specifically, the binder is preferably a transparent or translucent hydrophilic material, exemplified by a naturally occurring compound, such as a protein including gelatin, a gelatin derivative and the like; and a polysaccharide including a cellulose derivative, starch, gum arabic, dextran, pullulane and the like, and by a synthetic polymer such as polyvinyl alcohol, polyvinyl pyrrolidone, acryl amide polymer and the like. Also usable as the binder is a highly water-absorbent polymer described in U.S. Pat. No. 4,960,681 and Japanese Patent Application Laid-Open (JP-A) No. 62-245,260, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate (e.g., SUMIKAGEL L-5H manufactured by Sumitomo Chemical Co., Ltd.). These binders may be used alone or in combinations of two or more. Particularly, a combination of gelatin and any of the above-mentioned non-gelatin binders is preferable. Depending on the desired outcome, a lime-processed gelatin, acid-processed gelatin, and delimed gelatin which has undergone a deliming process to decrease the content of calcium and the like can be used, preferably in combination.

When a system is adopted in which a small amount of water is supplied to effect heat developing, it is possible to absorb water quickly by using the above-described high water-absorbing polymer. Further, apart from the present invention, if a high water-absorbing polymer is used in a dye fixing layer and protective layer thereof, re-transferring of the dye from the dye fixing element to another substance after transfer can be prevented.

In the present invention, the appropriate amount coated of the binder is preferably from 0.2 to 20 g, preferably from 0.2 to 10 g, and more preferably from 0.5 to 7 g per 1 $m^2$.

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant may include benzotriazoles, fatty acids and other compounds described in U.S. Pat. No. 4,500,626, columns 52–53. The silver acetylide, which is described in U.S. Pat. No. 4,775,613, is also useful. These organic silver salts may also be used in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/$m^2$, and preferably 0.1 to 4 g/$m^2$, based on the weight of silver.

In the present invention, in addition to the compound represented by the above-described general formulae, known reducing agents can be used together. Further, a dye donating compound having reducing properties as described later is also included (in this case, other reducing agents can also be used together). Further, a reducing agent precursor, which does not have reducing properties itself but exhibits reducing properties by being influenced by a nucleophilic agent and heat in a developing process can also be used.

Examples of the reducing agent used in the present invention include reducing agents and reducing agent precursors described in U.S. Pat. No. 4,500,626, columns 49 to 50, U.S. Pat. Nos. 4,839,272, 4,330,617, 4,590,152, 5,017,454, 5,139,919, Japanese Patent Application Laid-Open (JP-A) Nos. 60-140,335, pp. (17) to (18), 57-40,245, 56-138,736, 59-178,458, 59-53,831, 59-182,449, 59-182,450, 60-119,555, 60-128,436, 60-128,439, 60-198,540, 60-181,742, 61-259,253, 62-201,434, 62-244,044, 62-131,253, 62-131,256, 63-10,151,64-13,546, pp. (40) to (57), 1-120,553, 2-32,338, 2-35,451,2-234,158, 3-160,443, EP No. 220,746, pp. 78 to 96 and the like.

Combinations of various reducing agents such as those disclosed in U.S. Pat. No. 3,039,869 can also be used.

The above-described reducing agents can be used in the intermediate layer and protective layer for various purposes such as prevention of color mixing, improvement in color reproducibility, improvement in the white background, prevention of silver transfer to a dye fixing material, and the like. Specific examples of the reducing agent which can be preferably used are described in EP Nos. 524,649, 357,040, Japanese Patent Application Laid-Open (JP-A) Nos. 4-249245, 2-64633, 2-46450 and 63-186240. Also, there can be used reductive compounds which release a development inhibitor described in JP-B No. 3-63733, Japanese Patent Application Laid-Open (JP-A) Nos. 1-150135, 2-110557, 2-64634, 3-43735 and EP No. 451,833.

Further, there can also be adopted an embodiment in which hydroquinone is added to the protective layer described in Japanese Patent Application Laid-Open (JP-A) No. 5-127335.

In the present invention, the total amount added of the reducing agent is from 0.01 to 20 mol, and particularly preferably from 0.1 to 10 mol based on 1 mol of silver.

Hydrophobic additives such as a dye donating compound, a diffusion resistant reducing agent and the like can be introduced into layers of the heat developing photosensitive material according to known methods such as that is described in U.S. Pat. No. 2,322,027 and the like. In this case, an organic solvent having a high boiling point described in U.S. Pat. Nos. 4,555,470, 4,536,466, 4,536,467, 4,587,206, 4,555,476, 4,599,296, Japanese Patent Application Publication (JP-B) No. 3-62,256 and the like can be optionally used together with an organic solvent having a low boiling point of 50 to 160° C. The dye donating compound, diffusion resistant reducing agent, and organic solvent having a high boiling point can be used in combinations of two or more.

The amount of the organic solvent having a high boiling point is 10 g or less, preferably 5 g or less, and more preferably 1 to 0.1 g per 1 g of the dye donating compound used. Alternatively, it is preferably 1 cc or less, more preferably 0.5 cc or less and most preferably 0.3 cc or less per 1 g of binder.

Further, a diffusion method using a polymer as described in Japanese Patent Application Publication (JP-B) No. 51-39853, Japanese Patent Application Laid-Open (JP-A) No. 51-59943, and a method in which a fine particle dispersion thereof is added described in Japanese Patent Application Laid-Open (JP-A) No. 62-30242 can also be used.

In the case of a compound which is substantially insoluble in water, a fine particle thereof can be dispersed and included in a binder in addition to the above-described methods.

When the hydrophobic compound is dispersed in a hydrophilic colloid, various surfactants can be used. For example, there can be used surfactants described in Japanese Patent Application Laid-Open (JP-A) No. 59-157636, pp. (37) to (38) and the above-described Research Disclosure.

In the heat developing photosensitive material of the present invention, a compound which can realize stabilization of an image at the same time as activating development can be used. Specific compounds which are preferably used are described in U.S. Pat. No. 4,500,626, pp. 51 to 52.

In a system which forms an image by diffusive transferring of a dye, various compounds can be added to the structural layers of the heat developing photosensitive material of the present invention for the purpose of fixing or de-coloring of unnecessary dyes and coloring materials and improvement in the white background of the resulting image.

Specifically, compounds described in EP No. 353,741, 461,416, Japanese Patent Application Laid-Open (JP-A) Nos. 63-163,345 and 62-203,158 can be used.

In the structural layers of the heat developing photosensitive material of the present invention, various pigments and dyes can be used for the purpose of improving color discrimination, making the material even more highly sensitive and the like.

Specifically, there can be used compounds described in the above-described Research Disclosure, and compounds and layer constructions described in EP-A No. 479,167, 502,508, JP-A Nos. 1-167,838, 4-343,355, 2-168,252, 61-20,943, EP-A No. 479, 167, 502, 508 and the like.

In the present invention, a dye fixing material is used together with the heat developing photosensitive material to form an image by diffusion transfer of a dye. The dye fixing material may be coated on a substrate other than that coated with the photosensitive material, or may be coated on the same substrate on which the photosensitive material is coated. The relation between the photosensitive material and the dye fixing material, the relation between the photosensitive material and the substrate, and the relation between the photosensitive material and the white reflective layer are described in U.S. Pat. No. 4,500,626, column 57, and can also be applied to the present invention.

The dye fixing material preferably used in the present invention has at least one layer containing a mordanting agent and a binder. As the mordanting agent, an agent known in the photography field can be used, and specific examples thereof include mordanting agents described in U.S. Pat. No. 4,500,626, column 58 to 59, Japanese Patent Application Laid-Open (JP-A) Nos. 61-88,256, pp. (32) to (41) and 1-161,236, pp. (4) to (7), mordanting agents described in U.S. Pat. NoS. 4,774,162, 4,619,883, 4,594,308 and the like. Further, dye receptive polymer compounds described in U.S. Pat. No. 4,463,079 may also be used.

The binder used in the dye fixing material of the present invention is preferably the above-described hydrophilic binder. Further, carageenans described in EP No. 443,529 can be preferably used, and latexes having a glass transition temperature of 40° C. or less described in Japanese Patent Application Publication (JP-B) No. 3-74,820 can preferably be used.

Auxiliary layers such as protective layers, peeling layers, undercoat layers, intermediate layers, backing layers, curl prevention layers and the like can be provided in the dye fixing material where necessary. It is particularly useful to provide a protective layer.

In the structural layers of the heat developing photosensitive material and dye fixing material, there can be used a plasticizer and lubricant, or an organic solvent having a high boiling point as a peeling improving agent between the photosensitive layer and the dye fixing material. Concrete examples thereof are described in the above-described Research Disclosure, JP-A No. 62-245,253 and the like.

Further, for the above-described objective, various silicone oils (all silicone oils including dimethyl silicone oil and modified silicone oil obtained by introducing various organic groups into dimethylsiloxane) can be used. Effective examples thereof include various modified silicone oils described in "Modified Silicone Oil" technical data P6-18B published by Shin-Etsu Silicone Co., Ltd., particularly carboxy-modified silicone (X-22-3710) and the like.

Further, silicone oil described in Japanese Patent Application Laid-Open (JP-A) Nos. 62-215953 and 63-46449 is also effective.

A brightening agent may also be used in the heat developing photosensitive material and dye fixing material. It is preferable that the brightening agent is originally contained inside the dye fixing material, or it is supplied from outside through the heat developing photosensitive material, transfer solvent, or the like. Examples thereof may include compounds described in K. Veenkataraman, "The Chemistry of Synthetic Dyes", vol. V, chapter 8, JP-A No. 61-143752 and the like. More specific examples thereof include stylbene-based compounds, cumarine-based compounds, biphenyl-based compounds, benzooxazolyl-based compounds, naphthalimide-based compounds, pyrazoline-based compounds, carbostylyl-based compounds and the like.

The brightening agent can be used in combination with a fading inhibitor and an ultraviolet ray absorber.

Specific examples of the fading inhibitor, ultraviolet ray absorber, and brightening agent are described in JP-A Nos. 62-215,272, pp. (125) to (137) and 1-161,236, pp. (17) to (43).

Examples of the hardening agent used in the structural layers of the heat developing photosensitive material and dye fixing material may include those described in the above-described Research Disclosures, U.S. Pat. No. 4,678,739, column 41 and U.S. Pat. No. 4,791,042, and in Japanese Patent Application Laid-Open (JP-A) Nos. 59-116655, 62-245261,61-18942, 4-218044 and the like. More specifically, examples of these hardeners may include an aldehyde (e.g., formaldehyde), an aziridine, an epoxy, a vinylsulfone (e.g., N,N'-ethylene-bis (vinylsulfonylacetamide)ethane), a N-methylol compound (e.g., dimethylolurea) and a polymeric compound (e.g., a compound described in Japanese Patent Application Laid-Open (JP-A) No. 62-234,157).

The amount of the hardener added may be in the range of 0.001 g to 1 g, and preferably 0.005 to 0.5 g, based on 1 g of coated gelatin. Further, the layer to which the hardener is added may be any of the structural layers of a light-sensitive material and dye fixing material, and also maybe separated into two or more layers before addition of the hardener.

The structural layers of the heat developing photosensitive material and dye fixing material may contain various anti-fogging agents or photographic stabilizers or precursors thereof. Specific examples thereof include azole and azaindenes described in RD 17643 (1978), pp. 24 to 25, carboxylic acids and phosphoric acids containing nitrogen described in Japanese Patent Application Laid-Open (JP-A) No. 59-168,442, mercapto compounds and metal salts thereof described in Japanese Patent Application Laid-Open (JP-A) No. 59-111636, acetylene compounds described in Japanese Patent Application Laid-Open (JP-A) No. 62-87957, and the like. In the present invention, when a precursor is used, it is preferably contained in the photosensitive silver halide emulsion layer as described above, and can also used in the dye fixing material. when the compound is not a precursor, the amount of the compound added may be preferably in the range of $5\times10^{-6}$ to $1\times10^{-}$the mol, and more preferably $1\times10^{-5}$ to $1\times10^{-2}$ mol, based on 1 mol of silver. In the case of a precursor, the amount more preferably used is as described above.

For purposes such as improving the coatability, improving peeling, improving lubrication, preventing electrostatic charges, accelerating the developing reaction and the like, various surfactants may be added to the structural layers of the heat developing photosensitive material and dye fixing material. Specific examples of the surfactants include those described in the above-described Research Disclosure, Japanese Patent Application Laid-Open (JP-A) Nos. 62-173,463, 62-183,457 and the like.

For purposes such as improving lubrication, preventing electrostatic charges, improving peeling, and the like, an organic fluorine-containing compound may be added to the structural layers of the heat developing photosensitive material and dye fixing material. Typical examples of organic fluorine-containing compounds include a fluorine-containing surfactant, a hydrophobic fluorine-containing compound, such as an oily fluorine-containing compound, e.g., fluorocarbon oil, and a solid fluorine-containing resin, e.g., tetrafluoroethylene, described in Japanese Patent Application Publication (JP-B) No. 57-9053, column 8-17, Japanese Patent Application Laid-Open (JP-A) Nos. 61-20944 and 62-135826 and the like.

For purposes such as preventing adhesion, improving lubrication, and the like, a matting agent can be used in the heat developing photosensitive material and dye fixing material. Examples of the matting agent may include compounds described in Japanese Patent Application Laid-Open (JP-A) Nos. 63-274944 and 63-274952 such as a benzoguanamine resin bead, polycarbonate resin bead, ABS resin bead-and the like, in addition to compounds described in Japanese Patent Application Laid-Open (JP-A) No. 61-88256, p. 29 such as silicon dioxide, polyolefin, polymethacrylate and the like. Further, compounds described in the above-described Research Disclosure can be used.

These matting agents can be added, if necessary, not only to the top layer (protective layer) but also to a lower layer.

Further, the structural layers of the heat developing photosensitive material and dye fixing material may contain a heat solvent, a de-foaming agent, an antimicrobial agent, colloidal silica and the like. Specific examples of these additives are described in Japanese Patent Application Laid-Open (JP-A) No. 61-88256, pp. 26 to 32, Japanese Patent Application Laid-Open (JP-A) No. 3-11338, Japanese Patent Application Publication (JP-B) No. 2-51496 and the like.

In the present invention, an image formation accelerator can be used in the heat developing photosensitive material and/or dye fixing material. The image formation accelerator has such functions as promoting a redox reaction of a silver salt oxidizing agent with a reducing agent, promoting reactions such as the formation or decomposition of a dye from the dye donating material or the releasing of a diffusive dye, and promoting the transfer of a dye from the layer of the heat developing photosensitive material to the dye fixing layer, and the like, and is classified from the view point of physicochemical functions into a base or base precursor, nucleophilic compound, high boiling point organic solvent (oil), heat solvent, surfactant, compound having mutual action with silver or silver ion, and the like. Since these compounds have generally complex functions, they usually have several of the functions described above in combination. The details thereof are described in U.S. Pat. No. 4,678,739, pp. 38 to 40.

Examples of the base precursor include a salt of a base and an organic acid which is de-carbonated by heating, a compound which releases amines by intramolecular nucleophilic substitution reaction, Lossen transformation or Beckmann transformation, and the like. Specific examples thereof are described in U.S. Pat. Nos. 4,514,493, 4,657,848 and the like.

In a system in which heat development and transfer of a dye are conducted simultaneously in the presence of a small amount of water, a method in which a base and/or base precursor is contained in the dye fixing material is preferable from the view point of increasing in preservability of the heat developing photosensitive material.

In addition to the above-described methods, a combination of a poor-soluble metal compound with a compound (complex forming compound) which can effect a complex forming reaction with a metal ion constituting this poor-soluble metal compound, described in EP No. 210,660 and U.S. Pat. No. 4,740,445, a compound which generates a base by electrolysis described in Japanese Patent Application Laid-Open (JP-A) No.61-232451, and the like can also be used as the base precursor. The former method is particularly effective. It is advantageous that the poor-soluble metal compound and complex forming compound are added separately to the heat developing photosensitive material and dye fixing material as described in the above-described patents.

In the present invention, various development stopping agents can be used in the heat developing photosensitive material and/or dye fixing material for the purpose of obtaining a constant image in spite of variations in the processing temperature and processing time during developing.

The development stopping agent is a compound which, at the appropriate stage of development, quickly neutralizes or reacts with a base to decrease the concentration of the base in a film for stopping the development, or which effects a mutual reaction with silver or silver salt to suppress the development. Specific examples thereof include an acid precursor which releases an acid by heating, an electrophilic compound which generates by heating a substitution reaction with a coexisting base, or a nitrogen-containing heterocyclic compound, mercapto compound and precursors thereof. Further details thereof are described in Japanese Patent Application Laid-Open (JP-A) No. 62-253159, pp. (31) to (32).

In the present invention, as the substrate of the heat developing photosensitive material and dye fixing material, a material which can endure the processing temperature can be used. In general, substrates for photography such as paper, synthetic polymer (film) and the like described in Japan Photograph Assosiation's "Base for Photographic Technology (ed. by Silver Salt Photography) Corona Corp., 1979, pp. (223) to (240), can be listed. Specific examples thereof which can be used include films composed of polyethylene terephthalate, polyethylene naphthalate, polycarbonate, poly vinyl chloride, polystyrene, polypropylene, polyimide or celluloses (for example, triacetylcellulose) or films containing a dye such as titanium oxide and the like, and synthetic paper for films made from polypropylene, mixed paper made from natural pulp, and synthetic resin pulp such as polyethylene and the like, Yankee paper, baryta paper, coated paper (particularly, cast-coated paper), metal, fabrics, glasses and the like.

These may be used alone, or may be used in the form of a substrate of which one side or both sides are laminated with a synthetic polymer such as polyethylene and the like. This laminated layer can optionally contain pigments and dyes such as titanium oxide, ultramarine blue pigment, carbon black and the like.

In addition to these, substrates described in Japanese Patent Application Laid-Open (JP-A) Nos. 62-253159, pp. (29) to (31), 1-61,236, pp. (14) to (17). 63-316848, 2-22651, 3-56955, U.S. Pat. No. 5,001,033 and the like can be used.

The back surface of this substrate may be coated with a hydrophilic binder and a semiconductive metal oxide such as alumina sol and tin oxide, carbon black and other anti-static agents. Specifically, substrates which are described in Japanese Patent Application Laid-Open (JP-A) No. 63-220246 and the like can be used. Further, the front surface of the substrate is preferably subjected to various surface processes and under coating for the purpose of improving adhesion with the hydrophilic binder.

For exposure and recording of an image on the heat developing photosensitive material, there are, for example, methods in which scenery and people are directly photographed using a camera, methods in which exposure is effected through a reversal film or negative film using a printer and enlarger, methods in which scanning exposure of an original image is effected through a slit and the like using an exposing apparatus of a copy machine, a method in which light emission is effected from an emission diode, various lasers (laser diode, gas laser) and the like via electric signals and scanning exposure is conducted on an image information (methods described in Japanese Patent Application Laid-Open (JP-A) Nos. No. 2-129625, 5176144, 5-199372, 6-127021), methods in which image information is outputted on an image display apparatus such as a CRT, a liquid crystal display, an electroluminescent display, a plasma display and the like, and exposure is effected directly or with an optical system, and the like.

As the light source for recording an image on the heat developing photosensitive material, there can be used light sources and exposing methods described in U.S. Pat. No. 4,500,626, column 56, Japanese Patent Application Laid-Open (JP-A) No. 2-53,378 and 2-54,672 such as natural light, a tungsten lamp, a light emitting diode, a laser light source, a CRT light source and the like, as described above.

Further, image exposure can also be-conducted using a wavelength converting element which is obtained by combining a non-linear optical material with a coherent light source such as a laser light and the like. The non-linear optical material is a material which can manifest non-linear characteristics between an electric field and the polarization which occurs when a strong light electric field such as from a laser light is imparted, and preferably used are inorganic compounds represented by lithium niobate, potassium dihydrogen phosphate (KDP), lithium iodate, $BaB_2O_4$ and the like, urea derivatives, nitroaniline derivatives, for example, nitropyridine-N-oxide derivatives such as 3-methyl-4-nitropyridine-N-oxide (POM), compounds described in Japanese Patent Application Laid-Open (JP-A) Nos. 61-53462 and 62-210432. Various forms of the wavelength converting element, such as a monocrystalline light directing route type, a fiber type, and the like are known, and all of them are effective.

Further, the above-described image information can utilize image signals obtained from a video camera, an electronic still camera, and the like, television signals represented by that stipulated by Nippon Television Signal Criteria (NTSC), image signals obtained by dividing an original image into many picture elements such as that obtained from a scanner, and image signals made by a computer represented by CG, CAD.

The heat developing photosensitive material and/or dye fixing material of the present invention may adopt a form having an electroconductive heat generating layer as a heating means for heat developing and diffusion transferring of a dye. As the heat generating element in this case, one from those described in Japanese Patent Application Laid-Open (JP-A) No. 61-145544 and the like can be used.

The heating temperature in the heat developing is from about 50 to 250° C., and a temperature from about 60 to 180° C. is particularly useful. The diffusion transfer process of a dye may be conducted simultaneously with the heat development or may be conducted after the completion of the heat development process. In the latter case, it is particularly preferable that the heating temperature in the transfer process is 50° C. or higher, and about 10° C. lower than the temperature during the heat developing process, although the transfer process can be conducted at between room temperature to the temperature in the heat developing process.

Though movement of the dye is caused only by heat, a solvent maybe used to promote the dye movement. A method is also useful in which development and transfer are conducted simultaneously or continuously by heating in the presence of a small amount of solvent (especially, water) as described in U.S. Pat. Nos. 4,704,345, 4,740,445, Japanese Paten Application Laid-Open (JP-A) No. 61-238,056 and the like. In this method, the heating temperature is preferably 50° C. or higher and not more than boiling point of the solvent. For example, when the solvent is water, it is preferably from 50 to 100° C.

Examples of the solvents used for promoting the development and/or the diffusion transfer of a dye include water, an aqueous basic solution containing an inorganic alkaline metal salt and an organic base (as these bases, those described in the column of the image formation promoter can be used), solvents having a low boiling point, or a mixture of solvents having a low boiling point and water or the above-described aqueous basic solution. Further, the solvent may contain a surfactant, an anti-fogging agent, a compound which forms a complex with a poor-soluble metal salt, an antifungal agent and, an antimicrobial agent.

As the solvent used in these heat developing and diffusion transfer processes, water is preferably used, and any water usually used may be used. Specifically, distilled water, tap water, well water, mineral water and the like can be used. Further, in a heat developing apparatus using the heat developing photosensitive material and dye fixing material of the present invention, water may be used without recycling or may be recycled and used repeatedly. In the latter case, water containing components eluted from material shall be used. Apparatuses and water described in Japanese Paten Application Laid-Open (JP-A) Nos. 63-144354, 63-144355, 62-38460, 3-21055 and the like may also be used.

These solvents may be added to the heat developing photosensitive material, the dye fixing material or to both of them. The amount used thereof may not be more than the weight of solvent corresponding to the maximum swollen volume of the total coated film.

As this method for imparting water, there are preferably used methods described in Japanese Paten Application Laid-Open (JP-A) No. 62-253159 p. (5), Japanese Paten Application Laid-Open (JP-A) No. 63-85544, Japanese Patent Application No. 8-181045 and the like. It is also possible that a solvent is enclosed in a micro capsule, or a solvent is previously contained in the heat developing photosensitive material or dye fixing element or both of them in the form of a hydrate.

The temperature of water added may be from 30 to 60° C. as described in Japanese Patent Application Laid-Open (JP-A) No. 63-85544 and the like. It is particularly useful that the temperature is 45° C. or higher for the purpose of preventing proliferation of contaminant bacteria in water.

To promote dye movement, a hydrophilic hot solvent which is solid at ordinary temperature and is dissolved at high temperatures can be contained in the heat developing photosensitive material and/or dye fixing material. The layer which contains the solvent may be any of a photosensitive silver halide emulsion layer, an intermediate layer, a protective layer, or a dye fixing layer, with dye fixing layer and/or adjacent layer thereof being preferable.

Examples of the hydrophilic hot solvent include ureas, pyridines, amides, sulfonamides, imides, alcohols, oximes and other heterocyclic rings.

Examples of heating methods in the developing and/or transferring processes include contacting with a heated block and plate, contacting with a heat plate, hot pressing, heat rolling, using a heat drum, a halogen lamp heater, infrared and far infrared lamp heaters and the like, passing through a high temperature atmosphere, and the like. For laminating the heat developing photosensitive material and dye fixing material, methods described in Japanese Paten Application Laid-Open (JP-A) Nos. 62-253159, 61-147244 p. (27) and the like can be adopted.

For processing the photographic element of the present invention, any of various heat developing apparatuses can be used. For examples, apparatuses described in Japanese Paten Application Laid-Open (JP-A) Nos. 59-75,247, 59-177,547, 59-181,353, 60-18,951,62-25,944, Japanese Patent Application Nos. 4-277517, 4-243072, 4-244693 and the like are preferably used. As commercially available apparatuses, PICTOSTAT 100, 200, PICTOGRAPHY 3000, 2000 manufactured by Fuji Photo Film Co., Ltd., and the like can be used.

When an image obtained from the above-described photosensitive material and dye fixing element is used as a color proof for printing, the method of density expression thereof may be any of a continuous gradation control method, an area gradation control method utilizing parts of discontinuous density, or a gradation control method obtained by combining the first two.

When LD or LED is used as a light source, output of a digital signal is possible. By this, applications in which control of the design and hue of a print is conducted on CRT, and a color proof is outputted as the final output (DDCP) are possible. Namely, DDCP is an effective means for conducting output of a proof efficiently in the field of color proofs. The reason for this is that a color printer has a relatively simple structure and is inexpensive, and by using the color printer, as is well known, production of a preparation film for a color printer and production of a press plate (PS plate) and the like are not necessary, therefore, a hard copy obtained by forming an image on a sheet can be easily produced in a short period of time for several times.

When LD or LED is used as a light source, it is preferable that three spectral sensitivities of yellow, magenta and cyan color forming layers, four spectral sensitivities of yellow, magenta, cyan and black color forming layers, or, for the purpose of obtaining a desirable hue, spectral sensitivities of the respective colors forming layers obtained by mixing two or more dye forming compound, have respective peaks of the spectral sensitivities at separate wavelengths respectively apart by 20 nm or more. Further, as another method, when the spectral sensitivities of two or more different colors differ by 10 times or more, a method in which an image of two or more colors is obtained by one radiation wavelength is also adopted.

Next, a method for reproducing moire and the like of a print using a color printer is described below.

To produce a color proof for printing which correctly reproduces moire and the like appearing on a print of high resolution by a color printer of low resolution, the respective net point area ratio data aj of a CMYK4 size plate are respectively converted to 48800DPI bit map data b'j by referring to a threshold matrix 24. Then, the area ratio ci of each color is counted by referring simultaneously to the bit map data b'j in a given range. Then, the primary three stimulation value data X, Y, Z of 1600DPI, which show the measured value data of the above-described respective colors previously calculated, are calculated. The secondary three stimulation value data X', Y', Z' of 400 DPI are calculated by anti-areazing filter processing of the primary three stimulation value data X, Y, Z. The calculated data are used as input data for the color printer. (This is described in Japanese Patent Application No. 7-5257 in detail.)

When color image recording is conducted using an output apparatus such as a color printer and the like, it is possible, for example, that a color image having desired color is realized by manipulating color signals relating to yellow, magenta, and cyan colors. However, since the color signals depend on the output characteristics of the output apparatus, it is necessary that a color signal supplied from an external apparatus having different characteristics is subjected to color converting processing with consideration given to the above-described output characteristics.

Then, a plurality of known color patches having different colors are produced using the output apparatus, and the colors of the above-described color patches are measured, to obtain, for example, a conversion relation (hereinafter referred to as the orderly conversion relation) in which the known color signals CMY of the above-described color patch are converted to stimulus value signals XYZ which do not depend on the output apparatus, then a conversion relation (hereinafter referred to as a reverse conversion relation) by which the stimulus value signals XYZ are converted to color signals CMY is calculated utilizing the orderly conversion relation, and the above-described color conversion processing is conducted using this reverse conversion relation.

Herein, the following three examples are listed as a method for calculating color signals CMY from the stimulus value signals XYZ, however, the examples of the present invention are not limited to them.

(1) A tetrahedral in which four stimulus value signals XYZ constitute respective summits is established, the space of the stimulus value signals XYZ is divided by this tetrahedron, and the space of color signals CMY is also divided by the tetrahedron in the same manner, and the color signals CMY are calculated by linear computing for any stimulus value signals XYZ in the corresponding tetrahedron.

(2) Color signals CMY are calculated by repeated computing using the Newton method (see, PHOTOGRAPHIC SCIENCE AND ENGINEERING Volume 16, Number 2. March-April 1972 pp136-pp143 "Metameric color matching in subtractive color photography" ) for any stimulus value signals XYZ.

(3) A color conversion method which converts color signals from the First Color System to the Second Color System, comprising a first step in which the relation of real color signals in First Color System obtained from known real color signals in Second Color System is found as the first orderly conversion relation, a second step in which the hypothesis color signals are set outside the area composed of the real color signals by approximating the first orderly conversion relation using a monotone function, a third step in which the relation of the color signals in First Color System obtained by color signals composed of the real color signals, and the hypothesis color signals in Second Color System is found as the second orderly conversion relation, and a fourth step in which the relation of color signals in the First Color System is found as a reverse conversion relation using a repeated computing method from the second conversion relation, and a color signal is converted from the First Color System to Second Color System using the reverse conversion relation. Namely, by this conversion method which converts color signals from First Color System to Second Color System, real color signals (for example, XYZ color signals) in First Color System corresponding to known real color signals (for example, CMY color signals) in Second Color System are found, then, the first orderly conversion relation between these real color signals is approximated by a monotone function, and hypothesis color signals are set outside the area composed of the real color signals. Then, according to the second orderly conversion relation between First Color System and Second Color System respectively composed of the real color signals and the hypothesis color signals, a reverse conversion relation is found which effects conversion to First Color System and Second Color System by repeated computing represented by the Newton method, and color conversion is conducted using this reverse conversion relation. Further, methods other than this are also listed.

The size of an image obtained from the heat developing photosensitive material and dye fixing element may be any of A line book size, A1 to A6, KIKU line book size (636 mm×939 mm), B line book size, B1 to B6, four-six size. The size of the heat developing photosensitive material and dye fixing element may be any size in the width range from 100 mm to 2000 mm, corresponding to the above-described sizes.

For the heat developing photosensitive material and dye fixing element, the materials may be supplied in the form of either a roll or sheet, and it is also possible that only one of them is in the form of roll, and the other is in the form of sheet.

The above object of the present invention has been attained by a silver halide photographic light-sensitive material which comprises at least a compound represented by the following formula (1) or (2):

formula (1)

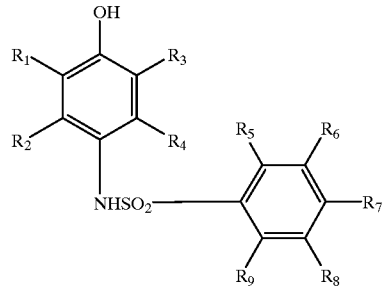

formula (2)

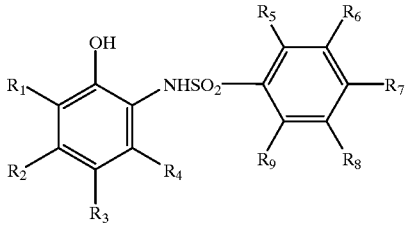

wherein $R_1$ to $R_9$ each represent a hydrogen atom, a halogen atom, or a substituent having 4 or less carbon atoms or an I/O value of 1 or more; but in formula (1), $R_2$ and/or $R_4$, and $R_5$ and/or $R_9$, each represent a substituent (a halogen atom or a substituent having 4 or less carbon atoms or an I/O value of 1 or more), except a hydrogen atom; and in formula (2), $R_4$, and $R_5$ and/or $R_9$ each represent a substituent (a halogen atom or a substituent having 4 or less carbon atoms or an I/O value of 1 or more), except a hydrogen atom; and when $R_1$ and $R_2$, $R_3$ and $R_4$, $R_5$ and $R_6$, $R_6$ and $R_7$, $R_7$ and $R_8$, and $R_8$ and $R_9$ each represent a substituent, except a hydrogen atom, the two of each of the combinations may independently bond together to form a ring.

Hereinbelow, preferable modes of the present invention are described in detail.

First, the compounds represented by formula (1) or (2) are described in detail.

The compounds represented by formula (1) or (2) represent reducing agents (developing agents) collectively called sulfonamidophenols. In formulas, $R_1$ to $R_9$ each represent a hydrogen atom, a halogen atom, or a substituent having 4 or less carbon atoms or an I/O value of 1 or more. The term I/O value means a parameter representing the scale of the lipophilicity and the hydrophilicity of a compound or a substituent, and it is described in detail in "Yuki Gainen-zu" (written by Koda Yoshiki; published by Sankyo Shuppan, 1984). "I" denotes inorganic nature, and "O" denotes organic nature. The larger the I/O value is, the higher the inorganic nature is. Here, specific examples of I/O values are described. The O value is 20 per carbon atom. Representative examples of the I value are 200 for an —NHCO— group, 240 for an —$NHSO_2$— group, and 60 for a —COO— group. For instance, in the case of —$NHCOC_5H_{11}$, the number of carbon atoms is 6, the O value is 20×6=120, and I=200, so that I/O≈1.67, and therefore I/O>1.

The compound for use in the present invention is a compound substituted by a substituent whose I/O value is 1 or more and preferably 12 or less, or the number of carbon atoms is 4 or less, and it is characterized by hydrophilicity. A specific example of the substituent is, for example, a halogen atom (e.g. chlorine and bromine), an alkyl group (e.g. methyl, ethyl, isopropyl, n-butyl, and t-butyl), an aryl group (e.g. 3-methanesulfonylaminophenyl), an alkylcarbonamido group (e.g. acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkoxy group (e.g. methoxy and ethoxy), an aryloxy group (e.g. 4-methanesulfonylaminophenoxy), an alkylthio group (e.g. methylthio, ethylthio, and butylthio), an arylthio group (e.g. 4-methanesulfonylaminophenylthio), an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), a carbamoyl group, an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), a sulfamoyl group, a cyano group, an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkoxycarbonyl group (e.g. methoxycarbonyl, ethoxycarbonyl, and butoxycarbonyl), an aryloxycarbonyl group (e.g. phenoxycarbonyl), an alkylcarbonyl group (e.g. acetyl, propionyl, and butyloyl), an arylcarbonyl group (e.g. benzoyl and alkylbenzoyl), or an acyloxy group (e.g. acetyloxy, propionyloxy, and butyloyloxy).

Further, in formula (1), $R_2$ and/or $R_4$, and $R_5$ and/or $R_9$, each represent a substituent (a halogen atom or a substituent having 4 or less carbon atoms or an I/O value of 1 or more), except a hydrogen atom; and in formula (2), $R_4$, and $R_5$ and/or $R_9$ each represent a substituent (a halogen atom or a substituent having 4 or less carbon atoms or an I/O value of 1 or more), except a hydrogen atom.

When $R_1$ and $R_2$, $R_3$ and $R_4$, $R_5$ and $R_6$, $R_6$ and $R_7$, $R_7$ and $R_8$, and $R_8$ and $R_9$ each represent a substituent, except a hydrogen atom, the two of each of the combinations may independently bond together to form a ring.

The compounds represented by formula (1) or (2) can be synthesized by combining, stepwise, methods widely known in the field of organic synthesis chemistry. Examples of the stepwise synthetic method are described below by illustrating synthesis schemes of the below-mentioned Exemplified Compounds.

Route for synthesizing Exemplified Compounds

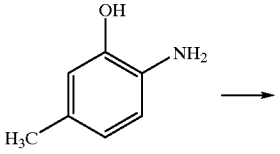

-continued

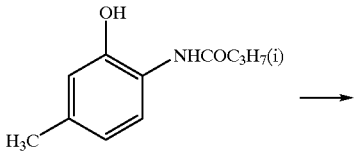

A

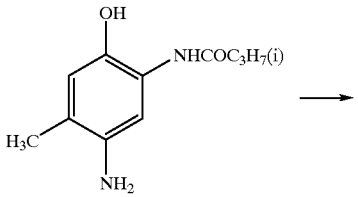

B

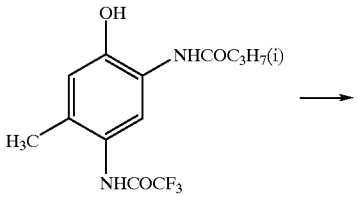

C

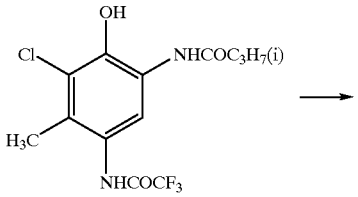

D

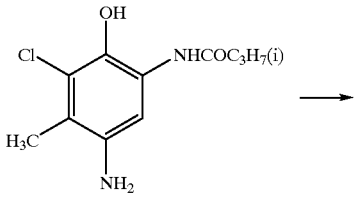

E

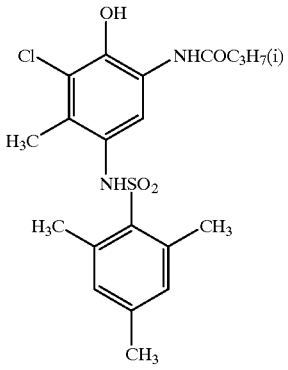

D-5

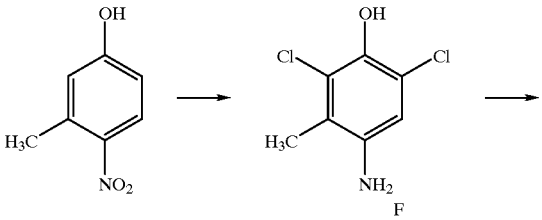

F

-continued

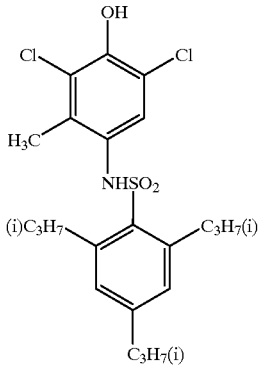

D-9

<<Synthesis of Exemplified Compound D-5>>

1) Synthesis of Compound A 766 g (5 mol) of 6-amino-m-cresol and 2,000 ml of acetonitrile were charged into a 5-liter three-necked flask equipped with a condenser, a thermometer, a dropping funnel, and a mechanical agitator, and they were stirred at room temperature. At that time, the solution was in the form of a non-uniform slurry. When 791 g (5 mol) of isobutyric anhydride was added thereto over 30 min, the temperature rose gradually until it reached 60° C., finally, and the solution became uniform, finally. When the rising of the temperature stopped, crystals of the product began to precipitate in the flask. After stirring for one hour further, the contents were poured into 15 liters of a 10% brine, and the precipitated crystals were filtered through a Nutsche, under reduced pressure. After the crystals were washed with 2 liters of distilled water, they were dried. The crystals were so pure that they could be used in the next step as they were. Thus, 928 g of crystals of Compound A were obtained (yield: 96%).

2) Synthesis of Compound B 193 g (1 mol) of Compound A was charged into a 10-liter beaker, and 500 ml of methanol and an aqueous solution of 120 g (30 mol) of sodium hydroxide dissolved in 500 ml of water were added thereto. This solution was continually stirred with the temperature kept at 0° C. or less. On the other hand, 216 g (1.25 mol) of sulfanilic acid was dissolved completely in an aqueous sodium hydroxide solution (an aqueous solution of 50 g of sodium hydroxide dissolved in 400 ml of water). 300 ml of concentrated hydrochloric acid was added thereto, to form a solution in the form of a slurry. While this liquid was stirred vigorously with the temperature kept at 0° C. or less, a solution of 93 g (1.35 mol) of sodium nitrite dissolved in 200 ml of water was added gradually, to produce a diazonium salt. At that time, the reaction was allowed to take place while ice was added appropriately, so that the temperature would be kept at 0° C. or less. The diazonium salt prepared in this way was added gradually to the above solution of Compound A that was kept stirred. At that time, again, the reaction was allowed to take place while ice was added appropriately, so that the temperature would be kept at 0° C. or less. With the addition, the solution assumed the red color of an azo dye. After completion of the addition, the reaction was allowed to proceed for 30 min further at 0° C. or less, and upon recognition of the disappearance of the raw material, 750 g (4.5 mol) of a powder of sodium hydrosulfite was added thereto. When this solution was heated to 50° C., reduction of the azo group took place, with vigorous bubbling. When the bubbling subsided and the liquid was decolored, to become a yellowish transparent liquid, the solution was cooled gradually to 10° C. From the time of about the start of the cooling, crystals began to deposit gradually. The deposited crystals were filtered, and the crude crystals were recrystallized from a mixed solvent of methanol and water, to obtain 162 g of crystals of Compound B (yield: 78%).

3) Synthesis of Compound C 833 g (4 mol) of Compound B and 2,000 ml of acetontrile were charged into a 5-liter three-necked flask equipped with a condenser, a thermometer, a dropping funnel, and a mechanical agitator, and they were stirred at room temperature. At that time, the solution was in the form of a non-uniform slurry. When 840 g (4 mol) of trifluoroacetic anhydride was added thereto over 30 min, the temperature rose gradually. It was cooled appropriately with an ice bath, so that the rise in the temperature would be up to 45° C. After completion of the addition, the solution became uniform. When the rise of the temperature stopped, crystals of the product began to precipitate in the flask. After stirring for one hour further, the contents were poured into 15 liters of a 10% brine, and the deposited crystals were filtered through a Nutsche, under reduced pressure. After the crystals were washed with 2 liters of distilled water, they were dried. The crystals were so pure that they could be used in the next step as they were. Thus, 1,132 g of crystals of Compound C were obtained (yield: 93%).

4) Synthesis of Compound D 913 g (3 mol) of Compound C and 2,500 ml of dichloromethane were charged into a 5-liter three-necked flask equipped with a condenser, a thermometer, a dropping funnel, and a mechanical agitator, and they were stirred at room temperature. At that time, the solution was in the form of a non-uniform slurry. When 540 g (4 mol) of sulfuryl chloride was added thereto over 30 min, the temperature rose gradually; then a gas was given off, and at the same time reflux was started. After completion of the addition, when the reaction was allowed to proceed for 2 hours further under reflux, the generation of the gas stopped. At that time the solution remained in the non-uniform state. After stirring for one hour further, the internal temperature was lowered to room temperature, and the contents were poured into 10 liters of n-hexane. The deposited crystals were filtered through a Nutsche, under reduced pressure, and after the crystals were washed with 2 liters of n-hexane, they were dried. The crystals were so pure that they could be used in the next step as they were. Thus, 940 g of crystals of Compound D were obtained (yield: 89%).

5) Synthesis of Compound E 224 g of potassium hydroxide and 1,200 ml of water were charged into a 3-liter three-necked flask equipped with a condenser, a thermometer, a dropping funnel, a nitrogen introduction pipe, and a mechanical agitator, and the potassium hydroxide was dissolved completely. While nitrogen was passed through the solution, 678 g (2 mol) of Compound D, in the form of a powder, was added gradually thereto, and after completion of the addition, the internal temperature was elevated to 60° C. At that time, the solution changed from a non-uniform slurry to a uniform solution.

After stirring for 2 hours further, the internal temperature was lowered to room temperature, and, when 200 ml of acetic acid was added, crystals deposited. The deposited crystals were filtered through a Nutsche, under reduced pressure. After the crystals were washed with cold distilled water, they were recrystallized from a methanol/water mixed solvent, to obtain 403 g of crystals of Compound E (yield: 83%).

6) Synthesis of Exemplified Compound D-5

971 g (4 mol) of Compound E and 2,800 ml of acetontrile were charged into a 5-liter three-necked flask equipped with a condenser, a thermometer, a dropping funnel, and a mechanical agitator, and they were stirred at room temperature. At that time, the solution was in the form of a non-uniform slurry. When 875 g (4 mol) of a powder of mesitylenesulfonyl chloride was added thereto over 10 min, the temperature rose gradually. It was cooled appropriately with an ice bath, so that the rise in the temperature would be up to 30° C. After completion of the addition, it was cooled with an ice bath, so that the internal temperature would be 15° C. or less, and then 324 ml (4 mol) of pyridine was added, dropwise, over 10 min. After completion of the addition, the reaction was allowed to proceed for 2 hours at room temperature, with stirring. After a while, crystals of the product began to deposit in the flask. After completion of the reaction, the contents were poured into 20 liters of a 3% aqueous hydrochloric acid solution, and the deposited crystals were filtered through a Nutsche, under reduced pressure. After the crystals were washed with 4 liters of distilled water, they were recrystallized from an acetonitrile/water mixed solvent, to obtain 1,564 g of crystals of Exemplified Compound D-5 (yield: 92%).

<<Synthesis of Exemplified Compound D-9)>>

1) Synthesis of Compound F 153 g (1 mol) of 4-nitro-m-cresol and 1,000 ml of methanol were charged into a 5-liter three-necked flask equipped with a condenser, a thermometer, a dropping funnel, and a mechanical agitator, and they were stirred at room temperature. At that time, the solution was in the form of a non-uniform slurry. 0.2 liters of an aqueous sodium hypochlorite solution (available chlorine: 5%) was added thereto, dropwise, with care taken so that the internal temperature did not exceed 50° C. At the time of the addition, the color of the solution turned reddish-brown. After completion of the addition, when 500 g (3 mol) of a powder of sodium hydrosulfite was added gradually, reduction of the nitro group took place, with vigorous bubbling. At that time, care had to be taken that the internal temperature did not exceed 60° C. and bubbling did not become too vigorous. When the bubbling stopped and the liquid was decolored, to become a yellowish transparent liquid, the solution was cooled gradually to 10° C. From about the time of the start of the cooling, crystals deposited gradually. The deposited crystals were filtered, and the crude crystals were recrystallized from a mixed solvent of methanol and water, to obtain 142 g of crystals of Compound F (yield: 74%).

2) Synthesis of Exemplified Compound D-9

768 g (4 mol) of Compound F, 1,500 ml of acetontrile, and 1,100 ml of N,N-dimethylacetamide (DMAc) were charged into a 5-liter three-necked flask equipped with a condenser, a thermometer, a dropping funnel, and a mechanical agitator, and they were stirred at room temperature. At that time, the solution became uniform. When 1,212 g (4 mol) of a powder of triisopropylbenzenesulfonyl chloride was added thereto over 10 min, the temperature rose gradually. It was cooled appropriately with an ice bath, so that the rise in the temperature would be up to 30° C. After completion of the addition, it was cooled with an ice bath, so that the internal temperature would be 15° C. or less, and then 324 ml (4 mol) of pyridine was added, dropwise, over 10 min. After completion of the addition, the reaction was allowed to proceed for 2 hours at room temperature, with stirring. After completion of the reaction, the contents were poured into 20 liters of a 3% aqueous hydrochloric acid solution, and the deposited crystals were filtered through a Nutsche, under reduced pressure. After the crystals were washed with 4 liters of distilled water, they were recrystallized from a mixed solvent of methanol and water, to obtain 1,669 g of crystals of Exemplified Compound D-9 (yield: 91%).

Specific examples of the compounds represented by formula (1) or (2) are shown below, which of course are not meant to limit the present invention.

D'-1

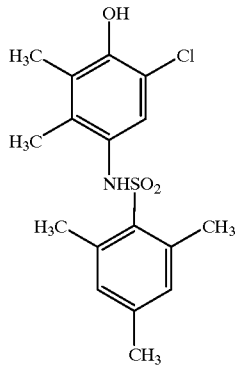

D'-2

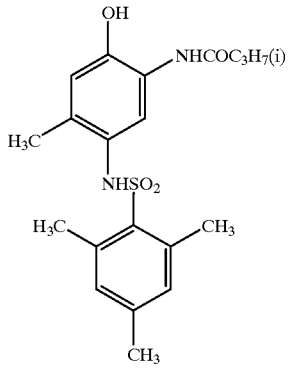

D'-3

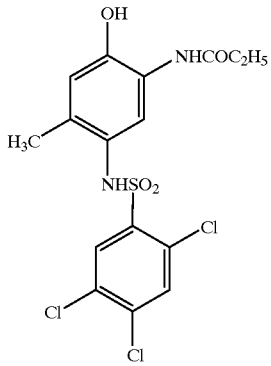

-continued
D′-4
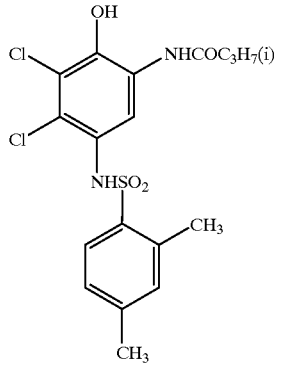
D′-5
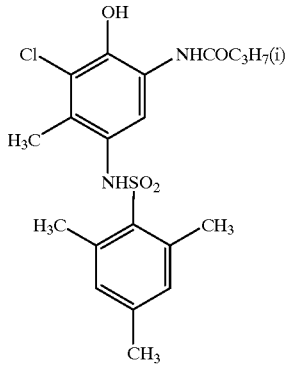
D′-6
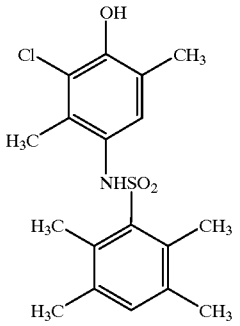
D′-7
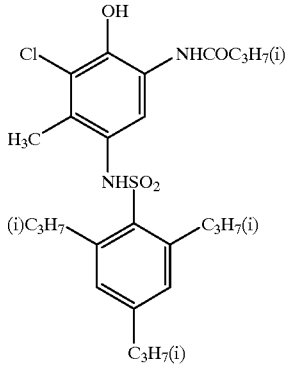
-continued
D′-8
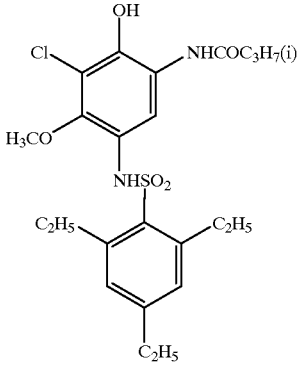
D′-9
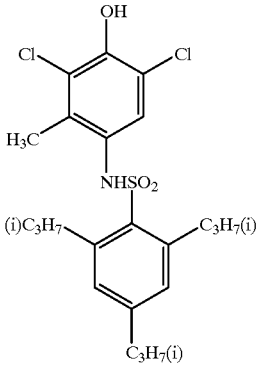
D′-10
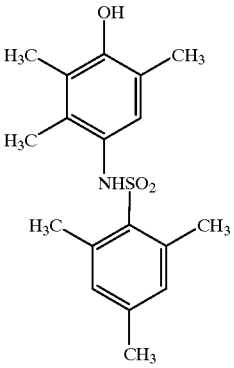
D′-11
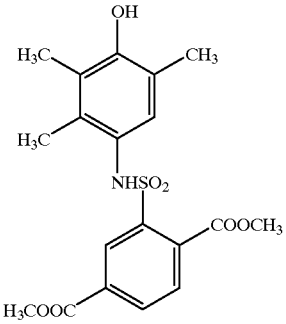

-continued
D′-12
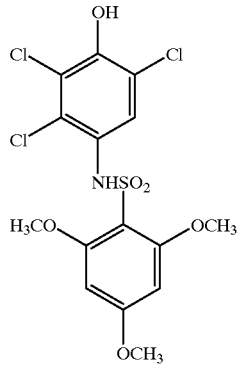
D′-13
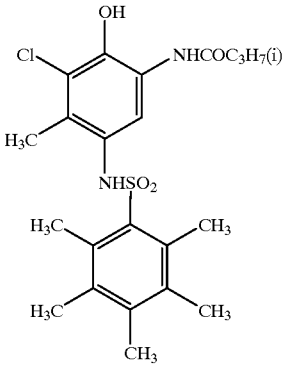
D′-14
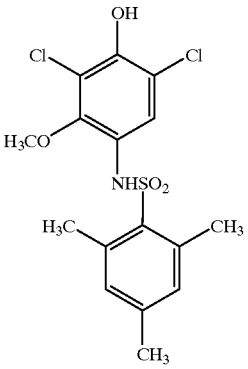
D′-15
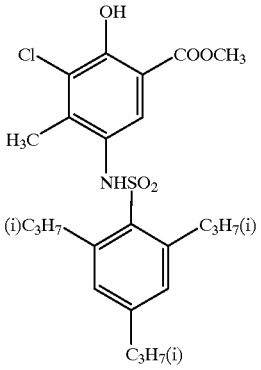
-continued
D′-16
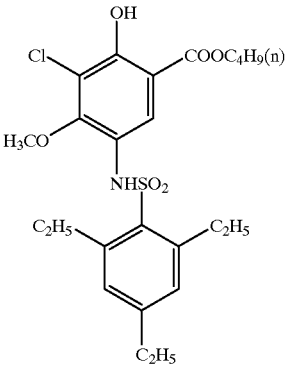
D′-17
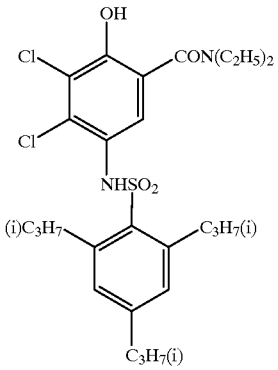
D′-18
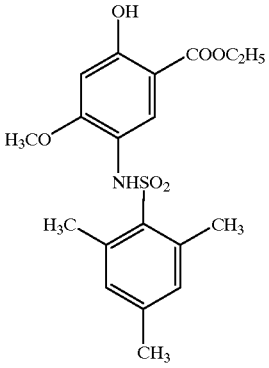
D′-19
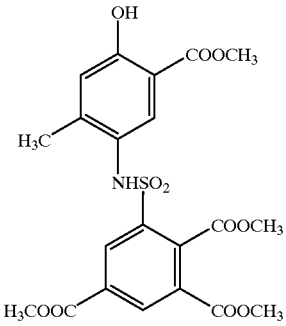

-continued
D′-20
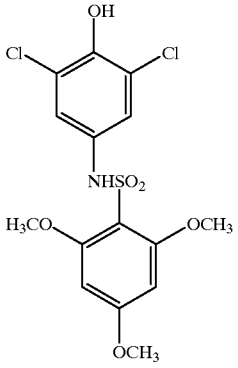
D′-21
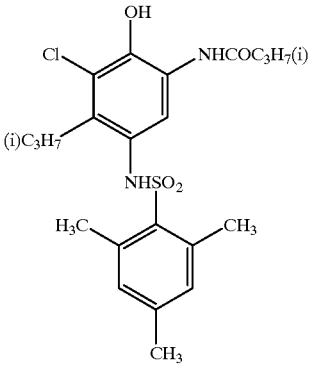
D′-22
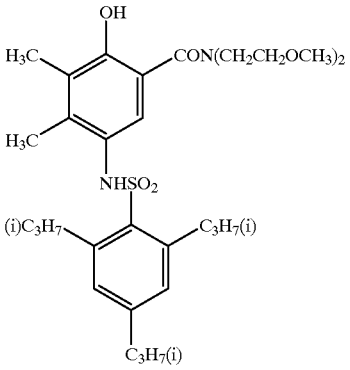
D′-23
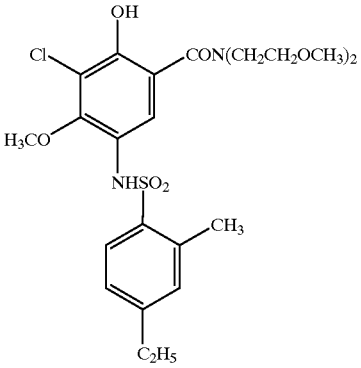
-continued
D′-24
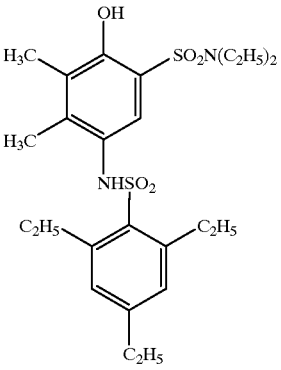
D′-25
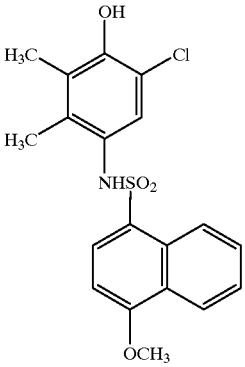
D′-26
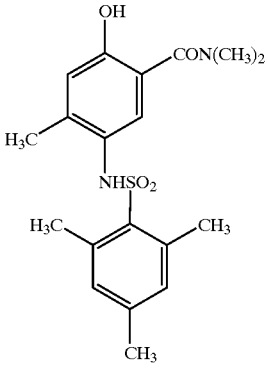
D′-27
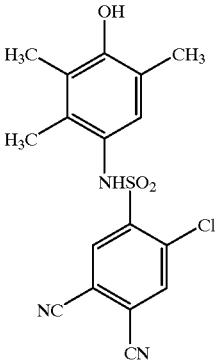

-continued
D′-28
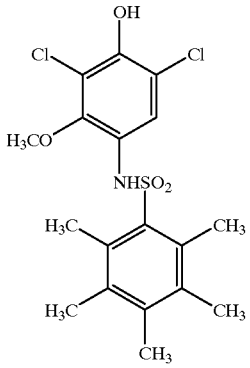
D′-29
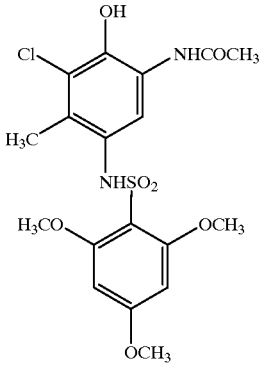
D′-30
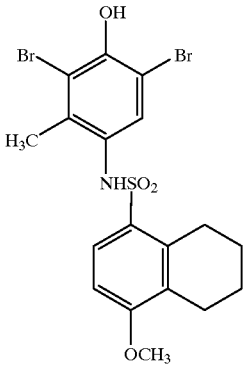
D′-31
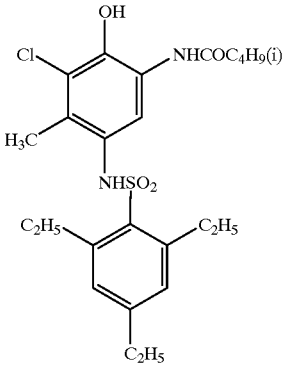
-continued
D′-32
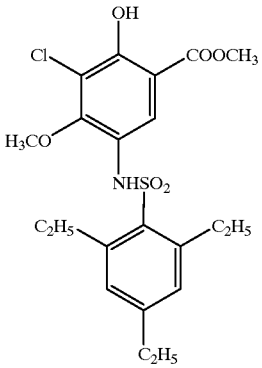
D′-33
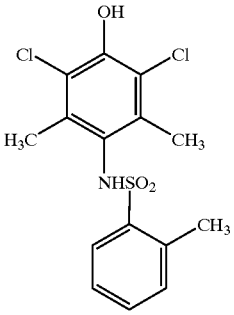
D′-34
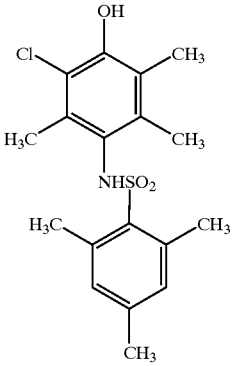
D′-35
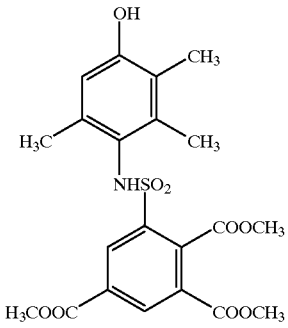

-continued
D′-36
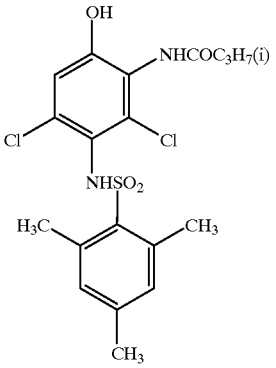
D′-37
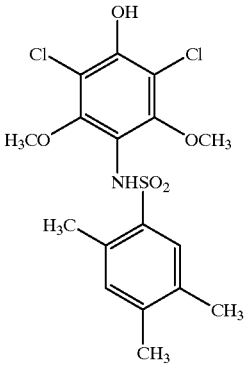
D′-38
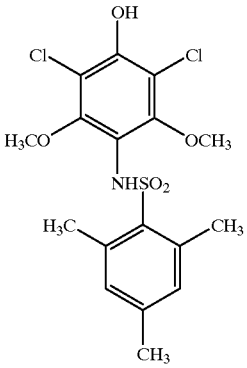
D′-39
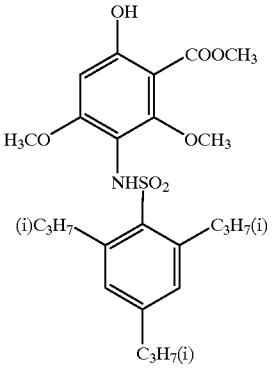
-continued
D′-40
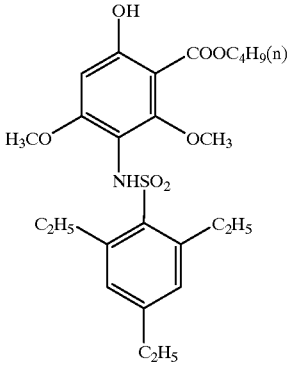
D′-41
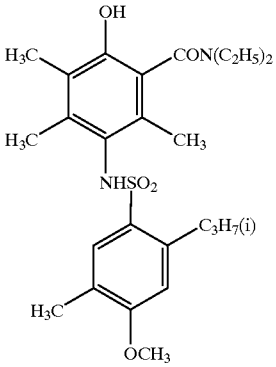
D′-42
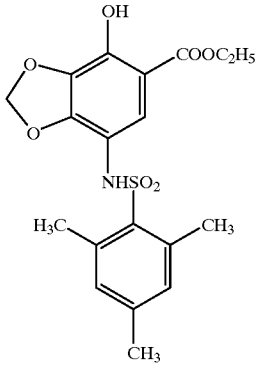
D′-43
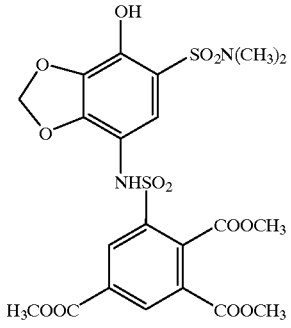

-continued
D′-44
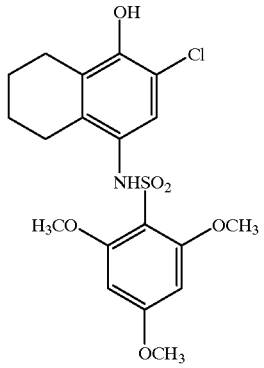
D′-45
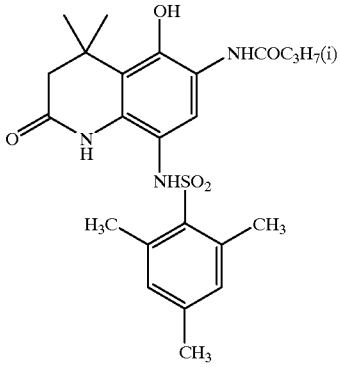
D′-46
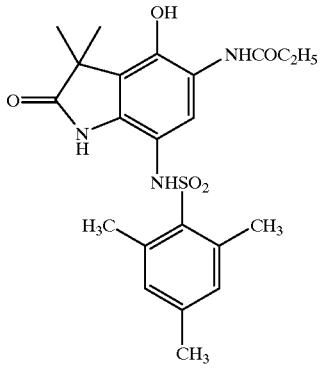
D′-47
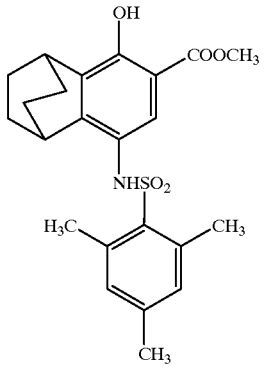
-continued
D′-48
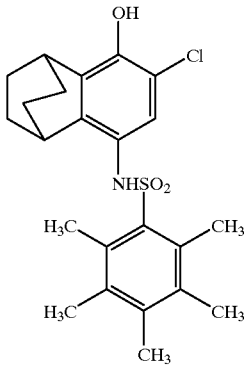
D′-49
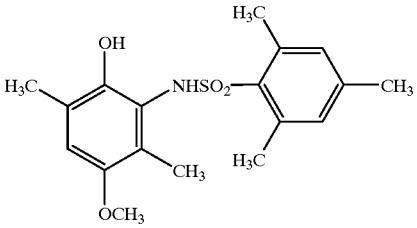
D′-50
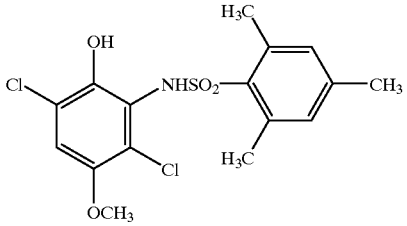
D′-51
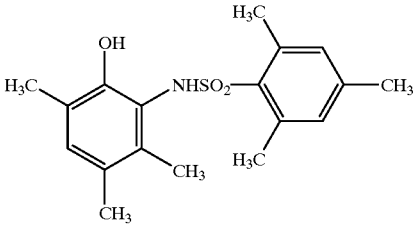
D′-52
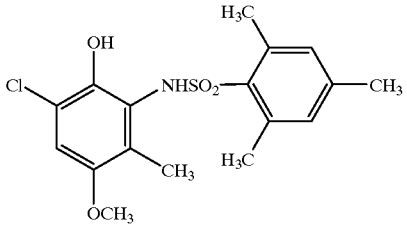
D′-53
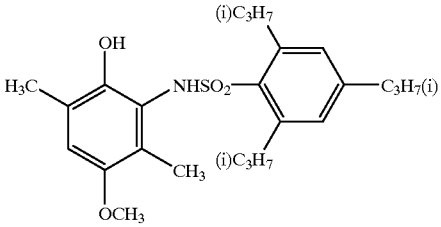

-continued

D'-54

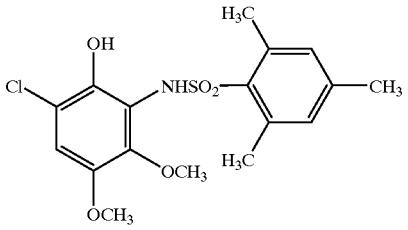

D'-55

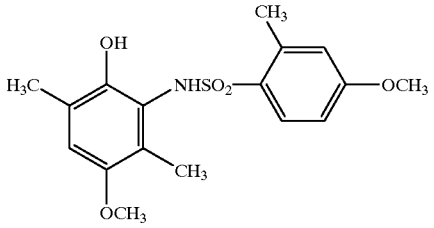

D'-56

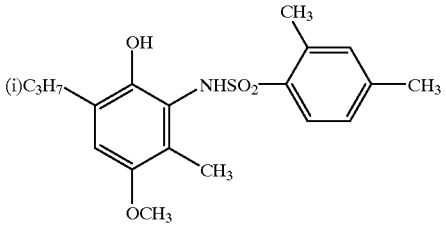

D'-57

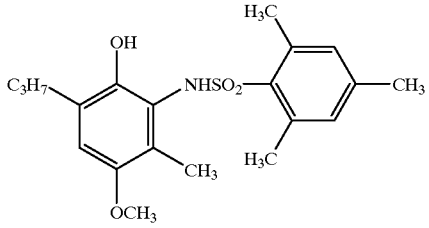

D'-58

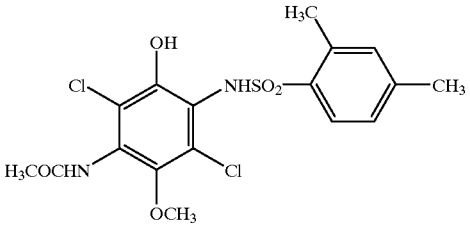

D'-59

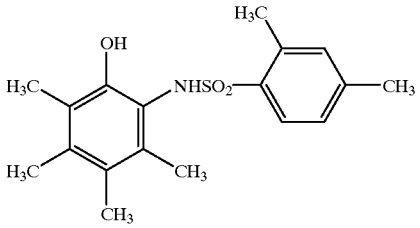

-continued

D'-60

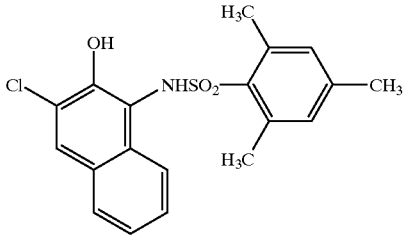

D'-61

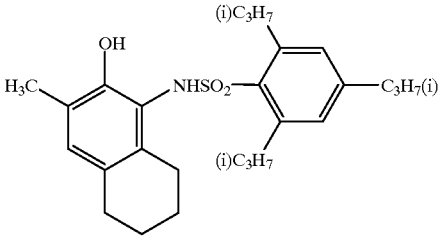

D'-62

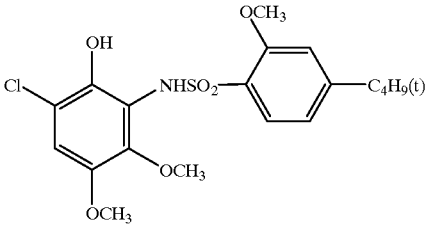

D'-63

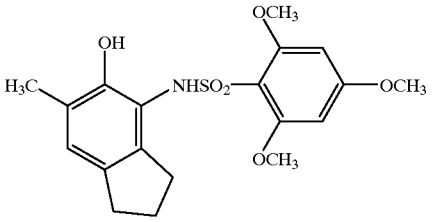

D'-64

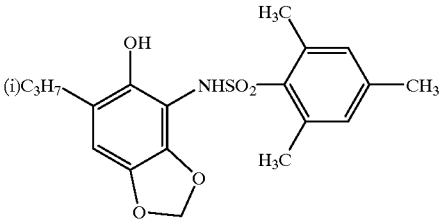

When the compounds represented by formula (1) or (2) are used in a silver halide photographic light-sensitive material, since these compounds allow rapid silver development as intended by the present invention, the image due to the reduced silver produced by the reduction reaction of these compounds alone can be used. Also an image can be formed by a cross-oxidizing reaction between a different kind of reducing agent and the oxidized product of the compound represented by formula (1) or (2). The reducing agent that is used in combination with the compound represented by formula (1) or (2) to carry out a cross-oxidizing reaction to form an image is described below.

1) Color-developing agents that can be used in combination with a coupler to form a dye image Examples of these compounds include sulfonamidophenols, sulfonylhydrazines, sulfonylhydrazones, carbamoylhydrazines, and carbamoylhydrazones described, for example, in JP-A-8-110608, JP-A-9-34081, and JP-A-8-267839, and aminoantipyrine derivatives described in JP-A-9-120132.

2) DDR couplers capable of releasing a diffusible dye by coupling

Examples of these DDR couplers include compounds described, for example, in U.S. Pat. No. 3,443,940, U.S. Pat. No. 4,474,867, and U.S. Pat. No. 4,483,914.

3) Dye-providing compounds (DRR compounds) that, when oxidized, release a diffusible dye Examples of these compounds include compounds described, for example, in JP-A-59-65839, JP-A-59-69839, and JP-A-53-3819.

4) Reducing agents that are used in combination with dye-providing compounds [ROSET compounds (Nihon Shashin Gakkai-shi, Vol. 55, No. 3, page 185, 1992), BEND compounds, or the like (U.S. Pat. No. 4,139,379)] that, when reduced, release a diffusible dye In this image-forming method, a positive image can be formed by the reducing agent that has remained unoxidized by silver development. Examples of the dye-providing compounds include compounds described, for example, in JP-A-1-26842, JP-A-63-201653, and JP-A-201654.

When the compounds represented by formula (1) or (2) are used in a light-sensitive material, the coating amount thereof can be selected in a wide range. In particular, the coating amount is different when these compounds are used singly from the amount when they are used in combination with other reducing agents as described above. When the compounds represented by formula (1) or (2) are used singly, preferably the coating amount is 0.001 to 1,000 mmol/$m^2$, and more preferably 0.05 to 50 mmol/$m^2$. When the compounds represented by formula (1) or (2) are used in combination with other reducing agents, the coating amount of the reducing agent used for forming an image is preferably 0.001 to 1,000 mmol/$m^2$, and more preferably 0.05 to 50 mmol/$m^2$, although it varies depending on the molar extinction coefficient of the dye to be formed. On the other hand, when the compounds represented by formula (1) or (2) are used as an auxiliary developing agent, they are added appropriately in an amount of generally 0.001 to 1,000 times, preferably 0.01 to 100 times, and more preferably 0.05 to 10 times, the molar amount of the above reducing agent.

The method for adding the compound represented by formula (1) or (2) can be carried out by mixing, first, the compound, oil-soluble compounds to be used with, such as a coupler, and a high-boiling organic solvent (e.g. an alkyl phosphate and an alkyl phthalate), dissolving the resultant mixture in a low-boiling organic solvent (e.g. ethyl acetate and methyl ethyl ketone), dispersing the resulting solution in water using an emulsifying and dispersing method known in the art, and adding the emulsified dispersion. The solid dispersion method described in JP-A-63-271339 can also be used for the addition.

The compound for use in the present invention can be used in monochromatic silver halide photographic light-sensitive materials, and it can also be used in color photographic light-sensitive materials. In the following examples, color photographing materials wherein the compound (1) or (2) for use in the present invention is used are described.

In order to obtain colors ranging widely on the chromaticity diagram by using three primary colors: yellow, magenta, and cyan, use is made of a combination of at least three silver halide emulsion layers photosensitive to respectively different spectral regions. For example, a combination of three layers of a blue-sensitive layer, a green-sensitive layer, and a red-sensitive layer, and a combination of a green-sensitive layer, a red-sensitive layer, and an infrared-sensitive layer, can be mentioned. The photosensitive layers can be arranged in various orders known generally for color photographic materials. Further, each of these photosensitive layers can be divided into two or more layers if necessary.

Further, after the formation of a color-formed image by heat development, the remaining silver halide and/or developed silver may or may not be removed. As a means for outputting to a different material based on its image information, the generally used projection exposure may be used, or the image information may be read photoelectrically by measuring the density of the transmitted light, and its signals may be outputted. The material to which the output is made may not be light-sensitive materials and may, for example, be sublimation-type thermographic (heat sensitive recording) materials, ink jet materials, electrophotographic materials, and full-color direct thermographic materials. An example of a preferable mode in the present invention is one in which, after the formation of a color-formed image by heat development, without carrying out additional processing for removing the remaining silver halide and the developed silver, the image information is read photoelectrically by measuring the transmitted density, using a CCD image sensor and diffused light, and the information is transformed into digital signals that in turn are subjected to image processing and are outputted to a heat development color printer, such as "PICTOGRAPHY" 3000" (trade name), manufactured by Fuji Photo Film Co., Ltd. In this case, a good print can be obtained quickly without using any of the processing solutions used in conventional color photography. Further, in this case, since the above digital signals can be processed and edited arbitrarily, the photographed image can be corrected (retouched), modified, and processed freely, to be outputted.

It is suitable that the light-sensitive material of the present invention is provided with at least one photosensitive layer on a support, and anti-halation layer under the photosensitive layer. The photosensitive layer may be a photosensitive layer that comprises a plurality of silver halide emulsion layers whose color sensitivities are substantially identical but whose sensitivities are different, and it is preferable that the photosensitive layer being a unit photosensitive layer having color sensitivity to any of blue light, green light, and red light, and in a multilayer silver halide color photographic light-sensitive material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them. Nonphotosensitive layers such as various intermediate layers may be placed between, on top of, or under the above-mentioned silver halide photosensitive layers. The intermediate layer may contain, for example, the above-described couplers, developing agents, DIR compounds, color-mixing inhibitor, and dyes. Each of the silver halide emulsion layers constituting unit photosensitive layers respectively can preferably take a two-layer constitution comprising a high-sensitive emulsion layer and a low-sensitive emulsion layer, as described in DE 1 121 470 or GB-923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support and a high-sensitive emulsion layer may be placed nearer to the support.

The silver halide may be any of silver iodobromide, silver chloroiodobromide, silver bromide, silver chlorobromide, silver iodochloride, and silver-chloride. The composition thereof is selected depending on the properties to be given to the light-sensitive silver halide. For example, when high sensitivity is required, as in the case of photographing materials, a silver iodobromide emulsion is mainly used. Further, in printing materials, in which rapid/easy development processing is regarded as important, silver chloride is used, in many cases. However, recently it has attempted, according to reports, to use silver chloride to make the processing of photographing materials rapid.

The size of the silver halide grains constituting the light-sensitive emulsion is preferably 0.1 to 2 $\mu$m, and particularly 0.2 to 1.5 $\mu$m, in terms of the diameter of a sphere having the same volume. The shape of the silver halide grains may be any shape, such as the shape of regular crystals, including cubic crystals, octahedral crystals, or tetradecahedral crystals; an irregular shape, including spherical shapes; and a tabular shape, including hexagons and rectangles. In the case of photographing materials, in order to provide high sensitivity, so-called high-aspect ratio tabular grains having a large diameter of the projected area to the thickness of the grains, are preferable. Herein the term "aspect ratio" means the value obtained by dividing the diameter of a circle equivalent to the projected area of the grain, by the thickness of the grain. The silver halide emulsion used in photographing materials comprises tabular grains preferably having an aspect ratio of 2 or more, more preferably 5 or more, further more preferably 8 or more, and most preferably 20 or more, that amount to generally 50% or more, preferably 80%-or more, and more preferably 90% or more, of the projected area of all grains in the emulsion. In the case of grains having a smaller grain size (about 0.5 $\mu$m or less in terms of the diameter of a sphere equivalent to the volume of the grain), grains having a tabular degree of 25 or more are preferable, the tabular degree being obtained by dividing the aspect ratio by the thickness of the grain.

By increasing the aspect ratio, since a large projected area can be obtained with the volume being kept the same, the spectral sensitization rate can be increased. When the photographic sensitivity is proportional to the projected area of the grain, the amount of a silver halide required to obtain the same sensitivity can be reduced. On the other hand, when grains are prepared with the projected area of the grain being kept constant, by increasing the aspect ratio, the number of grains can be increased even using the same amount of a silver halide, and therefore the graininess (granularity) can be improved. Further, when high-aspect ratio grains are used, since the scattered light component large in scattering angle to the incident optical path is decreased, the sharpness can be increased.

The application techniques and properties of these high-aspect ratio tabular grains are disclosed, for example, in U.S. Pat. No. 4,433,048, U.S. Pat. No. 4,434,226, and U.S. Pat. No. 4,439,520. Techniques for ultra-high-aspect ratio tabular grains having a thickness of less than 0.07 $\mu$m are disclosed, for example, in U.S. Pat. No. 5,494,789, U.S. Pat. No. 5,503,970, U.S. Pat. No. 5,503,971, U.S. Pat. No. 5,536,632, EP-A-0 699 945, EP-A-0 699 950, EP-A-0 699 948, EP-A-0 699 944, EP-A-0 701 165, and EP-A-0 699 946. The high-aspect ratio tabular grains described in these specifications are mainly made from silver bromide or silver iodobromide, and many of them are hexagonal tabular grains whose major planes are (111) planes. The grains having such a shape have generally two parallel twining planes within the (111) plane. To prepare high-aspect ratio thin tabular grains, it is a technical point that the distance between the two twining planes is made small. For that, it is important to control, for example, the binder concentration, the temperature, the pH, the excess halide ion species, the excess halide ion concentration, and the feed rate of the reaction liquid at the time of the formation of nuclei. To form high-aspect ratio tabular grains, it is a point that the formed tabular nuclei are allowed to grow not in the direction of the thickness of the tabular nuclei but in the direction toward the periphery, selectively. To this end, it is also important to control the feed rate of the reaction liquid for the growth of grains, and to choose a binder that is-optimal for from the formation of the grains through the process of the growth. In the above specifications, there are descriptions to the effect that a gelatin low in methionine content is advantageous for making the aspect ratio high.

On the other hand, techniques for forming tabular grains by means of silver chloride high in silver chloride content are also disclosed. For instance, techniques for high-silver-chloride tabular grains whose major planes are (111) planes are disclosed, for example, in U.S. Pat. No. 4,400,463, U.S. Pat. No. 4,713,323, U.S. Pat. No. 5,217,858, EP-A-0,423 840, and EP-A-0 647 877.

On the other hand, techniques for high-silver-chloride tabular grains whose major planes are (100) planes are disclosed, for example, in U.S. Pat. No. 5,264,337, U.S. Pat. No. 5,292,632, U.S. Pat. No. 5,310,635, U.S. Pat. No. 5,275,932, EU-A-0 534 395, EU-A-0 617 320, and International Publication No. WO 94/22054. These techniques are useful for preparing highly sensitive emulsions in which silver chloride is used and that are excellent in development rate and optical properties.

In addition to the above contrivances regarding shape, the silver halide grains are prepared to have a variety of structures in the grains. A generally used method is one in which grains are formed to have layers different in silver halide composition. In the case of silver iodobromide grains used for photographing materials, it is preferable to provide layers different in iodine content. There are known so-called inside-high-iodine-type core/shell grains, wherein the nuclei in the form of layers high-in iodine content are covered with shells low in iodine content, for the purpose of controlling developability. Reversely thereto, there are known outside-high-iodine-type core/shell grains, wherein nuclei are covered with shells high in iodine content, which are effective in increasing the stability of the shape when the thickness of tabular grains is decreased. There is also known a technique for providing a high sensitivity, wherein nuclei low in iodine content are covered with first shells high in iodine content, and then second shells low in iodine content are deposited thereon. In this type of silver halide grains, the shells (corresponding to the fringes of the outer edges in the case of tabular grains) deposited on high-iodine layers are formed with dislocation lines due to crystal disorder, which contributes to the securement of a high sensitivity.

Further a technique for epitaxially growing, at the localized sites of formed host grains, crystals different therefrom in halogen composition, is preferably used for obtaining high sensitivity. For example, there is known a technique wherein crystals high in iodine content are epitaxially grown on parts (apexes or edges of the grain, or on planes of the grain) of surfaces of host grains rich in silver bromide. Reversely, there is known a technique wherein, on host grains of silver bromide or silver iodobromide, are grown epitaxially crystals having a solubility higher than the host grains (e.g. crystals increased in silver chloride content). The latter is preferably used in providing tabular grains particularly decreased in thickness with high sensitivity.

In high-silver-chloride tabular grains high in silver chloride content, it is preferable to carry out forming of localized phases high in silver bromide content or silver iodide content inside the grains or on the surfaces of the grains. Particularly, these localized phases are preferably grown epitaxially on the apexes or edges on the surfaces of the grains. These sites of the epitaxially grown crystals serve as sites where effective light-sensitive nuclei are formed, giving high sensitivity.

To improve the photographic properties of the light-sensitive silver halide emulsion, preferably doping of a salt or a complex salt of a metal into the grains is carried out. These compounds act as transitional or permanent traps of electrons or positive holes in the silver halide crystals., and they are useful for obtaining high sensitivity or high contrast, for improving the illuminance dependency or the environment (temperature or humidity) dependency at the time of exposure, or for suppressing a change in performance when pressure is applied before or after the exposure. As for these dopants, the method for doping can be chosen to suit the purpose; for example, the silver halide grains may be uniformly doped, specific sites in the grains may be locally doped, the subsurfaces or surfaces may be locally doped, or the above epitaxial parts may be locally doped.

Preferable metals include the first to third transitional metal elements, such as iron, ruthenium, rhodium, palladium, cadmium, rhenium, osmium, iridium, and platinum, and the amphoteric metal elements, such as thallium and lead. The ions of these metals are doped in a suitable form of a salt or a complex salt. Among the salts and complex salts, six-coordinate halogeno complexes or cyano complexes, wherein ligands are halide ions or cyanide ions, are preferably used. Further, complexes having organic ligands can also be used, such as a nitrosyl ligand, a carbonyl ligand, a thiocarbonyl ligand, a dinitrogen ligand, a bipyridyl ligand, a cyclopentadienyl ligand, and a 1,2-dithiolenyl ligand. Techniques concerning these are described, for example, in JP-A-2-236542, JP-A-1-116637, and JP-A-4-126629.

Further, doping with divalent anions of so-called chalcogen elements, such as sulfur, selenium, and tellurium, is also preferably carried out. These dopants are also effective in securing high sensitivity and in improving exposure condition dependency.

As a method employed to prepare silver halide grains, known method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of pH regions among the acid process, the neutral process, the ammonia process, and the like can be used to prepare silver halide grains. Further, to supply a soluble silver salt solution and a soluble halogen salt solution that are reaction solutions, any of the single-jet method, the double-jet method, a combination thereof, and the like can be used. The controlled double-jet method, can also be used preferably, wherein the addition of reaction solutions are controlled, to keep the pAg in the reaction constant. A method in which the pH of the reaction liquid during the reaction is kept constant can also be used. In the step for forming grains of the light-sensitive silver halide emulsion for use in the present invention, a method in which the solubility of the silver-halide is controlled by changing the temperature, pH, or pAg of the system can be used, and a thioether, a thiourea, and a rhodanate, can be used as a silver halide solvent, examples of these are described in JP-B-47-11386 ("JP-B" means examined Japanese patent publication), and JP-A-53-144319.

Generally, the preparation of the silver halide grains is carried out by feeding a solution of a water-soluble silver salt, such as silver nitrate, and a solution of a water-soluble halogen salt, such as an alkali halide, into a solution containing a water-soluble binder dissolved therein, such as gelatin, under controlled conditions. After the formation of the silver halide grains, the excess water-soluble salts are preferably removed. This step is called "desalting" or "washing", and various means can be used in the step. For example, the noodle water-washing method, in which a gelatin solution containing silver halide grains are made into a gel and the gel is cut into a string-shape, then the water-soluble salts are washed away using a cold water, and the sedimentation method, in which inorganic salts comprising polyvalent anions (e.g. sodium sulfate), an anionic surfactant, an anionic polymer (e.g. polystyrenesulfonic acid sodium salt), or a gelatin derivative (e.g. an aliphatic-acylated gelatin, an aromatic-acylated gelatin, and an aromatic-carbamoylated gelatin) is added, to allow the gelatin to aggregate, thereby removing the excess salts, can be used. In particular, the sedimentation method is preferably used because removal of the excess salts can be carried out rapidly.

In the present invention, generally it is preferable to use a chemically sensitized silver halide emulsion. The chemical sensitization contributes to giving high sensitivity to the prepared silver halide grains, and to giving exposure condition stability and storage stability. In the chemical sensitization, generally known sensitization methods may be used singly or in combination.

Preferably use is made of, as the chemical sensitization method, the chalcogen sensitization method, wherein a sulfur, selenium, or tellurium compound is used. As the sensitizer used therein, a compound is used that, when added to the silver halide emulsion, releases the above chalcogen element, to form a silver chalcogenide. The use of such sensitizers in combination is preferable to obtain high sensitivity and to keep fogging low.

The noble metal sensitization method, wherein gold, platinum, iridium, or the like is used, is also preferable. Particularly the gold sensitization method, wherein chloroauric acid is used alone or in combination with thiocyanate ions or the like that act as ligands of gold, can give high sensitivity. The use of a combination of gold sensitization with chalcogen sensitization can give higher sensitivity.

The so-called reduction sensitization method is also preferably used, wherein a compound having a suitable reducing ability is used during the grain formation to introduce reducing silver nuclei, to obtain high sensitivity. The reduction sensitization method, wherein an alkynylamine compound having an aromatic ring is added at the time of chemical sensitization, is also preferred.

In carrying out the chemical sensitization, it is also preferable to use various compounds adsorbable to silver halide grains, to control reactivity. Particularly the method wherein sensitizing dyes, such as cyanines and melocyanines, mercapto compounds, or nitrogen-containing heterocyclic compounds, are added prior to chalcogen sensitization or gold sensitization, is particularly preferable.

The reaction conditions under which the chemical sensitization is conducted vary in accordance with the purpose: The temperature is generally 30 to 95° C., and preferably 40 to 75° C.; the pH is generally 5.0 to 11.0, and preferably 5.5 to 8.5; and the pAg is generally 6.0 to 10.5, and preferably 6.5 to 9.8.

Chemical sensitization techniques are described, for example, in JP-A-3-110555, JP-A-4-75798, JP-A-62-253159, JP-A-5-45833, and JP-A-62-40446.

In the present invention, preferably the so-called spectral sensitization, for sensitizing the light-sensitive silver halide emulsion to a desired light wavelength range, is carried out. Particularly, in a color photographic light sensitive material, for color reproduction faithful to the original, light-sensitive layers having light sensitivities to blue, green, and red are incorporated. These sensitivities are provided by spectrally sensitizing the silver halide. In the spectral sensitization, use is made of a so-called spectrally sensitizing dye that is adsorbed to the silver halide grains, to cause them to have sensitivity in the range of its own absorption wavelength.

Examples of such dyes include cyanine dyes, merocyanine dyes, composite cyanin dyes, composite merocyanine dyes, halopolar dyes, hemicyanine dyes, styryl dyes, and hemioxonol dyes. These examples are described, for example, in U.S. Pat. No. 4,617,257, JP-A-59-180550, JP-A-64-13546, JP-A-5-45828, and JP-A-5-45834.

These spectral sensitizing dyes can be used singly or in combination, and a single use or a combination use of these sensitizing dyes is selected for the purpose of adjusting the wavelength distribution of the spectral sensitivity, and for the purpose of supersensitization. When using a combination of the dyes having supersensitizing effect, it is possible to attain sensitivity much larger than the sum of sensitivities which can be attained by each single dye.

Further, together with the sensitizing dye, it is also preferable to use a dye having no spectral sensitizing action itself, or a compound that does not substantially absorb visible light and that exhibits supersensitization. As an example of the supersensitizer, a diaminostilbene compound and the like can be mentioned. These examples are described, for example, in U.S. Pat. No. 3,615,641 and JP-A-63-23145.

The addition of these spectrally sensitizing dyes and supersensitizers to the silver halide emulsion may be carried out at any time during the preparation of the emulsion. Different methods, such as addition when a coating solution is prepared from the chemically sensitized emulsion, addition after the completion of the chemical sensitization, addition during the chemical sensitization, addition prior to the chemical sensitization, addition after the formation of the grains and before the desalting, addition during the formation of the grains, and addition prior to the formation of the grains, can be used alone or in combination. The addition is preferably carried out in a step before the chemical sensitization, to obtain high sensitivity.

The amount of the spectrally sensitizing dye or the supersensitizer to be added may vary depending on the shape of the grains, the size of the grains, and the desired photographic properties, and it is generally in the range of $10^{-8}$ to $10^{-1}$ mol, and preferably $10^{-5}$ to $10^{-2}$ mol, per mol of the silver halide. These compounds can be added with them dissolved in an organic solvent, such as methanol and a fluoroalcohol, or with them dispersed together with a surfactant or gelatin in water.

In the silver halide emulsion used in the present invention, various stabilizers can be incorporated for the purpose of preventing fogging, or for the purpose of improving stability at storage. As a preferable stabilizer, nitrogen-containing heterocyclic compounds, such as azaindenes, triazoles, tetrazoles, and purines; mercapto compounds, such as mercaptotetrazoles, mercaptotriazoles, mercaptoimidazoles, and mercaptothiadiazoles, can be mentioned. Details of these compounds are described, for example, by T. H. James in "The Theory of the Photographic Process," Macmillan, 1997, pages 396 to 399, and references cited therein.

The timing when the antifoggant or the stabilizer is added to the silver halide emulsion may be at any stage in the preparation of the emulsion. The addition to the emulsion can be carried out at any time, singly or in combination, of after the completion of the chemical sensitization and during the preparation of a coating solution, at the time of the completion of the chemical sensitization, during the chemical sensitization, prior to the chemical sensitization, after the completion of the grain formation and before desalting, during the grain formation, or prior to the grain formation.

The amount of these antifogging agents or stabilizers to be added varies in accordance with the halogen composition of the silver halide emulsion and the purpose, and it is generally in the range of $10^{-6}$ to $10^{-1}$ mol, and preferably $10^{-5}$ to $10^{-2}$ mol, per mol of the silver halide.

The amount of the light-sensitive silver halide used in the light-sensitive material is suitably generally 0.05 to 20 g/m$^2$, and preferably 0.1 to 10 g/m$^2$, in terms of silver.

Organic metal salts, binders, high-boiling organic solvents, surfactants, hardeners, antifoggants, photographic stabilizers and their precursors, coating aids, antistatic agents, development accelerators, organic fluorocompounds, slip agents, polymer latexes, matting agents, bases (supports), film magazines (cartridges), and the like that can be used in the present invention are described, for example, also in EP-A-0 762 201 (A1) supra. In addition, the following compounds can be used effectively.

Dispersion mediums of oil-soluble organic compounds: P-3, 5, 16, 19, 25, 30, 42, 49, 54, 55, 66, 81,85, 86, and 93 (pages 140 to 144) of JP-A-62-215272;

Latexes for impregnation of oil-soluble organic compounds: latexes described in U.S. Pat. No. 4,199,363;

Scavengers for the oxidized product of a developing agent: compounds represented by formula (I) in column 2, lines 54 to 62 of U.S. Pat. No. 4,978,606 (particularly I-, (1), (2), (6), and (12) (columns 4 to 5), compounds represented by formulae in column 2, lines 5 to 10 of U.S. Pat. No. 4,923,787 (particularly compound 1 (column 3);

Antistaining agents: compounds represented by any of formulae (I) to (III) on page 4, lines 30 to 33 of EP-A-298, 321 (particularly I-47, 72, III-1, and 27 (pages 24 to 48);

Antifading agents: compounds A-6, 7, 20, 21,23, 24, 25, 26, 30, 37, 40, 42, 48, 63, 90, 92, 94, and 164 (pages 69 to 118) of EP-A-298,321, compounds II-1 to III-23 in columns 25 to 38 of U.S. Pat. No. 5,122,444 (particularly III-10), compounds I-1 to III-4 on pages 8 to 12 of EP-A-471,347 (particularly II-2), and compounds A-1 to 48 in columns 32 to 40 of U.S. Pat. No. 5,139,931 (particularly A-39 and 42);

Materials for reducing the amount to be used of color-formation enhancing agents or color-mixing inhibitors: compounds I-1 to II-15 on pages 5 to 24 of EP-A-411,324 (particularly I-46);

Formalin scavengers: compounds SCV-1 to 28 on pages 24 to 29 of EP-A-477,932 (particularly SCV-8);

Hardeners: compounds H-i, 4, 6, 8, and 14 on page 17 of JP-A-1-214845, compounds (H-1 to 54) represented by any of formulae (VII) to (XII) in columns 13 to 23 of U.S. Pat. No. 4,618,573, compounds (H-1 to 76) represented by formula (6) shown in-the lower right part on page 8 of JP-A-2-214852 (particularly H-14) and compounds recited in claim 1 of U.S. Pat. No. 3,325,287;

Development-inhibitor precursors: compounds P-24, 37, and 39 (pages 6 to 7) of JP-A-62-168139 and compounds recited in claim 1 of U.S. Pat. No. 5,019,492 (particularly 28 and 29 in column 7);

Antiseptics and mildewproofing agents: compounds I-1 to III-43 in columns 3 to 15 of U.S. Pat. No. 4,923,790 (particularly II-1,9, 10, and 18 and III-25);

Stabilizers and antifogging agents: compounds I-1 to (14) in columns 6 to 16 of U.S. Pat. No. 4,923,793 (particularly I-1,60, (2), and (13)) and compounds 1 to 65 in columns 25 to 32 of U.S. Pat. No. 4,952,483 (particularly 36);

Chemical sensitizers: triphenylphosphine selenides, and compound 50 of JP-A-5-40324;

Dyes: compounds A-1 to B-20 on pages 15 to 18 of JP-A-3-156450 (particularly A-1, 12, 18, 27, 35, 36, and B-5) and compounds V-1 to 23 on page 27 to 29 of JP-A-3-156450 (particularly V-1), compounds F-I-1 to F-II-43 on pages 33 to 55 of EP-A-445,627 (particularly F-I-11 and F-II-8), compounds III-1 to 36 on pages 17 to 28 of EP-A-457,153 (particularly III-1 and 3), fine crystal dispersions of Dye-i to 124 of 8 to 26 of WO 88/04794, compounds 1 to 22 on pages 6 to 11 of EP-A-319,999 (particularly compound 1), compounds D-1 to 87 represented by any of formulas (1) to (3) (pages 3 to 28) of EP-A-519,306, compounds 1 to 22 represented by formula (I) (columns 3 to 10) of U.S. Pat. No. 4,268,622, and compounds (1) to (31) represented by formula (I) (columns 2 to 9) of U.S. Pat. No. 4,923,788;

UV absorbers: compounds (18B) to (18R) and 101 to 427 represented by formula (1) (pages 6 to 9) of JP-A-46-3335, compounds (3) to (66) represented by formula (I) (pages 10 to 44) and compounds HBT-1 to 10 represented by formula (III) (page 14) of EP-A-520,938, and compounds (1) to (31) represented by formula (1) (columns 2 to 9) of EP-A-521,823.

The silver halide photographic light-sensitive material of the present invention can be processed with a developer containing a developing agent, or with such a processing solution as an activator solution comprising an aqueous alkali solution, or it can be subjected to heat development processing. Also as is shown in JP-A-9-127670, a method can be utilized wherein, after the silver halide photographic light-sensitive material of the present invention is exposed imagewise, it is brought in close contact with the processing layer of a processing member and is heated, to form an image in the silver halide photographic light-sensitive material.

The processing layer of the processing member used preferably in the present invention contains at least a base and/or a base precursor.

As the base, an inorganic or organic base can be used. Examples of the inorganic base include the hydroxide, the phosphate, the carbonate, the borate, and an organic acid salt of an alkali metal or an alkali earth metal described in JP-A-62-209448, and the acetylide of an alkali metal or an alkali earth metal described, for example, in JP-A-63-25208.

Examples of the organic base include ammonia, aliphatic or aromatic amines (e.g. primary amines, secondary amines, tertiary amines, polyamines, hydroxyamines, and heterocyclic amines), amidines; bis-, tris-, or tetra-amidines; guanidines; water-soluble mono-, bis-, tris-, or tetra-guanidines; and quaternary ammonium hydroxides.

Examples of the base precursors that can be used include those of the decarboxylation type, the decomposition type, the reaction type, and the complex salt formation type.

In the present invention, as is described in EP-A-210,660 and U.S. Pat. No. 4,40,445, a method is effectively employed wherein a base is produced by means of a combination of a basic metal compound that is hardly soluble in water, as a base precursor, with a compound (referred to as a complex-forming compound) capable of a complex-forming reaction with the metal ion constituting that basic metal compound, using water as a medium. In this case, although it is desirable to add the basic metal compound that is hardly soluble in water to the light-sensitive material, and to add the complex-forming compound to the processing member, the procedure may be reversed.

The amount to be added of the base or the base precursor is generally 0.1 to 20 g/m$^2$, and preferably 1 to 20 g/m$^2$. As the binder in the processing layer, a hydrophilic polymer can be used in the same manner as the light-sensitive member. Further, materials and other constitutions that can be used for the processing member are described in EP-0 762 201 (A1).

In a preferable example of the present invention, a method for subjecting to development a light-sensitive material that has been used for photographing by means of a camera is used, wherein the light-sensitive member and the processing member are put together with the light-sensitive layer and the processing layer facing each other, in the presence of water in an amount of 0.1 to 1 times the amount required for the maximum swelling of all the coating films of the light-sensitive member and the processing member, except the backing layers, and they are heated at a temperature of 60 to 100° C. for 5 to 60 sec.

Herein water may be any water generally used. Specifically, distilled water, deionized water, tap water, well water, mineral water, and the like can be used. These waters may be used preferably by adding a small amount of an antiseptic agent, to prevent scale formation, decay, or the like, or by filtering them through an activated-carbon filter, an ion-exchange resin filter, or the like, to be circulated.

The light-sensitive member and/or the processing member is stuck and heated with them swollen with water. The state of the swollen films is unstable, and therefore it is important to restrict the amount of water in the above range, in order-to prevent color formation from becoming locally uneven.

The amount of water required for the maximum swelling can be found by immersing the light-sensitive member or the processing member, having a coating film to be measured, in the water that will be used, to allow it to swell enough, then measuring the thickness, and subtracting the weight of the coating film from the calculated weight of the maximum swell. Further, an example of the method for measuring the swell is also described in Photographic Science Engineering, Vol. 16 page 449 (1972).

According to the present invention, a silver halide photographic light-sensitive material excellent in the discrimination of an image and raw stock storability can be provided.

The present invention will now be described in more detail with reference to the following examples, but of course the present invention is not limited to them.

EXAMPLES

The following examples further illustrate the present invention in detail, but do not limit the scope thereof.

Example 1

Image receiving elements $R^{101}$ having the structures shown in Table 1 and Table 2 were produced.

TABLE 1

Structure of image receiving element R101

| Number of layer | Additive | Amount applied (mg/m$^2$) |
|---|---|---|
| 6th layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Ampholytic surfactant (1) | 50 |
| | Stain inhibitor (1) | 7 |
| | Stain inhibitor (2) | 12 |
| | Matting agent (1) | 7 |
| 5th layer | Gelatin | 250 |
| | Water-soluble polymer (1) | 25 |
| | Anionic surfactant (3) | 9 |
| | Hardener (1) | 185 |
| 4th layer | Mordanting agent (1) | 1850 |
| | Water-soluble polymer (2) | 260 |
| | Water-soluble polymer (4) | 1400 |
| | Latex dispersion (1) | 600 |
| | Anionic surfactant (3) | 25 |
| | Nonionic surfactant (1) | 18 |
| | Guanidine picolinate | 2550 |
| | Sodium quinolinate | 350 |
| 3rd layer | Gelatin | 370 |
| | Mordanting agent (1) | 300 |
| | Anionic surfactant (3) | 12 |
| 2nd layer | Gelatin | 700 |
| | Mordanting agent (1) | 290 |
| | Water-soluble polymer (1) | 55 |
| | Water-soluble polymer (2) | 330 |
| | Anionic surfactant (3) | 30 |
| | Anionic surfactant (4) | 7 |
| | Organic solvent having a high boiling point (1) | 700 |
| | Optical brightener (1) | 30 |
| | Stain inhibitor (3) | 32 |
| | Guanidine picolinate | 360 |
| | Potassium quinolinate | 45 |
| 1st layer | Gelatin | 280 |
| | Water-soluble polymer (1) | 12 |
| | Anionic surfactant (1) | 14 |
| | Sodium-borate | 35 |
| | Hardener (1) | 185 |

Substrate (1) Paper substrate laminated with polyethylene (thickness: 215 μm)
The amount applied of latex dispersion is the same as the amount applied of latex solid

TABLE 2

Structure of substrate

| Name of layer | Composition | Film thickness (μm) |
|---|---|---|
| Surface undercoat layer | Gelatin | 0.1 |
| Surface PE layer (glossy) | Low density polyethylene (density: 0.923): 90.2 parts<br>Titanium oxide subjected to surface treatment: 9.8 parts<br>Ultramarine blue: 0.001 parts | 36.0 |
| Pulp layer | High quality paper (LBKP/NBSP = 6/4, density: 1.053) | 152.0 |
| Back surface PE layer (matt) | High density polyethylene (density: 0.955) | 27.0 |
| Back surface undercoat layer | Styrene/acrylate copolymer<br>Colloidal silica<br>Sodium polystyrene sulfonate | 0.1 |
| | | 215.2 |

Anionic surfactant (1)

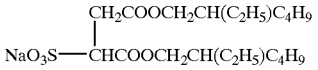

Anionic surfactant (2)

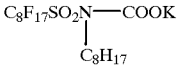

Anionic surfactant (3)

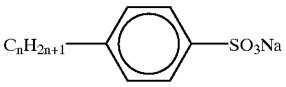

$n = 12.6$

Anionic surfactant (4)

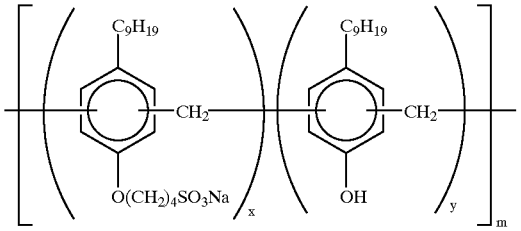

$m \approx 6.8$

Nonionic surfactant (1)

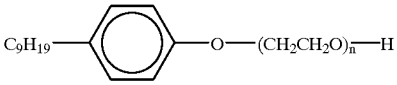

$n = 8.5$

Ampholytic surfactant (1)

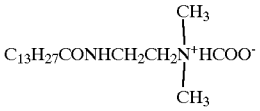

Brightening agent (1)

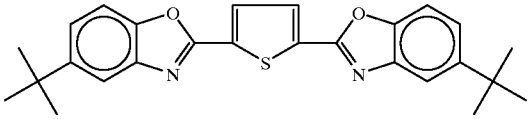

Mordanting agent (1)

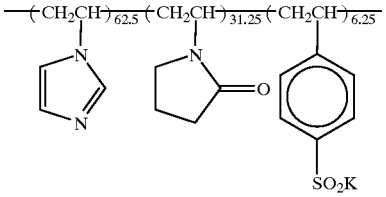

Stain inhibitor (1)

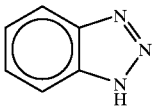

Stain inhibitor (2)

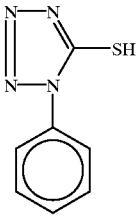

-continued

Stain inhibitor (3)

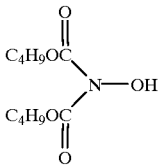

Organic solvent having a high boiling point (1)

$C_{26}H_{46.9}Cl_{7.1}$ (En-para 40 [manufactured by Ajinomono Co., Inc.])

Water-soluble polymer (1)

SUMIKAGEL L5-H (manufactured bySumitomoChemical Co., Ltd.)

Water-soluble polymer (2)

DEXTRAN (molecular weight: 70000)

Water-soluble polymer (3)

κ-carageenan (manufactured by Taito Corp.)

Water-soluble polymer (4)

MP polymer MP-102 (manufactured by Kuraray Co., Ltd.)

Water-soluble polymer (5)

Acryl-modified copolymer of polyvinyl alcohol (degree of modification: 17%)

Latex dispersion (1)

LX-438 (manufactured by Nippon Xeon Co., Ltd.)

Matting agent (1)

SYLOID79 (manufactured by Fuji Devison Chemical Co., Ltd.)

Matting agent (2)

PMMA particle (average particle size 4 μm)

Hardener (1)

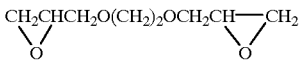

Among these compounds, an oil-soluble compound was dissolved in the organic solvent having a high boiling point (1) and emulsified and dispersed before being added to the composition, and a water-soluble compound or latex was directly added to the composition. Next, a method for producing a photosensitive element is described.

First, a method for producing a photosensitive silver halide emulsion is described.

Photosensitive silver halide emulsion (1) [for red sensitive emulsion layer]

A solution (I) having the composition shown in Table 4 was added to an aqueous solution having the composition shown in Table 3 at a constant flow rate with sufficient stirring over a period of 9 minutes, and a solution (II) was added at a constant flow rate 10 seconds before the addition of the solution (I) over a period of 9 minutes and 10 seconds. 36 minutes after the addition, a solution (III) having the composition shown in Table 4 was added at a constant flow rate over a period of 24 minutes, and a solution (IV) was added at a constant flow rate simultaneously with the solution (III) over a period of 25 minutes.

The mixture was washed with water and desalted (conducted at a pH of 4.0 using a flocculating agent a) by ordinary methods, then 880 g of lime-processed ossein gelatin was added to control pH to 6.0 before the addition of 12.8 g of ribonucleic acid dissociated compound and 32 mg of trimethylthiourea, and the mixture was chemically sensitized for 71 minutes at 60° C., then, 2.6 g of 4-hydroxy-6-methyl-1,3,3a,7-tetrazaindene, 3.2 g of a dye (a), 5.1 g of KBr and 2.6 g of a stabilizer described below were added one by one, and the resulting mixture was cooled. In this manner, 28.1 kg of monodispersed cubic silver chloride bromide emulsion having an average particle size of 0.35 μm was obtained.

TABLE 3

| Composition | |
|---|---|
| $H_2O$ | 26300 cc |
| Lime-processed gelatin | 800 g |
| kBr | 12 g |
| NaCl | 80 g |
| Compound (a) | 1.2 g |
| Temperature | 53° C. |

TABLE 4

| | (I) solution | (II) solution | (III) solution | (IV) solution |
|---|---|---|---|---|
| $AgNO_3$ | 1200 g | None | 2800 g | None |
| KBr | None | 546 g | None | 1766 g |
| NaCl | None | 144 g | None | 96 g |
| $K_2IrCl_6$ | None | 3.6 mg | None | None |
| Total amount | Water is added up to 6.5 liter | Water is added up to 6.5 liter | Water is added up to 10 liter | Water is added up to 10 liter |

Compound (a)

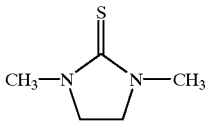

Compound (b)

TABLE 4-continued

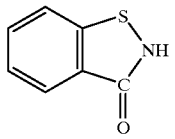

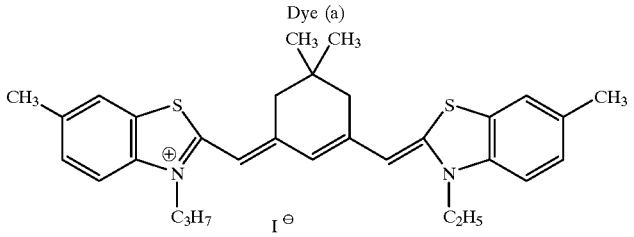

Photosensitive silver halide emulsion (2) [for green sensitive emulsion layer]

Solutions (I) and (II) each having the composition shown in Table 6 were simultaneously added to an aqueous solution having the composition shown in Table 5 at a constant flow rate with sufficient stirring over a period of 9 minutes. 5 minutes after the addition, solutions (III) and (IV) each having the composition shown in Table 6 were simultaneously added at a constant flow rate over a period of 32 minutes. After completion of the addition of the solutions (III) and (IV), 60 ml of a methanol solution of dyes (containing 360 mg of a dye (b1) and 73.4 mg of a dye (b2)) was added at one time.

The mixture was washed with water and desalted (conducted at a pH of 4.0 using a flocculating agent a) by ordinary methods, then 22 g of lime-processed ossein gelatin was added to control pH to 6.0 and pAg to 7.6 before addition of 1.8 mg of sodium thiosulfate and 180 mg of 4-hydroxy-6-methyl-1,3,3a,7 -tetrazaindene and the mixture was chemically sensitized at 60° C. then 90 mg of an anti-fogging agent (1) were added, and the resulting mixture was cooled. In this manner, 635 g of monodispersed cubic silver chloride bromide emulsion having an average particle size of 0.30 $\mu$m was obtained.

TABLE 5

| Composition | |
|---|---|
| $H_2O$ | 600 cc |
| Lime-processed gelatin | 29 g |
| kBr | 0.3 g |
| NaCl | 2 g |
| Compound (a) | 0.03 g |
| Sulfuric acid (1N) | 16 cc |
| Temperature | 46° C. |

TABLE 6

| | (I) solution | (II) solution | (III) solution | (IV) solution |
|---|---|---|---|---|
| $AgNO_3$ | 10.0 g | None | 90.0 g | None |
| KBr | None | 3.50 g | None | 57.1 g |
| NaCl | None | 1.72 g | None | 3.13 g |
| $K_2IrCl_6$ | None | None | None | 0.03 mg |
| Total amount | Water is added up to 126 ml | Water is added up to 131 ml | Water is added up to 280 ml | Water is added up to 289 ml |

Dye (b1)

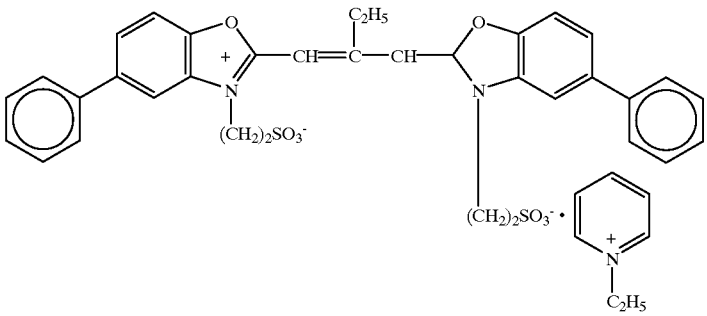

Dye (b2)

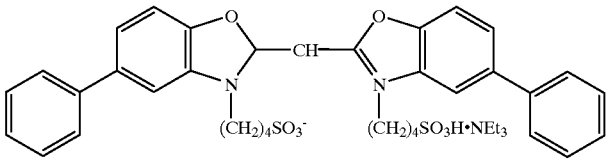

Flocculating agent (a)

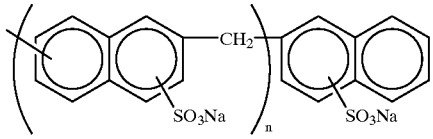

Anti-fogging agent (1)

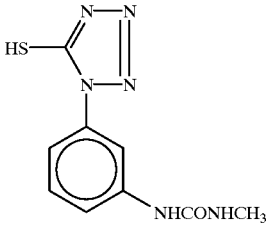

Compound (c)

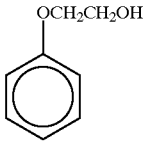

Photosensitive silver halide emulsion (3) [for blue sensitive emulsion layer]

Solutions (I) and (II) each having the composition shown in Table 8 were added to an aqueous solution having a composition as shown in Table 7, in a manner that the solution (II) was added first, and 10 seconds after, the solution (I) was added respectively over a period of 30 minutes with sufficient stirring. 2 minutes after completion of the addition of the (I) solution, a solution (V) was added, and 5 minutes after completion of the addition of the solution (-II), a solution (IV) was added over a period of 28 minutes, and 10 seconds after, a solution (III) was added over a period of 27 minutes and 50 seconds.

The mixture was washed with water and desalted (conducted at a pH of 3.9 using a flocculating agent b) by ordinary methods, then 1230 g of lime-processed ossein gelatin and 2.8 mg of a compound (b) were added to control pH to 6.1 and pAg to 8.4, before addition of 24.9 mg of sodium thiosulfate, and the mixture was chemically sensitized at 60° C., then, 13.1 g of a dye (c) and 118 ml of a compound (c) were added successively, and the resulting mixture was cooled. The halide particles in the resulted emulsion were potato-like particles, and had an average particle size of 0.53 μm, with a yield of 30700 g.

TABLE 7

| Composition | |
|---|---|
| $H_2O$ | 29200 cc |
| Lime-processed gelatin | 1582 g |
| kBr | 127 g |
| Compound (a) | 0.66 g |
| Temperature | 72° C. |

TABLE 8

| | (I) solution | (II) solution | (III) solution | (IV) solution | (V) solution |
|---|---|---|---|---|---|
| $AgNO_3$ | 939 g | None | 3461 g | None | None |
| KBr | None | 572 g | None | 2464 g | None |
| KI | None | None | None | None | 22 g |
| Total amount | Water is added up to 6690 ml | Water is added up to 6680 ml | Water is added up to 9700 ml | Water is added up to 9740 ml | Water is added up to 4400 ml |

Flocculating agent (b)

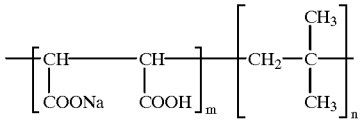

$m:n = 1:1$

Dye (c)

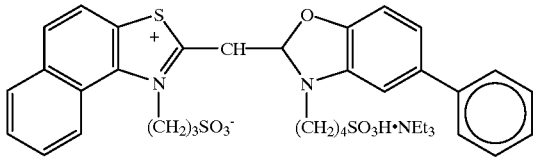

Next, a method for preparing a gelatin dispersion of a hydophobic additive is described.

Gelatin dispersions of yellow coupler (9), magenta coupler (10), cyan coupler (11) and developing agent were prepared respectively according to formulations shown in Table 9. Namely, oil phase components were heated at about 70° C. to be dissolved to form a uniform solution, to this solution were added aqueous phase components heated to about 60° C., and the solution was stirred and mixed, then was dispersed at 10000 rpm by a homogenizer for 10 minutes. To this was added water, and the solution was stirred to give a uniform dispersion.

TABLE 9

| | Dispersion composition | | |
|---|---|---|---|
| | Yellow | Magenta | Cyan |
| Oil phase | | | |
| Cyan dye forming coupler (16) | None | None | 7.0 g |
| Magenta dye forming coupler (10) | None | 7.0 g | None |
| Yellow dye forming coupler (9) | 7.0 g | None | None |
| Developing agent (10) | None | None | 5.6 g |
| Developing agent (20) | None | 5.6 g | None |
| Developing agent (22) | 5.6 g | None | None |
| Anti-fogging agent (5) | 0.25 g | None | None |
| Anti-fogging agent (2) | None | 0.25 g | 0.25 g |
| Solvent having a high boiling point (4) | 7.4 g | 7.4 g | 7.4 g |
| Ethyl acetate | 15 cc | 15 cc | 15 cc |
| Water phase | | | |
| Lime-processed gelatin | 10.0 g | 10.0 g | 10.0 g |
| Calcium nitrate | 0.1 g | 0.1 g | 0.1 g |
| Surfactant (1) | 0.7 g | 0.7 g | 0.7 g |
| Water | 110 cc | 110 cc | 110 cc |
| Water addition | 110 cc | 110 cc | 110 cc |
| Preservative (1) | 0.04 g | 0.04 g | 0.04 g |

Anti-fogging agent (5)

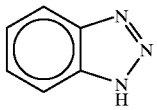

Anti-fogging agent (2)

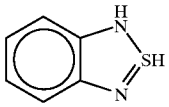

Organic solvent having a high boiling point (4)

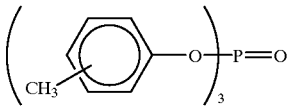

Preservative (1)

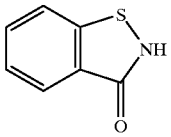

Surfactant (1)

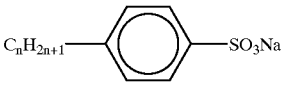

$n \neq 12.6$

A gelatin dispersion of an anti-fogging agent (4) was prepared according to the formulation shown in Table 10. Namely, oil phase components were heated at about 60° C. to be dissolved, to this solution were added aqueous phase components heated to about 60° C., and the solution was stirred and mixed, then was dispersed at 10000 rpm by a homogenizer for 10 minutes to give a uniform dispersion.

TABLE 10

| | Dispersion composition |
|---|---|
| Oil phase | |
| Anti-fogging agent (4) | 0.16 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Water phase | |
| Acid-processed gelatin | 10.0 g |
| Preservative (1) | 0.004 g |

TABLE 10-continued

| | Dispersion composition |
|---|---|
| Calcium nitrate | 0.1 g |
| Water | 35.0 ml |
| Water addition | 104.4 ml |

Anti-fogging agent (4)

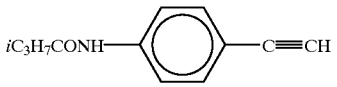

Surfactant (4)

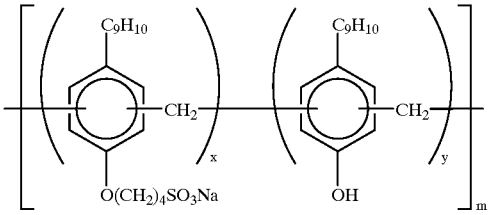

$x:y = 4:6$
$m \approx 6.8$

Organic solvent having a high boiling point (2)

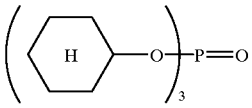

-continued

Organic solvent having a high boiling point (5)
(En-para 40 [manufactured by Ajinomono Co., Inc.])

$C_{26}H_{48.9}Cl_{7.1}$

A dispersion of a polymer latex (a) was prepared according to the formulation shown in Table 11. Namely, to a mixture of a polymer latex (a), surfactant (5) and water in amounts shown in Table 1 was added an anionic surfactant (6) over a period of 10 minutes while stirring to give a uniform dispersion. Further, the resulting dispersion was repeatedly diluted with water and concentrated using a ultrafiltration module (ultrafiltration module manufactured by Asahi Chemical Industry Co., Ltd.: ACV-3050) to decrease salt concentration in the dispersion to one-ninth.

TABLE 11

| | Dispersion composition |
|---|---|
| Polymer latex (a) aqueous solution (solid content: 13%) | 108 ml |
| Surfactant (5) | 20 g |
| Anionic surfactant (6) | 600 ml |
| Water | 1232 ml |

Polymer latex (a)

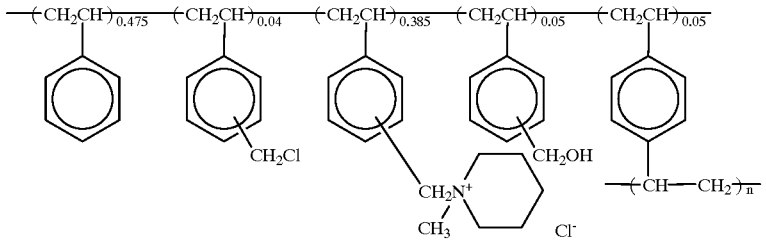

Surfactant (5)

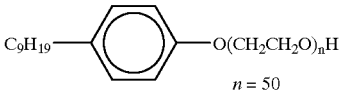

$n = 50$

Anionic surfactant (6)

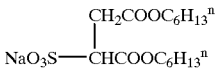

Preservative (2)

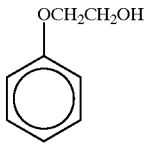

A gelatin dispersion of zinc hydroxide was prepared according to a formulation shown in Table 12. Namely, components were mixed and dissolved, and then dispersed for 30 minutes using glass beads having an average particle size of 0.75 mm by a mill. Further, the glass beads were separated and removed, to give a uniform dispersion.

TABLE 12

| | Dispersion composition |
|---|---|
| Zinc hydroxide | 15.9 g |
| Carboxymethylcellulose | 0.7 g |
| Sodium polyacrylate | 0.07 g |
| Lime-processed gelatin | 4.2 g |
| Water | 100 ml |
| Preservative (2) | 0.4 g |

Then, a gelatin dispersion of a reducing agent (1) was prepared according to the formulation shown in Table 13. Namely, oil phase components were heated at 60° C. to be issolved, to this solution were added aqueous phase components heated to about 60° C., and the solution was stirred and mixed, then was dispersed at 10000 rpm by a homogenizer for 10 minutes to give a uniform dispersion. Further, ethyl acetate was removed from the resulted dispersion using a vacuum organic solvent removing apparatus.

TABLE 13

| | Dispersion composition |
|---|---|
| Oil phase | |
| Reducing agent (1) | 7.5 g |
| Solvent having a high boiling point (6) | 4.7 g |
| Surfactant (1) | 1.9 g |
| Ethyl acetate | 14.4 ml |
| Water phase | |
| Acid-processed gelatin | 10.0 g |
| Preservative (1) | 0.02 g |
| Preservative (2) | 0.04 g |
| Sodium hydrogen sulfite | 0.1 g |
| Water | 136.7 ml |

Reducing agent (1)

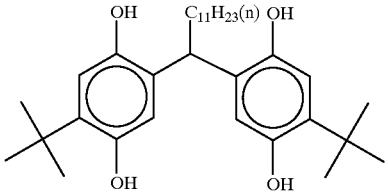

Organic solvent having a high boiling point (6)

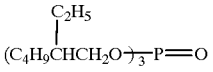

Next, a method for preparing a gelatin dispersion of a matting agent added to a protective layer is described. A solution obtained by dissolving PMMA in methylene chloride was added to gelatin together with a small amount of a surfactant, and the mixture was stirred at high speed to be dispersed. Then, methylene chloride was removed by using a vacuum solvent removing apparatus to give a uniform dispersion having an average particle sized of 4.3 $\mu$m.

The above-described products were used to produce photosensitive elements 101 shown in Tables 14 and 15.

TABLE 14

Composition of main materials of lightsensitive element 101

| NO of layer | Name of layer | Additive | Amount added (mg/m$^2$) |
|---|---|---|---|
| 7th layer | Protective layer | Acid-processed gelatin | 387 |
| | | Matting agent (PMMA resin) | 17 |
| | | Surfactant (2) | 6 |
| | | Surfactant (3) | 20 |
| | | Polymer latex (a) Dispersion | 10 |
| | | Reducing agent (1) | 47 |
| 6th layer | Intermediate layer | Lime-processed gelatin | 862 |
| | | Anti-fogging agent (4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 5 |
| | | Zinc hydroxide | 558 |
| | | Calcium nitrate | 6 |
| 5th layer | Blue lightsensitive layer | Lime-processed gelatin | 587 |
| | | Lightsensitive silver halide emulsion (3) | 399 |
| | | Yellow dye forming coupler (9) | 410 |
| | | Developing agent (22) | 328 |
| | | Anti-fogging agent (3) | 15 |
| | | Solvent having a high boiling point (4) | 433 |
| | | Surfactant (1) | 12 |
| | | Water-soluble polymer (1) | 40 |
| 4th layer | Intermediate layer | Lime-processed gelatin | 862 |
| | | Anti-fogging agent(4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 4 |
| | | Zinc hydroxide | 341 |
| | | Calcium nitrate | 8 |

TABLE 15

Composition of main materials of lightsensitive element 101 (cont.)

| NO of layer | Name of layer | Additive | Amount added (mg/m$^2$) |
|---|---|---|---|
| 3rd layer | Green lightsensitive layer | Lime-processed gelatin | 452 |
| | | Lightsensitive silver halide emulsion (2) | 234 |
| | | Magenta dye forming coupler (10) | 420 |
| | | Developing agent (20) | 336 |
| | | Anti-fogging agent (2) | 15 |
| | | Solvent having a high boiling point (4) | 444 |
| | | Surfactant (1) | 12 |
| | | Water-soluble polymer (1) | 10 |
| 2nd layer | Intermediate layer | Lime-processed gelatin | 862 |
| | | Anti-fogging agent (4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 10 |
| | | Calcium nitrate | 6 |

TABLE 15-continued

Composition of main materials of lightsensitive element 101 (cont.)

| NO of layer | Name of layer | Additive | Amount added (mg/m$^2$) |
|---|---|---|---|
| 1st layer | Red lightsensitive layer | Lime-processed gelatin | 373 |
| | | Lightsensitive silver halide emulsion (1) | 160 |
| | | Cyan dye forming coupler (16) | 390 |
| | | Developing agent (10) | 312 |
| | | Anti-fogging agent (2) | 14 |
| | | Solvent having a high boiling point (4) | 412 |
| | | Surfactant (1) | 11 |
| | | Water-soluble polymer (2) | 25 |
| | | Hardener (1) | 45 |
| | | Preservative (3) | 45 |

Substrate (substrate obtained by aluminum vapor deposition on a 20 $\mu$m PET and subsequent coating of gelatin on the surface as an undercoat)

Surfactant (2)

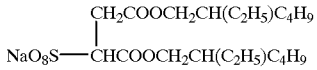

-continued

Surfactant (3)

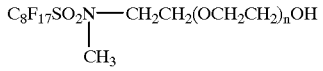

Water-soluble polymer (1)

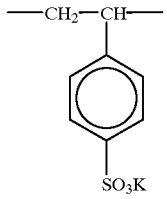

Intrinsic viscosity [η] = 1.6
(0.1N NaCl, 30° C.)
Molecular weight ≈ 1000000

Water-soluble polymer (2)

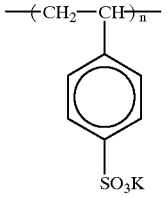

Intrinsic viscosity [η] = 0.8
(0.1N NaCl, 30° C.)
Molecular weight ≈ 400000

Hardener (1)

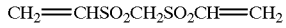

Then, photosensitive materials 102 to 115 shown in Table 16 were produced by adding the compound of the present invention to the 1st, 3rd and 5th layers or the 2nd, 4th and 6th layers, and by changing the coupler and developing agent.

TABLE 16

| Lightsensitive element | Type of coupler | Type of developing agent | Compound of the present invention | | | Remarks |
|---|---|---|---|---|---|---|
| 101 | Y (9) | (22) | | — | | Comparative |
| | M (10) | (20) | | | | |
| | Cy (16) | (10) | | | | |
| 102 | Y (9) | (22) | 1st layer | II-50 | 57 mg/m$^2$ | Present invention |
| | M (10) | (20) | 3rd layer | II-50 | 57 | |
| | Cy (16) | (10) | 5th layer | II-50 | 57 | |
| 103 | Y (9) | (22) | 2nd layer | II-50 | 60 | Present invention |
| | M (10) | (20) | 4th layer | II-50 | 60 | |
| | Cy (16) | (10) | 6th layer | II-50 | 40 | |
| 104 | Y (9) | (22) | 2nd layer | III-22 | 70 | Present invention |
| | M (10) | (20) | 4th layer | | — | |
| | Cy (16) | (10) | 6th layer | | — | |
| 105 | Y (9) | (22) | 1st layer | IV-b-4 | 50 | Present invention |
| | M (10) | (20) | 3rd layer | IV-d-5 | 50 | |
| | Cy (16) | (10) | 5th layer | IV-d-5 | 50 | |
| 106 | Y (9) | (22) | 1st layer | IV-a-4 | 50 | Present invention |
| | M (10) | (20) | 3rd layer | IV-c-1 | 50 | |
| | Cy (16) | (10) | 5th layer | IV-e-1 | 50 | |
| 107 | Y (9) | (22) | 1st layer | IV-a-4 | 50 mg/m$^2$ | Present invention |
| | M (10) | (20) | 3rd layer | IV-f-1 | 50 | |
| | Cy (16) | (10) | 5th layer | IV-g-5 | 50 | |
| 108 | Y (9) | (22) | 1st layer | II-50 | 70 | Present invention |
| | | | | IV-a-4 | 50 | |
| | M (10) | (20) | 3rd layer | II-26 | 50 | |
| | | | | IV-f-1 | 50 | |
| | Cy (16) | (10) | 5th layer | II-50 | 70 | |
| | | | | IV-g-5 | 50 | |
| 109 | Y (5) | (10) | | — | | Comparative |
| | M (14) | (15) | | | | |
| | Cy (24) | (28) | | | | |
| 110 | Y (5) | (10) | 1st layer | II-50 | 57 mg/m$^2$ | Present invention |
| | M (14) | (15) | 3rd layer | II-50 | 57 | |
| | Cy (24) | (28) | 5th layer | II-50 | 57 | |

TABLE 16-continued

| Lightsensitive element | Type of coupler | Type of developing agent | Compound of the present invention | | | Remarks |
|---|---|---|---|---|---|---|
| 111 | Y (10) | (14) | | — | | Comparative |
| | M (28) | (19) | | | | |
| | Cy (28) | (28) | | | | |
| 112 | Y (10) | (14) | 1st layer | II-50 | 57 mg/m$^2$ | Present invention |
| | M (28) | (19) | 3rd layer | II-50 | 57 | |
| | Cy (28) | (28) | 5th layer | II-50 | 57 | |
| 113 | Y (8) | (16) | 1st layer | II-64 | 50 mg/m$^2$ | Present invention |
| | M (15) | (26) | 3rd layer | II-64 | 50 | |
| | Cy (17) | (6) | 5th layer | II-64 | 50 | |
| 114 | Y (8) | (16) | 1st layer | II-63 | 50 mg/m$^2$ | Present invention |
| | M (15) | (26) | 3rd layer | II-63 | 50 | |
| | Cy (17) | (6) | 5th layer | II-63 | 50 | |
| 115 | Y (8) | (16) | 1st layer | II-66 | 50 mg/m$^2$ | Present invention |
| | M (15) | (26) | 3rd layer | II-66 | 50 | |
| | Cy (17) | (6) | 5th layer | II-66 | 50 | |

Then, image output was conducted using photosensitive elements 101 to 115 and image receiving element $R^{101}$ in heating conditions of 80° C. for 30 seconds or 75° C. for 30 seconds using a PICTOSTAT 330 manufactured by Fuji Photo Film Co., Ltd. The resulting image was a clear color image. {Maximum density and minimum density were measured by a reflection density meter X-lite 304 manufactured by X-lite Corp.}

The discrimination of the resulting image was evaluated by d-value=(Minimum density/Maximum density) (when d value is low, discrimination is excellent).

The results are shown in Table 17. It is understood that the photosensitive element of the present invention is not easily affected by differences in processing conditions, and can provide an image having an excellent discrimination even under low temperature developing conditions.

Each photosensitive element was left for 5 days under 60° C. −60%RH, then image formation was conducted under conditions of 80° C. for 30 seconds as described above, and preservability of the photosensitive element was evaluated. The photosensitive element of the present invention provided a clear color image even after preservation.

TABLE 17

| Lightsensitive element | d value (80 to 30 seconds) | d value (75 to 30 seconds) |
|---|---|---|
| 101 | Y 0.30 | Y 0.38 |
| | M 0.20 | M 0.30 |
| | Cy 0.18 | Cy 0.29 |
| 102 | Y 0.25 | Y 0.27 |
| | M 0.15 | M 0.16 |
| | Cy 0.14 | Cy 0.17 |
| 103 | Y 0.24 | Y 0.28 |
| | M 0.16 | M 0.16 |
| | Cy 0.15 | Cy 0.18 |
| 104 | Y 0.24 | Y 0.27 |
| | M 0.16 | M 0.17 |
| | Cy 0.15 | Cy 0.19 |
| 105 | Y 0.25 | Y 0.28 |
| | M 0.15 | M 0.18 |
| | Cy 0.16 | Cy 0.19 |
| 106 | Y 0.24 | Y 0.27 |
| | M 0.16 | M 0.17 |
| | Cy 0.15 | Cy 0.19 |
| 107 | Y 0.25 | Y 0.28 |
| | M 0.15 | M 0.16 |
| | Cy 0.16 | Cy 0.18 |
| 108 | Y 0.24 | Y 0.26 |
| | M 0.14 | M 0.15 |
| | Cy 0.14 | Cy 0.17 |

TABLE 17-continued

| Lightsensitive element | d value (80 to 30 seconds) | d value (75 to 30 seconds) |
|---|---|---|
| 109 | Y 0.33 | Y 0.39 |
| | M 0.22 | M 0.33 |
| | Cy 0.19 | Cy 0.31 |
| 110 | Y 0.25 | Y 0.28 |
| | M 0.15 | M 0.18 |
| | Cy 0.16 | Cy 0.19 |
| 111 | Y 0.30 | Y 0.38 |
| | M 0.23 | M 0.31 |
| | Cy 0.19 | Cy 0.22 |
| 112 | Y 0.24 | Y 0.29 |
| | M 0.19 | M 0.20 |
| | Cy 0.17 | Cy 0.19 |
| 113 | Y 0.21 | Y 0.22 |
| | M 0.11 | M 1.14 |
| | Cy 0.10 | Cy 0.14 |
| 114 | Y 0.21 | Y 0.23 |
| | M 0.13 | M 1.13 |
| | Cy 0.11 | Cy 0.13 |
| 115 | Y 0.21 | Y 0.22 |
| | M 0.12 | M 1.14 |
| | Cy 0.11 | Cy 0.13 |

Example 2

Image receiving elements were produced in the same manner as in Example 1.

Next, a method for producing a photosensitive element is described.

Firstly, a method for producing a photosensitive silver halide emulsion is described.

Photosensitive silver halide emulsion (1) [emulsion for 5th layer (680 nm photosensitive layer)]

Solutions (I) and (II) each having the composition shown in Table 19 were simultaneously added to an aqueous solution having the composition shown in Table 18 with sufficient stirring over a period of 13 minutes, and 10 minutes after, solutions (III) and (IV) each having the composition shown in Table 19 were added over a period of 33 minutes.

TABLE 18

| Composition | |
|---|---|
| $H_2O$ | 620 cc |
| Lime-processed gelatin | 20 g |
| kBr | 0.3 g |
| NaCl | 2 g |
| Solvent for silver halide (1) | 0.03 g |
| Sulfuric acid (1 N) | 16 cc |
| Temperature | 45° C. |

TABLE 19

| | (I) solution | (II) solution | (III) solution | (IV) solution |
|---|---|---|---|---|
| $AgNO_3$ | 30.0 g | None | 70.0 g | None |
| KBr | None | 13.7g | None | 44.2 g |
| NaCl | None | 3.62 g | None | 2.4 g |
| $K_2IrCl_6$ | None | None | None | 0.039 mg |
| Total amount | Water is added up to 126 ml | Water is added up to 132 ml | Water is added up to 254 ml | Water is added up to 252 ml |

Solvent for silver halide (1)

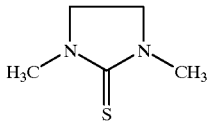

13 minutes after initiation of the addition of the solution (III), 150 cc of an aqueous solution containing 0.350% of a sensitizing dye (1) was added over 27 minutes.

The mixture was washed with water and desalted (conducted at a pH of 4.1 using a flocculating agent a) by ordinary methods, then 22 g of lime-processed ossein gelatin was added to control pH to 6.0 and pAg to 7.9, and the mixture was chemically sensitized at 60° C. The compound used in the chemical sensitization is shown in Table 20.

The resulted emulsion (630 g) was a monodispersed cubic silver chloride bromide emulsion having a variation coefficient of 10.2% and an average particle size of 0.20 $\mu$m.

Sensitizing dye (1)

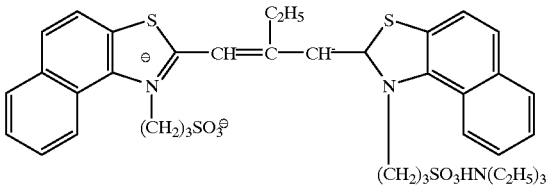

TABLE 20

| Drug used in chemical sensitization | Amount added |
|---|---|
| 4-hydroxy-6-methyl-1,3,3a,7-tetrazaindene | 0.36 g |
| Sodium thiosulfate | 6.75 mg |
| Anti-fogging agent (1) | 0.11 g |
| Preservative (1) | 0.07 g |
| Preservative (2) | 3.31 g |

Flocculating agent a

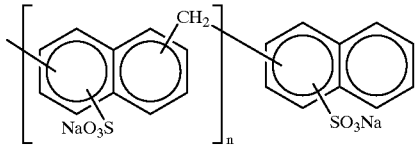

Flocculating agent b

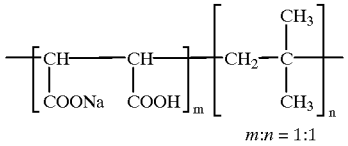

$m:n = 1:1$

Anti-fogging agent (1)

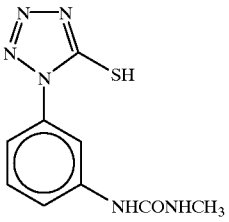

Preservative (1)

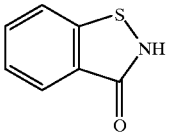

Preservative (2)

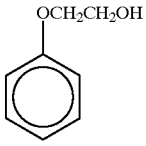

Photosensitive silver halide emulsion (2) [emulsion for 3rd layer (750 nm Photosensitive layer)]

Solutions (I) and (II) each having the composition shown in Table 22 were simultaneously added to an aqueous solution having a composition shown in Table 21 with sufficient stirring over a period of 18 minutes. 10 minute after the addition solutions (III) and (IV) each having the composition shown in Table 22 were added over a period of 24 minutes.

TABLE 21

| Composition | |
|---|---|
| $H_2O$ | 620 cc |
| Lime-processed gelatin | 20 g |
| KBr | 0.3 g |
| NaCl | 2 g |
| Solvent for silver halide (1) | 0.03 g |
| Sulfuric acid (1N) | 16 cc |
| Temperature | 45° C. |

TABLE 22

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.2 g |
| NaCl | None | 3.62 g | None | 2.4 g |
| $K_4[Fe(CN)_6].H_2O$ | None | None | None | 0.07 g |
| $K_2IrCl_6$ | None | None | None | 0.04 mg |
| Total amount | Water is added up to 188 ml | Water is added up to 188 ml | Water is added up to 250 ml | Water is added up to 250 ml |

The mixture was washed with water and desalted (conducted at a pH of 3.9 using a flocculating agent b) by ordinary methods, then 22 g of lime-processed ossein gelatin which had been subjected to de-calcium processing (calcium content: 150 PPM or less) was added, and the mixture was dispersed at 40° C., and 0.39 g of 4-hydroxy-6-methyl-1,3,3a,7-tetrazaindene was added to control pH to 5.9 and pAg to 7.8. Then, the mixture was chemically sensitized at 70° C. using the chemicals shown in Table 23. Further, at the end of the chemical sensitization, sensitizing dye (2) was added in the form of a methanol solution (the solution having the composition shown in Table 24). Further, after chemical sensitization, the solution was cooled down to 40° C., to this was added 200 g of a gelatin dispersion of a stabilizer (1) described later, and they were sufficiently stirred before being stored. The resulting emulsion was a monodispersion cubic silver chloride iodide having a variation coefficient of 12.6% and an average particle size of 0.25 μm, and the yield was 938 g. The emulsion for 750 nm photosensitive layer had J-band type spectral sensitivity.

TABLE 23

| Compound used in chemical sensitization | Amount added |
|---|---|
| 4-hydroxy-6-methyl-1,3,3a,7-tetrazaindene | 0.39 g |
| Triethyl thiourea | 3.3 mg |
| Nucleic acid decomposed material | 0.39 g |
| NaCl | 0.15 g |
| Kl | 0.12 g |
| Anti-fogging agent (2) | 0.10 g |
| Preservative (1) | 0.07 g |

TABLE 24

| Composition of dye solution | Amount added |
|---|---|
| Sensitizing dye (2) | 0.19 g |
| Methanol | 18.7 cc |

Stabilizer (1)

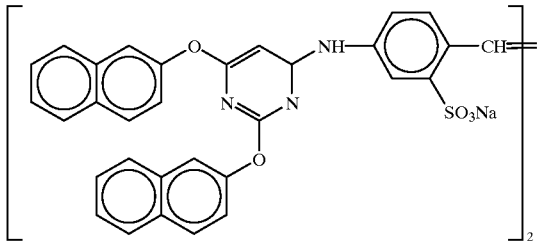

-continued

Anti-fogging agent (2)

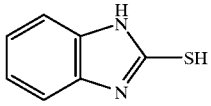

Sensitizing dye (2)

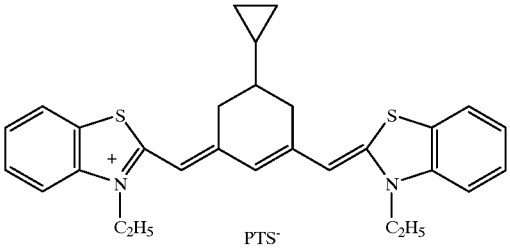

PTS = p-toluenesulfonic acid

Photosensitive silver halide emulsion (3) [emulsion for 1st layer (810 nm photosensitive layer)]

Solutions (I) and (II) each having the composition shown in Table 26 were added to an aqueous solution having the composition shown in Table 25 over a period of 18 minutes with sufficient stirring, and 10 minutes later, solutions (III) and (IV) each having the composition shown in Table 26 were added over a period of 24 minutes.

TABLE 25

| Composition | |
|---|---|
| $H_2O$ | 620 cc |
| Lime-processed gelatin | 20 g |
| KBr | 0.3 g |
| NaCl | 2 g |
| Solvent for silver halide (1) | 0.03 g |
| Sulfuric acid (1N) | 16 cc |
| Temperature | 50° C. |

TABLE 26

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.1 g |
| NaCl | None | 3.62 g | None | 2.4 g |
| $K_2IrCl_6$ | None | None | None | 0.02 mg |
| Total amount | Water is added up to 180 ml | Water is added up to 181 ml | Water is added up to 242 ml | Water is added up to 250 ml |

The mixture was washed with water and desalted (conducted at a pH of 3.8 using a flocculating agent a) by ordinary methods, then 22 g of lime-processed ossein gelatin was added to control pH to 7.4 and pAg to 7.8 before chemical sensitization at 60° C. The compounds used in the chemical sensitization are shown in Table 27. The resulting emulsion was a monodispersion cubic silver chloride bromide emulsion having a variation coefficient of 9.7% and an average particle size of 0.32 μm, and the yield was 680 g.

TABLE 27

| Compound used in chemical sensitization | Amount added |
|---|---|
| 4-hydroxy-6-methyl-1,3,3a,7-tetrazaindene | 0.38 g |
| Triethyl thiourea | 3.1 mg |

TABLE 27-continued

| Compound used in chemical sensitization | Amount added |
|---|---|
| Anti-fogging agent (2) | 0.19 g |
| Preservative (1) | 0.07 g |
| Preservative (2) | 3.13 g |

Next, a method for preparing a gelatin dispersion of colloid silver is described.

A solution having the composition shown in Table 29 was added to an aqueous solution having the composition shown in Table 28 over a period of 24 minutes with sufficient stirring. Next, the mixture was washed with water using a flocculating agent a, then 43 g of lime-processed ossein gelatin was added to control pH to 6.3. The resulting product had an average particle size of 0.02 $\mu$m, and the yield was 512 g (dispersion containing 2% of silver and 6.8% of gelatin).

TABLE 28

| Composition | |
|---|---|
| $H_2O$ | 620 cc |
| Dextrin | 16 g |
| NaOH (5N) | 41 cc |
| Temperature | 30° C. |

TABLE 29

| composition | |
|---|---|
| $H_2O$ | 135 cc |
| $AgNO_3$ | 17 g |

Next, a method for preparing a gelatin dispersion of a hydrophobic additive is described.

Gelatin dispersions of a yellow dye-forming coupler (9), a magenta dye-forming coupler (10), a cyan coupler dye-forming (16), and a developing agent were prepared respectively according to the formulations shown in Table 30. Namely, oil phase components were heated to about 70° C. to be dissolved to form a uniform solution, to this solution were added aqueous phase components heated to about 60° C., and the solution was stirred and mixed. It was then dispersed at 10000 rpm by a homogenizer for 10 minutes. To this was added water, and the solution was stirred to give a uniform dispersion.

TABLE 30

| | Dispersion composition | | |
|---|---|---|---|
| | Yellow | Magenta | Cyan |
| Oil phase | | | |
| Cyan dye forming coupler (16) | None | None | 7.0 g |
| Magenta dye forming coupler (10) | None | 7.0 g | None |
| Yellow dye forming coupler (9) | 7.0 g | None | None |
| Developing agent (10) | None | None | 5.6 g |
| Developing agent (20) | None | 5.6 g | None |
| Developing agent (22) | 5.6 g | None | None |
| Anti-fogging agent (5) | 0.25 g | None | None |
| Anti-fogging agent (2) | None | 0.25 g | 0.25 g |
| Solvent having a high boiling point (4) | 7.4 g | 7.4 g | 7.4 g |

TABLE 30-continued

| | Dispersion composition | | |
|---|---|---|---|
| | Yellow | Magenta | Cyan |
| Dye (a) | 1.1 g | None | 0.5 g |
| Ethyl acetate | 15 cc | 15 cc | 15 cc |
| Water phase | | | |
| Lime-processed gelatin | 10.0 g | 10.0 g | 10.0 g |
| Calcium nitrate | 0.1 g | 0.1 g | 0.1 g |
| Surfactant (1) | 0.2 g | 0.2 g | 0.2 g |
| Water | 110 cc | 110 cc | 110 cc |
| Water addition | 110 cc | 110 cc | 110 cc |
| Preservative (1) | 0.04 g | 0.04 g | 0.04 g |

A gelatin dispersion of an anti-fogging agent (4) was prepared according to the formulation shown in Table 31. Namely, oil phase components were heated to about 60° C. to be dissolved, to this solution were added aqueous phase components heated to about 60° C., and the solution was stirred and mixed, then was dispersed at 10000 rpm by a homogenizer for 10 minutes to give a uniform dispersion.

TABLE 31

| | Dispersion composition |
|---|---|
| Oil phase | |
| Anti-fogging agent (4) | 0.16 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Water phase | |
| Acid-processed gelatin | 10.0 g |
| Preservative (1) | 0.004 g |
| Calcium nitrate | 0.1 g |
| Water | 35.0 ml |
| Water addition | 104.4 ml |

A gelatin dispersion of a reducing agent (1) was prepared according to the formulation shown in Table 32. Namely, oil phase components were heated to about 60° C. to be dissolved, to this solution were added aqueous phase components heated to about 60° C., and the solution was stirred and mixed, then was dispersed at 10000 rpm by a homogenizer for 10 minutes to give a uniform dispersion. Further, ethyl acetate was removed from the resulting dispersion using a vacuum organic solvent removing apparatus.

TABLE 32

| | Dispersion composition |
|---|---|
| Oil phase | |
| Reducing agent (1) | 7.5 g |
| Solvent having a high boiling point (1) | 4.7 g |
| Surfactant (1) | 1.9 g |
| Ethyl acetate | 14.4 ml |
| Water phase | |
| Acid-processed gelatin | 10.0 g |
| Preservative (1) | 0.02 g |
| Gentamicin | 0.04 g |
| Sodium hydrogen sulfite | 0.1 g |
| Water | 136.7 ml |

A dispersion of a polymer latex (a) was prepared according to a formulation shown in Table 33. Namely, to a mixture of a polymer latex (a) surfactant (5) and water in amounts shown in Table 33 was added an anionic surfactant (6) over a period of 10 minutes with stirring to give a uniform dispersion. Further, the resulting dispersion was repeatedly diluted with water and concentrated using an ultrafiltration module (ultrafiltration module manufactured by Asahi Chemical Industry Co., Ltd.: ACV-3050) to decrease salt concentration in the dispersion to one-ninth.

TABLE 33

| | Dispersion composition |
|---|---|
| Polymer latex (a) aqueous solution (solid content: 13%) | 108 ml |
| Surfactant (5) | 20 g |
| Anionic surfactant (6) | 600 ml |
| Water | 1232 ml |

A gelatin dispersion of a reducing agent (1) was prepared according to the formulation shown in Table 34. Namely, oil phase components were dissolved at room temperature, to this solution were added aqueous phase components heated to about 40° C., and the solution was stirred and mixed, then was dispersed at 10000 rpm by a homogenizer for 10 minutes to give a dispersion. Further, water added and the mixture was stirred to give a uniform dispersion.

TABLE 34

| | Dispersion composition |
|---|---|
| Oil phase | |
| Stabilizing agent (1) | 4.0 g |
| Sodium hydroxide | 0.3 g |
| Methanol | 62.8 g |
| Preservative (2) | 0.8 g |
| Water phase | |
| De-calcium-grocessed gelatin (Ca content: 100 ppm or less) | 10.0 g |
| Preservative (1) | 0.004 g |
| Water | 320 ml |

A gelatin dispersion of zinc hydroxide was prepared according to the formulation shown in Table 35. Namely, components were mixed and dissolved, and then dispersed for 30 minutes using a glass bead having an average particle size of 0.75 mm by a mill. Further, the glass bead was separated and removed, to give a uniform dispersion.

TABLE 35

| | Dispersion composition |
|---|---|
| Zinc hydroxide | 15.9 g |
| Carboxymethylcellulose | 0.7 g |
| Sodium polyacrylate | 0.07 g |
| Lime-processed gelatin | 4.2 g |
| Water | 100 ml |
| Preservative (2) | 0.4 g |

Next, a method for preparing a gelatin dispersion of a matting agent added to a protective layer is described. A solution obtained by dissolving PMMA in methylene chloride was added to gelatin together with a small amount of a surfactant, and the mixture was stirred at high speed to be dispersed. Then, methylene chloride was removed by using a vacuum solvent removing apparatus to give a uniform dispersion having an average particle size of 4.3 μm.

Anti-fogging agent (5)

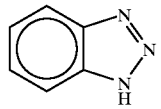

Anti-fogging agent (2)

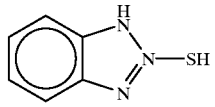

Organic solvent having a high boiling point (4)

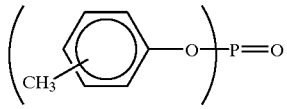

Surfactant (1)

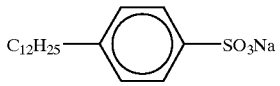

Dye (a)

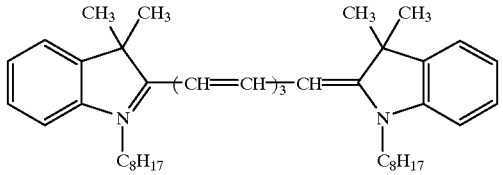

Preservative (1)

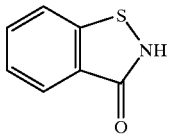

Anti-fogging agent (3)

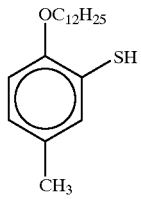

Anti-fogging agent (4)

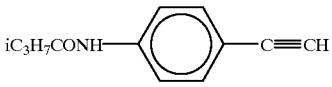

Surfactant (1)

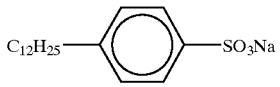

-continued

Development accelerator (1)

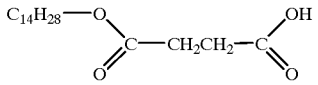

Solvent having a high boiling point (1)

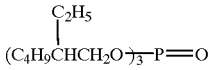

Solvent having a high boiling point (2)

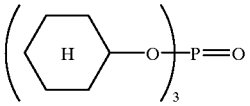

Solvent having a high boiling point (3)

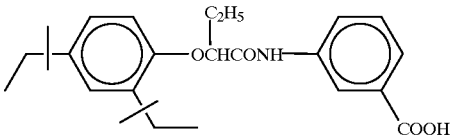

Preservative (3)

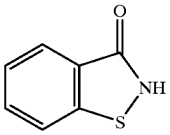

The above-described products were used to produce the photosensitive elements 201 shown in Tables 36 and 37.

TABLE 36

Composition of main materials of lightsensitive element 201

| NO of layer | Name of layer | Additive | Amount added (mg/m$^2$) |
|---|---|---|---|
| 7th layer | Protective layer | Acid-processed gelatin | 442 |
| | | Reducing agent (1) | 47 |
| | | Solvent having a high boiling point (1) | 30 |
| | | Colloid silver particle | 2 |
| | | Matting agent (PMMA resin) | 17 |
| | | Surfactant (1) | 16 |
| | | Surfactant (2) | 9 |
| | | Surfactant (3) | 2 |
| 6th layer | Intermediate layer | Lime-processed gelatin | 862 |
| | | Anti-fogging agent (4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Polymer latex (a) dispersion | 5 |
| | | Water-soluble polymer (1) | 4 |
| | | Calcium nitrate | 6 |
| 5th layer | Red lightsensitive layer | Lime-processed gelatin | 452 |
| | | Lightsensitive silver halide emulsion (1) | 301 |
| | | Magenta dye forming coupler (10) | 420 |
| | | Developing agent (20) | 336 |
| | | Anti-fogging agent (2) | 15 |
| | | Solvent having a high boiling point (2) | 444 |
| | | Surfactant (1) | 12 |
| | | Water-soluble polymer (1) | 10 |
| 4th layer | Intermediate layer | Lime-processed gelatin | 862 |
| | | Anti-fogging agent (4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Polymer latex (a) dispersion | 5 |

TABLE 36-continued

Composition of main materials of lightsensitive element 201

| NO of layer | Name of layer | Additive | Amount added (mg/m$^2$) |
|---|---|---|---|
| | | Water-soluble polymer (1) | 4 |
| | | Calcium nitrate | 6 |

TABLE 37

Composition of main materials of lightsensitive element 201 (cont.)

| NO of layer | Name of layer | Additive | Amount added (mg/m$^2$) |
|---|---|---|---|
| 3rd layer | Second infrared lightsensitive layer | Lime-processed gelatin | 373 |
| | | Lightsensitive silver halide emulsion (2) | 106 |
| | | Cyan dye forming coupler (16) | 390 |
| | | Developing agent (10) | 312 |
| | | Anti-fogging agent (2) | 14 |
| | | Solvent having a high boiling point | 412 |
| | | Surfactant (1) | 11 |
| | | Water-soluble polymer (1) | 11 |
| 2nd layer | Intermediate layer | Lime-processed gelatin | 862 |
| | | Anti-fogging agent (4) | 7 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (2) | 25 |
| | | Zinc hydroxide | 750 |
| | | Calcium nitrate | 6 |
| 1st layer | First infrared lightsensitive layer | Lime-processed gelatin | 587 |
| | | Lightsensitive silver halide emulsion (3) | 311 |
| | | Yellow dye forming coupler (9) | 410 |
| | | Developing agent (22) | 328 |
| | | Anti-fogging agent (2) | 15 |
| | | Solvent having a high boiling point (4) | 433 |
| | | Surfactant (1) | 12 |
| | | Water-soluble polymer (2) | 40 |
| | | Hardener (1) | 45 |

Substrate (substrate obtained by aluminum vapor deposition on a 20 $\mu$m PET and subsequent coating of gelatin on the back surface as an undercoat)

Reducing agent (2)

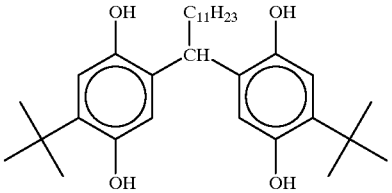

Solvent having a high boiling point (4)

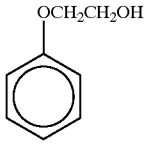

Surfactant (2)

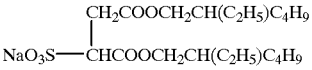

Surfactant (3)

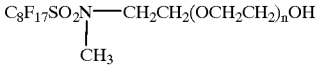

Water-soluble polymer (1)

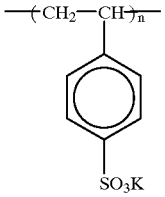

Intrinsic viscosity [η] = 1.6
(0.1N NaCl, 30° C.)
Molecular weight ≈ 1000000

Water-soluble polymer (2)

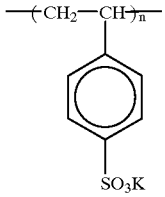

Intrinsic viscosity [η] = 0.8
(0.1N NaCl, 30° C.)
Molecular weight ≈ 4000000

Sensitizing dye (3)

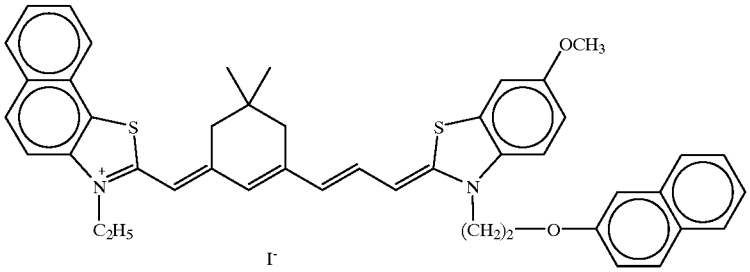

Hardener (1)

$CH_2{=}CHSO_2CH_2SO_2CH{=}CH_2$

Surfactant (4)

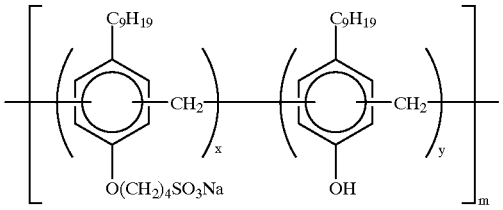

x:y = 4:6
m ≈ 6.8

Organic solvent having a high boiling point (5)

$C_{26}H_{48.9}Cl_{7.1}$ (En-para 40 [manufactured by Ajinomono Co., Inc.])

Polymer latex (a)

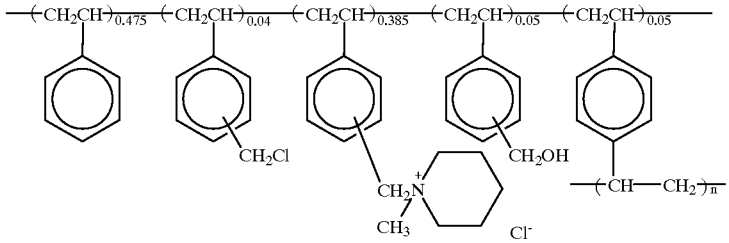

Surfactant (5)

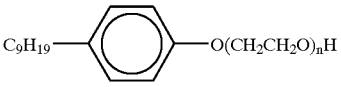

n = 50

Anionic surfactant (6)

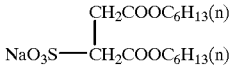

Next, photosensitive elements 202 to 212 were prepared in the same manner as for the photosensitive element 201 except that the developing agents were changed to developing agents of yellow, magenta and cyan and the compounds of the present invention as shown in Table 38.

TABLE 38

| Lightsensitive element | Type of coupler | Type of developing agent | Compound of the present invention | | | Remarks |
|---|---|---|---|---|---|---|
| 201 | Y (9) | (22) | | — | | Comparative |
| | M (10) | (20) | | | | |
| | Cy (16) | (10) | | | | |
| 202 | Y (9) | (22) | 1st layer | II-50 | 45 mg/m$^2$ | Present invention |
| | M (10) | (20) | 3rd layer | II-50 | 50 | |
| | Cy (16) | (10) | 5th layer | II-50 | 47 | |
| 203 | Y (9) | (22) | 2nd layer | II-50 | 50 | Present invention |
| | M (10) | (20)0 | 4th layer | II-50 | 60 | |
| | Cy (16) | (10) | 6th layer | II-50 | 40 | |
| 204 | Y (9) | (22) | 2nd layer | III-22 | 15 | Present invention |
| | M (10) | (20) | 4th layer | | — | |
| | Cy (16) | (10) | 6th layer | | — | |
| 205 | Y (9) | (22) | 1st layer | IV-b-4 | 50 | Present invention |
| | M (10) | (20) | 3rd layer | IV-d-5 | 45 | |
| | Cy (16) | (10) | 5th layer | IV-d-5 | 50 | |
| 206 | Y (9) | (22) | 1st layer | IV-a-6 | 40 | Present invention |
| | M (10) | (20) | 3rd layer | IV-c-1 | 50 | |
| | Cy (16) | (10) | 5th layer | IV-e-1 | 50 | |
| 207 | Y (9) | (22) | 1st layer | IV-a-4 | 60 | Present invention |
| | M (10) | (20) | 3rd layer | IV-f-2 | 66 | |
| | Cy (16) | (10) | 5th layer | IV-g-6 | 55 | |
| 208 | Y (9) | (22) | 1st layer | II-50 | 55 mg/m$^2$ | Present invention |
| | | | | IV-a-4 | 50 | |
| | M (10) | (20) | 3rd layer | II-26 | 50 | |
| | | | | IV-f-1 | 50 | |
| | Cy (16) | (10) | 5th layer | II-50 | 65 | |
| | | | | IV-g-5 | 50 | |
| 209 | Y (5) | (10) | | — | | Comparative |
| | M (14) | (15) | | | | |
| | Cy (24) | (28) | | | | |
| 210 | Y (5) | (10) | 1st layer | II-50 | 45 | Present invention |
| | M (14) | (15) | 3rd layer | II-50 | 50 | |
| | Cy (24) | (28) | 5th layer | II-50 | 47 | |
| 211 | Y (10) | (14) | | — | | Comparative |
| | M (28) | (19) | | | | |
| | Cy (28) | (28) | | | | |
| 212 | Y (10) | (14) | 1st layer | II-50 | 45 | Present invention |
| | M (28) | (19) | 3rd layer | II-50 | 50 | |
| | Cy (28) | (28) | 5th layer | II-50 | 47 | |

Next, image output was conducted using the photosensitive elements 201 to 212 and image receiving element $R^{101}$ under heating conditions of 83° C. for 35 seconds or 78° C. for 35 seconds, by a digital color printer FIJIX PICTOGRAPHY PG-3000 manufactured by Fuji Photo Film Co., Ltd. The resulting image was a clear color image. {Maximum density and minimum density were measured by using a reflection density meter X-lite 304 manufactured by X-lite Corp.}

The discrimination of the resulting image was evaluated by d-value in the same manner as in Example 1.

The results are shown in Table 39.

TABLE 39

| Lightsensitive element | d value (83 to 35 seconds) | d value (78 to 35 seconds) |
|---|---|---|
| 201 | Y 0.25 | Y 0.38 |
| | M 0.19 | M 0.28 |
| | Cy 0.18 | Cy 0.29 |

TABLE 39-continued

| Lightsensitive element | d value (83 to 35 seconds) | d value (78 to 35 seconds) |
|---|---|---|
| 202 | Y 0.16 | Y 0.18 |
| | M 0.13 | M 0.15 |
| | Cy 0.14 | Cy 0.15 |
| 203 | Y 0.17 | Y 0.19 |
| | M 0.14 | M 0.16 |
| | Cy 0.13 | Cy 0.15 |
| 204 | Y 0.16 | Y 0.19 |
| | M 0.14 | M 0.15 |
| | Cy 0.14 | Cy 0.16 |
| 205 | Y 0.17 | Y 0.18 |
| | M 0.14 | M 0.15 |
| | Cy 0.15 | Cy 0.16 |
| 206 | Y 0.18 | Y 0.19 |
| | M 0.14 | M 0.15 |
| | Cy 0.13 | Cy 0.15 |
| 207 | Y 0.18 | Y 0.20 |
| | M 0.15 | M 0.17 |
| | Cy 0.15 | Cy 0.18 |

TABLE 39-continued

| Lightsensitive element | d value (83 to 35 seconds) | d value (78 to 35 seconds) |
|---|---|---|
| 208 | Y 0.16 | Y 0.19 |
| | M 0.12 | M 0.14 |
| | Cy 0.13 | Cy 0.14 |
| 209 | Y 0.27 | Y 0.39 |
| | M 0.20 | M 0.28 |
| | Cy 0.19 | Cy 0.28 |
| 210 | Y 0.17 | Y 0.20 |
| | M 0.14 | M 0.15 |
| | Cy 0.14 | Cy 0.16 |
| 211 | Y 0.26 | Y 0.38 |
| | M 0.19 | M 0.28 |
| | Cy 0.20 | Cy 0.29 |
| 212 | Y 0.16 | Y 0.18 |
| | M 0.13 | M 0.15 |
| | Cy 0.13 | Cy 0.15 |

It is understood that the photosensitive element of the present invention is not easily affected by differences in the processing conditions, and can provide an image having an excellent discrimination even under low temperature developing conditions. Each photosensitive element was left for 5 days under 45° C. −80%RH, then image formation was conducted under conditions of 83° C. for 35 seconds as described above. The photosensitive element of the present invention provided a clear color image.

As described above, the heat developing color photosensitive material of the present invention can provide an excellent image in an extremely short developing time and is not easily affected by variations in processing conditions. Further, the heat developing color photosensitive material is able to provide an image in lower temperature processing conditions and has excellent storability.

Example 3

A method for preparing a photosensitive element (heat developing photosensitive material) is described below.

Firstly, a method for producing a photosensitive silver halide emulsion is described.

Photosensitive silver halide emulsion (1) [for red sensitive emulsion layer]

A solution (I) having the composition shown in Table 41 was added to an aqueous solution having the composition shown in Table 40 at a constant flow rate with sufficient stirring over a period of 9 minutes, and a solution (II) was added at a constant flow rate 10 seconds before the addition of the solution (I) over a period of 9 minutes and 10 seconds. 36 minutes after the addition, a solution (III) having the composition shown in Table 41 was added at a constant flow rate over a period of 24 minutes, and a solution (IV) was added at a constant flow rate simultaneously with the solution (III) over a period of 25 minutes.

The mixture was washed with water and desalted (conducted at a pH of 4.0 using a flocculating agent a) by ordinary methods, then 880 g of lime-processed ossein gelatin was added to control pH to 6.0 before the addition of 12. 8 g of ribonucleic acid dissociated compound and 32 mg of trimethylthiourea, and the mixture was chemically sensitized for 71 minutes at 60° C., then, 2.6 g of 4-hydroxy-6-methyl-1,3,3a,7-tetrazaindene, 3.2 g of a dye (a)s 5.1 g of KBr and 2.6 g of a stabilizer (1) described below were added one by one, and the resulting mixture was cooled. In this manner, 28. 1 kg of monodispersed cubic silver chloride bromide emulsion having an average particle size of 0.35 μm was obtained.

TABLE 40

| Composition | |
|---|---|
| $H_2O$ | 26300 cc |
| Lime-processed gelatin | 800 g |
| KBr | 12 g |
| NaCl | 80 g |
| Compound (a) | 1.2 g |
| Temperature | 53° C. |

TABLE 41

| | (I) solution | (II) solution | (III) solution | (IV) solution |
|---|---|---|---|---|
| $AgNO_3$ | 1200 g | None | 2800 g | None |
| KBr | None | 546 g | None | 1766 g |
| NaCl | None | 144 g | None | 96 g |
| $K_2IrCl_6$ | None | 3.6 mg | None | None |
| Total amount | Water is added up to 6.5 liter | Water is added up to 6.5 liter | Water is added up to 10 liter | Water is added up to 10 liter |

Compound (a)

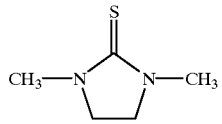

Dye (a)

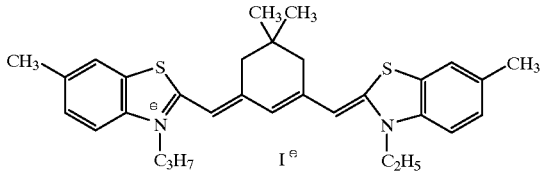

Photosensitive silver halide emulsion (2) [for green sensitive emulsion layer]

Solutions (I) and (II) each having the composition shown in Table 43 were simultaneously added to an aqueous solution having the composition shown in Table 42 at a constant flow rate with sufficient stirring over a period of 9 minutes. 5 minutes after the addition, solutions (III) and (IV) each having the compositions shown in Table 43 were simultaneously added at a constant flow rate over a period of 32 minutes. After completion of the addition of the solutions (III) and (IV), 60 ml of a methanol solution of dyes (containing 360 mg of a dye (b1) and 73.4 mg of a dye (b2)) was added in one time.

The mixture was washed with water and desalted (conducted at a pH of 4.0 using a flocculating agent a) by ordinary methods, then 22 g of lime-processed ossein gelatin was added to control pH to 6.0 and pAg to 7.6 before the addition of 1.8 mg of sodium thiosulfate and 180 mg of 4-hydroxy-6-methyl-1,3,3a,7-tetrazaindene and the mixture was chemically sensitized at 60° C., then 90 mg of an anti-fogging agent (1), and the resulting mixture was cooled. In this manner, 635 g of monodispersed cubic silver chloride bromide emulsion having an average particle size of 0.30 μm was obtained.

TABLE 42

| Composition | |
|---|---|
| $H_2O$ | 600 cc |
| Lime-processed gelatin | 20 g |
| KBr | 0.3 g |
| NaCl | 2 g |
| Compound (a) | 0.03 g |
| Sulfuric acid (1 N) | 16 cc |
| Temperature | 46° C. |

TABLE 43

| | (I) solution | (II) solution | (III) solution | (IV) solution |
|---|---|---|---|---|
| $AgNO_3$ | 10.0 g | None | 90.0 g | None |
| KBr | None | 3.50 g | None | 57.1 g |
| NaCl | None | 1.72 g | None | 3.13 g |
| $K_2IrCl_6$ | None | None | None | 0.03 mg |
| Total amount | Water is added up to 126 ml | Water is added up to 131 ml | Water is added up to 280 ml | Water is added up to 289 ml |

Dye (b1)

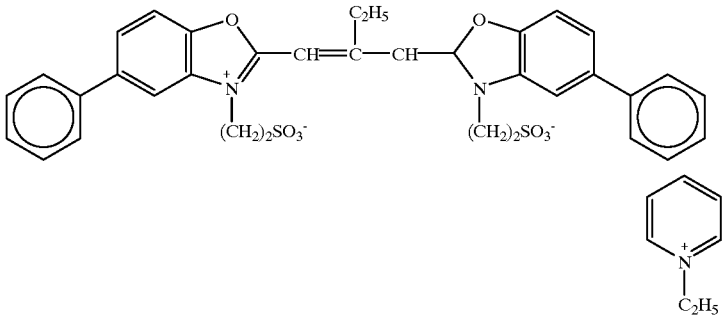

Dye (b2)

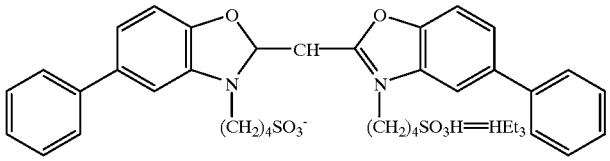

Flocculation agent a

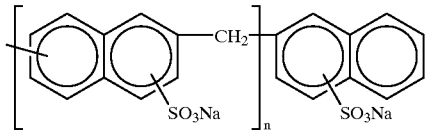

Anti-fogging agent (1)

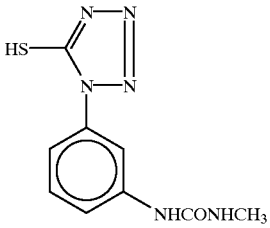

Photosensitive silver halide emulsion (3) [for blue sensitive emulsion layer]

Solutions (I) and (II) each having the compositions shown in Table 45 were added to an aqueous solution having the composition shown in Table 44 in a manner that the solution (II) was added first, and IO seconds later, the solution (I) was added over a period of 30 minutes each with sufficient stirring. 2 minutes after completion of the addition of the (I) solution, a solution (V) was added, and 5 minutes after completion of the addition of the solution (II), a solution (IV) was added over a period of 28 minutes, and 10 seconds later, a solution (III) was added over a period of 27 minutes and 50 seconds.

The mixture was washed with water and desalted (conducted at a pH of 3.9 using a flocculating agent b) by ordinary methods, then 1230 g of lime-processed ossein gelatin and 2.8 mg of a compound (b) were added to control pH to 6.1 and pAg to 8.4 before addition of 24.9 mg of sodium thiosulfate, and the mixture was chemically sensitized at 60° C., then, after 13.1 g of a dye (c) and 118 ml of a compound (c) were added successively, the resulting mixture was cooled. The halide particles in the resulted emulsion were potato-like particles, and had an average particle size of 0.53 $\mu$m, and the yield was 30700 g.

TABLE 44

| Composition | |
|---|---|
| $H_2O$ | 29200 cc |
| Lime-processed gelatin | 1582 g |
| kBr | 127 g |
| Compound (a) | 0.66 g |
| Temperature | 72° C. |

TABLE 44

| | (I) solution | (II) solution | (III) solution | (IV) solution | (V) solution |
|---|---|---|---|---|---|
| $AgNO_3$ | 939 g | None | 3461 g | None | None |
| KBr | None | 572 g | None | 2464 g | None |
| KI | None | None | None | None | 22 g |
| Total amount | Water is added up to 6690 ml | Water is added up to 6680 ml | Water is added up to 9700 ml | Water is added up to 9740 ml | Water is added up to 4400 ml |

Sedimenting agent b

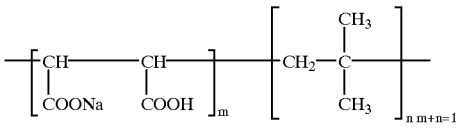

Dye (c)

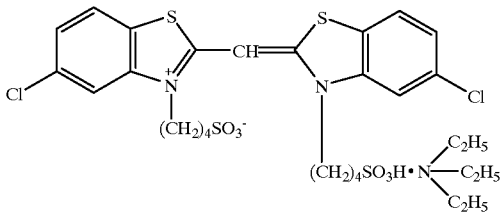

-continued

Compound c

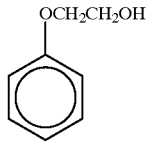

Compound b

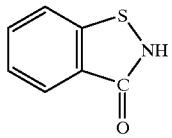

Next, a method for preparing a gelatin dispersion of a hydophobic additive is described.

Gelatin dispersions of a yellow dye-forming coupler, a magenta dye-forming coupler, a cyan dye-forming coupler, and a developing agent were prepared respectively according to formulations shown in Table 46. Namely, oil phase components were heated to about 70° C. to be dissolved to form a uniform solution, to this solution were added aqueous phase components heated to about 60° C., and the solution was stirred and mixed, then was dispersed at 10000 rpm by a homogenizer for 10 minutes. To this was added water, and the solution was stirred to give a uniform dispersion.

TABLE 46

| | Dispersion composition | | |
|---|---|---|---|
| | Yellow | Magenta | Cyan |
| Oil phase | | | |
| Cyan dye forming coupler (19) | None | None | 7.0 g |
| Magenta dye forming coupler (8) | None | 7.0 g | None |
| Yellow dye forming coupler (4) | 7.0 g | None | None |
| Developing agent D-11 | None | None | 5.6 g |
| Developing agent D-13 | None | 5.6 g | None |
| Developing agent D-1 | 5.6 g | None | None |
| Anti-fogging agent (5) | 0.25 g | None | None |
| Anti-fogging agent (2) | None | 0.25 g | 0.25 g |
| Solvent having a high boiling point (4) | 7.4 g | 7.4 g | 7.4 g |
| Ethyl acetate | 15 cc | 15 cc | 15 cc |
| Water phase | | | |
| Lime-processed gelatin | 10.0 g | 10.0 g | 10.0 g |
| Calcium nitrate | 0.1 g | 0.1 g | 0.1 g |
| Surfactant (1) | 0.7 g | 0.7 g | 0.7 g |
| Water | 110 cc | 110 cc | 110 cc |
| Water addition | 110 cc | 110 cc | 110 cc |
| Preservative (1) | 0.04 g | 0.04 g | 0.04 g |

Cyan dye forming coupler 19
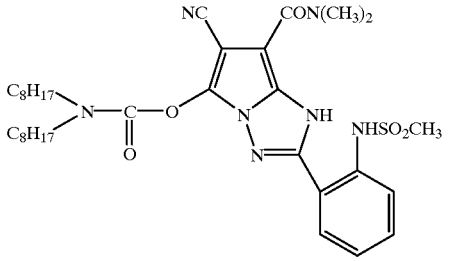
Magenta dye forming coupler 8
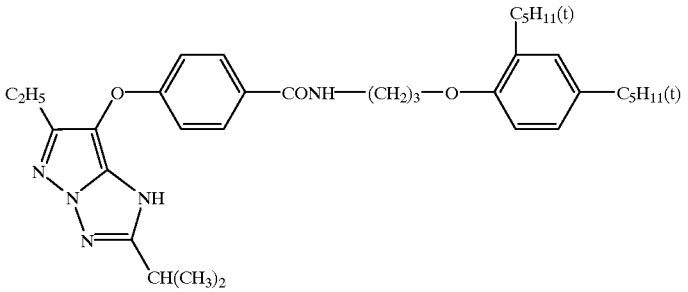
Yellow dye forming coupler 4
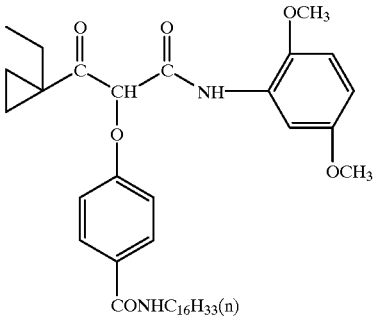
Developing agent D-11
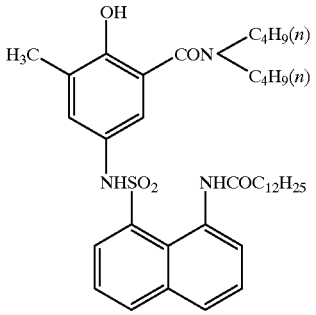
-continued
Developing agent D-13
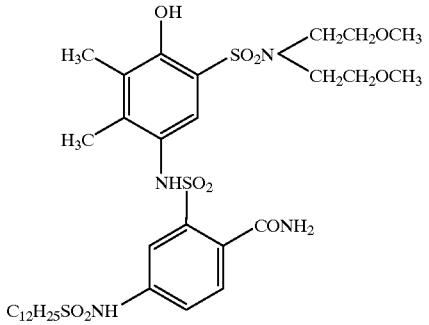

-continued

Developing agent D-1

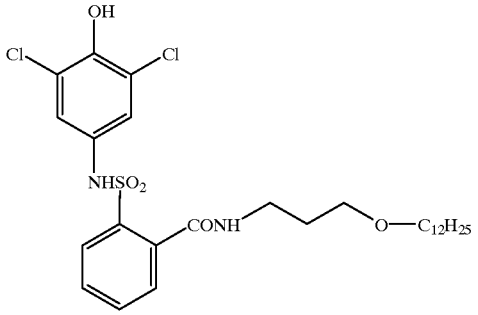

Anti-fogging agent (5)

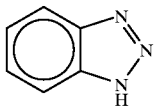

Anti-fogging agent (2)

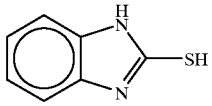

Organic solvent having a high boiling point (4)

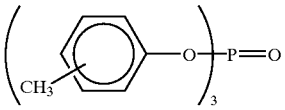

Preservative (1)

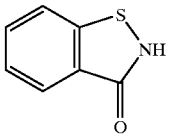

A gelatin dispersion of an anti-fogging agent (4) and reducing agent (1) was prepared according to the formulation shown in Table 47. Namely, oil phase components were heated to about 60° C. to be dissolved, to this solution were added aqueous phase components heated to about 60° C., and the solution was stirred and mixed, then was dispersed at 10000 rpm by a homogenizer for 10 minutes to give a uniform dispersion.

TABLE 47

| | Dispersion composition |
|---|---|
| Oil phase | |
| Anti-fogging agent (4) | 0.16 g |
| Reducing agent (1) | 1.3 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Water phase | |
| Acid-processed gelatin | 10.0 g |
| Preservative (1) | 0.004 g |
| Calcium nitrate | 0.1 g |
| Water | 35.0 ml |
| Water addition | 104.4 ml |

Surfactant (1)

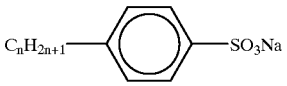

n ≈ 12.6

-continued

Anti-fogging agent (4)

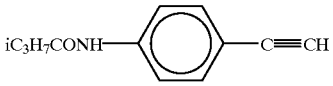

Surfactant (4)

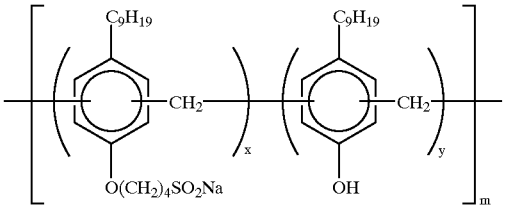

x:y = 4:6 m ≈ 6.8

Organic solvent having a high boiling point (2)

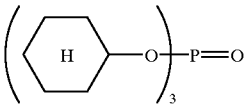

Preservative (1)

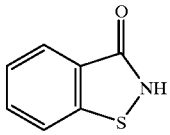

Organic solvent having a high boiling point (5)

(En-para 40 [manufactured by Ajinomono Co., Inc.])

$C_{24}H_{48.9}Cl_{7.1}$

Reducing agent (1)

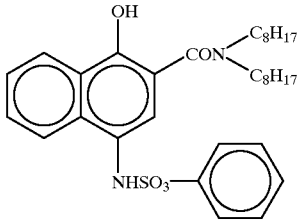

A dispersion of a polymer latex (a) was prepared according to the formulation shown in Table 48. Namely, to a mixture of a polymer latex (a), surfactant (5) and water in amounts shown in Table 48 was added an anionic surfactant (6) over a period of 10 minutes while stirring to give a uniform dispersion. Further, the resulting dispersion was repeatedly diluted with water and concentrated using an ultrafiltration module (ultrafiltration module manufactured by Asahi Chemical Industry Co., Ltd.: ACV-3050) to decrease salt concentration in the dispersion to one-ninth.

TABLE 48

| | Dispersion composition |
|---|---|
| Polymer latex (a) aqueous solution (solid content: 13%) | 108 ml |
| Surfactant (5) | 20 g |
| Surfactant (6) | 600 ml |
| Water | 1232 ml |

Polymer latex (a)

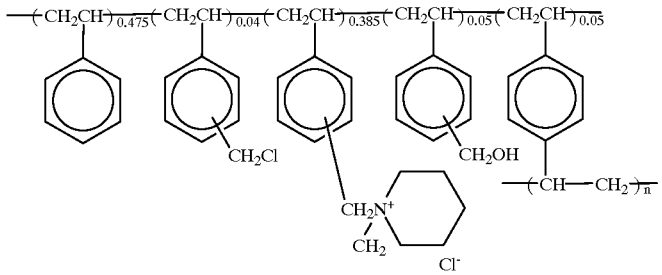

Surfactant (5)

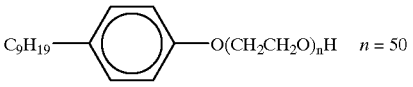

Surfactant (6)

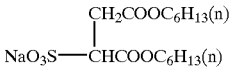

Preservative (2)

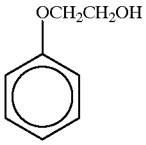

Surfactant (2)

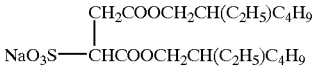

A gelatin dispersion of zinc hydroxide was prepared according to the formulation shown in Table 49. Namely, components were mixed and dissolved, and then dispersed for 30 minutes using glass beads having an average particle size of 0.75 mm by a mill. Further, the glass beads were separated and removed, to give a uniform dispersion.

TABLE 49

| | Dispersion composition |
|---|---|
| Zinc hydroxide | 15.9 g |
| Carboxymethylcellulose | 0.7 g |
| Sodium polyacrylate | 0.07 g |
| Lime-processed gelatin | 4.2 g |
| Water | 100 ml |
| Preservative (2) | 0.4 g |

Next, a method for preparing a gelatin dispersion of a matting agent added to a protective layer is described. A solution obtained by dissolving PMMA in methylene chloride was added to gelatin together with a small amount of a surfactant, and the mixture was stirred at high speed to be dispersed. Then, methylene chloride was removed by a vacuum solvent removing apparatus to give a uniform dispersion having an average particle size of 4.3 $\mu$m.

The above-described products were used to produce the photosensitive elements 301 shown in Tables 50 and 51.

TABLE 50

Composition of main materials of heat developable photosensitive material 301

| NO of layer | Name of layer | Additive | Amount added (mg/m$^2$) |
|---|---|---|---|
| 7th layer | Protective layer | Acid-processed gelatin | 387 |
| | | Matting agent (PMMA resin) | 17 |

TABLE 50-continued

Composition of main materials of heat developable photosensitive material 301

| NO of layer | Name of layer | Additive | Amount added (mg/m$^2$) |
|---|---|---|---|
| | | Surfactant (2) | 6 |
| | | Surfactant (3) | 20 |
| | | Polymer latex (a) Dispersion | 10 |
| 6th layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 5 |
| | | Zinc hydroxide | 558 |
| | | Calcium nitrate | 6 |
| 5th layer | Blue light-sensitive layer | Lime-processed gelatin | 587 |
| | | Lightsensitive silver halide emulsion (3) | 399 |
| | | Yellow dye forming coupler (4) | 410 |
| | | Developing agent D-1 | 328 |
| | | Anti-fogging agent (3) | 15 |
| | | Solvent having a high boiling point (4) | 433 |
| | | Surfactant (1) | 12 |
| | | Water-soluble polymer (1) | 40 |
| 4th layer | Intermediate layer | Lime-processed gelatin | 862 |
| | | Anti-fogging agent (4) | 7 |

TABLE 50-continued

Composition of main materials of heat developable photosensitive material 301

| NO of layer | Name of layer | Additive | Amount added (mg/m²) |
|---|---|---|---|
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 4 |
| | | Zinc hydroxide | 341 |
| | | Calcium nitrate | 8 |

TABLE 51

Composition of main materials of heat developable photosensitive material 301 (cont.)

| NO of layer | Name of layer | Additive | Amount added (mg/m²) |
|---|---|---|---|
| 3rd layer | Green light-sensitive layer | Lime-processed gelatin | 452 |
| | | Lightsensitive silver halide emulsion (2) | 234 |
| | | Magenta dye forming coupler (8) | 420 |
| | | Developing agent D-13 | 336 |
| | | Anti-fogging agent (2) | 15 |
| | | Solvent having a high boiling point (4) | 444 |
| | | Surfactant (1) | 12 |
| | | Water-soluble polymer (1) | 10 |
| 2nd layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 10 |
| | | Calcium nitrate | 6 |
| 1st layer | Red light-sensitive layer | Lime-processed gelatin | 373 |
| | | Lightsensitive silver halide emulsion (1) | 160 |
| | | Cyan dye forming coupler (19) | 390 |
| | | Developing agent D-11 | 312 |
| | | Anti-fogging agent (2) | 14 |
| | | Solvent having a high boiling point (4) | 412 |
| | | Surfactant (1) | 11 |
| | | Water-soluble polymer (2) | 25 |
| | | Hardener (1) | 45 |
| | | Preservative (3) | 45 |

Substrate (substrate obtained by aluminum vapor deposition on a 20 μm PET and subsequent coating of gelatin on the back surface as an undercoat)

Surfactant (3)

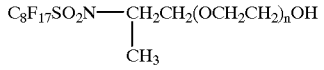

-continued

Water-soluble polymer (1)

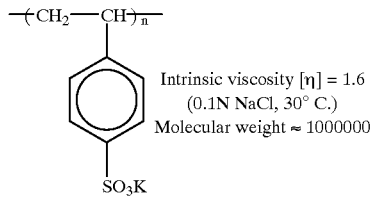

Water-soluble polymer (2)

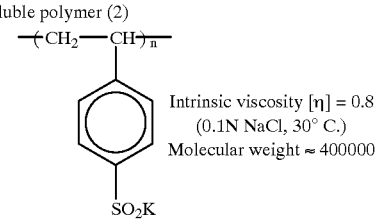

Hardener (1)

Next, heat developing photosensitive materials 302 to 321 were produced in the same manner as described above, except that the developing agent, coupler and the compounds of the present invention represented by the general formulae (II) and (III) were added to the 1st, 3rd and 5th layers or 2nd, 4th and 6th layers in the amounts shown in Tables 52 and 53.

Next, image output was conducted using the above-described heat developing photosensitive elements 301 to 321 and image receiving element $R^{101,}$ as in Example 1 in heating conditions of 80° C. for 30 seconds or 75° C. for 30 seconds by PICTOSTAT 330 manufactured by Fuji Photo Film Co., Ltd. The image output on a dye fixing material was a clear color image. {Maximum density and minimum density were measured by using a reflection density meter X-lite 304 manufactured by X-lite Corp.}

The discrimination of the resulting image was evaluated by d-value r(Minimum density/Maximum density) (when d value is low, discrimination is excellent).

The results are shown in Tables 52 and 53. It is understood that the heat developing photosensitive material of the present invention can provide an image having an excellent discrimination even under low temperature developing conditions.

Each heat developing photosensitive material was left for 5 days under 60° C. −60%RH, then image formation was conducted in conditions of 80° C. for 30 seconds as described above, and preservability of the heat developing photosensitive material was evaluated. The heat developing photosensitive material of the present invention could provide a clear color image even after storage.

TABLE 52

| Lightsensitive element | Type of coupler | Type of developing agent | Compound of the present invention | | | d value (80 to 30 seconds) | d value (75 to 30 seconds) | Remarks |
|---|---|---|---|---|---|---|---|---|
| 301 | Y (4) | D-1 | | — | | 0.30 | 0.38 | Comparative |
| | M (8) | D-13 | | | | 0.20 | 0.30 | |
| | C (19) | D-11 | | | | 0.18 | 0.29 | |
| 302 | Y (4) | D-1 | 1st layer | II-50 | 57 mg/m$^2$ | 0.22 | 0.24 | Present invention |
| | M (8) | D-13 | 3rd layer | II-50 | 57 | 0.13 | 0.13 | |
| | C (19) | D-11 | 5th layer | II-50 | 57 | 0.12 | 0.14 | |
| 303 | Y (4) | D-1 | 2nd layer | II-50 | 60 | 0.22 | 0.24 | Present invention |
| | M (8) | D-13 | 4th layer | II-50 | 60 | 0.14 | 0.12 | |
| | C (19) | D-11 | 6th layer | II-50 | 40 | 0.13 | 0.14 | |
| 304 | Y (4) | D-1 | 2nd layer | III-22 | 70 | 0.21 | 0.23 | Present invention |
| | M (8) | D-13 | 4th layer | | — | 0.13 | 0.15 | |
| | C (19) | D-11 | 6th layer | | — | 0.12 | 0.15 | |
| 305 | Y (4) | D-1 | 1st layer | II-18 | 50 | 0.22 | 0.24 | Present invention |
| | M (8) | D-13 | 3rd layer | II-22 | 50 | 0.12 | 0.16 | |
| | C (19) | D-11 | 5th layer | II-7 | 50 | 0.13 | 0.15 | |
| 306 | Y (4) | D-1 | 1st layer | III-18 | 50 mg/m$^2$ | 0.21 | 0.23 | Present invention |
| | M (8) | D-13 | 3rd layer | III-21 | 50 | 0.13 | 0.15 | |
| | C (19) | D-11 | 5th layer | III-7 | 50 | 0.12 | 014 | |
| 307 | Y (4) | D-1 | 1st layer | II-3 | 50 | 0.22 | 0.24 | Present invention |
| | M (8) | D-13 | 3rd layer | II-10 | 50 | 0.12 | 0.15 | |
| | C (19) | D-11 | 5th layer | II-15 | 50 | 0.13 | 0.15 | |
| 308 | Y (4) | D-1 | 1st layer | II-50 | 70 | 0.21 | 0.22 | Present invention |
| | M (8) | D-13 | | III-22 | 50 | 0.11 | 0.12 | |
| | C (19) | D-11 | 3rd layer | II-50 | 50 | 0.11 | 0.13 | |
| | | | | III-19 | 50 | | | |
| | | | 5th layer | II-50 | 70 | | | |
| | | | | III-26 | 50 | | | |

TABLE 53

| Lightsensitive element | Type of coupler | Type of developing agent | Compound of the present invention | | | d value (80 to 30 seconds) | d value (75 to 30 seconds) | Remarks |
|---|---|---|---|---|---|---|---|---|
| 309 | Y (3) | D-21 | | — | | 0.33 | 0.39 | Comparative |
| | M (10) | D-26 | | | | 0.22 | 0.33 | example |
| | C (22) | D-28 | | | | 0.19 | 0.31 | |
| 310 | Y (3) | D-21 | 1st layer | II-50 | 50 mg/m$^2$ | 0.22 | 0.25 | Present invention |
| | M (10) | D-26 | 3rd layer | II-50 | 50 | 0.13 | 0.15 | |
| | C (22) | D-28 | 5th layer | II-50 | 50 | 0.14 | 0.16 | |
| 311 | Y (5) | D-31 | | — | | 0.30 | 0.38 | Comparative |
| | M (9) | D-35 | | | | 0.23 | 0.31 | example |
| | C (24) | D-15 | | | | 0.19 | 0.22 | |
| 312 | Y (5) | D-31 | 1st layer | II-50 | 50 mg/m$^2$ | 0.21 | 0.25 | Present invention |
| | M (9) | D-35 | 3rd layer | II-50 | 50 | 0.16 | 0.27 | |
| | C (24) | D-15 | 5th layer | II-50 | 50 | 0.14 | 0.16 | |
| 313 | Y (4) | D-1 | | II-66 | | 0.10 | 0.12 | Present invention |
| | M (8) | D-13 | | II-66 | | 0.09 | 1.10 | |
| | C (19) | D-11 | | II-66 | | 0.08 | 0.09 | |
| 314 | Y (4) | D-1 | | II-63 | | 0.11 | 0.12 | Present invention |
| | M (8) | D-13 | | II-63 | | 1.10 | 1.11 | |
| | C (19) | D-11 | | II-63 | | 0.09 | 0.10 | |
| 315 | Y (4) | D-1 | | II-62 | | 0.10 | 0.13 | Present invention |
| | M (8) | D-13 | | II-62 | | 1.08 | 1.10 | |
| | C (19) | D-11 | | II-62 | | 0.07 | 0.11 | |
| 316 | Y (4) | D-1 | | II-59 | | 0.11 | 0.12 | Present invention |
| | M (8) | D-13 | | II-59 | | 1.09 | 1.11 | |
| | C (19) | D-11 | | II-59 | | 0.10 | 0.11 | |
| 317 | Y (4) | D-1 | | II-61 | | 0.09 | 0.12 | Present invention |
| | M (8) | D-13 | | II-61 | | 1.10 | 1.11 | |
| | 9 (19) | D-11 | | II-61 | | 0.11 | 0.10 | |
| 318 | Y (9) | 16 | | II-18 | 50 | 0.22 | 0.23 | Present invention |
| | M (9) | D-9 | | II-18 | 50 | 0.13 | 0.14 | |
| | C (20) | D-7 | | II-18 | 50 | 0.13 | 0.15 | |
| 319 | Y (8) | 16 | | III-21 | 50 | 0.21 | 0.22 | Present invention |
| | M (10) | 26 | | III-21 | 50 | 0.12 | 0.14 | |
| | C (20) | D-7 | | III-21 | 50 | 0.11 | 0.13 | |
| 320 | Y (8) | 16 | | II-61 | 50 | 0.11 | 0.12 | Present invention |
| | M (15) | 26 | | II-59 | 50 | 0.09 | 0.10 | |
| | C (20) | D-7 | | II-63 | 50 | 0.09 | 0.11 | |
| 321 | Y (4) | D-2 | | II-7 | 50 | 0.18 | 0.19 | Present invention |
| | M (9) | D-9 | | II-7 | 50 | 0.12 | 0.14 | |
| | C (17) | 6 | | II-7 | 50 | 0.11 | 0.13 | |

Example 4

Image receiving elements (dye fixing materials) were produced in the same manner as in Example 1.

Next, a method for producing a photosensitive element (heat developing photosensitive material) is described.

First, a method for producing a photosensitive silver halide emulsion is described. Photosensitive silver halide emulsion (1) [emulsion for 5th layer (680 nm photosensitive layer)]

Solutions (I) and (II) each having the compositions shown in Table 55 were simultaneously added to an aqueous solution having the composition shown in Table 54 with sufficient stirring over a period of 13 minutes, and 10 minutes later, solutions (III) and (IV) each having the compositions shown in Table 55 were added over a period of 33 minutes.

TABLE 54

| Composition | |
|---|---|
| $H_2O$ | 620 cc |
| Lime-processed gelatin | 20 g |
| KBr | 0.3 g |
| NaCl | 2 g |
| Solvent for silver halide (1) | 0.03 g |
| Sulfuric acid (1 N) | 16 cc |
| Temperature | 45° C. |

TABLE 55

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.2 g |
| NaCl | None | 3.62 g | None | 2.4 g |
| $K_2IrCl_6$ | None | None | None | 0.039 mg |
| Total amount | Water is added up to 126 ml | Water is added up to 132 ml | Water is added up to 254 ml | Water is added up to 252 ml |

Solvent for silver halide (1)

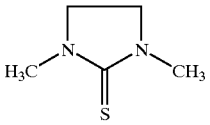

13 minutes after initiation of the addition of the solution (III), 150 cc of an aqueous solution containing 0.350% of a sensitizing dye (1) was added over 27 minutes.

The mixture was washed with water and desalted (conducted at a pH of 4.1 using a flocculating agent a) by ordinary methods, then 22 g of lime-processed ossein gelatin was added to control pH to 6.0 and pAg to 7.9, and the mixture was chemically sensitized at 60° C. The compound used in the chemical sensitization is shown in Table 56.

The resulting emulsion (630 g) was a monodispersed cubic silver chloride bromide emulsion having a variation coefficient of 10.2%, and an average particle size of 0.20 $\mu$m.

TABLE 56

| Compound used in chemical sensitization | Amount added |
|---|---|
| 4-hydroxy-6-methyl-1,3,3a,7-tetrazaindene | 0.36 g |
| Sodium thiosulfate | 6.75 mg |
| Anti-fogging agent (1) | 0.11 g |
| Preservative (1) | 0.07 g |
| Preservative (2) | 3.31 g |

Anti-fogging agent (1)

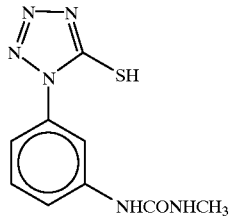

Preservative (1)

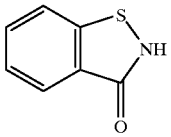

Preservative (2)

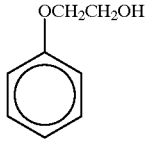

Photosensitive silver halide emulsion (2) [emulsion for 3rd layer (750 nm photosensitive layer)]

Solutions (I) and (II) each having the compositions shown in Table 58 were simultaneously added to an aqueous solution having the composition shown in Table 57 with sufficient stirring over a period of 18 minutes. 10 minutes after the addition, solutions (III) and (IV) each having the compositions shown in Table 58 were added over a period of 24 minutes.

TABLE 57

| Composition | |
|---|---|
| $H_2O$ | 620 cc |
| Lime-processed gelatin | 20 g |
| KBr | 0.3 g |
| NaCl | 2 g |
| Solvent for silver halide (1) | 0.03 g |
| Sulfuric acid (1N) | 16 cc |
| Temperature | 45° C. |

TABLE 58

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.2 g |
| NaCl | None | 3.62 g | None | 2.4 g |
| $K_4[Fe(CN)_6].H_2O$ | None | None | None | 0.07 g |
| $K_2IrCl_6$ | None | None | None | 0.04 mg |
| Total amount | Water is | Water is | Water is | Water is |

TABLE 58-continued

| | (I) solution | (II) solution | (III) solution | (IV) solution |
|---|---|---|---|---|
| | added up to 188 ml | added up to 188 ml | added up to 250 ml | added up to 250 ml |

The mixture was washed with water and desalted (conducted at a pH of 3.9 using a flocculating agent b) by ordinary methods, then 22 g of lime-processed ossein gelatin which had been subjected to de-calcium treatment (calcium content: 150 PPM or less) was added, and the mixture was dispersed at 40° C., and 0.39 g of 4-hydroxy-6-methyl-1,3,3a,7-tetrazaindene was added to control pH to 5.9 and pAg to 7.8. Then, the mixture was chemically sensitized at 70° C. using chemicals shown in Table 59. Further, at the end of the chemical sensitization, sensitizing dye was added in the form of a methanol solution (solution having the composition shown in Table 60). Further, after chemical sensitization, the solution was cooled down to 40° C., to this was added 200 g of a gelatin dispersion of a stabilizer (1) described later, and they were sufficiently stirred before being stored. The resulting emulsion was a monodispersion cubic silver chloride iodide having a variation coefficient of 12.6% and an average particle size of 0.25 μm, and the yield was 938 g. The emulsion for 750 nm photosensitive layer had J-band type spectral sensitivity.

TABLE 59

| Compound used in chemical sensitization | Amount added |
|---|---|
| 4-hydroxy-6-methyl-1,3,3a,7-tetrazaindene | 0.39 g |
| Triethyl thiourea | 3.3 mg |
| Nucleic acid decomposed material | 0.39 g |
| NaCl | 0.15 g |
| Kl | 0.12 g |
| Anti-fogging agent (2) | 0.10 g |
| Preservative (1) | 0.07 g |

TABLE 60

| Composition of dye solution | Amount added |
|---|---|
| Sensitizing dye (2) | 0.19 g |
| Methanol | 18.7 cc |

Stabilizer (1)

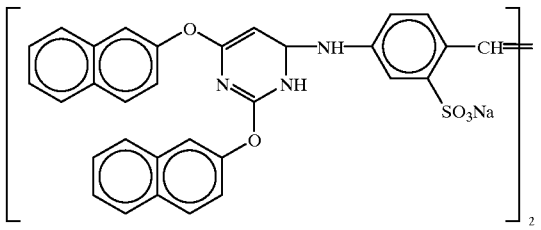

Anti-fogging agent (2)

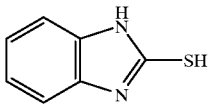

-continued

Sensitizing dye (2)

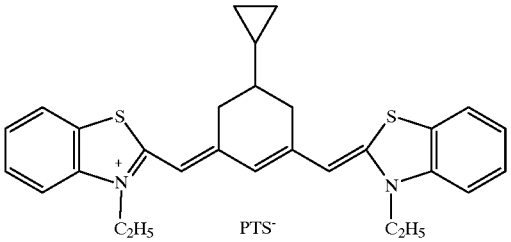

PTS = p-toluenesulfonic acid

Flocculation agent b

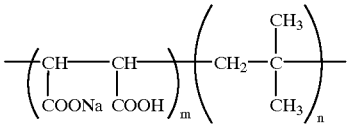

$m:n$ = 1:1

Photosensitive silver halide emulsion (3) [emulsion for 1st layer (810 nm photosensitive layer)]

Solutions (I) and (II) each having the composition shown in Table 62 were added to an aqueous solution having the composition shown in Table 61 over a period of 18 minutes with sufficient stirring, and 10 minutes later, solutions (III) and (IV) each having the compositions shown in Table 62 were added over a period of 24 minutes.

TABLE 61

| Composition | |
|---|---|
| $H_2O$ | 620 cc |
| Lime-processed gelatin | 20 g |
| kBr | 0.3 g |
| NaCl | 2 g |
| Solvent for silver halide (1) | 0.03 g |
| Sulfuric acid (1 N) | 16 cc |
| Temperature | 50° C. |

TABLE 62

| | (I) solution | (II) solution | (III) solution | (IV) solution |
|---|---|---|---|---|
| $AgNO_3$ | 30.0 g | None | 70.0 g | None |
| KBr | None | 13.7 g | None | 44.1 g |
| NaCl | None | 3.62 g | None | 2.4 g |
| $K_2IrCl_6$ | None | None | None | 0.02 mg |
| Total amount | Water is added up to 180 ml | Water is added up to 181 ml | Water is added up to 242 ml | Water is added up to 250 ml |

The mixture was washed with water and desalted (conducted ata pH of 3.8 using a flocculating agent a) by ordinary methods, then 22 g of lime-processed ossein gelatin was added to control pH to 7.4 and pAg to 7. 8 before chemical sensitization at 60° C. The compounds used in the chemical sensitization are shown in Table 63. The resulting emulsion was a monodispersion cubic silver chloride bromide emulsion having a variation coefficient of 9.7% and an average particle size of 0.32 μm, and the yield was 680 g.

TABLE 63

| Compound in chemical sensitization | Amount added |
|---|---|
| 4-hydroxy-6-methyl-1,3,3a,7-tetrazaindene | 0.38 g |
| Triethyl thiourea | 3.1 mg |
| Anti-fogging agent (2) | 0.19 g |
| Preservative (1) | 0.07 g |
| Preservative (2) | 3.13 g |

Next, a method for preparing a gelatin dispersion of colloid silver is described.

A solution having the composition shown in Table 65 was added to an aqueous solution having the composition shown in Table 64 over a period of 24 minutes with sufficient stirring. Next, the mixture was washed with water using a flocculating agent a, then 43 g of lime-processed ossein gelatin was added to control pH to 6.3. The resulted product had an average particle size of 0.02 $\mu$m, and the yield was 512 g (dispersion containing 2% of silver and 6.8% of gelatin).

TABLE 64

| Composition | |
|---|---|
| $H_2O$ | 620 cc |
| Dextrin | 16 g |
| NaOH (5 N) | 41 cc |
| Temperature | 30° C. |

TABLE 65

| Composition | |
|---|---|
| $H_2O$ | 135 cc |
| $AgNO_3$ | 17 g |

Next, a method for preparing a gelatin dispersion of a hydrophobic additive is described.

Gelatin dispersions of a yellow coupler, a magenta coupler, a cyan coupler, and a developing agent were prepared respectively according to the formulations shown in Table 66. Namely, oil phase components were heated to about 70° C. to be dissolved to form a uniform solution, to this solution were added aqueous phase components heated to about 60° C., and the solution was stirred and mixed, then was dispersed at 10000 rpm by a homogenizer for 10 minutes. To this was added water, and the solution was stirred to give a uniform dispersion.

TABLE 66

| | Dispersion composition | | |
|---|---|---|---|
| | Yellow | Magenta | Cyan |
| Oil phase | | | |
| Cyan dye forming coupler (20) | None | None | 7.0 g |
| Magenta dye forming coupler (9) | None | 7.0 g | None |
| Yellow dye forming coupler (4) | 7.0 g | None | None |
| Developing agent D-7 | None | None | 5.6 g |
| Developing agent D-9 | None | 5.6 g | None |
| Developing agent D-2 | 5.6 g | None | None |
| Anti-fogging agent (5) | 0.25 g | None | None |
| Anti-fogging agent (2) | None | 0.25 g | 0.25 g |

TABLE 66-continued

| | Dispersion composition | | |
|---|---|---|---|
| | Yellow | Magenta | Cyan |
| Solvent having a high boiling point (4) | 7.4 g | 7.4 g | 7.4 g |
| Dye (a) | 1.1 g | None | 0.5 g |
| Ethyl acetate | 15 cc | 15 cc | 15 cc |
| Water phase | | | |
| Lime-processed gelatin | 10.0 g | 10.0 g | 10.0 g |
| Calcium nitrate | 0.1 g | 0.1 g | 0.1 g |
| Surfactant (1) | 0.2 g | 0.2 g | 0.2 g |
| Water | 110 cc | 110 cc | 110 cc |
| Water addition | 110 cc | 110 cc | 110 cc |
| Preservative (1) | 0.04 g | 0.04 g | 0.04 g |

A gelatin dispersion of an anti-fogging agent (4) and a reducing agent (1) was prepared according to the formulation shown in Table 67. Namely, oil phase components were heated to about 60° C. to be dissolved, to this solution were added aqueous phase components heated to about 60° C., and the solution was stirred and mixed, then was dispersed at 10000 rpm by a homogenizer for 10 minutes to give a uniform dispersion.

TABLE 67

| | Dispersion composition |
|---|---|
| Oil phase | |
| Anti-fogging agent (4) | 0.16 g |
| Reducing agent (1) | 1.3 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Water phase | |
| Acid-processed gelatin | 10.0 g |
| Preservative (1) | 0.004 g |
| Calcium nitrate | 0.1 g |
| Water | 35.0 ml |
| Water addition | 104.4 ml |

A gelatin dispersion of a reducing agent (2) was prepared according to the formulation shown in Table 68. Namely, oil phase components were heated to about 60° C. to be dissolved, to this solution were added aqueous phase components heated to about 60° C., and the solution was stirred and mixed, then was di000spersed at 10000 rpm by a homogenizer for 10 minutes to give a uniform dispersion. Further, ethyl acetate was removed from the resulting dispersion using a vacuum organic solvent removing apparatus.

TABLE 68

| | Dispersion composition |
|---|---|
| Oil phase | |
| Reducing agent (2) | 7.5 g |
| Solvent having a high boiling point (1) | 4.7 g |
| Surfactant (1) | 1.9 g |
| Ethyl acetate | 14.4 ml |

TABLE 68-continued

| | Dispersion composition |
|---|---|
| Water phase | |
| Acid-processed gelatin | 10.0 g |
| Preservative (1) | 0.02 g |
| Gentamicin | 0.04 g |
| Sodium hydrogen sulfite | 0.1 g |
| Water | 136.7 ml |

A dispersion of a polymer latex (a) was prepared according to the formulation shown in Table 69. Namely, an anionic surfactant (6) was added to a mixture of a polymer latex (a), surfactant (5) and water in amounts shown in Table 31 over a period of 10 minutes while stirring to give a uniform dispersion. Further, the resulting dispersion was repeatedly diluted with water and concentrated using a ultrafiltration module (ultrafiltration module manufactured by Asahi Chemical Industry Co., Ltd.: ACV-3050) to decrease salt concentration in the dispersion to one-ninth.

TABLE 69

| | Dispersion composition |
|---|---|
| Polymer latex (a) aqueous solution (solid content 13%) | 108 ml |
| Surfactant (5) | 20 g |
| Surfactant (6) | 600 ml |
| Water | 1232 ml |

A gelatin dispersion of a stabilizing agent (1) was prepared according to the formulation shown in Table 70. Namely, oil phase components were dissolved at room temperature, to this solution were added aqueous phase components heated to about 40° C., and the solution was stirred and mixed, then was dispersed at 10000 rpm by a homogenizer for 10 minutes to give a dispersion. Further, water added and the mixture was stirred to give a uniform dispersion.

TABLE 70

| | Dispersion composition |
|---|---|
| Oil phase | |
| Stabilizing agent (1) | 4.0 g |
| Sodium hydroxide | 0.3 g |
| Methanol | 62.8 g |
| Preservative (2) | 0.8 g |
| Water phase | |
| De-calcium-processed gelatin (Ca content: 100 ppm or less) | 10.0 g |
| Preservative (1) | 0.04 g |
| Water | 320 ml |

A gelatin dispersion of zinc hydroxide was prepared according to a formulation shown in Table 71. Namely, components were mixed and dissolved, and then dispersed for 30 minutes using glass beads having an average particle size of 0.75 mm by a mill. Further, the glass beads were separated and removed, to give a uniform dispersion.

TABLE 71

| | Dispersion composition |
|---|---|
| Zinc hydroxide | 15.9 g |
| Carboxymethylcellulose | 0.7 g |
| Sodium polyacrylate | 0.07 g |
| Lime-processed gelatin | 4.2 g |
| Water | 100 ml |
| Preservative (2) | 0.4 g |

Next, a method for preparing a gelatin dispersion of a matting agent added to a protective layer is described. A solution obtained by dissolving PMMA in methylene chloride was added to gelatin together with a small amount of a surfactant, and the mixture was stirred at high speed to be dispersed. Then, methylene chloride was removed by a vacuum solvent removing apparatus to give a uniform dispersion having an average particle sized of 4.3 $\mu$m.

Structure of dye (a)

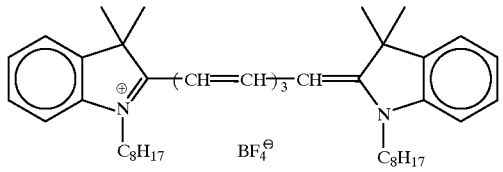

Stabilizer (1)

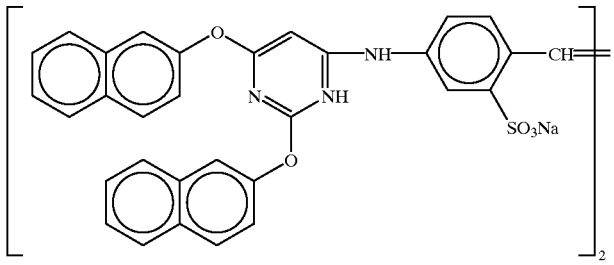

-continued
preservative (1)
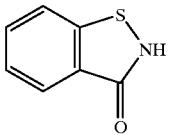
preservative (2)
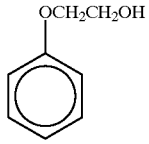
Cyan dye forming coupler 20
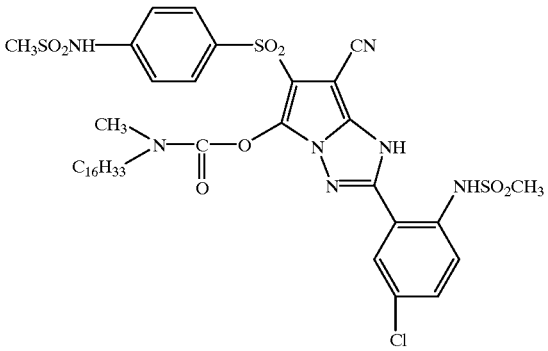
Magneta dye forming coupler 9
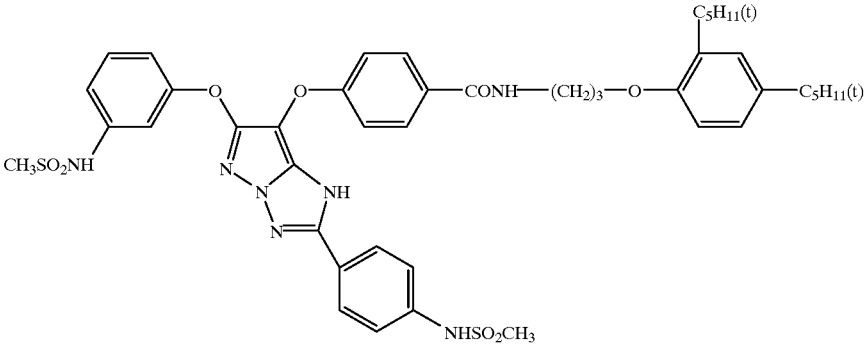
Yellow dye forming coupler 4
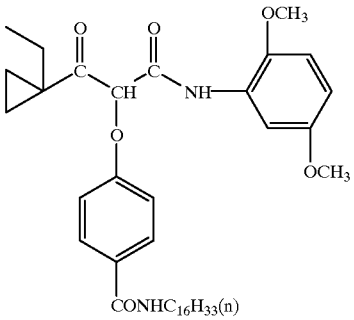
Developing agent D-7
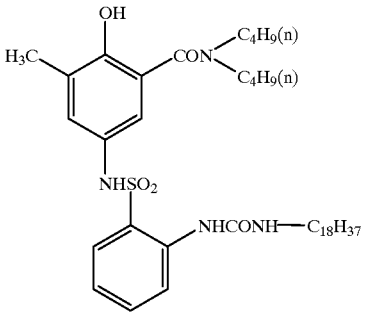
Developing agent D-9
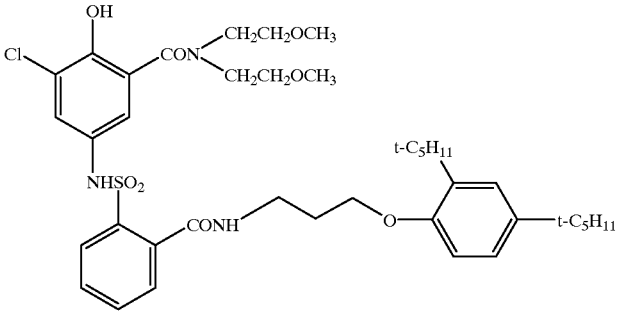

-continued
Developing agent D-2
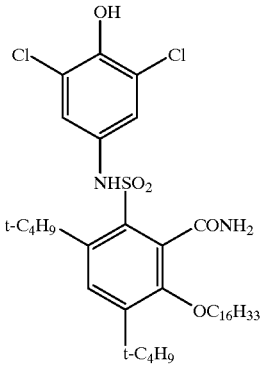
Anti-fogging agent (5)
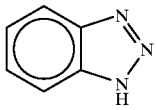
Anti-fogging agent (2)
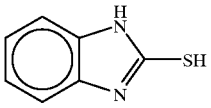
Organic solvent having a high boiling point (4)
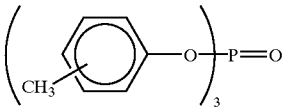
Preservatives (1)
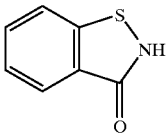
Reducing agent (1)
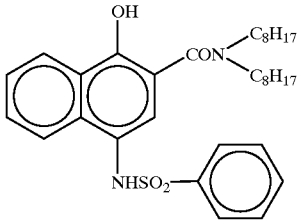
Anti-fogging agent (3)
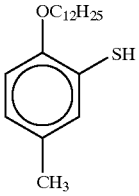
Anti-fogging agent (4)
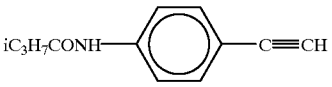
Surfactant (1)
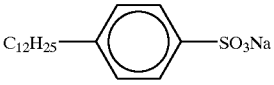
Organic solvent having a high boiling point (1)
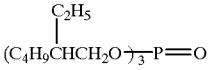
Organic solvent having a high boiling point (2)
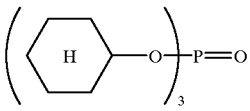
Preservative (1)
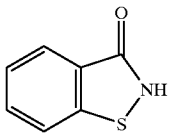
Reducing agent (2)
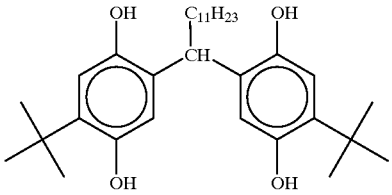
Surfactant (2)
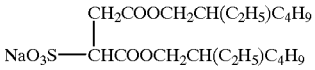

-continued
Surfactant (3)
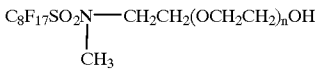
Water-soluble polymer (1)
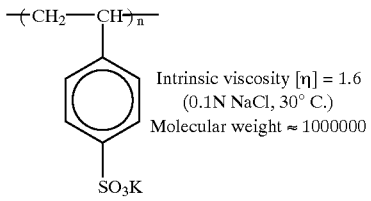
Water-soluble polymer (2)
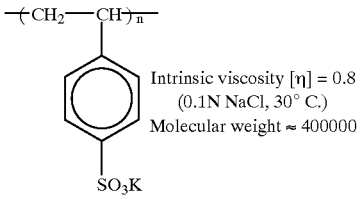
Sensitizing dye (3)
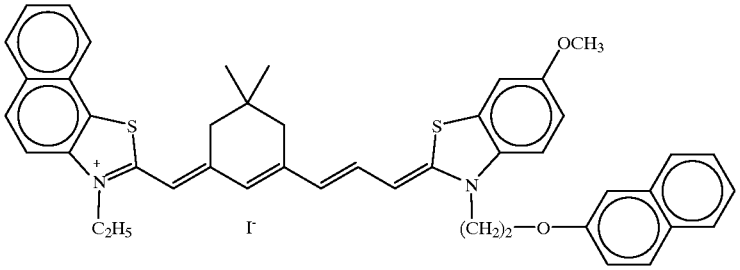
Hardener (1)
$CH_2{=}CHSO_2CH_2SO_2CH{=}CH_2$
Surfactant (4)
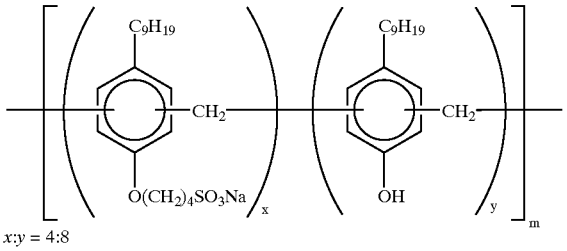
$x{:}y = 4{:}8$
$m \approx 6.8$
Organic solvent having a high boiling point (5)
(En-para 40 [manufactured by Ajinomono Co., Inc.])
$C_{28}H_{48.9}Cl_{7.1}$
Polymer latex (a)
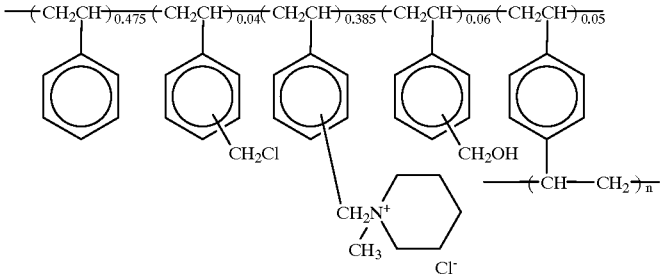
Surfactant (5)
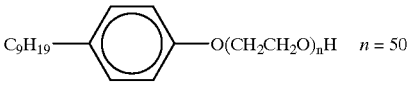
Surfactant (6)
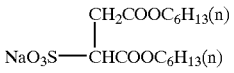

The above-described products were used to produce photosensitive elements 401 shown in Tables 72 and 73.

TABLE 72

Composition of main materials of heat developable photosensitive material 401

| NO of layer | Name of layer | Additive | Amount added (mg/m$^2$) |
|---|---|---|---|
| 7th layer | Protective layer | Acid-processed gelatin | 442 |
| | | Reducing agent (2) | 47 |
| | | Solvent having a high boiling point (1) | 30 |
| | | Colloid silver particle | 2 |
| | | Matting agent (PMMA resin) | 17 |
| | | Surfactant (1) | 16 |
| | | Surfactant (2) | 9 |
| | | Surfactant (3) | 2 |
| 6th layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Polymer latex (a) dispersion | 5 |
| | | Water-soluble polymer (1) | 4 |
| | | Calcium nitrate | 6 |
| 5th layer | Red light-sensitive layer | Lime-processed gelatin | 452 |
| | | Lightsensitive silver halide emulsion (1) | 301 |
| | | Magenta dye forming coupler (9) | 420 |
| | | Developing agent D-9 | 336 |
| | | Anti-fogging agent (2) | 15 |
| | | Solvent having a high boiling point (2) | 444 |
| | | Surfactant (1) | 12 |
| | | Water-soluble polymer (1) | 10 |
| 4th layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Polymer latex (a) dispersion | 5 |
| | | Water-soluble polymer (1) | 4 |
| | | Calcium nitrate | 6 |

TABLE 73

Composition of main materials of heat developable photosensitive material 401 (cont.)

| NO of layer | Name of layer | Additive | Amount added (mg/m$^2$) |
|---|---|---|---|
| 3rd layer | Second infrared lightsensitive layer | Lime-processed gelatin | 373 |
| | | Lightsensitive silver halide emulsion (2) | 106 |

TABLE 73-continued

Composition of main materials of heat developable photosensitive material 401 (cont.)

| NO of layer | Name of layer | Additive | Amount added (mg/m$^2$) |
|---|---|---|---|
| | | Cyan dye forming coupler (20) | 390 |
| | | Developing agent D-7 | 312 |
| | | Anti-fogging agent (2) | 14 |
| | | Solvent having a high boiling point (5) | 412 |
| | | Surfactant (1) | 11 |
| | | Water-soluble polymer (1) | 11 |
| 2nd layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (2) | 25 |
| | | Zinc hydroxide | 750 |
| | | Calcium nitrate | 6 |
| 1st layer | First infrared lightsensitive layer | Lime-processed gelatin | 587 |
| | | Lightsensitive silver halide emulsion (3) | 311 |
| | | Yellow dye forming coupler (4) | 410 |
| | | Developing agent D-2 | 328 |
| | | Anti-fogging agent (2) | 15 |
| | | Solvent having a high boiling point (4) | 433 |
| | | Surfactant (1) | 12 |
| | | Water-soluble polymer (2) | 40 |
| | | Hardener (1) | 45 |

Substrate (substrate obtained by aluminum vapor deposition on a 20 $\mu$m PET and subsequent coating of gelatin on the back surface as an undercoat)

Next, heat developing photosensitive materials 402 to 412 were prepared in the same manner as for the heat developing photosensitive material 401, except that the developing agents were changed to developing agents of yellow, magenta and cyan and the compounds of the present invention as shown in Tables 74 and 75.

Next, image output was conducted using the heat developing photosensitive materials 201 to 212 and image receiving elements under heating conditions of 83° C. for 35 seconds or 78° C. for 35 seconds by a digital color printer FIJIX PICTOGRAPHY PG-3000 manufactured by Fuji Photo Film Co., Ltd. The output image was a clear color image. {Maximum density and minimum density were measured by using a reflection density meter X-lite 304 manufactured by X-lite Corp.}

The discrimination of the resulting image was evaluated by d-value in the same manner as in Example 3.

The results are shown in Tables 74 and 75.

TABLE 74

| Lightsensitive element | Type of coupler | Type of developing agent | Compound of the present invention | | | d value (80 to 30 seconds) | d value (75 to 30 seconds) | Remarks |
|---|---|---|---|---|---|---|---|---|
| 401 | Y (4) | D-2 | | — | | 0.25 | 0.38 | Comparative |
| | M (9) | D-9 | | | | 0.19 | 0.28 | |
| | C (20) | D-7 | | | | 0.18 | 0.29 | |
| 402 | Y (4) | D-2 | 1st layer | II-50 | 57 mg/m$^2$ | 0.13 | 0.15 | Present invention |
| | M (9) | D-9 | 3rd layer | II-50 | 57 | 0.10 | 0.12 | |
| | C (20) | D-7 | 5th layer | II-50 | 57 | 0.11 | 0.13 | |
| 403 | Y (4) | D-2 | 2nd layer | II-50 | 60 | 0.14 | 0.16 | Present invention |
| | M (9) | D-9 | 4th layer | II-50 | 60 | 0.11 | 0.14 | |
| | C (20) | D-7 | 6th layer | II-50 | 40 | 0.10 | 0.12 | |
| 404 | Y (4) | D-2 | 2nd layer | III-22 | 15 | 0.13 | 0.15 | Present invention |
| | M (9) | D-9 | 4th layer | | — | 0.11 | 0.13 | |
| | C (20) | D-7 | 6th layer | | — | 0.11 | 0.14 | |
| 405 | Y (4) | D-2 | 1st layer | II-18 | 50 | 0.14 | 0.16 | Present invention |
| | M (9) | D-9 | 3rd layer | II-22 | 50 | 0.11 | 0.13 | |
| | C (20) | D-7 | 5th layer | II-7 | 50 | 0.12 | 0.15 | |
| 406 | Y (4) | D-2 | 1st layer | III-18 | 50 mg/m$^2$ | 0.15 | 0.17 | Present invention |
| | M (9) | D-9 | 3rd layer | III-21 | 50 | 0.11 | 0.13 | |
| | C (20) | D-7 | 5th layer | III-7 | 50 | 0.10 | 0.12 | |
| 407 | Y (4) | D-2 | 1st layer | II-3 | 50 | 0.15 | 0.18 | Present invention |
| | M (9) | D-9 | 3rd layer | II-10 | 50 | 0.12 | 0.15 | |
| | C (20) | D-7 | 5th layer | II-15 | 50 | 0.12 | 0.15 | |
| 408 | Y (4) | D-2 | 1st layer | II-50 | 70 | 0.13 | 0.15 | Present invention |
| | M (9) | D-9 | | III-22 | 50 | 0.09 | 0.10 | |
| | C (20) | D-7 | 3rd layer | II-50 | 50 | 0.10 | 0.11 | |
| | | | | III-19 | 50 | | | |
| | | | 5th layer | II-50 | 70 | | | |
| | | | | III-26 | 50 | | | |

TABLE 75

| Lightsensitive element | Type of coupler | Type of developing agent | Compound of the present invention | | | d value (80 to 30 seconds) | d value (75 to 30 seconds) | Remarks |
|---|---|---|---|---|---|---|---|---|
| 409 | Y (3) | D-12 | | — | | 0.27 | 0.39 | Comparative |
| | M (11) | D-19 | | | | 0.20 | 0.28 | example |
| | C (15) | D-21 | | | | 0.19 | 0.28 | |
| 410 | Y (3) | D-12 | 1st layer | II-50 | 50 mg/m$^2$ | 0.13 | 0.17 | Present invention |
| | M (11) | D-19 | 3rd layer | II-50 | 50 | 0.10 | 0.14 | |
| | C (15) | D-21 | 5th layer | II-50 | 47 | 0.11 | 0.13 | |
| 411 | Y (5) | D-22 | | — | | 0.26 | 0.38 | Comparative |
| | M (9) | D-23 | | | | 0.19 | 0.28 | example |
| | C (19) | D-26 | | | | 0.20 | 0.29 | |
| 412 | Y (5) | D-22 | 1st layer | II-50 | 45 mg/m$^2$ | 0.12 | 0.14 | Present invention |
| | M (9) | D-23 | 3rd layer | II-50 | 50 | 0.10 | 0.13 | |
| | C (19) | D-26 | 5th layer | II-50 | 50 | 0.10 | 0.15 | |

It is understood that the heat developing photosensitive material of the present invention can provide an excellent image even under low temperature developing conditions. Each heat developing photosensitive material was left for 5 days under 45° C. –80%RH, then image formation was conducted under conditions of 83° C. for 35 seconds as described above. The heat developing photosensitive material of the present invention provided a clear color image.

The heat developing color photosensitive material of the present invention can provide an excellent image in a short developing time and is not easily affected by variations in processing conditions. Further, the heat developing color photosensitive material is able to provide an image under lower temperature processing conditions.

Example 1A

<Preparation Method of Light-Sensitive Silver Halide Emulsion-1>

To a well-stirred aqueous gelatin solution (containing 30 g of inert gelatin and 2 g of potassium bromide in 1,000 ml of water), were added ammonia-ammonium nitrate as a solvent for silver halide, the temperature was kept at 75° C., and then 1000 ml of an aqueous solution containing 1 mol of silver nitrate, and 1,000 ml of an aqueous solution containing 1 mol of potassium bromide and 0.03 mol of potassium iodide, were simultaneously added thereto, over 78 min. After washing with water and desalting, inert gelatin was added, for redispersion, thereby preparing a silver iodobromide emulsion having a diameter of the grain volume, which is assumed to be a sphere, of 0.76 $\mu$m, and an iodine content of 3 mol %. The diameter of the grain volume, which is assumed to be a sphere, was measured by Model TA-3, manufactured by Coulter Counter Co.

To the above emulsion were added potassium thiocyanate, chloroauric acid, and sodium thiosulfate, at 56 Oc, to achieve optimal chemical sensitization. To this emulsion, each sensitizing dye corresponding to each of the spectral sensitivities was added at the time of preparation of the coating solution, to provide color sensitivities.

<Preparation Method of Zinc Hydroxide Dispersion>

31 g of zinc hydroxide powder, whose primary particles had a grain size of 0.2 $\mu$m, 1.6 g of carboxylmethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

<Preparation Method of Emulsified Dispersion of Coupler>

The oil-phase components and the aqueous-phase components of each composition shown in Table 1A were dissolved, respectively, to obtain uniform solutions at 60° C. The oil-phase components and the aqueous-phase components were combined together and were dispersed in a 1-liter stainless steel vessel, by a dissolver equipped with a disperser having a diameter of 5 cm, at 10,000 rpm for 20 min. Warm water (as an additional water) was added thereto in the amount shown in Table 1, followed by stirring at 2,000 rpm for 10 min. Thus, emulsified dispersions of a coupler were prepared, respectively.

TABLE 1A

| | | Cyan | Magenta | Yellow |
|---|---|---|---|---|
| Oil phase | Cyan coupler (1) | 8.70 g | — | — |
| | Magenta coupler (2) | — | 6.36 g | — |
| | Yellow coupler (3) | — | — | 5.77 g |
| | Developing agent (4) | 5.46 g | 5.46 g | 5.46 g |
| | Antifoggant (5) | 3.0 mg | 1.0 mg | 10.0 mg |
| | High-boiling solvent (6) | 7.08 g | 5.91 g | 5.62 g |
| | Ethyl acetate | 24.0 ml | 24.0 ml | 24.0 ml |
| Aqueous phase | Lime-processed gelatin | 12.0 g | 12.0 g | 12.0 g |
| | Surface-active agent (7) | 0.60 g | 0.60 g | 0.60 g |
| | Water | 138.0 ml | 138.0 ml | 138.0 ml |
| | Additional water | 180.0 ml | 180.0 ml | 180.0 ml |

Cyan coupler (1)

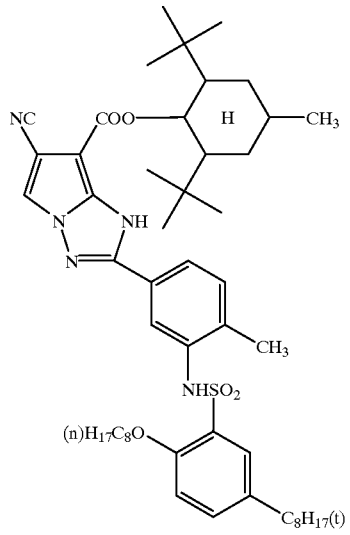

-continued

Magenta coupler (2)

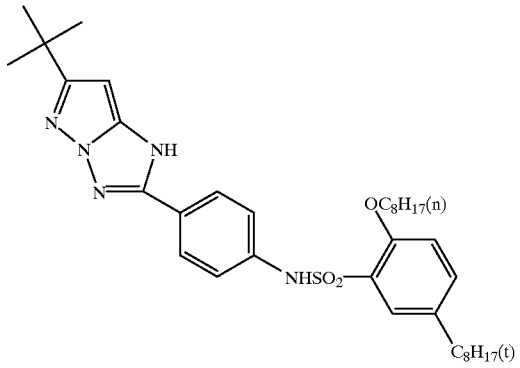

Yellow coupler (3)

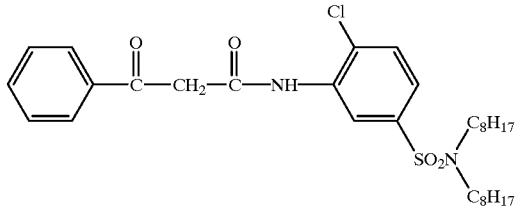

Developing agent (4)

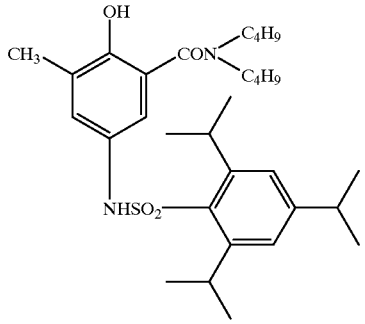

Antifoggant (5)

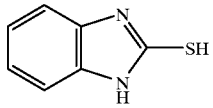

High-boiling solvent (6)

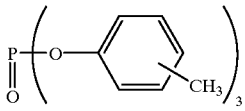

Surface-active agent (7)

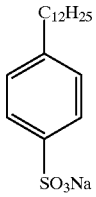

By using the thus obtained materials, a heat-development light-sensitive material 101A, having the multi-layer configuration shown in Table 2A was prepared.

TABLE 2A

Constitution of light-sensitive material 101A

| Layer Configuration | Additive | Added amount ($mg/m^2$) |
|---|---|---|
| Seventh layer | Lime-processed gelatin | 1000 |
| Protective layer | Matting agent (silica) | 50 |
| | Surface-active agent (8) | 100 |
| | Surface-active agent (9) | 300 |
| | Water-soluble polymer (10) | 15 |
| Sixth layer | Lime-processed gelatin | 375 |
| Interlayer | Surface-active agent (9) | 15 |
| | Zinc hydroxide | 1130 |
| | Water-soluble polymer (10) | 15 |
| Fifth layer | Lime-processed gelatin | 1450 |
| Yellow color-forming layer | Light-sensitive silver halide emulsion | 692 (in terms of silver) |
| | Sensitizing dye (12) | 3.65 |
| | Yellow coupler (3) | 462 |
| | Developing agent (4) | 437 |
| | Antifoggant (5) | 0.8 |
| | High-boiling solvent (6) | 450 |
| | Surface-active agent (7) | 48 |
| | Water-soluble polymer (10) | 20 |
| Forth layer | Lime-processed gelatin | 1000 |
| Interlayer | Surface-active agent (9) | 8 |
| | Water-soluble polymer (10) | 5 |
| | Hardener (11) | 65 |
| Third layer | Lime-processed gelatin | 993 |
| Magenta color-forming layer | Light-sensitive silver halide emulsion | 475 (in terms of silver) |
| | Sensitizing dye (13) | 0.07 |
| | Sensitizing dye (14) | 0.71 |
| | Sensitizing dye (15) | 0.19 |
| | Magenta coupler (2) | 350 |
| | Developing agent (4) | 300 |
| | Antifoggant (5) | 0.06 |
| | High-boiling solvent (6) | 325 |
| | Surface-active agent (7) | 33 |
| | Water-soluble polymer (10) | 14 |
| Second layer | Lime-processed gelatin | 1000 |
| Interlayer | Surface-active agent (9) | 8 |
| | Zinc hydroxide | 1130 |
| | Water-soluble polymer (10) | 5 |
| First layer | Lime-processed gelatin | 720 |
| Cyan color-forming layer | Light-sensitive silver halide emulsion | 346 (in terms of silver) |
| | Sensitizing dye (16) | 1.52 |
| | Sensitizing dye (17) | 1.03 |
| | Sensitizing dye (18) | 0.05 |
| | Cyan coupler (1) | 348 |
| | Developing agent (4) | 218 |
| | Antifoggant (5) | 0.12 |
| | High-boiling solvent (6) | 283 |
| | Surface-active agent (7) | 24 |
| | Water-soluble polymer (10) | 10 |
| | Transparent PET base (102 $\mu$m) | |

Surface-active agent (8)

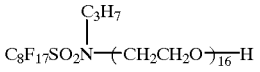

Surface-active agent (9)

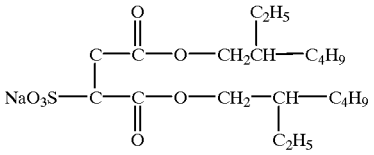

-continued

Water-soluble polymer (10)

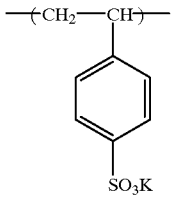

Hardener (11)

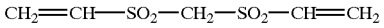

Sensitizing dye (12)

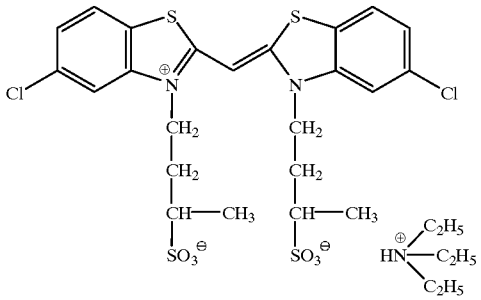

Sensitizing dye (13)

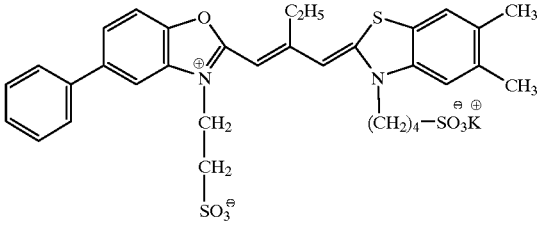

Sensitizing dye (14)

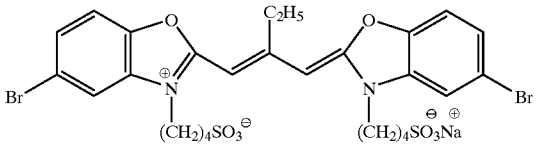

Sensitizing dye (15)

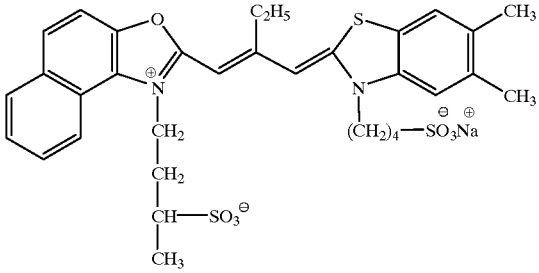

Sensitizing dye (16)

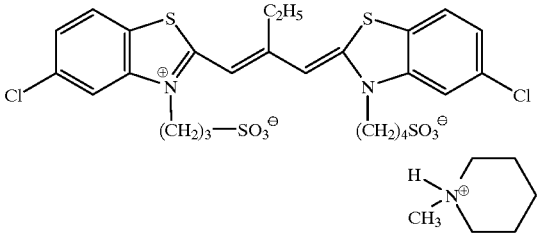

-continued

Sensitizing dye (17)

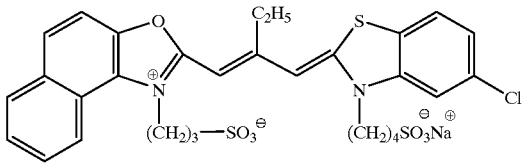

Sensitizing dye (18)

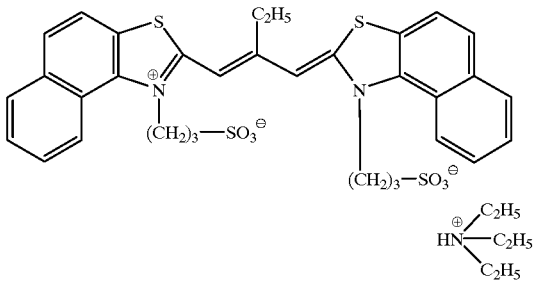

TABLE 3A

Processing Material R-1

| Layer Configuration | Main added material | Added amount (g/m$^2$) |
|---|---|---|
| Fourth layer | Gelatin | 0.22 |
| | κ-carrageenan | 0.06 |
| | Silicone oil | 0.02 |
| | Matting agent (PMMA) | 0.4 |
| Third layer | Gelatin | 0.24 |
| | Hardener (H-2) | 0.18 |
| Second layer | Gelatin | 2.41 |
| | Dextran | 1.31 |
| | Mordant (P-1) | 2.44 |
| | Guanidine picolinic acid | 5.82 |
| | Potassium quinolinic acid | 0.45 |
| | Sodium quinolinic acid | 0.36 |
| First layer | Gelatin | 0.19 |
| | Hardener (H-2) | 0.18 |
| | Undercoat layer | |
| | PET base (63 μm) | |

H-2

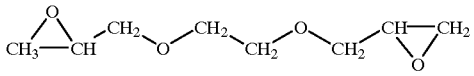

P-1

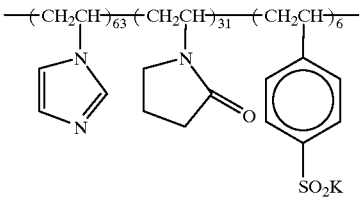

Further, Light-sensitive materials 102A to 115A were prepared in the same manner as in Light-sensitive material 101A, except that the developing agent and the reducing agent in the third layer (magenta color-forming layer) were changed as shown in Table 4A. The thus prepared Light-sensitive materials 101A to 115A were exposed to light at 2,500 lux for 0.01 sec through a B, G, R, or gray filter, whose density was respectively changed continuously. Warm water at 40° C. was applied to the surface of the thus exposed light-sensitive materials, in an amount of 15 ml/m$^2$, and then after each processing material and each film surface were brought together, they were subjected to heat development at 83° C. for 30 sec using a heat dram. After the processing, when the processing material was removed (pealed off), an image was obtained clearly on the side of the light-sensitive material corresponding to the filter used for the exposure. Immediately after the processing, for each Samples, the maximum density (Dmax) parts of exposed part and minimum density (Dmin) of white background, in terms of an transmittion density, were measured by an X-rite density-measuring apparatus. The results are shown in Table 5A. Further, samples which were left to stand under the conditions of 45° C. and 80% relative humidity for 7 days, were processed in the same manner as above. The results are shown in Table 6A.

TABLE 4A

| Light-sensitive material No. | Developing agent/Added amount (mmol/m$^2$) | Reducing agent/Added amount (mmol/m$^2$) |
|---|---|---|
| 101A (comparative example) | Developing agent (4)/0.55 | none |
| 102A (comparative example) | Developing Agent (a)/0.55 | none |
| 103A (comparative example) | Developing agent (b)/0.55 | none |
| 104A (comparative example) | Developing agent (c)/0.55 | none |
| 105A (comparative example) | Developing agent (4)/0.55 | Reducing agent (x)/0.2 |
| 106A (comparative example) | Developing agent (a)/0.55 | Reducing agent (x)/0.2 |
| 107A (comparative example) | Developing agent (a)/0.55 | Reducing agent (y)/0.2 |
| 108A (comparative example) | Developing agent (a)/0.55 | Reducing agent (z)/0.2 |
| 109A (comparative example) | Developing agent (b)/0.55 | Reducing agent (z)/0.2 |
| 110A (This invention) | Developing agent (4)/0.55 | Exemplified compound D-5/0.2 |
| 111A (This invention) | Developing agent (a)/0.55 | Exemplified compound D-5/0.2 |
| 112A (This invention) | Developing agent (a)/0.55 | Exemplified compound D-6/0.2 |
| 113A ( This invention) | Developing agent (b)/0.55 | Exemplified compound D-5/0.2 |
| 114A (This invention) | Developing agent (b)/0.55 | Exemplified compound D-6/0.2 |
| 115A (This invention) | Developing agent (c)/0.55 | Exemplified compound D-5/0.2 |

Developing agent (a)

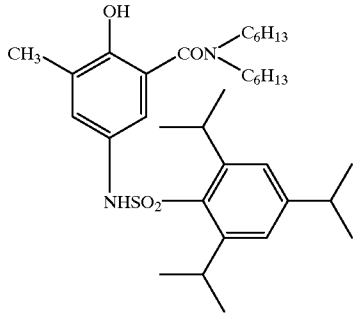

Developing agent (b)

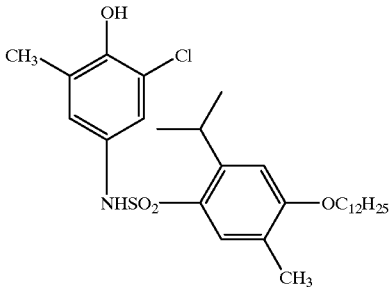

Developing agent (c)

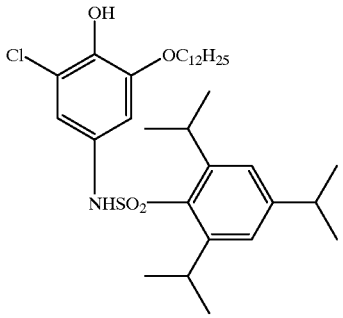

Reducing agent (x)

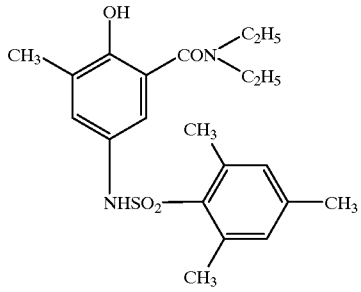

Reducing agent (y)

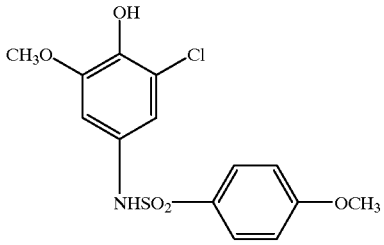

-continued

Reducing agent (z)

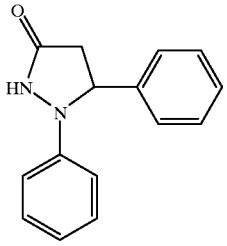

TABLE 5A

| Light-sensitive material No. | Dmax (G) | Dmin (G) | Dmax (IR) |
|---|---|---|---|
| 101A (comparative example) | 1.85 | 0.22 | 0.35 |
| 102A (comparative example) | 1.02 | 0.21 | 0.31 |
| 103A (comparative example) | 0.95 | 0.20 | 0.3 |
| 104A (comparative example) | 0.88 | 0.20 | 0.29 |
| 105A (comparative example) | 2.25 | 0.28 | 0.62 |
| 106A (comparative example) | 2.33 | 0.27 | 0.62 |
| 107A (comparative example) | 2.32 | 0.28 | 0.62 |
| 108A (comparative example) | 2.13 | 0.28 | 0.38 |
| 109A (comparative example) | 2.09 | 0.28 | 0.38 |
| 110A (This invention) | 2.35 | 0.28 | 0.38 |
| 111A (This invention) | 2.36 | 0.28 | 0.37 |
| 112A (This invention) | 2.31 | 0.28 | 0.37 |
| 113A (This invention) | 2.32 | 0.28 | 0.37 |
| 114A (This invention) | 2.33 | 0.28 | 0.37 |
| 115A (This invention) | 2.32 | 0.28 | 0.38 |

TABLE 6A

| Light-sensitive material No. | Dmax (G) | Dmin (G) | Dmax (IR) |
|---|---|---|---|
| 101A (comparative example) | 1.86 | 0.22 | 0.35 |
| 102A (comparative example) | 1.03 | 0.21 | 0.31 |
| 103A (comparative example) | 0.94 | 0.21 | 0.3 |
| 104A (comparative example) | 0.89 | 0.20 | 0.29 |
| 105A (comparative example) | 2.26 | 0.28 | 0.64 |
| 106A (comparative example) | 2.31 | 0.27 | 0.62 |
| 107A (comparative example) | 2.32 | 0.28 | 0.63 |
| 108A (comparative example) | 1.90 | 0.28 | 0.34 |
| 109A (comparative example) | 1.33 | 0.28 | 0.30 |
| 110A (This invention) | 2.35 | 0.27 | 0.38 |
| 111A (This invention) | 2.37 | 0.28 | 0.37 |
| 112A (This invention) | 2.33 | 0.28 | 0.38 |
| 113A (This invention) | 2.32 | 0.27 | 0.37 |
| 114A (This invention) | 2.31 | 0.28 | 0.38 |
| 115A (This invention) | 2.33 | 0.28 | 0.38 |

*(Note): Dmax(IR) represents a silver-image density.

Summerizing the results shown in Tables 5A and 6A, in Comparative example Samples 101A to 104A, although the developing agent was changed, it is recognized that the photographic properties were not improved so much. In Comparative example Samples 105A to 107A, the effect of the combination use of the developing agent having a small molecular weight was recognized, but the density of the silver image in each color was increased that was unpreferable. Further, in Comparative example Samples 108A and 109A wherein a 1-phenyl-3-pyrazolidinone derivative was used as a reducing agent, the effect of the addition disappeared completely after storage. In contrast, in Light-Sensitive Materials 110A to 115A of the present invention, it is understood that, while the increase in density of the silver image was quite small, a great increase in the dye image density was confirmed, and that effect was kept after storage.

Then, these light-sensitive materials were set in cameras, and after shooting, they were processed in the same manner as above. The images obtained on the light-sensitive materials were outputted through a digital image reading/reproducing apparatus, Frontier SP-1000 (trade name, manufactured by Fuji Photo Film Co., Ltd.). In comparison with Light-Sensitive Materials 110A to 115A, in Light-Sensitive Materials 101A to 104A, wherein satisfactory color formation could not be obtained, Light-Sensitive Materials 105A to 107A, wherein the silver image density was high, and Light-Sensitive Materials 108A and 109A, that were stored under conditions of high temperature and high humidity, the image quality was poor because, for example, the granularity was unpreferably conspicuous.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A silver halide photographic light-sensitive material which comprises at least a compound represented by the following formula (1)or (2):

formula (1)

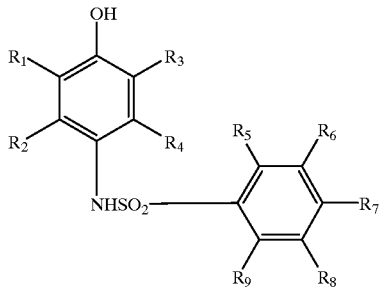

formula (2)

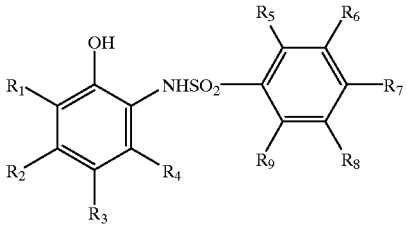

wherein $R_1$ $R_2$, $R_3$, $R_4$, $R_5$, $R_6$, $R_7$, $R_8$, and $R_9$ each represent a hydrogen atom, a halogen atom, a substituent having 4 or less carbon atoms, or a substituent having an I/O value of 1 or more; provided that in formula (1), $R_2$ and/or $R_4$, and $R_5$ and/or $R_9$, are not hydrogen atoms; and in formula (2), $R_4$, and $R_5$ and/or $R_9$, are not hydrogen atoms; and when $R_1$ and $R_2$, $R_3$ and $R_4$, $R_5$ and $R_6$, $R_6$ and $R_7$, $R_7$ and $R_8$, and $R_8$ and $R_9$ are not hydrogen atoms, the two of each of the combinations may independently bond together to form a ring.

2. The silver halide photographic light-sensitive material as claimed in claim 1, wherein $R_1$, $R_2$, $R_3$, $R_4$, $R_5$, $R_6$, $R_7$, $R_8$, and $R_9$ each represent a substituent having an I/O value of 1 or more, but 12 or less.

3. The silver halide photographic light-sensitive material as claimed in claim 1, wherein the compound represented by formula (1) or (2) is contained in an amount of 0.001 to 1,000 mmol/$m^2$.

4. The silver halide photographic light-sensitive material as claimed in claim 1 which further comprises a reducing agent capable of carrying out a cross-oxidizing reaction with the compound represented by formula (1) or (2), to form an image.

5. The silver halide photographic light-sensitive material as claimed in claim 4, wherein the reducing agent is a color-developing agent.

6. The silver halide photographic light-sensitive material as claimed in claim 4, wherein the reducing agent is contained in an amount of 0.001 to 1,000 mmol/$m^2$, and the compound represented by formula (1) or (2) is contained in an amount of 0.001 to 1,000 times the molar amount of the reducing agent.

7. The silver halide photographic light-sensitive material as claimed in claim 1 which is a silver halide photographic heat-development light-sensitive material.

8. The silver halide photographic light-sensitive material as claimed in claim 1, which is, after being exposed to light imagewise, brought into close contact with a processing layer of a processing member and heated to form an image.

9. The silver halide photographic light-sensitive material as claimed in claim 8, wherein the processing layer of the processing member contains at least a base and/or a base precursor.

10. The silver halide photographic light-sensitive material as claimed in claim 1, wherein the substituent having 4 or less carbon atoms or an I/O value of 1 or more is selected from an alkyl group, an aryl group, an alkylcarbonamido group, an arylcarbonamido group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, and an acyloxy group.

11. The silver halide photographic light-sensitive material as claimed in claim 1, wherein the halogen atom, or the substituent having 4 or less carbon atoms or an I/O value of 1 or more is a chlorine atom or a bromine atom, or a methyl group, an ethyl group, an isopropyl group, a n-butyl group, a t-butyl group, a 3-methanesulfonylamynophenyl group, an acetylamino group, a propionylamino group, a butyroylamino group, a benzoylamino group, a methanesulfonylamino group, an ethanesulfonylamino group, a benzenesulfonylamino group, a toluenesulfonylamino group, a methoxy group, an ethoxy group, a 4-methanesulfonylaminophenoxy group, a methylthio group, an ethylthio group, a butylthio group, a 4-methanesulfonylaminophenylthio group, a methylcarbamoyl group, a dimethylcarbamoyl group, an ethylcarbamoyl group, a diethylcarbamoyl group, a dibutylcarbamoyl group, a piperidinocarbamoyl group, a morpholinocarbamoyl group, a phenylcarbamoyl group, a methylphenylcarbamoyl group, an ethylphenylcarbamoyl group, a benzylphenylcarbamoyl group, a carbamoyl group, a methylsulfamoyl group, a dimethylsulfamoyl group, an ethylsulfamoyl group, a diethylsulfamoyl group, a dibutylsulfamoyl group, a piperidinosulfamoyl group, a morpholinosulfamoyl group, a phenylsulfamoyl group, a methylphenylsulfamoyl group, an ethylphenylsulfamoyl group, a benzylphenylsulfamoyl group, a sulfamoyl group, a cyano group, a methanesulfonyl group, an ethanesulfonyl group, a phenylsulfonyl group, a 4-chlorophenylsulfonyl group, a p-toluenesulfonyl group, a methoxycarbonyl group, an ethoxycarbonyl group, a butoxycarbonyl group, a phenoxycarbonyl group, an acetyl group, a propionyl group, a butyloyl group, a benzoyl group, an alkylbenzoyl group, an acetyloxy group, a propionyloxy group, or a butyloyloxy group.

12. The silver halide photographic light-sensitive material as claimed in claim 1, wherein said I/O value is more than 1.

13. A silver halide photographic light-sensitive material which comprises at least a compound represented by the following formula (1) or (2):

formula (1)

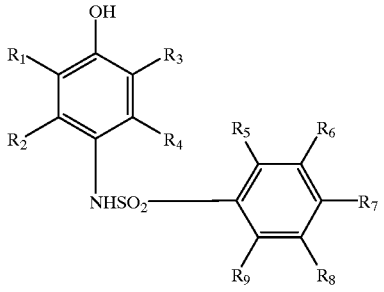

formula (2)

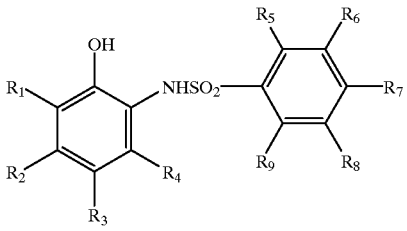

wherein $R_1$, $R_2$, $R_3$, $R_4$, $R_5$, $R_6$, $R_7$, $R_8$, and $R_9$ each represent a hydrogen atom, a halogen atom, a substituent having 4 or less carbon atoms, or a substituent having an I/O value of 1 or more; provided that in formula (1), $R_2$ and/or $R_4$, and $R_5$ and/or $R_9$, are not hydrogen atoms; and in formula (2), $R_4$, and $R_5$ and/or $R_9$, are not hydrogen atoms; and when $R_1$ and $R_2$, $R_3$ and $R_4$, $R_5$ and $R_6$, $R_6$ and $R_7$, $R_7$ and $R_8$, and $R_8$ and $R_9$ are not hydrogen atoms, the two of each of the combinations may independently bond together to form a ring, and wherein at least a compound of formula (1) or (2) is a compound other than compound D-13:

D-13

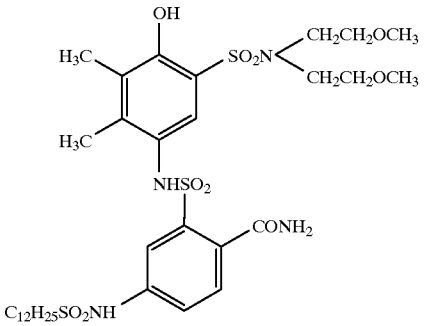

14. The silver halide photographic light-sensitive material as claimed in claim 13, wherein $R_1$, $R_2$, $R_3$, $R_4$, $R_5$, $R_6$, $R_7$, $R_8$, and $R_9$ each represent a substituent having an I/O value of 1 or more, but 12 or less.

15. The silver halide photographic light-sensitive material as claimed in claim 13, wherein the compound represented by formula (1) or (2) is contained in an amount of 0.001 to 1,000 mmol/$m^2$.

16. The silver halide photographic light-sensitive material as claimed in claim 13 which further comprises a reducing agent capable of carrying out a cross-oxidizing reaction with the compound represented by formula (1) to (2), to form an image.

17. The silver halide photographic light-sensitive material as claimed in claim 16, wherein the reducing agent is a color-developing agent.

18. The silver halide photographic light-sensitive material as claimed in claim 16, wherein the reducing agent is contained in an amount of 0.001 to 1,000 mmol/$m^2$, and the compound represented by formula (1) or (2) is contained in an amount of 0.001 to 1,000 times the molar amount of the reducing agent.

19. The silver halide photographic light-sensitive material as claimed in claim 13, which is a silver halide photographic heat-development light-sensitive material.

20. The silver halide photographic light-sensitive material as claimed in claim 13, which is, after being exposed to light imagewise, brought into close contact with a processing layer of a processing member and heated to form an image.

21. The silver halide photographic light-sensitive material as claimed in claim 20, wherein the processing layer of the processing member contains at least a base and/or a base precursor.

22. The silver halide photographic light-sensitive material as claimed in claim 16, wherein the substituent having 4 or less carbon atoms or an I/O value of 1 or more is selected from an alkyl group, an aryl group, an alkylcarbonamido group, an arylcarbonamido group, an alkylsulfonamide group, an arylsulfonamide group, and alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkycarbonyl group, an arylcarbonyl group, and an acyloxy group.

* * * * *